US007651092B2

(12) United States Patent
Hirao et al.

(10) Patent No.: US 7,651,092 B2
(45) Date of Patent: Jan. 26, 2010

(54) PRINTING SYSTEM AND CONTROL METHOD THEREOF

(75) Inventors: Toyomi Hirao, Kawasaki (JP); Kouichi Unno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 12/016,508

(22) Filed: Jan. 18, 2008

(65) Prior Publication Data

US 2008/0174626 A1 Jul. 24, 2008

(30) Foreign Application Priority Data

Jan. 24, 2007 (JP) ..... 2007-014201

(51) Int. Cl.
*B65H 39/10* (2006.01)

(52) U.S. Cl. ..... 271/298; 271/256; 271/262; 271/265.01; 271/265.04; 271/258.01; 271/258.02; 271/263; 271/287; 271/288; 271/289; 271/290

(58) Field of Classification Search ..... 271/256, 271/262, 265.01, 265.04, 258.01, 258.02, 271/263, 3.01, 319, 287, 288, 289, 290, 298
See application file for complete search history.

(56) References Cited

U.S. PATENT DOCUMENTS 4,098,185 A * 7/1978 Davidson, Jr. ..... 101/137
4,231,291 A * 11/1980 Davidson, Jr. ..... 101/137
4,936,564 A * 6/1990 Hain ..... 271/3.19
5,105,229 A * 4/1992 Ozaki ..... 399/17
5,464,099 A * 11/1995 Stevens et al. ..... 209/3.1
5,853,089 A * 12/1998 Milne ..... 209/534
6,637,852 B2 * 10/2003 Bjune ..... 347/16
6,773,009 B2 * 8/2004 So ..... 271/259
7,364,157 B2 * 4/2008 Iida ..... 271/265.02
7,448,618 B2 * 11/2008 Inoue et al. ..... 271/207
2006/0145409 A1 * 7/2006 Able et al. ..... 271/10.01
2007/0007720 A1 * 1/2007 Shay et al. ..... 271/265.01
2008/0048390 A1 * 2/2008 Gutierrez-Vazquez et al. ..... 271/256

FOREIGN PATENT DOCUMENTS

JP 2004-310746 11/2004
JP 2004-310747 11/2004

* cited by examiner

*Primary Examiner*—Patrick H Mackey
*Assistant Examiner*—Prasad V Gokhale
(74) *Attorney, Agent, or Firm*—Cowan, Liebowitz & Latman, P.C.

(57) ABSTRACT

An object of this invention is to provide a convenient printing system applicable not only to the office environment but also to the POD environment. To accomplish this, a printing system capable of supplying a print medium to a printing apparatus from a plurality of feeding apparatuses each having a feeding unit for feeding a print medium, a multi feed detection unit for detecting occurrence of multi feed of overlapping print media, and a multi feed discharge unit for discharging multi-fed print media includes a multi feed discharge destination setting unit for, when the multi feed detection unit detects occurrence of multi feed, setting which of multi feed discharge units is to accept multi-fed print media, and a control unit for controlling the feeding apparatus to discharge the multi-fed print media to the multi feed discharge unit set by the multi feed discharge destination setting unit.

6 Claims, 79 Drawing Sheets

[SYSTEM CONFIGURATION EXAMPLE (1) OF PRINTING SYSTEM 1000]
SYSTEM CONFIGURATION IN WHICH THREE INLINE TYPE SHEET PROCESSING APPARATUSES, I.E., LARGE-VOLUME STACKER, GLUE BINDING APPARATUS, AND SADDLE STITCHING APPARATUS ARE CONNECTED IN ORDER NAMED TO PRINTING APPARATUS 100.

SECTIONAL VIEW OF APPARATUSES IN SYSTEM CONFIGURATION EXAMPLE OF FIG. 8A

[SYSTEM CONFIGURATION EXAMPLE (2) OF PRINTING SYSTEM 1000]
SYSTEM CONFIGURATION IN WHICH THREE INLINE TYPE SHEET PROCESSING APPARATUSES, I.E., GLUE BINDING APPARATUS, LARGE-VOLUME STACKER, AND SADDLE STITCHING APPARATUS ARE CONNECTED IN ORDER NAMED TO PRINTING APPARATUS 100.

SECTIONAL VIEW OF APPARATUSES IN SYSTEM CONFIGURATION EXAMPLE OF FIG. 9A

[SYSTEM CONFIGURATION EXAMPLE (3) OF PRINTING SYSTEM 1000]
SYSTEM CONFIGURATION IN WHICH TWO INLINE TYPE SHEET PROCESSING APPARATUSES, I.E., LARGE-VOLUME STACKER AND SADDLE STITCHING APPARATUS ARE CONNECTED IN ORDER NAMED TO PRINTING APPARATUS 100.

SECTIONAL VIEW OF APPARATUSES IN SYSTEM CONFIGURATION EXAMPLE OF FIG. 10A

CONFIGURATION EXAMPLE OF SADDLE STITCHING APPARATUS AVAILABLE AS INLINE TYPE SHEET PROCESSING APPARATUS IN SYSTEM 1000

FIG. 18A

SYSTEM MANAGEMENT SETTING

[REGISTRATION SETTING OF INLINE SHEET PROCESSING APPARATUS]
REGISTER TYPES OF SHEET PROCESSING APPARATUSES TO BE CONNECTED TO PRINTING APPARATUS AND THEIR CONNECTION ORDER.
YOU CAN CONNECT MAXIMUM OF FIVE SHEET PROCESSING APPARATUSES.
CONNECT SADDLE STITCHING APPARATUS LAST.

| | | |
|---|---|---|
| 1 | | ADVANCED SETTINGS |
| 2 | | ADVANCED SETTINGS |
| 3 | | ADVANCED SETTINGS |
| 4 | | ADVANCED SETTINGS |

REGISTER CLOSE

FIG. 18B

SYSTEM MANAGEMENT SETTING

[REGISTRATION SETTING OF INLINE SHEET PROCESSING APPARATUS]
REGISTER TYPES OF SHEET PROCESSING APPARATUSES TO BE CONNECTED TO PRINTING APPARATUS AND THEIR CONNECTION ORDER.
YOU CAN CONNECT MAXIMUM OF FIVE SHEET PROCESSING APPARATUSES.
CONNECT SADDLE STITCHING APPARATUS LAST.

| | | |
|---|---|---|
| 1 | LARGE-VOLUME STACKER | ADVANCED SETTINGS |
| 2 | GLUE BINDING APPARATUS | ADVANCED SETTINGS |
| 3 | SADDLE STITCHING APPARATUS | ADVANCED SETTINGS |
| 4 | | ADVANCED SETTINGS |

REGISTER CLOSE

FIG. 18C

SYSTEM MANAGEMENT SETTING

[REGISTRATION SETTING OF INLINE SHEET PROCESSING APPARATUS]
REGISTER TYPES OF SHEET PROCESSING APPARATUSES TO BE CONNECTED TO PRINTING APPARATUS AND THEIR CONNECTION ORDER.
YOU CAN CONNECT MAXIMUM OF FIVE SHEET PROCESSING APPARATUSES.
CONNECT SADDLE STITCHING APPARATUS LAST.

| | | | |
|---|---|---|---|
| 1 | GLUE BINDING APPARATUS | ▶ | ADVANCED SETTINGS |
| 2 | LARGE-VOLUME STACKER | ▶ | ADVANCED SETTINGS |
| 3 | SADDLE STITCHING APPARATUS | ▶ | ADVANCED SETTINGS |
| 4 | | ▶ | ADVANCED SETTINGS |

REGISTER CLOSE

FIG. 18D

SYSTEM MANAGEMENT SETTING

[REGISTRATION SETTING OF INLINE SHEET PROCESSING APPARATUS]
REGISTER TYPES OF SHEET PROCESSING APPARATUSES TO BE CONNECTED TO PRINTING APPARATUS AND THEIR CONNECTION ORDER.
YOU CAN CONNECT MAXIMUM OF FIVE SHEET PROCESSING APPARATUSES.
CONNECT SADDLE STITCHING APPARATUS LAST.

| | | |
|---|---|---|
| 1 | LARGE-VOLUME STACKER | ADVANCED SETTINGS |
| 2 | SADDLE STITCHING APPARATUS | ADVANCED SETTINGS |
| 3 | | ADVANCED SETTINGS |
| 4 | | ADVANCED SETTINGS |

REGISTER CLOSE

EXAMPLE OF OUTER APPEARANCE OF LARGE-VOLUME STACKER

[SYSTEM CONFIGURATION (4) OF PRINTING SYSTEM 1000]
SYSTEM CONFIGURATION IN WHICH THREE FEEDING APPARATUSES, I.E., LARGE-VOLUME FEEDING DECKS 1, 2, AND 3 ARE CONNECTED IN ORDER NAMED TO PRINTING APPARATUS 100.

SECTIONAL VIEW OF APPARATUSES IN SYSTEM CONFIGURATION EXAMPLE

PRINTING SYSTEM AND CONTROL METHOD THEREOF

BACKGROUND OF THE INVENTION

1. Field of the Invention

The present invention relates to a printing system capable of accepting a plurality of jobs, and a control method thereof.

2. Description of the Related Art

In a conventional printing industry, a publication is issued through various work steps such as entry of a document, designing of the document, layout editing, comprehensive layout (presentation by printing), proofreading (layout correction and color correction), proof (proof print), block copy preparation, printing, post-processing, and shipping.

In the conventional printing industry, an offset reproduction printing press has been used in the printing step, requiring the block copy preparation step. However, once the block copy is prepared, it is difficult to correct the block copy. If the block copy is corrected, the cost rises. In block copy preparation, therefore, careful proofreading (i.e., careful layout check and color confirmation) is indispensable. Some period of time is generally taken until a publication is issued.

Most apparatuses used in respective work steps are bulky and require expert knowledge, and know-how of experts is indispensable.

In this situation, POD (Print On Demand) printing systems using electrophotographic and inkjet printing apparatuses are proposed recently.

(See Japanese Patent Laid-Open Nos. 2004-310746 and 2004-310747).

The POD printing system does not require the above-mentioned block copy preparation and other complicated work steps.

As for sheets (print media) used in the POD market, the printing system may process various types of sheets in order to receive a variety of printing orders from customers. In this situation, an operation to separate and convey a print medium from a feeding apparatus serving as an example of a print medium supply source may change from that for a general sheet. For example, the printing system can process a print medium of a type different in surface property, glossiness, and thickness from a print medium such as plain paper. For this reason, print media which should be separated and fed one by one from a feeding apparatus may be conveyed simultaneously. A state in which print media are conveyed while at least partially overlapping each other is defined as "multi feed (double feed)". If multi feed occurs, problems such as a fixing error, a jam in the printing apparatus, and mixing of a blank sheet arise. It is desirable to detect multi feed before conveying multi-fed sheets into the printing unit of the printing apparatus, and discharge the multi-fed sheets outside the apparatus.

SUMMARY OF THE INVENTION

The present invention allows realization of reducing errors upon occurrence of multi feed and increasing the final throughput in a printing system.

According to one aspect of the present invention, a system configured to be able to cause a printing system to perform processing based on a certain abnormal state, the certain abnormal state being a state in which overlapping sheets are supplied from a supplier, the system comprises a receiver adapted to receive a certain processing condition about the certain abnormal state via a user interface, and a controller adapted to control the printing system to discharge the overlapping sheets to a certain place selected based on the certain processing condition set via the user interface.

According to another aspect of the present invention, a program product stored in a computer usable storage medium, the program product including a program code for causing a computer system to perform a method for enabling a printing system to perform processing based on a certain abnormal state, the certain abnormal state being a state in which overlapping sheets are supplied from a supplier, the method comprises receiving a certain processing condition about the certain abnormal state via a user interface, and controlling the printing system to discharge the overlapping sheets to a certain place selected based on the certain processing condition.

Further features of the present invention will be apparent from the following description of exemplary embodiments with reference to the attached drawings.

BRIEF DESCRIPTION OF THE DRAWINGS

FIG. 18A is a view showing an example of a display window on the UI unit to be controlled in the first embodiment of the present invention;

FIG. 18B is a view showing an example of a display window on the UI unit to be controlled in the first embodiment of the present invention;

FIG. 18C is a view showing an example of a display window on the UI unit to be controlled in the first embodiment of the present invention;

FIG. 18D is a view showing an example of a display window on the UI unit to be controlled in the first embodiment of the present invention;

DESCRIPTION OF THE EMBODIMENTS

Figure 1:
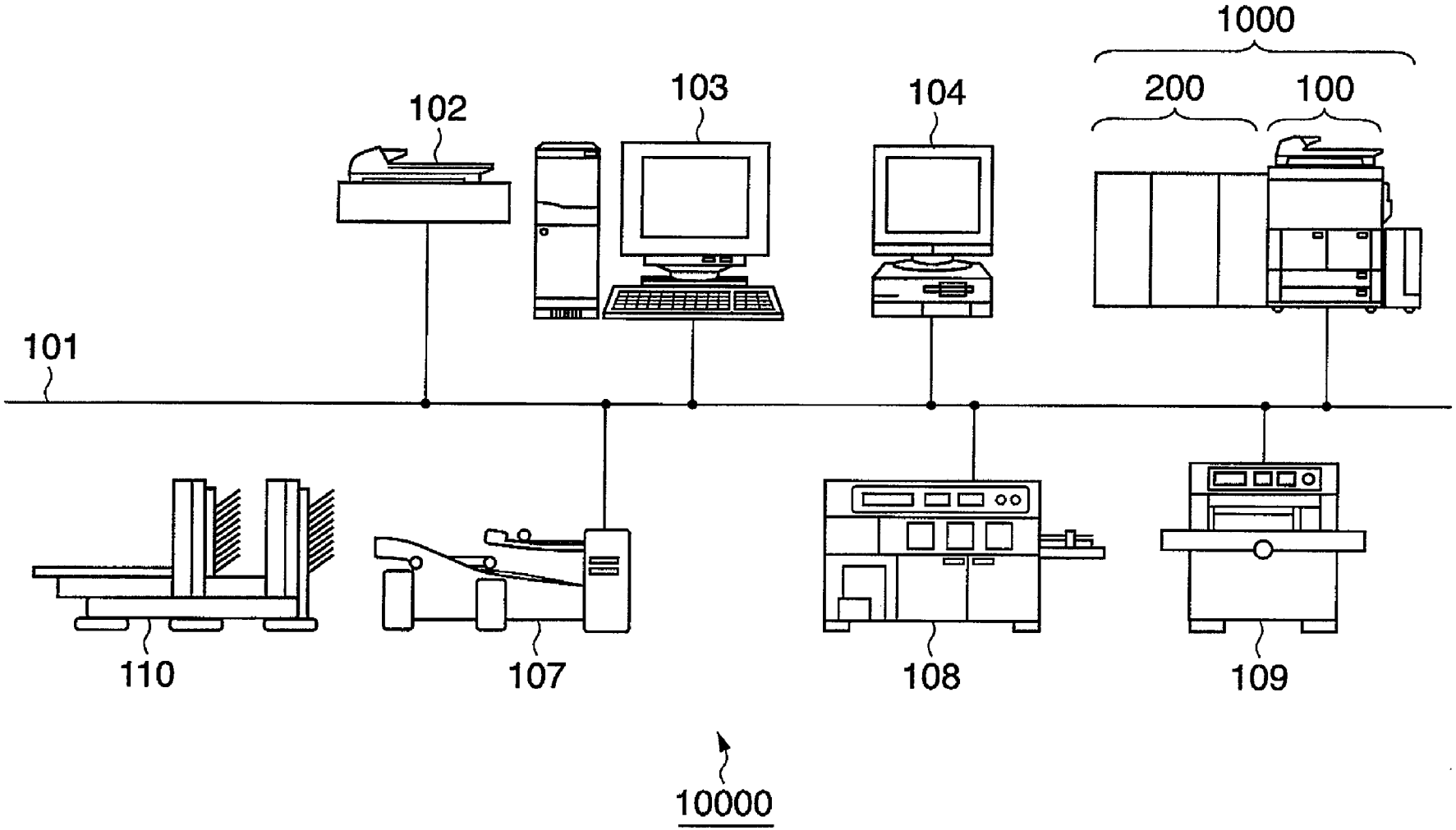
FIG. 1 is a view explaining an overall configuration of a POD printing system 10000 including a printing system 1000 to be controlled in the first embodiment of the present invention.

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

[Description of System Configuration of Entire POD Printing System 10000 Including Printing System 1000]

The first embodiment of the present invention assumes a printing environment such as the POD environment different from the office environment in order to solve problems described in Description of the Related Art. The first embodiment will explain the system environment of an entire POD environment site (POD printing system 10000 in FIG. 1) including a printing system 1000. The printing environment itself is a feature of the embodiment.

In the embodiment, a printing environment where the printing system 1000 is applicable is also suited to the POD environment and is called the POD printing system 10000.

The POD printing system 10000 in FIG. 1 comprises, as building components, the printing system 1000 of the embodiment, and a server computer and client computer (to be referred to as PCs 103 and 104 hereinafter). The POD printing system 10000 also comprises a paper folding apparatus 107, cutting apparatus 109, saddle stitching apparatus 110, case binding apparatus 108, scanner 102, and the like. In this manner, a plurality of apparatuses are prepared in the POD printing system 10000.

The printing system 1000 comprises a printing apparatus 100 and sheet processing apparatus 200 as building components. As an example of the printing apparatus 100, the embodiment will explain a multi-function peripheral having a plurality of functions such as the copy function and PC print function. However, the printing apparatus 100 may be a single function type printing apparatus having only the PC function or copy function. The multi-function peripheral will also be called an MFP hereinafter.

The paper folding apparatus 107, cutting apparatus 109, saddle stitching apparatus 110, and case binding apparatus 108 in FIG. 1 are defined as sheet processing apparatuses, similar to the sheet processing apparatus 200 of the printing system 1000. This is because these apparatuses can execute sheet processes for sheets of a job printed by the printing apparatus 100 of the printing system 1000. For example, the paper folding apparatus 107 can fold sheets of a job printed by the printing apparatus 100.

The cutting apparatus 109 can cut a bundle of sheets printed by the printing apparatus 100. The saddle stitching apparatus 110 can saddle-stitch sheets of a job printed by the printing apparatus 100. The case binding apparatus 108 can case-bind sheets of a job printed by the printing apparatus 100. To execute various sheet processes by these sheet processing apparatuses, the operator needs to take out a printed material of a job printed by the printing apparatus 100 from the delivery unit of the printing apparatus 100, and set the printed material in a target sheet processing apparatus.

When using a sheet processing apparatus other than the sheet processing apparatus 200 of the printing system 1000, intervention work by the operator is required after print processing by the printing apparatus 100.

In other words, when the sheet processing apparatus 200 of the printing system 1000 executes sheet processing required for a job printed by the printing apparatus 100, no intervention work by the operator is necessary after the printing apparatus 100 executes print processing. This is because the printing apparatus 100 can directly supply sheets printed by it to the sheet processing apparatus 200. More specifically, the sheet feeding path in the printing apparatus 100 can be coupled to that in the sheet processing apparatus 200. In this manner, the sheet processing apparatus 200 and printing apparatus 100 of the printing system 1000 are physically connected to each other. In addition, the printing apparatus 100 and sheet processing apparatus 200 comprise CPUs and can communicate data. That is, the printing apparatus 100 and sheet processing apparatus 200 are electrically connected to each other.

Figure 2:
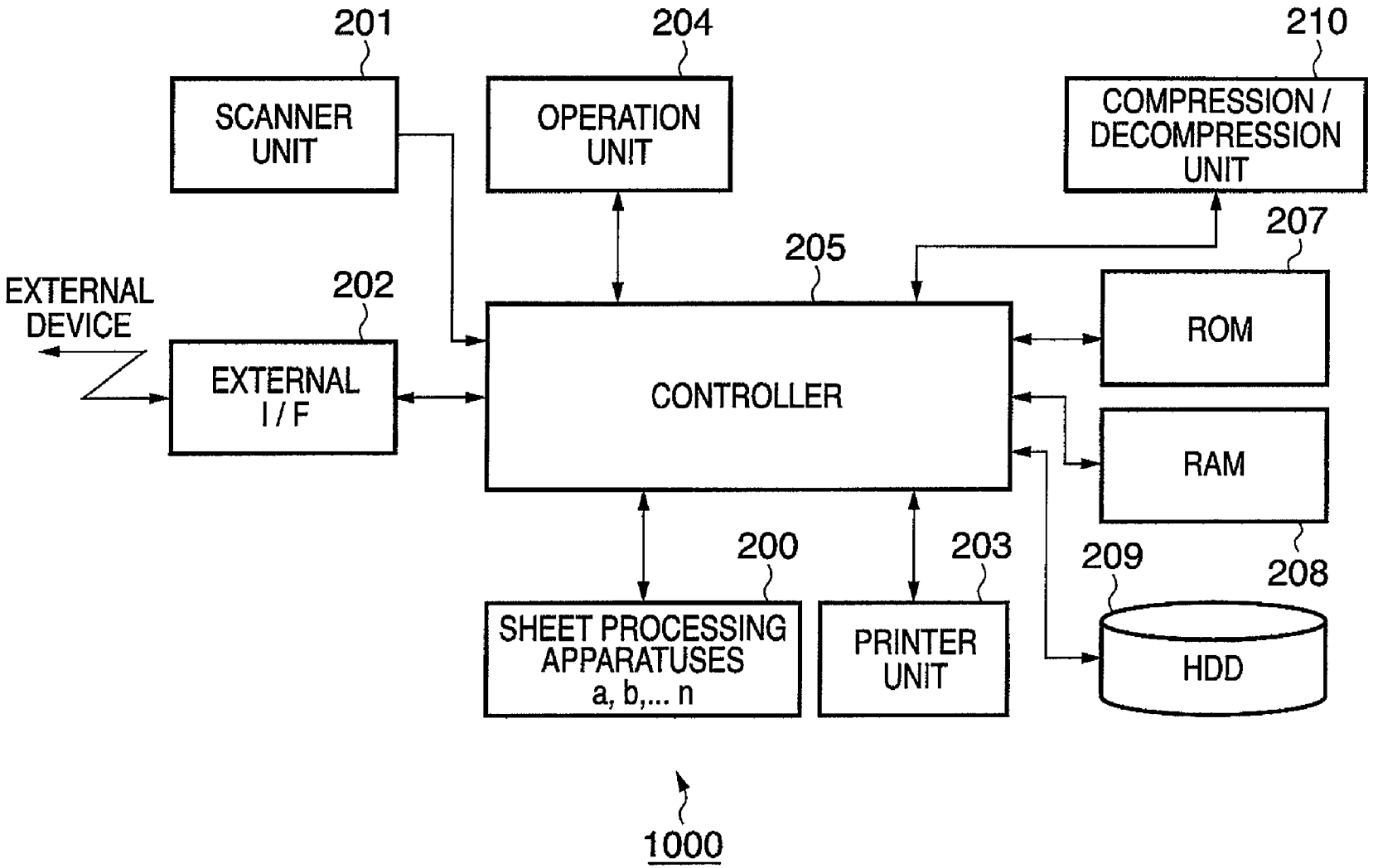
FIG. 2 is a block diagram for explaining a configuration of the printing system 1000 to be controlled in the first embodiment of the present invention.

In the embodiment, a controller unit 205 in the printing apparatus 100 in FIG. 2 performs comprehensive control as an example of a control means for comprehensively controlling the printing apparatus 100 and sheet processing apparatus 200. In the embodiment, these sheet processing apparatuses are also called post-processing apparatuses or post-presses.

All these apparatuses in the POD printing system 10000 of FIG. 1 except the saddle stitching apparatus 110 are connected to a network 101 and can communicate data with each other.

For example, the printing apparatus 100 prints print data of a target job whose printing execution request is transmitted via the network 101 from an information processing apparatus serving as an example of external apparatuses such as the PCs 103 and 104.

For example, the PC 103 manages all jobs to be processed in the POD printing system 10000 by transmitting/receiving data to/from another apparatus by network communication. In other words, the PC 103 functions as a computer which comprehensively manages a series of workflow steps including a plurality of processing steps. The PC 103 determines post-processing conditions capable of finishing in the POD printing system 10000 on the basis of a job instruction accepted from an operator. In addition, the PC 103 designates a post-processing (finishing) step complying with a request from an end user (customer who requests printing in this example). At this time, the PC 103 uses information exchange tools such as JDF to exchange information with respective post-processing devices using commands and statuses in post-presses.

As a point of the embodiment in the POD printing system 10000 having the above-mentioned building components, the embodiment classifies the above sheet processing apparatuses into three categories and defines them as follows.

[Definition 1] A sheet processing apparatus which satisfies both (condition 1) and (condition 2) listed below is defined as an "inline finisher". The embodiment also refers to an apparatus satisfying this definition as an inline type sheet processing apparatus.

(Condition 1) The paper path (sheet feeding path) of a sheet processing apparatus is physically connected to the printing apparatus 100 so that the sheet processing apparatus can directly receive sheets conveyed from the printing apparatus 100 without any operator intervention.

(Condition 2) A sheet processing apparatus is electrically connected to another apparatus so as to communicate data necessary for an operation instruction, status confirmation, and the like with another apparatus. More specifically, a sheet processing apparatus is electrically connected to the printing apparatus 100 so as to communicate data with it, or electrically connected to an apparatus (e.g., the PC 103 or 104) other than the printing apparatus 100 via the network 101 so as to communicate data with the apparatus. A sheet processing apparatus which satisfies at least either condition meets (condition 2).

More specifically, the sheet processing apparatus 200 of the printing system 1000 corresponds to an "inline finisher". This is because the sheet processing apparatus 200 is physically and electrically connected to the printing apparatus 100, as described above.

[Definition 2] A sheet processing apparatus which satisfies not (condition 1) but (condition 2) out of (condition 1) and (condition 2) listed above is defined as a "near-line finisher". The embodiment also refers to an apparatus satisfying this definition as a near-line type sheet processing apparatus.

For example, the paper path of a sheet processing apparatus is not connected to the printing apparatus 100, and the sheet processing apparatus requires intervention work by an operator such as carrying of a printed material. However, the sheet processing apparatus can electrically exchange information such as an operation instruction and status confirmation via a communication means such as the network 101. A sheet processing apparatus which meets these conditions will be defined as a "near-line finisher".

More specifically, the paper folding apparatus 107, cutting apparatus 109, saddle stitching apparatus 110, and case binding apparatus 108 in FIG. 1 correspond to "near-line finishers". This is because these sheet processing apparatuses are not physically connected to the printing apparatus 100, but are electrically connected to another apparatus such as the PC 103 or 104 via the network 101 so as to communicate data.

[Definition 3] A sheet processing apparatus which satisfies neither (condition 1) nor (condition 2) listed above is defined as an "offline finisher". The embodiment also refers to an apparatus satisfying this definition as an offline type sheet processing apparatus.

For example, the paper path of a sheet processing apparatus is not connected to the printing apparatus 100, and the sheet processing apparatus requires intervention work by an operator such as carrying of a printed material. Further, the sheet processing apparatus does not comprise any communication unit necessary for an operation instruction and status confirmation, and cannot communicate data with another apparatus. Thus, the operator carries an output material, sets it, manually inputs an operation, and manually gives a status report from the device. A sheet processing apparatus which meets these conditions will be defined as an "offline finisher".

More specifically, the saddle stitching apparatus 110 in FIG. 1 corresponds to an "offline finishers". This is because this sheet processing apparatus is not physically connected to the printing apparatus 100, cannot be connected to the network 101, is not electrically connected to another apparatus, and cannot communicate data to another apparatus.

Various sheet processes are executable in the POD printing system 10000 having various sheet processing apparatuses classified into these three categories.

For example, printed media of a job printed by the printing apparatus 100 can undergo various sheet processes such as cutting, saddle stitching, case binding, sheet folding, punching, sealing, and collation. Sheets can be processed in a bookbinding printing style the end user (client) wants.

Near-line finishers and offline finishers managed by the PC 103 include various finishers such as a dedicated stapler, dedicated puncher, inserter, and collator. The PC 103 grasps a device status and job status from near-line finishers via the network 101 by sequential polling or the like using a predetermined protocol. In addition, the PC 103 manages the execution statuses (progresses) of many jobs processed by the POD printing system 10000.

In the embodiment, different sheet processing apparatuses may execute a plurality of types of print sheet processes described above, or one sheet processing apparatus may execute them. The printing system may comprise any of sheet processing apparatuses.

Another point of the embodiment will be explained. The printing system 1000 in FIG. 1 comprises the printing apparatus 100, and the sheet processing apparatus 200 detachable from the printing apparatus 100. The sheet processing apparatus 200 can directly receive, via the sheet feeding path, sheets of a job printed by the printing apparatus 100. The sheet processing apparatus 200 executes sheet processing requested by a user together with a printing execution request via a user interface unit for sheets of a job printed by a printer unit 203 of the printing apparatus 100. This is apparent from the fact that the sheet processing apparatus 200 is an inline type sheet processing apparatus, as described above.

It should be noted that the sheet processing apparatus 200 in the embodiment can also be defined as a group of sheet processing apparatuses. This is because in the embodiment, a plurality of sheet processing apparatuses, which are independent housings and independently available, can be coupled to the printing apparatus 100 and used as the sheet processing apparatus 200.

The printing system 1000 in FIG. 1 comprises the printing apparatus 100 and three sheet processing apparatuses. In other words, in the printing system 1000 in FIG. 1, three sheet processing apparatuses are series-connected to the printing apparatus 100. In the embodiment, a configuration in which a plurality of sheet processing apparatuses are connected to the printing apparatus 100 is called cascade connection. The embodiment handles, as inline finishers, all sheet processing apparatuses included in a group of sheet processing apparatuses 200 cascade-connected to the printing apparatus 100. The controller 205 in FIG. 2 serving as an example of the control unit of the printing system 1000 comprehensively controls the printing apparatus 100 and a plurality of inline type sheet processing apparatuses, and executes various control examples to be described below in the embodiment. The embodiment also has this feature. This configuration will be described later with reference to FIG. 3 and the like.

[Internal Configuration (Mainly Software Configuration) of Printing System 1000]

The internal configuration (mainly software configuration) of the printing system 1000 will be explained with reference to the system block diagram of FIG. 2. The printing apparatus 100 incorporates all the units of the printing system 1000 shown in FIG. 2 except the sheet processing apparatus 200 (strictly speaking, a group of sheet processing apparatuses configurable by a plurality of inline type sheet processing apparatuses). The sheet processing apparatus 200 is detachable from the printing apparatus 100, and is providable as an option of the printing apparatus 100. This configuration aims to provide a necessary number of necessary inline finishers in the POD environment. For this purpose, the printing system 1000 adopts the following configuration.

The printing apparatus 100 incorporates a nonvolatile memory such as a hard disk drive (to be referred to as an HDD hereinafter) 209 capable of storing a plurality of job data to be processed. The printing apparatus 100 has a copy function of printing, by the printer unit 203 via the HD, job data accepted from a scanner unit 201 of the printing apparatus 100. The printing apparatus 100 also has a print function of printing, by the printer unit 203 via the HD, job data accepted from an external apparatus such as the PC 103 or 104 via an external I/F unit 202 serving as an example of a communication unit. The printing apparatus 100 is an MFP type printing apparatus (to be also referred to as an image forming apparatus) having a plurality of functions.

The printing apparatus according to the embodiment can take any form such as a color or monochrome printing apparatus as long as it can execute various control examples described in the embodiment.

The printing apparatus 100 according to the embodiment comprises the scanner unit 201 which scans an original document image and processes scanned image data. The printing apparatus 100 also comprises the external I/F unit 202 which transmits/receives image data to/from a facsimile device, a network connection device, or a dedicated external device. The printing apparatus 100 comprises the HDD 209 capable of storing image data of jobs to be printed that are accepted from either the scanner unit 201 or external I/F unit 202. The printing apparatus 100 comprises the printer unit 203 which prints target job data stored in the HDD 209 on a print medium. The printing apparatus 100 further comprises an operation unit 204 which has a display unit and serves as an example of the user interface unit of the printing system 1000. Other examples of the user interface unit provided by the printing system 1000 are the display unit, keyboard, and mouse of an external apparatus such as the PC 103 or 104.

The controller unit (to be also referred to as a control unit or CPU) 205 serving as an example of the control unit of the printing system 1000 comprehensively controls the processes, operations, and the like of various units of the printing system 1000. A ROM 207 stores various control programs necessary in the embodiment including programs for executing various processes of flowcharts (to be described later) and the like. The ROM 207 also stores a display control program for displaying various UI windows on the display unit of the operation unit 204 including user interface windows (to be referred to as UI windows hereinafter) shown in the drawings.

The controller 205 reads out and executes programs from the ROM 207, and causes the printing apparatus to execute various operations described in the embodiment. The ROM 207 also stores, e.g., a program for executing an operation to interpret PDL (Page Description Language) code data received from an external apparatus (e.g., the PC 103 or 104) via the external I/F unit 202, and rasterize the PDL code data into raster image data (bitmap image data). These programs are processed by software.

The ROM 207 is a read-only memory, and stores programs (e.g., a boot sequence and font information) and various programs (e.g., the above-mentioned programs) in advance. A RAM 208 is a readable/writable memory, and stores image data, various programs, and setting information sent from the scanner unit 201 or external I/F unit 202 via a memory controller.

The HDD (Hard Disk Drive) 209 is a large-capacity storage device which stores image data compressed by a compression/decompression unit 210. The HDD 209 can hold a plurality of data such as print data of a job to be processed. The controller 205 controls cause the printer unit 203 to print, via the HDD 209, target job data which are input via various input units such as the scanner unit 201 and external I/F unit 202. The controller 205 also controls to transmit job data to an external apparatus via the external I/F unit 202. In this fashion, the controller 205 controls to execute various output processes for target job data stored in the HDD 209. The compression/decompression unit 210 compresses/decompresses image data and the like stored in the RAM 208 and HDD 209 in accordance with various compression schemes such as JBIG and JPEG.

With the above-described configuration, the controller 205 serving as an example of the control unit of the printing system controls even the operation of the inline type sheet processing apparatus 200, as shown in FIG. 1. The mechanical structure of the printing system 1000 including a description of this operation will be explained with reference to FIG. 3 and the like.

[Apparatus Configuration (Mainly Mechanical Structure) of Printing System 1000]

The configuration (mainly mechanical structure) of the printing system 1000 will be explained with reference to the view of FIG. 3 for explaining the apparatus configuration.

As described above, in the printing system 1000, a plurality of inline type sheet processing apparatuses are cascade-connected to the printing apparatus 100. An arbitrary number of inline type sheet processing apparatuses connectable to the printing apparatus 100 can be installed in accordance with the use environment in order to enhance the effects of the embodiment under specific limitations.

Figure 3:
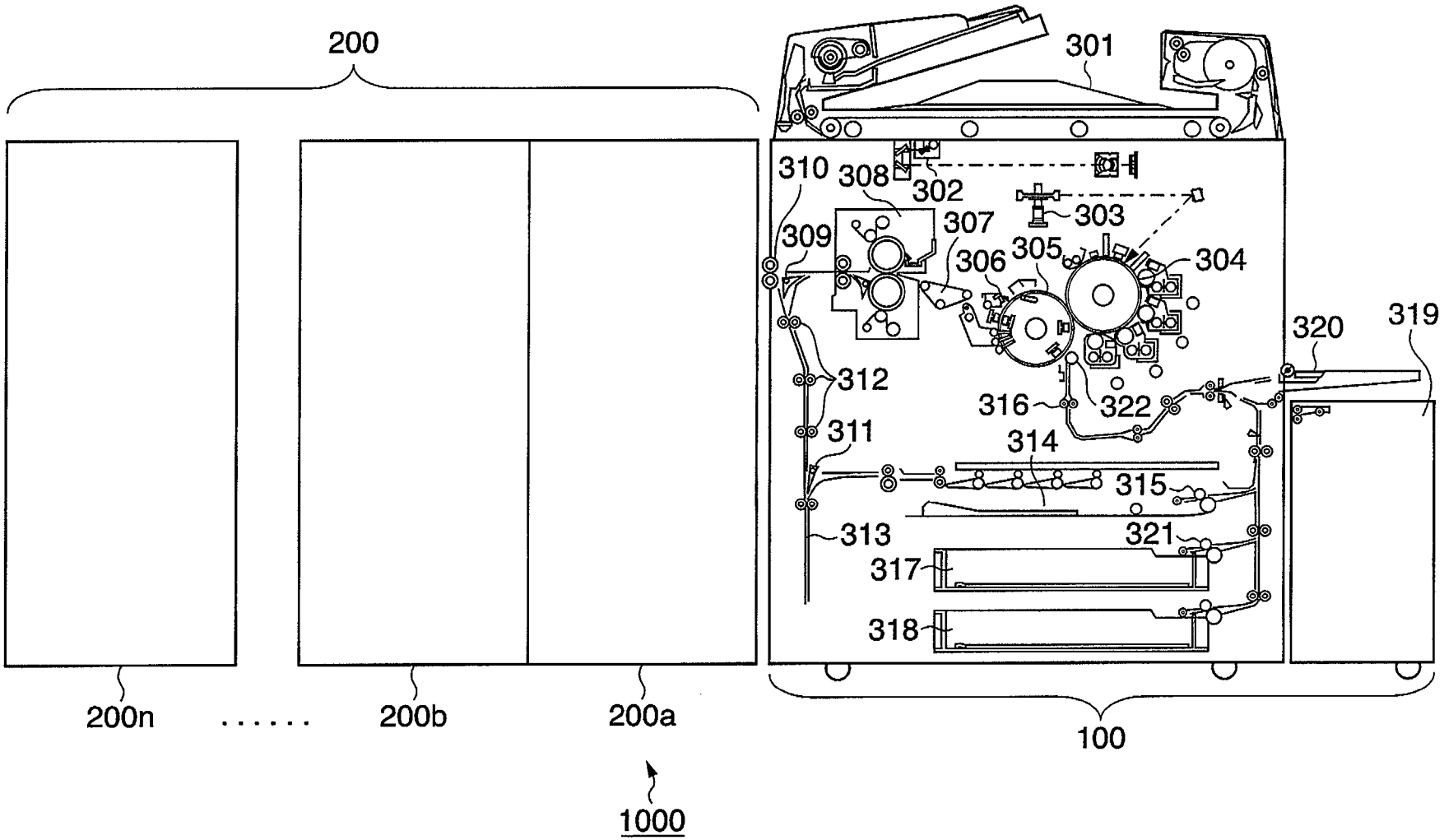
FIG. 3 is a view for explaining a configuration of the printing system 1000 to be controlled in the first embodiment of the present invention.

To make the description clearer, N sheet processing apparatuses 200 are connectable as a group of sheet processing apparatuses in FIGS. 2 and 3. Sheet processing apparatuses are defined as sheet processing apparatuses 200*a*, 200*b*, . . . sequentially from the first sheet processing apparatus, and the Nth sheet processing apparatus is defined as a sheet processing apparatus 200*n*. For descriptive convenience, each sheet processing apparatus 200 has a shape as shown in FIGS. 1 to 3, but has an actual appearance to be described later.

A mechanical structure will be explained when the printing apparatus 100 executes print processing corresponding to a step preceding to sheet processes executed by the inline type sheet processing apparatuses 200. A paper handling operation and the like until sheets of a printed job are supplied from the printer unit 203 into the sheet processing apparatus 200 will be explained. The controller unit (to be also referred to as a control unit or CPU hereinafter) 205 in FIG. 2 causes the printing apparatus 100 to mainly execute the paper handling operation and the like.

Of reference numerals 301 to 322 shown in FIG. 3, reference numeral 301 corresponds to the mechanical structure of the scanner unit 201 in FIG. 2. Reference numerals 302 to 322 correspond to the mechanical structure of the printer unit 203 in FIG. 2. The embodiment will describe the structure of a 1D type color MFP. A 4D type color MFP and monochrome MFP are also examples of the printing apparatus according to the embodiment, but a description thereof will be omitted.

The auto document feeder (ADF) 301 in FIG. 3 separates the first and subsequent original document sheets in the order of pages from an original document bundle set on the support surface of the document tray, and feeds each original document sheet to the document table glass in order to scan the original document sheet by the scanning unit 302. The scanning unit 302 scans the image of the original document sheet fed onto the document table glass, and converts the image into image data by a CCD. A light ray (e.g., a laser beam) modulated in accordance with the image data strikes the rotary polygon mirror 303, and irradiates the photosensitive drum 304 as a reflected scan beam via a reflecting mirror. A latent image formed by the laser beam on the photosensitive drum 304 is developed with toner. The toner image is transferred onto a sheet material supported on the transfer drum 305. A series of image forming processes is executed sequentially with yellow (Y), magenta (M), cyan (C), and black (K) toners, forming a full-color image. After four image forming processes, the sheet material bearing the full-color image is separated by the separation gripper 306 from the transfer drum 305, and conveyed to the fixing unit 308 by the pre-fixing conveyor 307.

The fixing unit 308 comprises a combination of rollers and belts, and incorporates a heat source such as a halogen heater. The fixing unit 308 fuses and fixes, by heat and pressure, toner on a sheet material bearing a toner image. The delivery flapper 309 is swingable about the swing shaft, and regulates the sheet material conveyance direction. When the delivery flapper 309 swings clockwise in FIG. 3, a sheet material is conveyed straight, and discharged outside the apparatus by the discharge rollers 310. To form images on the two surfaces of a sheet material, the delivery flapper 309 swings counterclockwise in FIG. 3. The course of the sheet material changes downward to supply the sheet material to the double-sided conveyor. The double-sided conveyor comprises the reverse flapper 311, reverse rollers 312, reverse guide 313, and double-sided tray 314.

The reverse flapper 311 is swingable about the swing shaft, and regulates the sheet material conveyance direction. To process a double-sided print job, the controller 205 controls to swing the reverse flapper 311 counterclockwise in FIG. 3 and supply a sheet having the first surface printed by the printer unit 203 to the reverse guide 313 via the reverse rollers 312. While the reverse rollers 312 clamp the trailing end of the sheet material, the reverse rollers 312 temporarily stop, the reverse flapper 311 swings clockwise in FIG. 3, and the reverse rollers 312 rotate backward. The sheet is switched back to replace its trailing and leading ends, and then the sheet is guided to the double-sided tray 314.

The double-sided tray 314 temporarily supports the sheet material, and the refeed roller 315 supplies the sheet material again to the registration rollers 316. At this time, the sheet material is sent with a surface opposite to the first surface in the transfer step facing the photosensitive drum. The second image is formed on the second surface of the sheet by the same process as that described above. After the images are formed on the two surfaces of the sheet material, the sheet undergoes the fixing step and is discharged from the printing apparatus to outside the apparatus via the discharge rollers 310. The controller 205 executes this double-sided print sequence, and allows the printing apparatus to execute double-sided printing of target job data on the first and second surfaces of a sheet.

The sheet feed/conveyance section comprises the paper cassettes 317 and 318 (each capable of storing, e.g., 500 sheets) as feeding units storing sheets necessary for print processing, the paper deck 319 (capable of storing, e.g., 5,000 sheets), and the manual feed tray 320. Units for feeding sheets stored in these feeding units are the feeding rollers 321, registration rollers 316, and the like. The paper cassettes 317 and 318 and the paper deck 319 are configured to be able to set sheets of various materials at various sheet sizes in distinction from each other in the feeding units.

The manual feed tray 320 is also configured to be able to set a variety of print media including a special sheet such as an OHP sheet. The paper cassettes 317 and 318, the paper deck 319, and the manual feed tray 320 respectively have the feeding rollers 321, and are configured to be able to successively feed sheets one by one. For example, a pickup roller sequentially picks up stacked sheet materials. A separation roller facing the feeding roller 321 prevents multi feed, and sheet materials are supplied one by one to the conveyance guide. The separation roller receives, via a torque limiter (not shown), a driving force for rotating the separation roller in a direction opposite to the conveyance direction. When only one sheet material enters a nip formed between the separation roller and the feeding roller, the separation roller rotates in the conveyance direction following the sheet material.

If multi feed occurs, the separation roller rotates in the direction opposite to the conveyance direction to set back the multi-fed sheet materials and supply only one top sheet material. The supplied sheet material is guided between the conveyance guides, and conveyed to the registration rollers 316 by a plurality of conveyance rollers. At this time, the registration rollers 316 stand still. The leading end of the sheet material abuts against the nip formed between the pair of registration rollers 316. Then, the sheet material forms a loop to correct skew. The registration rollers 316 start rotating to convey the sheet material in synchronism with the timing of a toner image formed on the photosensitive drum 304 in the image forming section. By the attraction roller 322, the sheet material sent by the registration rollers 316 is electrostatically attracted onto the surface of the transfer drum 305. The sheet material discharged from the fixing unit 308 is introduced into the sheet feeding path in the sheet processing apparatus 200 via the discharge rollers 310.

Through the above-described print process, the controller 205 processes a job to be printed. The controller 205 causes the printer unit 203 by the above-described method to print job print data stored in the HDD 209 from a data generation source based on a printing execution request accepted from a user via the UI unit.

For example, the data generation source of a job whose printing execution request is accepted from the operation unit 204 means the scanner unit 201. The data generation source of a job whose printing execution request is accepted from a server computer is the server computer, as a mater of course.

The controller 205 stores print data of a job to be processed sequentially from the start page in the HDD 209, and reads out the print data of the job sequentially from the start page from the HDD 209 to form the image of the print data on a sheet. The controller 205 performs this start page processing. In addition, the controller 205 supplies printed sheets sequentially from the start page to the sheet feeding path in the sheet processing apparatus 200 with the image surfaces of the sheets facing down. For this purpose, immediately before a sheet enters the sheet processing apparatus 200 via the discharge rollers 310, the controller 205 causes the delivery flapper 309, reverse rollers 312, and the like to execute a switchback operation to reverse the sheet traveling from the fixing unit 308. The controller 205 also executes paper handling control for the start page processing.

The arrangement of the inline type sheet processing apparatus 200 of the printing system 1000 also having the printing apparatus 100 will be explained.

As shown in FIG. 3, the printing system 1000 according to the embodiment comprises a total of n inline type sheet processing apparatuses cascade-connectable to the printing apparatus 100. The number of installed inline type sheet processing apparatuses is arbitrary as many as possible. However, the printing system 1000 must utilize at least a sheet processing apparatus which can supply a sheet printed by the printer unit 203 to an internal sheet processing unit without any intervention work by an operator. In other words, the printing system 1000 must utilize a sheet processing apparatus having a sheet feeding path (paper path) capable of conveying, within the apparatus, a print medium discharged from the printer unit 203 via the discharge rollers 310 of the printing apparatus 100. The printing system 1000 is configured to follow this restriction.

However, the printing system 1000 is flexibly configurable as long as it follows this restriction, as one mechanism for enhancing the effects of the embodiment. For example, the number of connected inline type sheet processing apparatuses is arbitrary three or five, etc. The embodiment also assumes the POD environment where the administrator determines that no inline type sheet processing apparatus is necessary, in order to increase the efficiency of use of an offline type sheet processing apparatus. For example, even when no inline type sheet processing apparatus is used (i.e., the number of inline type sheet processing apparatuses is 0), the printing apparatus 100 of the embodiment is available.

When cascade-connecting a plurality of inline type sheet processing apparatuses to the printing apparatus 100, a specific user (e.g., administrator) can arbitrarily change and determine their connection order under the restriction.

The above-mentioned mechanism aims to improve user friendliness, and is not an indispensable constituent feature. In other words, the present invention is not limited to this configuration. For example, the present invention is applicable to a system configuration which uniformly defines the number of inline type sheet processing apparatuses available in the printing system 1000 and their connection order. The present invention incorporates any system configuration and apparatus configuration as long as at least one of various job control examples (to be described later) is executable.

How many and what kinds of inline type sheet processing apparatuses are connectable to the printing apparatus 100 in the printing system 1000, how to connect them, and what kinds of sheet processes they can execute will be described later.

[Arrangement of Operation Unit 204 as Example of UI Unit of Printing System 1000]

Figure 4:
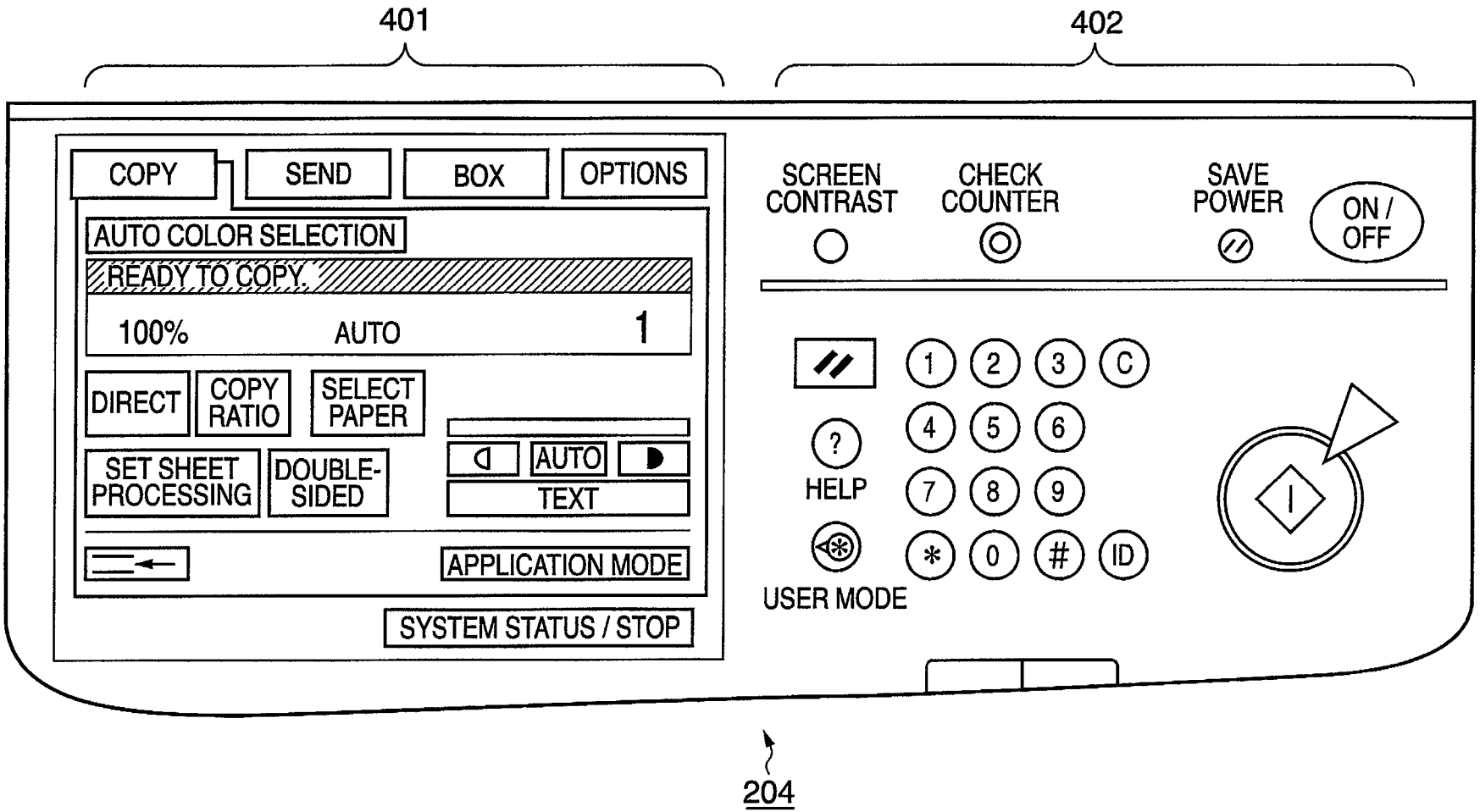
FIG. 4 is a view for explaining an example of a UI unit to be controlled in the first embodiment of the present invention.

The operation unit 204 serving as an example of the user interface unit (to be referred to as a UI unit hereinafter) of the printing apparatus 100 in the printing system 1000 will be explained with reference to FIG. 4 and the like.

The operation unit 204 comprises a key input section 402 capable of accepting a user operation with hard keys, and a touch panel section 401 serving as an example of a display unit capable of accepting a user operation with soft keys (display keys).

Figure 5:
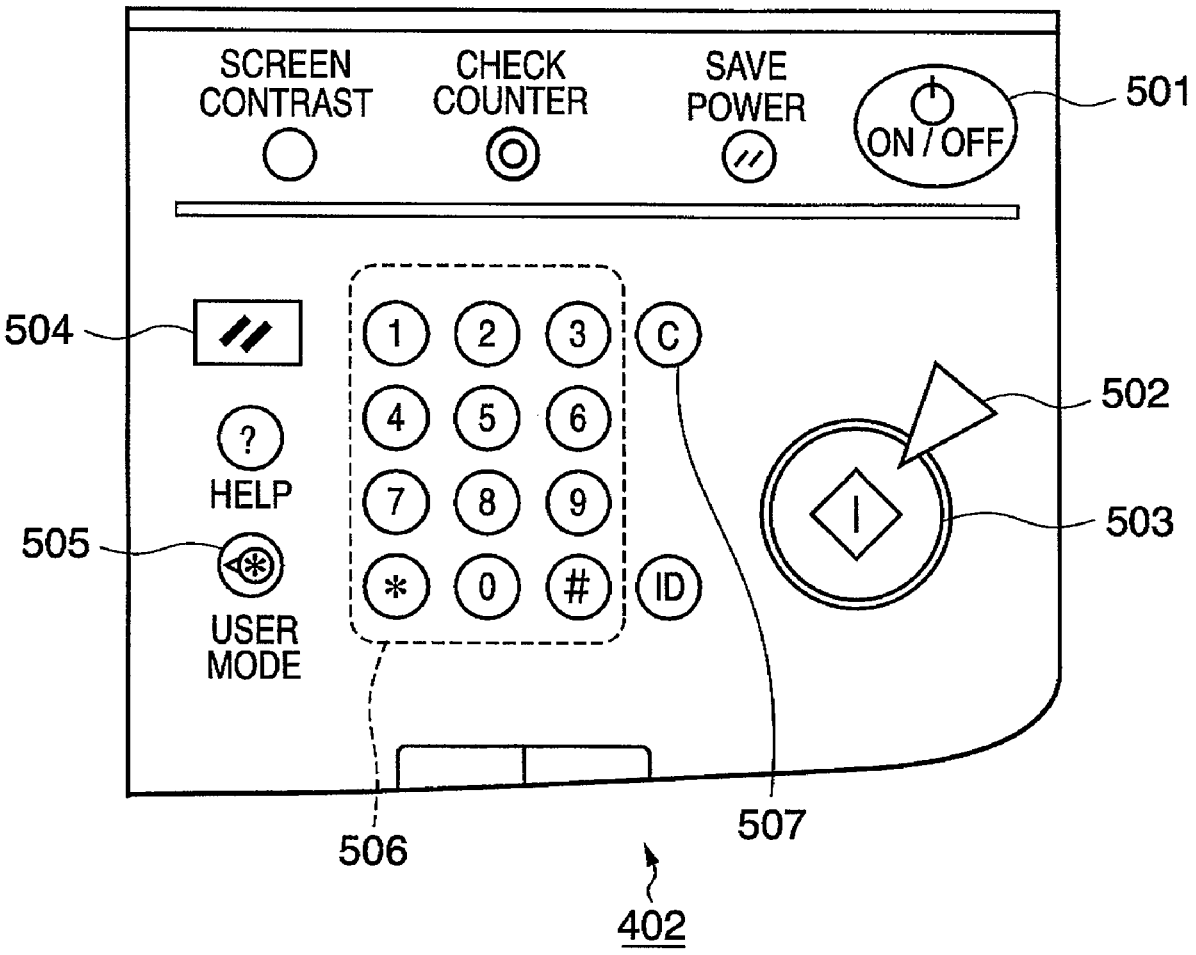
FIG. 5 is a view for explaining an example of the UI unit to be controlled in the first embodiment of the present invention.

As shown in FIG. 5, the key input section 402 comprises a switch 501 for turning on/off the power supply on the operation unit. In response to an operation to the switch 501, the controller 205 controls to selectively switch between the standby mode (normal operation state) and the sleep mode (a state in which the program stops in wait for an interrupt in preparation for network printing, facsimile transmission, or the like, suppressing power consumption). The controller 205 controls to accept a user operation to the switch 501 while a main power switch (not shown) for supplying power to the whole system is ON.

A start key 503 allows accepting an instruction from a user to cause the printing apparatus to start a kind of job processing designated by a user, such as copying or transmission of a job to be processed. A stop key 502 allows accepting an instruction from the user to cause the printing apparatus to interrupt the process of an accepted job. A ten-key pad 506 allows the user to set the entries of various settings. A clear key 507 is used to cancel various parameters such as entries set by the user via the ten-key pad 506. A reset key 504 is used to accept an instruction from the user to invalidate various settings made by the user for a job to be processed and restore the setting values to defaults. A user mode key 505 is used to shift to a system setup window for each user.

Figure 6:
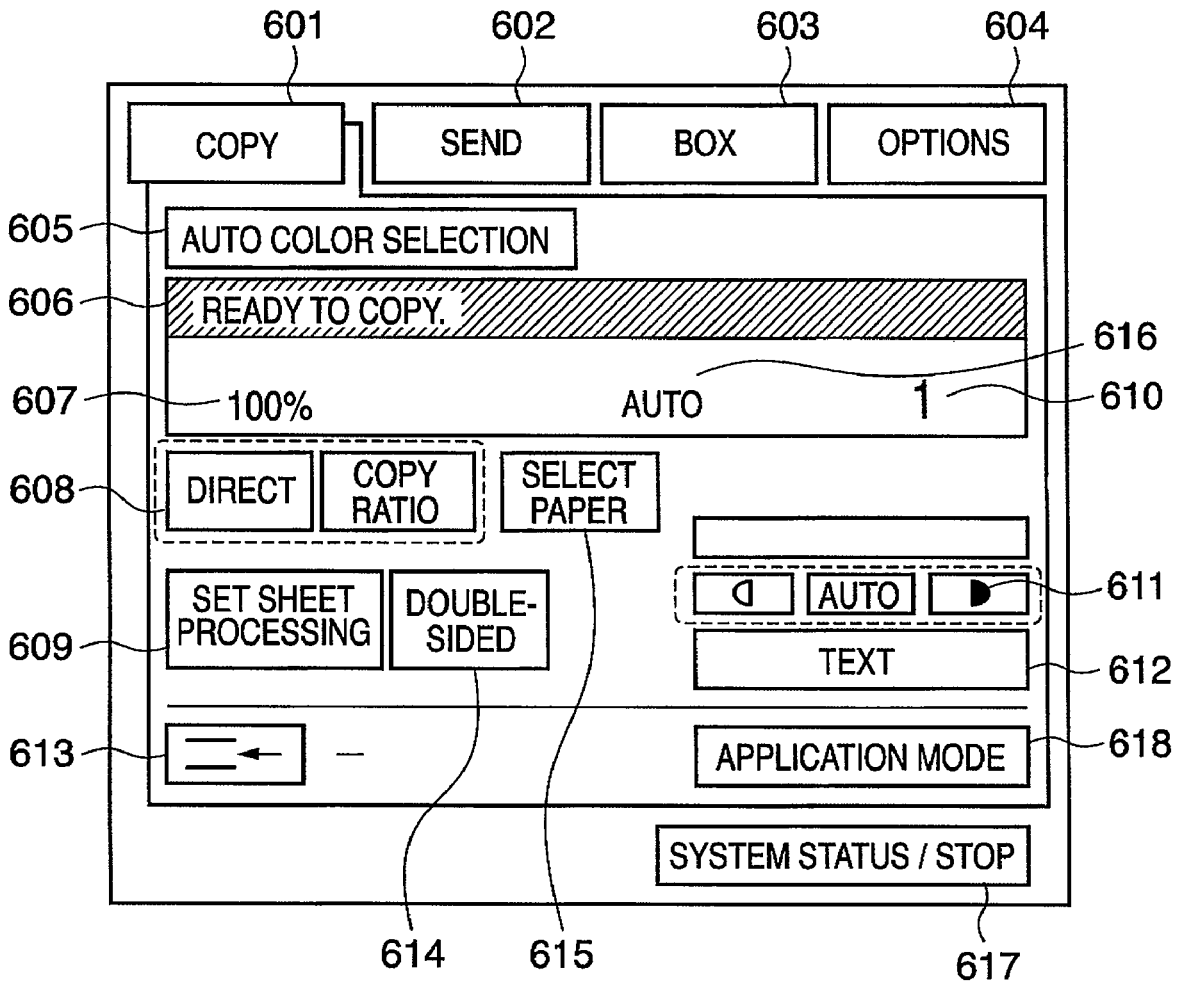
FIG. 6 is a view showing an example of a display window on the UI unit to be controlled in the first embodiment of the present invention.

FIG. 6 is a view for explaining the touch panel section (to be also referred to as a display unit) 401 serving as an example of a user interface unit provided by the printing system 1000.

The touch panel section 401 has an LCD (Liquid Crystal Display), and a touch panel display formed from a transparent electrode adhered onto the LCD. The touch panel section 401 has both a function of accepting various settings from an operator and a function of presenting information to the operator. For example, when detecting that the user presses a portion corresponding to a valid display key on the LCD, the controller 205 controls the touch panel section 401 to display an operation window corresponding to the key operation in accordance with a display control program stored in advance in the ROM 207. FIG. 6 shows an example of an initial window displayed on the touch panel section 401 when the printing apparatus is in the standby mode (a state in which there is no job to be processed by the printing apparatus 100).

When the user presses a copy tab 601 on the touch panel section 401 shown in FIG. 6, the controller 205 causes the touch panel section 401 to display the operation window of the copy function provided by the printing apparatus. When the user presses a send tab 602, the controller 205 causes the touch panel section 401 to display the operation window of the data send function (e.g., FAX transmission or E-mail sending) provided by the printing apparatus. When the user presses a box tab 603, the controller 205 causes the touch panel section 401 to display the operation window of the box function provided by the printing apparatus.

The box function uses a plurality of data storage boxes (to be referred to boxes hereinafter) which are virtually ensured in the HDD 209 in advance and are available distinctively for respective users. With the box function, the controller 205 allows a user to select a desired one of boxes via the user interface unit, and can accept a desired operation from the user. For example, the controller 205 responds to an instruction input from the user via the operation unit 204, and controls the HDD 209 to store, in a box selected by the user, document data of a job accepted from the scanner 201 of the printing apparatus.

The controller 205 also allows storing, for example, text data of a job accepted from an external apparatus (e.g., the PC 103 or 104) via the external I/F unit 202 in a box designated by the user in accordance with an instruction designated by the user from the external apparatus via its user interface unit. The controller 205 controls, for example, the printer unit 203 to print job data stored in a box in an output form the user wants in accordance with a user instruction from the operation unit 204, or controls the external I/F unit 202 to transmit the job data to an external apparatus the user wants.

To allow a user to execute various box operations, the controller 205 controls the touch panel section 401 to display a box function operation window in response to press of the box tab 603 by the user. When the user presses an option tab 604 on the touch panel section 401 of FIG. 6, the controller 205 causes the touch panel section 401 to display a window for setting optional functions such as scanner setting. When the user presses a system monitor key 617, the controller 205 causes the touch panel section 401 to display a display window for notifying the user of the MFP state or status.

A color selection setting key 605 is a display key which allows the user to select color copying, monochrome copying, or auto selection in advance. A copy ratio setting key 608 causes the touch panel section 401 to display a setup window which allows the user to set a copy ratio such as equal magnification, enlargement, or reduction.

When the user presses a double-sided key 614, the controller 205 causes the touch panel section 401 to display a window which allows the user to set which of single-sided printing and double-sided printing is executed to print a target job. In response to press of a sheet selection key 615 by the user, the controller 205 causes the touch panel section 401 to display a window which allows the user to set a feeding unit, sheet size, and sheet type (medium type) necessary to print a target job. In response to press of a key 612 by the user, the controller 205 causes the touch panel section 401 to display a window which allows the user to select an image processing mode (e.g., a text mode or photo mode) suited to an original document image. When the user operates a density setting key 611, the controller 205 allows him to adjust the density of the output image of a job to be printed.

The controller 205 causes the touch panel section 401 to display, in a status display field 606, the operation state (e.g., standby, warm-up, printing, jam, or error) of an event which occurs in the printing apparatus, in order to prompt the user to confirm the event. The controller 205 causes the touch panel section 401 to display information in a display field 607 for prompting the user to confirm the copy ratio of a job to be processed. The controller 205 causes the touch panel section 401 to display information in a display field 616 for prompting the user to confirm the sheet size and feeding mode of a job to be processed. The controller 205 causes the touch panel section 401 to display, in a display field 610, information for prompting the user to confirm the number of copies of a job to be processed, and information for prompting the user to confirm the sheet number during printing. In this manner, the controller 205 causes the touch panel section 401 to display various kinds of information to be announced to the user.

When the user presses an interrupt key 613, the controller 205 causes the printing apparatus to stop printing a current job, and execute printing of a job from the user. When the user presses an application mode key 618, the controller 205 causes the touch panel section 401 to display a window for setting various image processes and layouts, such as two-page separation, cover sheet/slip sheet setting, reduction layout, and image movement.

Still another point of the embodiment will be described.

As a setting for a job to be processed, the controller 205 causes the UI unit to execute a display for accepting a request from a user to execute sheet processing by the sheet processing unit of the inline type sheet processing apparatus 200 of the printing system 1000. The controller 205 also causes the UI unit to execute a display for accepting an instruction from the user to cause the UI unit to execute this display.

For example, the controller 205 causes the touch panel section 401 to display a sheet processing setting key 609 in FIG. 6. Assume that the user presses the sheet processing setting key 609. Then, the controller 205 causes the touch panel section 401 to execute a display for allowing the user to specify desired sheet processing among sheet processing selection candidates executable using the inline type sheet processing apparatus of the printing system 1000. The "sheet processing setting key 609" illustrated in the display of FIG. 6 will also be referred to as a "finishing key". That is, the "sheet processing setting key 609" and "finishing key" mean the same function button. In the following description, "sheet processing" will also be referred to as "finishing". As for "punching", needs for various punching processes (processes to punch a printed sheet) are assumable in the POD environment.

Another apparatus or unit may also execute these punching processes. However, the printing system 1000 is permitted to use an apparatus which satisfies the definition of an inline finisher, and is inhibited from using an apparatus which does not satisfy this definition.

Figure 7:
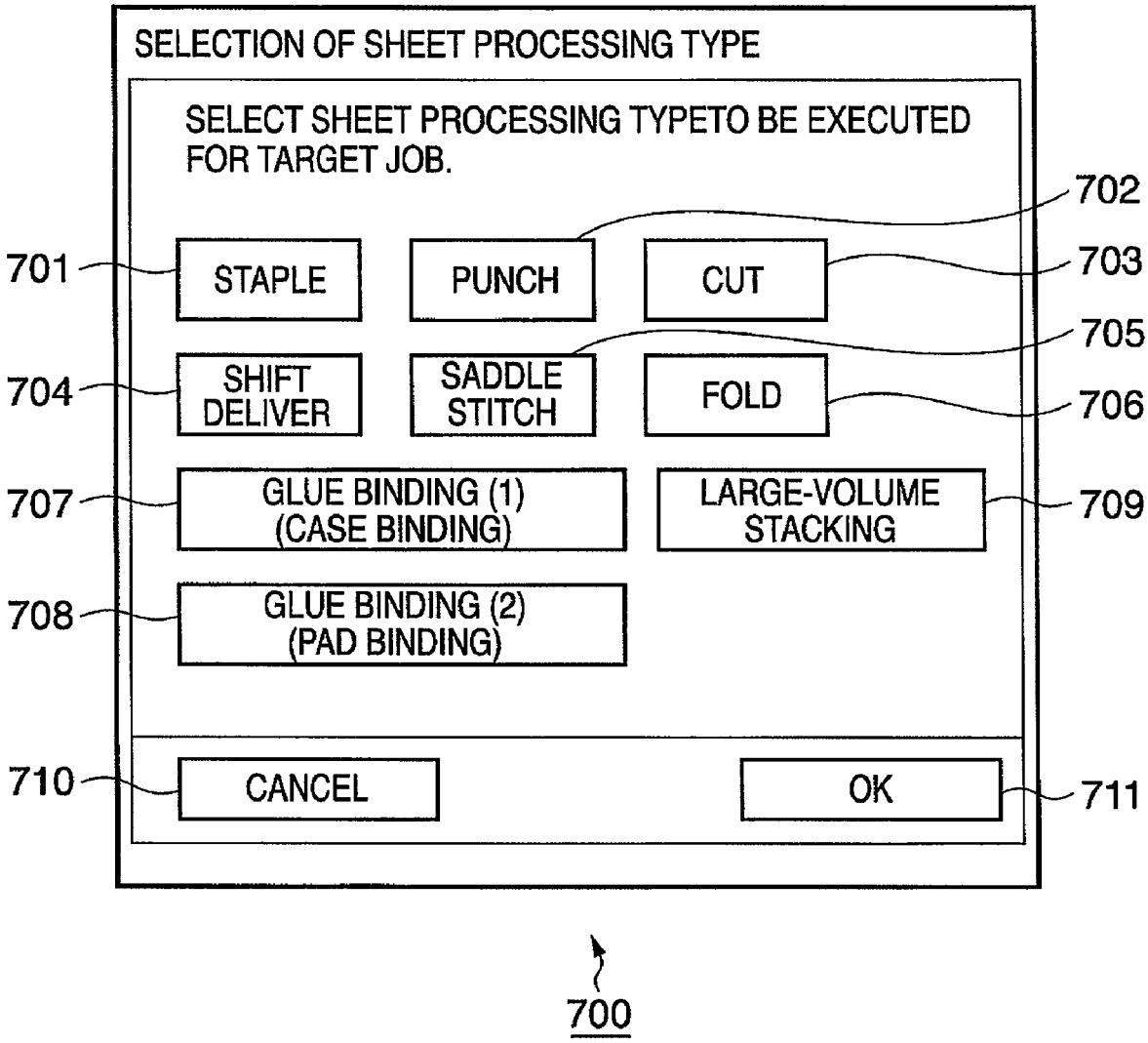
FIG. 7 is a view showing an example of a display window on the UI unit to be controlled in the first embodiment of the present invention.

In the embodiment, the controller 205 causes the touch panel section 401 to execute a display in FIG. 7 in response to press of the sheet processing setting key 609 by the user. The controller 205 controls to accept a request via the display of FIG. 7 to execute sheet processing by the inline sheet processing apparatus 200 for a printed sheet of a job to be processed.

The controller 205 determines sheet processing apparatus candidates selectable via the display of FIG. 7 in accordance with the kind of sheet processing apparatus arranged in the printing system 1000 and the installation of the sheet processing apparatus. For example, the display of FIG. 7 permits accepting a request from a user to execute any type of sheet processing among a plurality of types of sheet processes listed below for a sheet printed by the printer unit 203: (1) stapling, (2) punching, (3) folding, (4) shift delivery, (5) cutting, (6) saddle stitching, (7) case binding as an example of glue binding, (8) pad binding as another example of glue binding, and (9) large-volume stacking.

In the UI control example of FIG. 7, the controller 205 controls the operation unit 204 to set these nine sheet processes as selection candidates. This is because the inline type sheet processing apparatuses of the printing system 1000 can be used to selectively execute these nine sheet processes.

In other words, the controller 205 controls the UI unit to exclude a type of sheet processing unexecutable by the printing system 1000 from selection candidates in the display of FIG. 7. For example, when the printing system 1000 does not comprise one sheet processing apparatus capable of selectively executing case binding and pad binding, or this sheet processing apparatus is out of order, the controller 205 controls to invalidate keys 707 and 708. For example, the controller 205 grays out and hatches the keys 707 and 708. With this setting, the controller 205 controls not to accept a request from a user to execute these sheet processes. Further, when the printing system 1000 comprises a sheet processing apparatus capable of executing sheet processing different from the above-mentioned nine candidates, the controller 205 controls the display of FIG. 7 to validate a display key for accepting a request from a user to execute the different sheet processing. With this display key, the controller 205 permits accepting a request from a user to execute the sheet processing. The embodiment prevents any user operation error by executing this display control in addition to job processing control (to be described later).

When executing this control, the controller 205 acquires system configuration information for specifying what kind of sheet processing apparatus the printing system 1000 comprises as the sheet processing apparatus 200. In this control, the controller 205 also uses, for example, status information for specifying whether an error occurs in the sheet processing apparatus 200. The controller 205 acquires these pieces of information by prompting a user to manually input them via the UI unit, or acquires them automatically based on a signal output from the sheet processing apparatus 200 via a signal line when the sheet processing apparatus 200 is connected to the printing apparatus 100. On the premise of this configuration, the controller 205 causes the touch panel section 401 to execute the display of FIG. 7 with display contents based on the acquired information.

The printing system 1000 can accept a request from an external apparatus such as the PC 103 or 104 to print a target job and a request to execute sheet processing necessary for the job. When inputting a job from the external apparatus, the controller 205 controls the display unit of the external apparatus serving as a print data transmission source to display the same functions as those of the display in FIG. 7. For example, in the embodiment, the controller 205 causes the display unit of a computer such as the PC 103 or 104 to display a printer driver setup window (to be described later). When the UI of the external apparatus executes the display, the control unit of the external apparatus executes the above-described control. For example, when the display unit of the PC 103 or 104 displays a printer driver UI window (to be described later), the CPU of the PC executes the main control.

[Concrete Example of Configuration of Printing System 1000 to Be Controlled in Embodiment]

A system configuration representing how many and what kinds of inline type sheet processing apparatuses are connectable to the printing apparatus 100 in the printing system 1000, how to connect them, and what kinds of sheet processes they can execute will be explained with reference to FIGS. 8A and 8B and the like.

Figure 8A:
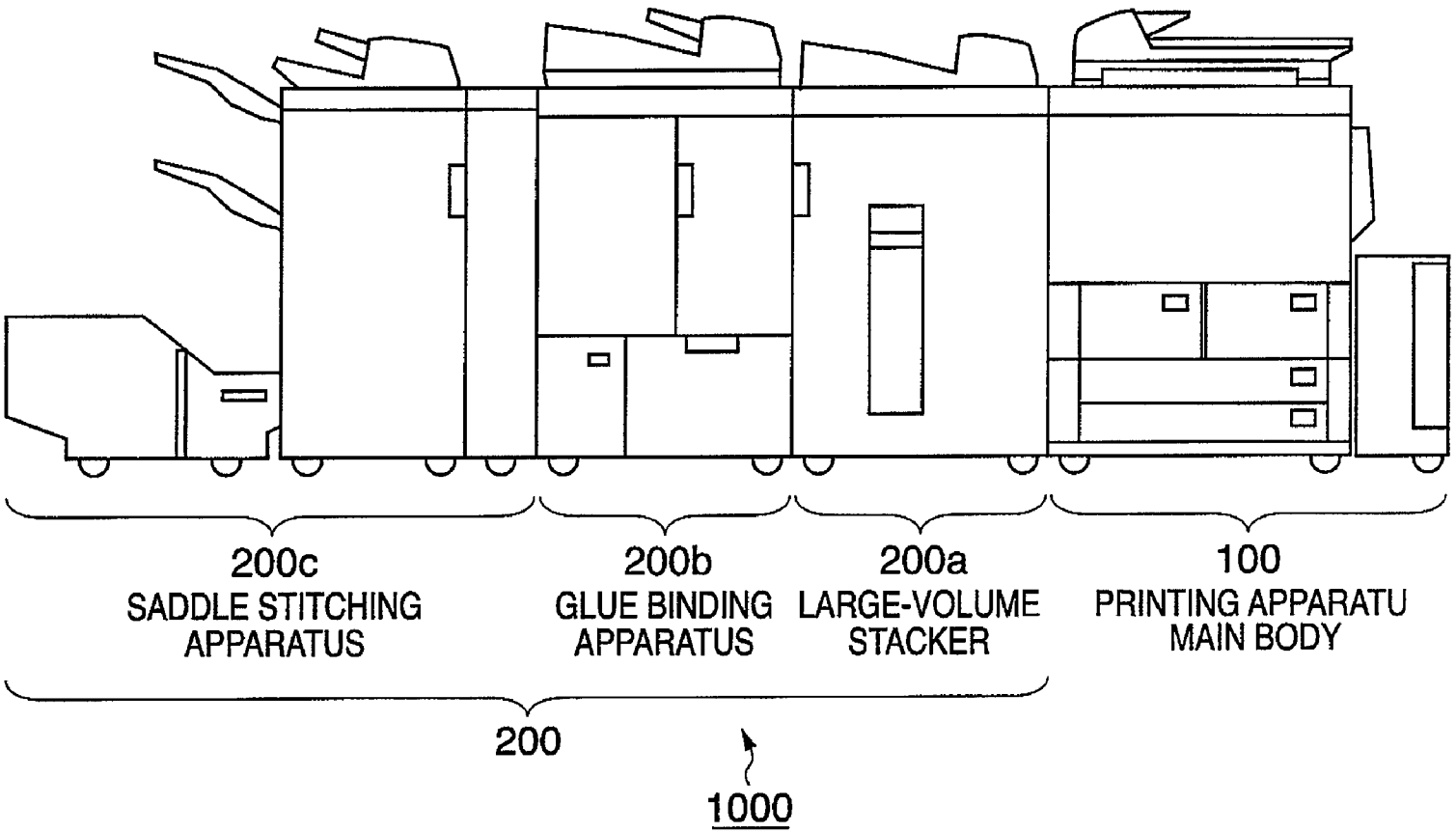
FIG. 8A is a view for explaining a control example of the printing system 1000 to be controlled in the first embodiment of the present invention.
Figure 8B:
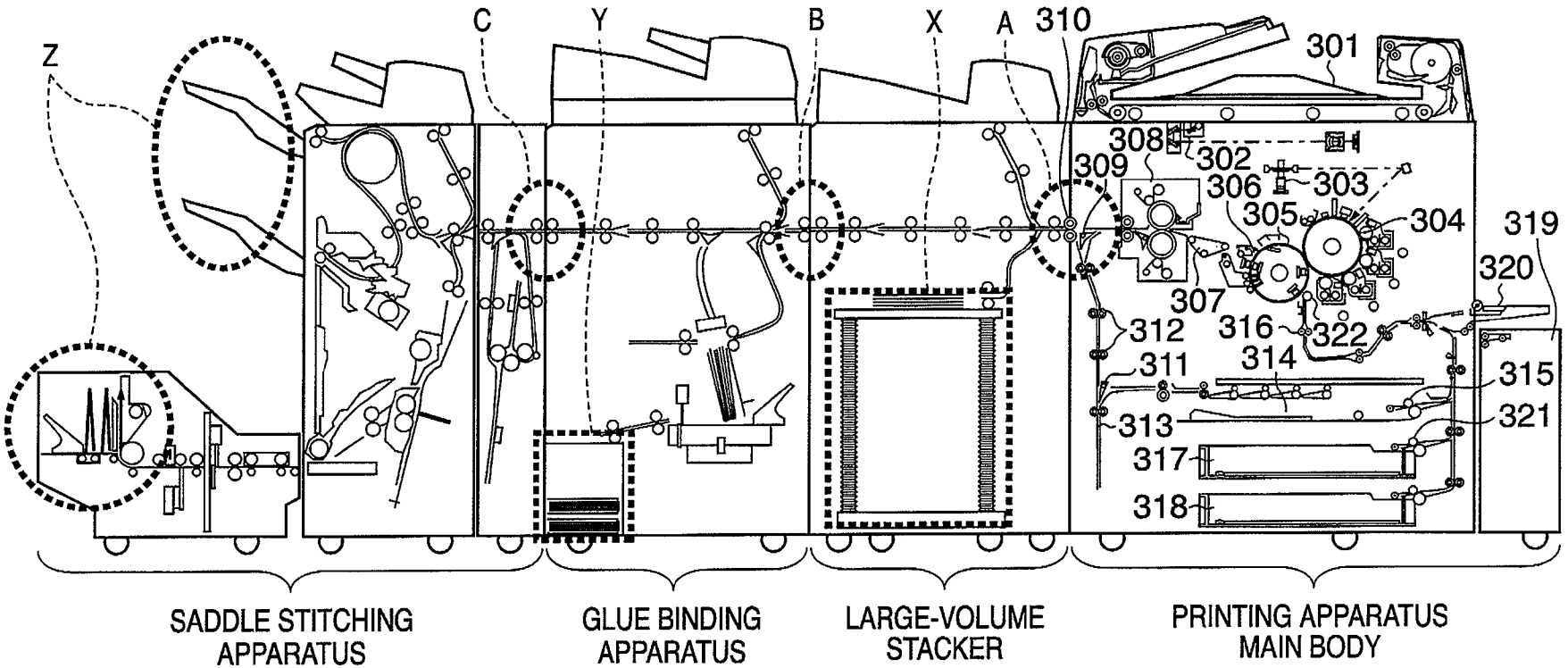
FIG. 8B is a view for explaining the control example of the printing system 1000 to be controlled in the first embodiment of the present invention.

The embodiment can implement, for example, a system configuration as shown in FIGS. 8A and 8B as the printing system 1000 shown in FIGS. 1 to 3.

In FIG. 8A, the printing system 1000 comprises a total of three inline type sheet processing apparatuses, that is, a large-volume stacker, glue binding apparatus, and saddle stitching apparatus as a group of sheet processing apparatuses 200. In FIG. 8A, the large-volume stacker, glue binding apparatus, and saddle stitching apparatus are connected in the order named to the printing apparatus 100 of the printing system 1000. The controller 205 serving as an example of the control unit of the printing system 1000 comprehensively controls the printing system 1000 having the system configuration as shown in FIGS. 8A and 8B.

In the embodiment, the large-volume stacker is a sheet processing apparatus capable of stacking a large number of (e.g., 5,000) sheets from the printer unit 203.

The glue binding apparatus in the embodiment is a sheet processing apparatus capable of executing case binding requiring sheet gluing when binding a bundle of sheets printed by the printer unit 203 by attaching a cover. The glue binding apparatus can also execute pad binding corresponding to sheet processing to glue and bind a bundle of sheets without attaching any cover. The glue binding apparatus is also called a case binding apparatus because it is a sheet processing apparatus capable of executing at least case binding.

The saddle stitching apparatus is a sheet processing apparatus capable of selectively executing stapling, punching, cutting, shift delivery, saddle stitching, and folding for sheets from the printer unit 203.

In the embodiment, the controller 205 registers, in a specific memory, various kinds of system configuration information on these sheet processing apparatuses as management information necessary for various control examples. For example, when the printing system 1000 has the system configuration as shown in FIG. 8A, the controller 205 registers the following pieces of information in the HDD 209.

(Information 1) Information 1 is apparatus presence/absence information which allows the controller 205 to confirm that the printing system 1000 comprises an inline type sheet processing apparatus. Information 1 corresponds to information which allows the control unit to specify whether the printing system 1000 comprises an inline type sheet processing apparatus.

(Information 2) Information 2 is inline sheet processing apparatus count information which allows the controller 205 to confirm that the printing system 1000 comprises three inline type sheet processing apparatuses 200. Information 2 corresponds to information which allows the control unit to specify the number of inline type sheet processing apparatuses of the printing system 1000.

(Information 3) Information 3 is inline sheet processing apparatus type information which allows the controller 205 to specify that the printing system 1000 comprises the large-volume stacker, glue binding apparatus, and saddle stitching apparatus. Information 3 corresponds to information which allows the control unit to confirm the types of inline type sheet processing apparatuses of the printing system 1000.

(Information 4) Information 4 includes information which allows the controller 205 to confirm that one of the three inline type sheet processing apparatuses is a large-volume stacker capable of stacking sheets from the printer unit 203. Information 4 includes apparatus performance information which allows the controller 205 to confirm that another inline type sheet processing apparatuses is a glue binding apparatus capable of executing glue binding (case binding and/or pad binding) for sheets from the printer unit 203. Information 4 includes information which allows the controller 205 to confirm that the remaining inline type sheet processing apparatuses is a saddle stitching apparatus capable of selectively executing stapling, punching, cutting, shift delivery, saddle stitching, and folding for sheets from the printer unit 203. In other words, information 4 is information which allows the controller 205 to specify that sheet processes executable by the printing system are a total of nine processes: stapling, punching, cutting, shift delivery, saddle stitching, folding, case binding, pad binding, and large-volume stacking. Information 4 corresponds to information which allows the control unit to confirm performance information of sheet processes executable by the inline type sheet processing apparatuses of the printing system 1000.

(Information 5) Information 5 is information which allows the controller 205 to confirm that the three sheet processing apparatuses are cascade-connected to the printing apparatus 100 in the order of the large-volume stacker, glue binding apparatus, and saddle stitching apparatus. Information 5 corresponds to connection order information of these sheet processing apparatuses in the printing system when a plurality of inline finishers are connected.

The controller 205 registers, in the HDD 209, various kinds of information as represented by (information 1) to (information 5) as system configuration information necessary for various control examples. The controller 205 utilizes these pieces of information as criterion information necessary for job control (to be described later).

On the premise of this configuration, for example, the printing system 1000 has the system configuration as shown in FIG. 8A. Control executed by the controller 205 in this system configuration will be exemplified.

For example, when the printing system 1000 has the system configuration in FIGS. 8A and 8B, it can execute all the nine sheet processes. The controller 205 recognizes this on the basis of the criteria of (information 1) to (information 5). Based on the recognition result, the controller 205 controls the UI unit to set all the nine sheet processes as selection candidates in the display of FIG. 7. In addition, the controller 205 executes the following control in response to a user operation.

Assume that the controller 205 accepts a stapling execution request from a user via the UI unit for a target job in response to press of a key 701 by the user in the display of FIG. 7 executed by the UI unit under the control of the controller 205. In response to this request, the controller 205 causes the saddle stitching apparatus corresponding to the sheet processing apparatus 200*c* in FIG. 8A to staple printed sheets of the job.

Assume that the controller 205 accepts a (sheet) punching execution request from a user via the UI unit for a target job in response to press of a key 702 by the user in the display of FIG. 7 executed by the UI unit under the control of the controller 205. In response to this request, the controller 205 causes the saddle stitching apparatus corresponding to the sheet processing apparatus 200*c* in FIG. 8A to punch printed sheets of the job.

Assume that the controller 205 accepts a cutting execution request from a user via the UI unit for a target job in response to press of a key 703 by the user in the display of FIG. 7 executed by the UI unit under the control of the controller 205. In response to this request, the controller 205 causes the saddle stitching apparatus corresponding to the sheet processing apparatus 200*c* in FIG. 8A to cut printed sheets of the job.

Assume that the controller 205 accepts a cutting execution request from a user via the UI unit for a target job in response to press of a key 704 by the user in the display of FIG. 7 executed by the UI unit under the control of the controller 205. In response to this request, the controller 205 causes the saddle stitching apparatus corresponding to the sheet processing apparatus 200*c* in FIG. 8A to cut printed sheets of the job.

Assume that the controller 205 accepts a saddle stitching execution request from a user via the UI unit for a target job in response to press of a key 705 by the user in the display of FIG. 7 executed by the UI unit under the control of the controller 205. In response to this request, the controller 205 causes the saddle stitching apparatus corresponding to the sheet processing apparatus 200*c* in FIG. 8A to saddle-stitch printed sheets of the job.

Assume that the controller 205 accepts a folding execution request from a user via the UI unit for a target job in response to press of a key 706 by the user in the display of FIG. 7 executed by the UI unit under the control of the controller 205. In response to this request, the controller 205 causes the saddle stitching apparatus corresponding to the sheet processing apparatus 200*c* in FIG. 8A to fold (e.g., Z-fold) printed sheets of the job.

Assume that the controller 205 accepts a case binding execution request from a user via the UI unit for a target job in response to press of the key 707 by the user in the display of FIG. 7 executed by the UI unit under the control of the controller 205. In response to this request, the controller 205 causes the glue binding apparatus corresponding to the sheet processing apparatus 200*b* in FIG. 8A to case-bind printed sheets of the job.

Assume that the controller 205 accepts a pad binding execution request from a user via the UI unit for a target job in response to a press of the key 708 by the user in the display of FIG. 7 executed by the UI unit under the control of the controller 205. In response to this request, the controller 205 causes the glue binding apparatus corresponding to the sheet processing apparatus 200*b* in FIG. 8A to pad-bind printed sheets of the job.

Assume that the controller 205 accepts a large-volume stacking execution request from a user via the UI unit for a target job in response to press of a key 709 by the user in the display of FIG. 7 executed by the UI unit under the control of the controller 205. In response to this request, the controller 205 causes the large-volume stacker corresponding to the sheet processing apparatus 200*a* in FIG. 8A to stack a large number of printed sheets of the job.

As described above, the controller 205 controls to accept, via the UI unit together with a printing execution request, a request to execute sheet processing the user wants among selection candidates corresponding to sheet processes executable by the sheet processing apparatuses of the printing system 1000. In response to accepting a request from the user via the UI unit provided by the embodiment to print a target job, the controller 205 causes the printer unit 203 to execute print processing necessary for the job. Further, the controller 205 causes a sheet processing apparatus of the printing system 1000 to execute sheet processing necessary for printed sheets of the job.

As another feature of the embodiment, the controller 205 executes the following control in the printing system 1000.

Assume that the printing system 1000 has the system configuration as shown in FIG. 8A. In other words, the printing system 1000 is built by connecting the printing apparatus 100→the large-volume stacker→the glue binding apparatus→the saddle stitching apparatus in the order named. The internal system configuration in this case is as shown in FIG. 8B.

FIG. 8B is a sectional view of the apparatuses of the whole printing system 1000 when the printing system 1000 has the system configuration in FIG. 8A. The apparatus configuration in FIG. 8B corresponds to that in FIG. 8A.

FIG. 8B is a sectional view of the apparatuses of the whole printing system 1000. The apparatus configuration in FIG. 8B corresponds to that in FIG. 8A.

As is apparent from the internal apparatus configuration in FIG. 8B, a sheet printed by the printer unit 203 of the printing apparatus 100 is suppliable into the respective sheet processing apparatuses. More specifically, as shown in FIG. 8B, the respective sheet processing apparatuses comprise sheet feeding paths capable of feeding a sheet via points A, B, and C in the apparatuses.

Each inline type sheet processing apparatus such as the sheet processing apparatus 200*a* or 200*b* in FIG. 8B has a function of receiving a sheet from a preceding apparatus connected to the input side of the sheet processing apparatus even if a target job does not require sheet processing executable by the sheet processing apparatus. Each inline type sheet processing apparatus also has a function of transferring a sheet received from a preceding apparatus to a succeeding apparatus connected to the output side of the sheet processing apparatus.

As described above, in the printing system 1000 of the embodiment, a sheet processing apparatus, which executes sheet processing different from sheet processing necessary for a target job, has a function of conveying sheets of the target job from a preceding apparatus to a succeeding apparatus. This configuration is also a feature of the embodiment.

For example, when the printing system 1000 has the system configuration shown in FIGS. 8A and 8B on the premise of the above-described system configuration, the controller 205 executes the following exemplary control for a job for which the user issues a printing execution request via the UI unit according to the above-described method.

Assume that a target job whose printing execution request is accepted from the user requires sheet processing (e.g., stacking) by the large-volume stacker after print processing in the system configuration of FIGS. 8A and 8B. This job is called a "stacker job".

When processing the stacker job in the system configuration of FIGS. 8A and 8B, the controller 205 makes job sheets printed by the printing apparatus 100 pass through point A in FIG. 8B, and causes the large-volume stacker to execute sheet processing. The controller 205 causes the large-volume stacker to hold, at a delivery destination X inside the large-volume stacker shown in FIG. 8B, the printing result of the stacker job having undergone the sheet processing (e.g., stacking) by the large-volume stacker, without conveying the printing result to another apparatus (e.g., a succeeding apparatus).

The operator can directly take out, from the delivery destination X, the printed material of the stacker job held at the delivery destination X in FIG. 8B. In other words, this configuration can omit a series of apparatus operations and operator operations to convey sheets to a most downstream delivery destination Z in the sheet conveyance direction in FIG. 8B and take out the printed material of the stacker job from the delivery destination Z.

A series of control operations executed by the controller 205 when the printing system 1000 has the system configuration in FIGS. 8A and 8B corresponds to a control example (case 1) in FIG. 8B.

Assume that a target job whose printing execution request is accepted from the user requires sheet processing (e.g., case binding or pad binding) by the glue binding apparatus after print processing in the system configuration of FIGS. 8A and 8B. This job is called a "glue binding job".

When processing the glue binding job in the system configuration of FIGS. 8A and 8B, the controller 205 makes job sheets printed by the printing apparatus 100 pass through points A and B in FIG. 8B, and causes the glue binding apparatus to execute sheet processing. The controller 205 causes the glue binding apparatus to hold, at a delivery destination Y inside the glue binding apparatus shown in FIG. 8B, the printing result of the glue binding job having undergone the sheet processing (e.g., case binding or pad binding) by the glue binding apparatus, without conveying the printing result to another apparatus (e.g., a succeeding apparatus).

The operator can directly take out, from the delivery destination Y, the printed material of the glue binding job held at the delivery destination Y in FIG. 8B. In other words, this configuration can omit a series of apparatus operations and operator operations to convey sheets to the most downstream delivery destination Z in the sheet conveyance direction in FIG. 8B and take out the printed material of the glue binding job from the delivery destination Z.

A series of control operations executed by the controller 205 when the printing system 1000 has the system configuration in FIGS. 8A and 8B corresponds to a control example (case 2) in FIG. 8B.

When a target job whose printing execution request is accepted from the user requires sheet processing by the saddle stitching apparatus after print processing in the system configuration of FIGS. 8A and 8B, this job is called a "saddle stitching job". The sheet processing is, for example, saddle stitching, punching, cutting, shift delivery, or folding.

When processing the saddle stitching job in the system configuration of FIGS. 8A and 8B, the controller 205 makes job sheets printed by the printing apparatus 100 pass through points A, B, and C in FIG. 8B, and causes the saddle stitching apparatus to execute sheet processing. The controller 205 causes the saddle stitching apparatus to hold, at the delivery destination Z of the saddle stitching apparatus shown in FIG. 8B, the printing result of the saddle stitching job having undergone the sheet processing by the saddle stitching apparatus, without conveying the printing result to another apparatus.

The delivery destination Z in FIG. 8B has a plurality of delivery destination candidates. This is because the saddle stitching apparatus of the embodiment can execute a plurality of types of sheet processes and the delivery destination changes for each sheet process, which will be described with reference to FIG. 13.

A series of control operations executed by the controller 205 when the printing system 1000 has the system configuration in FIGS. 8A and 8B corresponds to a control example (case 3) in FIG. 8B.

As described above, the controller 205 serving as an example of the control unit of the embodiment also executes paper handling control based on system configuration information of the printing system 1000 that is stored in the HDD 209.

Information corresponding to the system configuration information includes information representing whether the system comprises an inline finisher, and when the system comprises an inline finisher, information on the number of inline finishers and their performance information. When the system comprises a plurality of inline finishers, the system configuration information also includes their connection order information.

As shown in FIGS. 1 to 3, 8A, 8B, and the like, the printing system 1000 according to the embodiment is configured to be able to connect a plurality of inline type sheet processing apparatuses to the printing apparatus 100. As is apparent from a comparison between FIGS. 8A and 8B and FIGS. 9A, 9B, 10A, and 10B (to be described later), a plurality of inline type sheet processing apparatuses can be independently connected or disconnected, or a free combination of them can be attached to the printing apparatus 100. The connection order of inline type sheet processing apparatuses is arbitrary as long as they are physically connectable. However, the embodiment imposes restrictions on the system configuration.

For example, an apparatus permitted to be adopted as an inline type sheet processing apparatus in the printing system 1000 has the following constituent features.

That is, a sheet processing apparatus can execute sheet processing for sheets of a job requiring sheet processing executable by the sheet processing apparatus, and has a sheet conveyance function of receiving, from a preceding apparatus, sheets of a job requiring no sheet processing by the sheet processing apparatus and transferring them to a succeeding apparatus. For example, in the embodiment, this sheet processing apparatus corresponds to the large-volume stacker and glue binding apparatus shown in the system configuration of FIGS. 8A and 8B and that of FIGS. 9A and 9B (to be described later).

The embodiment also permits the use of a sheet processing apparatus, which does not meet the above configuration, as an inline type sheet processing apparatus in the printing system 1000. For example, this apparatus satisfies the following requirements.

That is, a sheet processing apparatus can execute sheet processing for sheets of a job requiring sheet processing executable by the sheet processing apparatus, but does not have the sheet conveyance function of receiving, from a preceding apparatus, sheets of a job requiring no sheet processing by the sheet processing apparatus and transferring them to a succeeding apparatus. For example, in the embodiment, this sheet processing apparatus corresponds to the saddle stitching apparatus shown in the system configuration of FIGS. 8A and 8B, that of FIGS. 9A and 9B, and that of FIGS. 11A and 10B (to be described later). The embodiment imposes restrictions on an apparatus of this type.

For example, when the printing system 1000 employs an inline finisher (e.g., the saddle stitching apparatus in FIGS. 8A and 8B) having no function of conveying sheets to a succeeding apparatus, the number of apparatuses of this type is limited to one. However, it is permitted to simultaneously use inline finishers of other types.

For example, it is permitted to use the large-volume stacker and glue binding apparatus together with the saddle stitching apparatus, as represented by the system configuration of FIGS. 8A and 8B and that of FIGS. 9A and 9B (to be described later). When a plurality of sheet processing apparatuses are cascade-connected and used, an inline type sheet processing apparatus having no function of conveying sheets to a succeeding apparatus is installed at the most downstream position in the sheet conveyance direction.

For example, the saddle stitching apparatus is connected last in the printing system 1000, as represented by the system configuration of FIGS. 8A and 8B and that of FIGS. 9A and 9B (to be described later). In other words, it is inhibited to configure the printing system by interposing the saddle stitching apparatus between the large-volume stacker and the glue binding apparatus, as a system configuration different from that of FIGS. 8A and 8B and that of FIGS. 9A and 9B (to be described later).

The control unit of the printing system comprehensively controls the printing system 1000 so as to operate under the above-described restrictions.

For example, if inline type sheet processing apparatuses are connected in a connection order which violates the restrictions, the controller 205 causes the UI unit to display a warning. For example, when the user inputs the connection order of sheet processing apparatuses via the UI unit, as represented by the above-mentioned configuration, the controller 205 controls to invalidate a user setting which violates the restrictions. For example, the controller 205 grays out or hatches the display to inhibit any improper connection setting.

By employing this configuration, any user operation error, apparatus malfunction, and the like can be prevented in the configuration of the embodiment. This configuration further enhances effects described in the embodiment.

On the premise of this configuration, according to the embodiment, the printing system 1000 can be flexibly configured under the restrictions.

For example, the operator of the POD printing system 10000 can arbitrarily determine and change the connection order of inline type sheet processing apparatuses and the number of connected inline type sheet processing apparatuses under the restrictions. The printing system 1000 executes control complying with the system configuration status. An example of this control will be described.

Figure 9A:
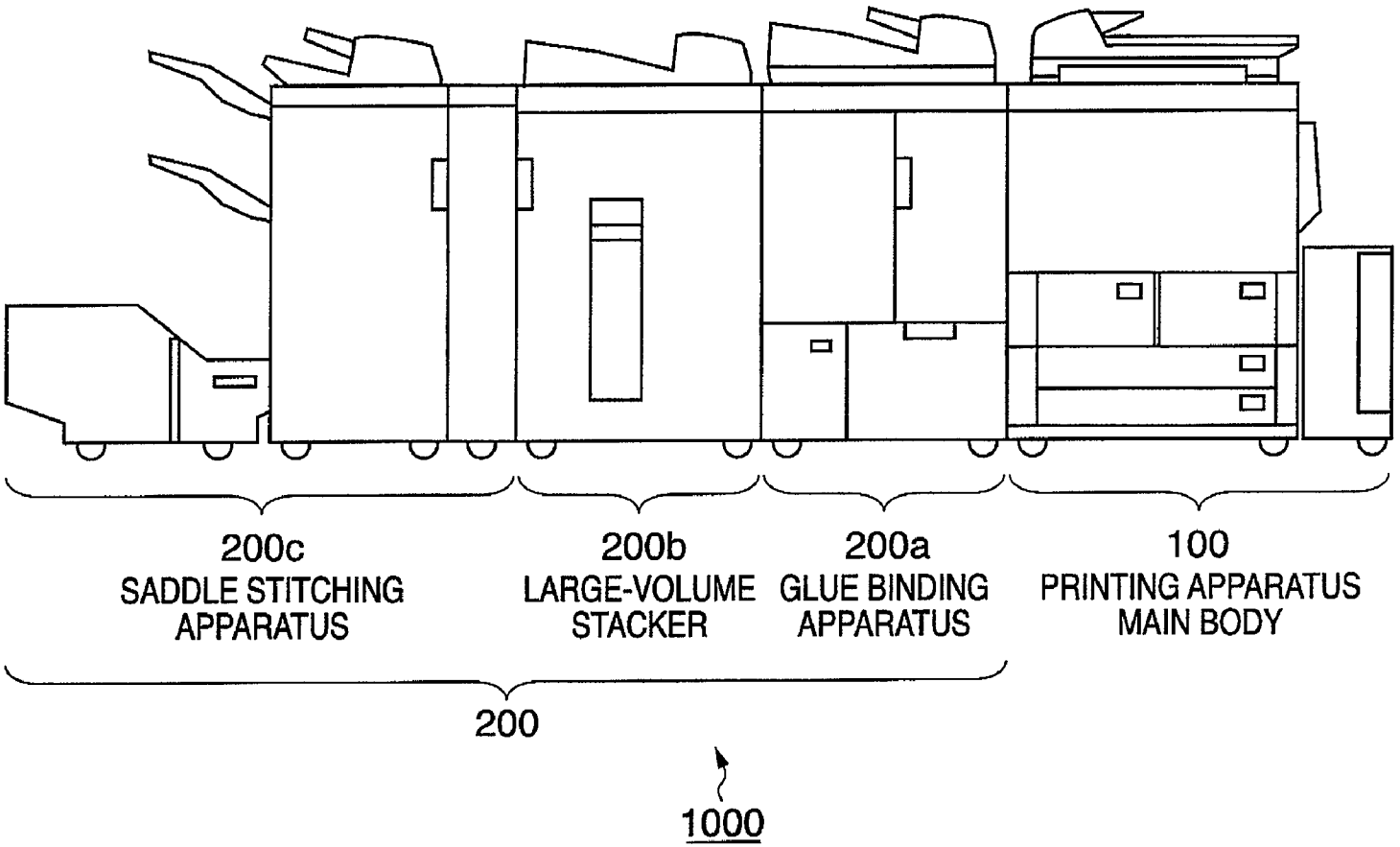
FIG. 9A is a view for explaining a control example of the printing system 1000 to be controlled in the first embodiment of the present invention.

The printing system 1000 can also take a system configuration as shown in FIG. 9A, as a system configuration in which the connection order of inline type sheet processing apparatuses changes from that in the system configuration of FIG. 8A.

The system configuration of FIG. 9A is different from that of FIG. 8A in the connection order of inline sheet processing apparatuses of the printing system 1000. More specifically, the printing system 1000 is built by connecting the printing apparatus 100→the glue binding apparatus→the large-volume stacker→the saddle stitching apparatus in the order named. The internal system configuration in this case is as shown in FIG. 9B.

Figure 9B:
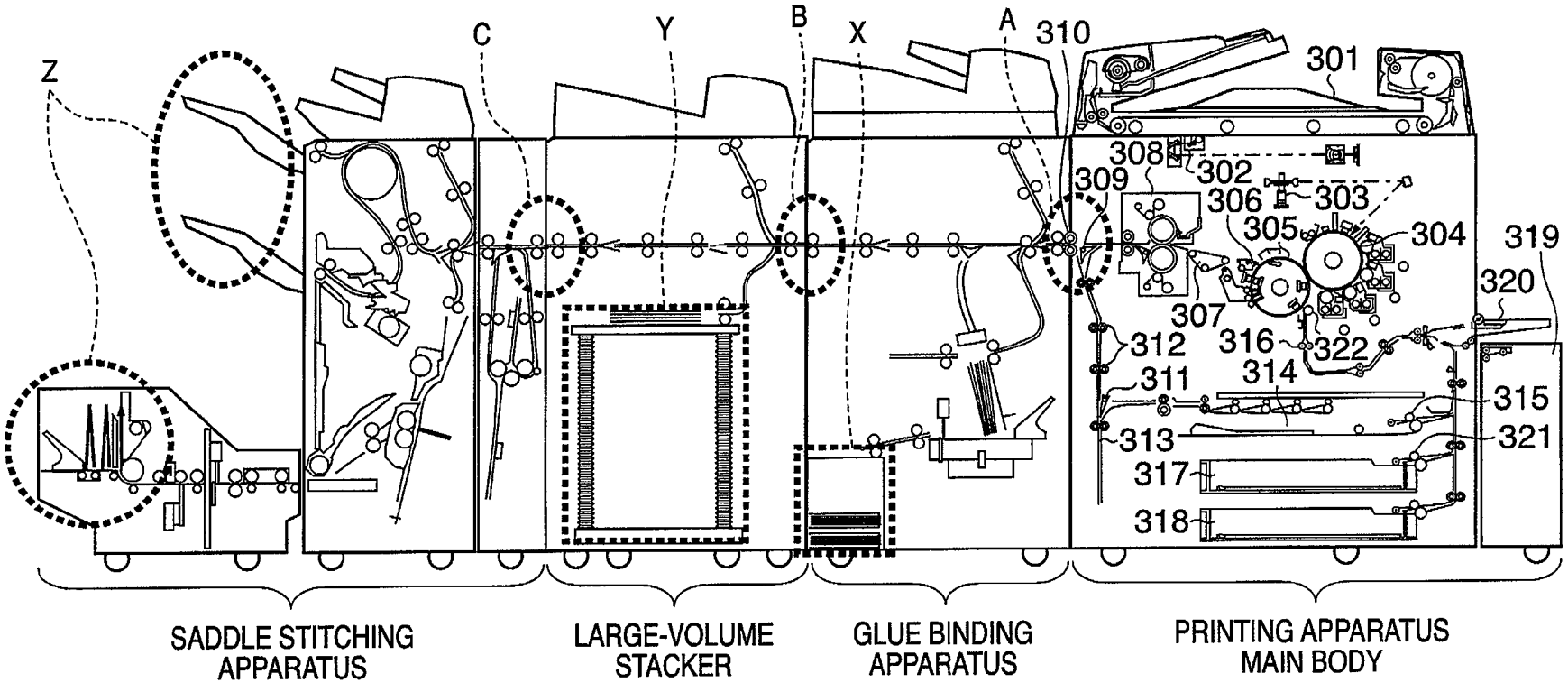
FIG. 9B is a view for explaining the control example of the printing system 1000 to be controlled in the first embodiment of the present invention.

FIG. 9B is a sectional view of the apparatuses of the whole printing system 1000 when the printing system 1000 has the system configuration in FIG. 9A. The system configuration in FIG. 9B corresponds to the internal system configuration in FIG. 9A.

Similar to the above-described system configuration example, the internal system configuration in FIG. 9B also allows supplying a sheet printed by the printer unit 203 of the printing apparatus 100 into the respective sheet processing apparatuses. More specifically, as shown in FIG. 9B, the respective sheet processing apparatuses comprise sheet feeding paths capable of feeding a sheet from the printer unit 203 via points A, B, and C in the apparatuses.

The system configuration in FIGS. 9A and 9B also follows the above-mentioned restrictions. For example, the sheet processing apparatuses are cascade-connected to the printing apparatus 100 so as to install the saddle stitching apparatus at the most downstream position in the sheet conveyance direction.

For example, when the printing system 1000 has the configuration shown in FIGS. 9A and 9B on the premise of the above configuration, the controller 205 executes the following exemplary control for a job for which the user issues a printing execution request via the UI unit according to the above-described method.

Assume that a target job whose printing execution request is accepted from the user requires sheet processing (e.g., stacking) by the large-volume stacker after print processing in the system configuration of FIGS. 9A and 9B. This job is called a "stacker job".

When processing the stacker job in the system configuration of FIGS. 9A and 9B, the controller 205 makes job sheets printed by the printing apparatus 100 pass through points A and B in FIG. 9B, and causes the large-volume stacker to execute sheet processing. The controller 205 causes the large-volume stacker to hold, at the delivery destination Y inside the large-volume stacker shown in FIG. 9B, the printing result of the stacker job having undergone the sheet processing (e.g., stacking) by the large-volume stacker, without conveying the printing result to another apparatus (e.g., a succeeding apparatus).

The operator can directly take out, from the delivery destination Y, the printed material of the stacker job held at the delivery destination Y in FIG. 9B. In other words, this configuration can omit a series of apparatus operations and operator operations to convey sheets to the most downstream delivery destination Z in the sheet conveyance direction in FIG. 9B and take out the printed material of the stacker job from the delivery destination Z.

A series of control operations executed by the controller 205 when the printing system 1000 has the system configuration in FIGS. 9A and 9B corresponds to a control example (case 1) in FIG. 9B.

Assume that a target job whose printing execution request is accepted from the user requires sheet processing (e.g., case binding or pad binding) by the glue binding apparatus after print processing in the system configuration of FIGS. 9A and 9B. This job is called a "glue binding job".

When processing the glue binding job in the system configuration of FIGS. 9A and 9B, the controller 205 makes job sheets printed by the printing apparatus 100 pass through point A in FIG. 9B, and causes the glue binding apparatus to execute sheet processing. The controller 205 causes the glue binding apparatus to hold, at the delivery destination X inside the glue binding apparatus shown in FIG. 9B, the printing result of the glue binding job having undergone the sheet processing (e.g., case binding or pad binding) by the glue binding apparatus, without conveying the printing result to another apparatus (e.g., a succeeding apparatus).

The operator can directly take out, from the delivery destination X, the printed material of the glue binding job held at the delivery destination X in FIG. 9B. In other words, this configuration can omit a series of apparatus operations and operator operations to convey sheets to the most downstream delivery destination Z in the sheet conveyance direction in FIG. 9B and take out the printed material of the glue binding job from the delivery destination Z.

A series of control operations executed by the controller 205 when the printing system 1000 has the system configuration in FIGS. 9A and 9B corresponds to a control example (case 2) in FIG. 9B.

When a target job whose printing execution request is accepted from the user requires sheet processing by the saddle stitching apparatus after print processing in the system configuration of FIGS. 9A and 9B, this job is called a "saddle stitching job". The sheet processing is, for example, saddle stitching, punching, cutting, shift delivery, or folding.

When processing the saddle stitching job in the system configuration of FIGS. 9A and 9B, the controller 205 makes job sheets printed by the printing apparatus 100 pass through points A, B, and C in FIG. 9B, and causes the saddle stitching apparatus to execute sheet processing. The controller 205 causes the saddle stitching apparatus to hold, at the delivery destination Z of the saddle stitching apparatus shown in FIG. 9B, the printing result of the saddle stitching job having undergone the sheet processing by the saddle stitching apparatus, without conveying the printing result to another apparatus.

The delivery destination Z in FIG. 9B has a plurality of delivery destination candidates. This is because the saddle stitching apparatus of the embodiment can execute a plurality of types of sheet processes and the delivery destination changes for each sheet process, which will be described with reference to FIG. 13.

A series of control operations executed by the controller 205 when the printing system 1000 has the system configuration in FIGS. 9A and 9B corresponds to a control example (case 3) in FIG. 9B.

As illustrated in FIGS. 8A, 8B, 9A, and 9B, the printing system 1000 is configured to be able to flexibly change the connection order of sheet processing apparatuses permitted to be used as inline sheet processing apparatuses under the restrictions. The present invention provides many mechanisms for maximizing the above-described effects of the embodiment.

From this viewpoint, in the embodiment, the printing system 1000 can properly employ a configuration other than the system configurations as shown in FIGS. 8A, 8B, 9A, and 9B. An example of this configuration will be explained below.

For example, the system configurations in FIGS. 8A, 8B, 9A, and 9B each comprise three inline type sheet processing apparatuses. In the embodiment, the user can arbitrarily determine the number of inline type sheet processing apparatuses under the restrictions.

Figure 10A:
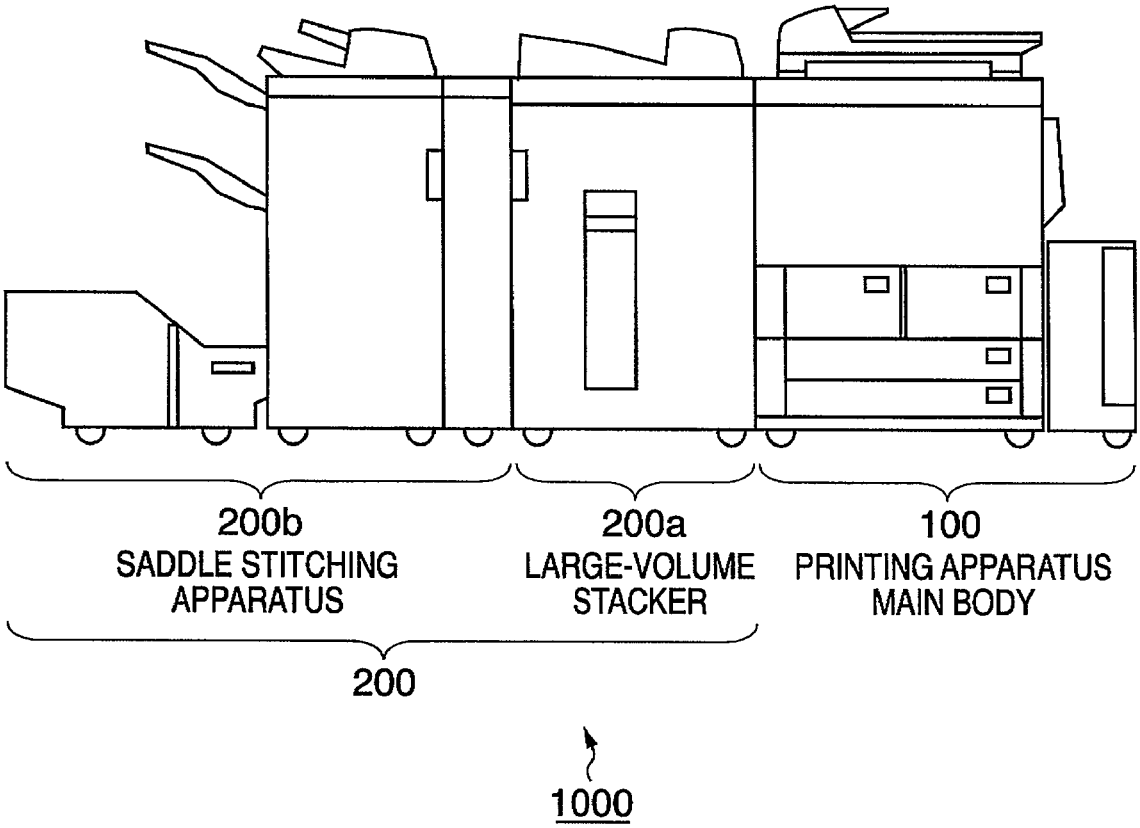
FIG. 10A is a view for explaining a control example of the printing system 1000 to be controlled in the first embodiment of the present invention.

For example, the printing system 1000 can also adopt a system configuration as shown in FIG. 10A.

The system configuration of FIG. 10A is different from those of FIGS. 8A and 9A in the number of connected sheet processing apparatuses. More specifically, the printing system 1000 is built by connecting two sheet processing apparatuses in the order of the printing apparatus 100→the large-volume stacker→the saddle stitching apparatus. The internal system configuration in this case is as shown in FIG. 10B.

Figure 10B:
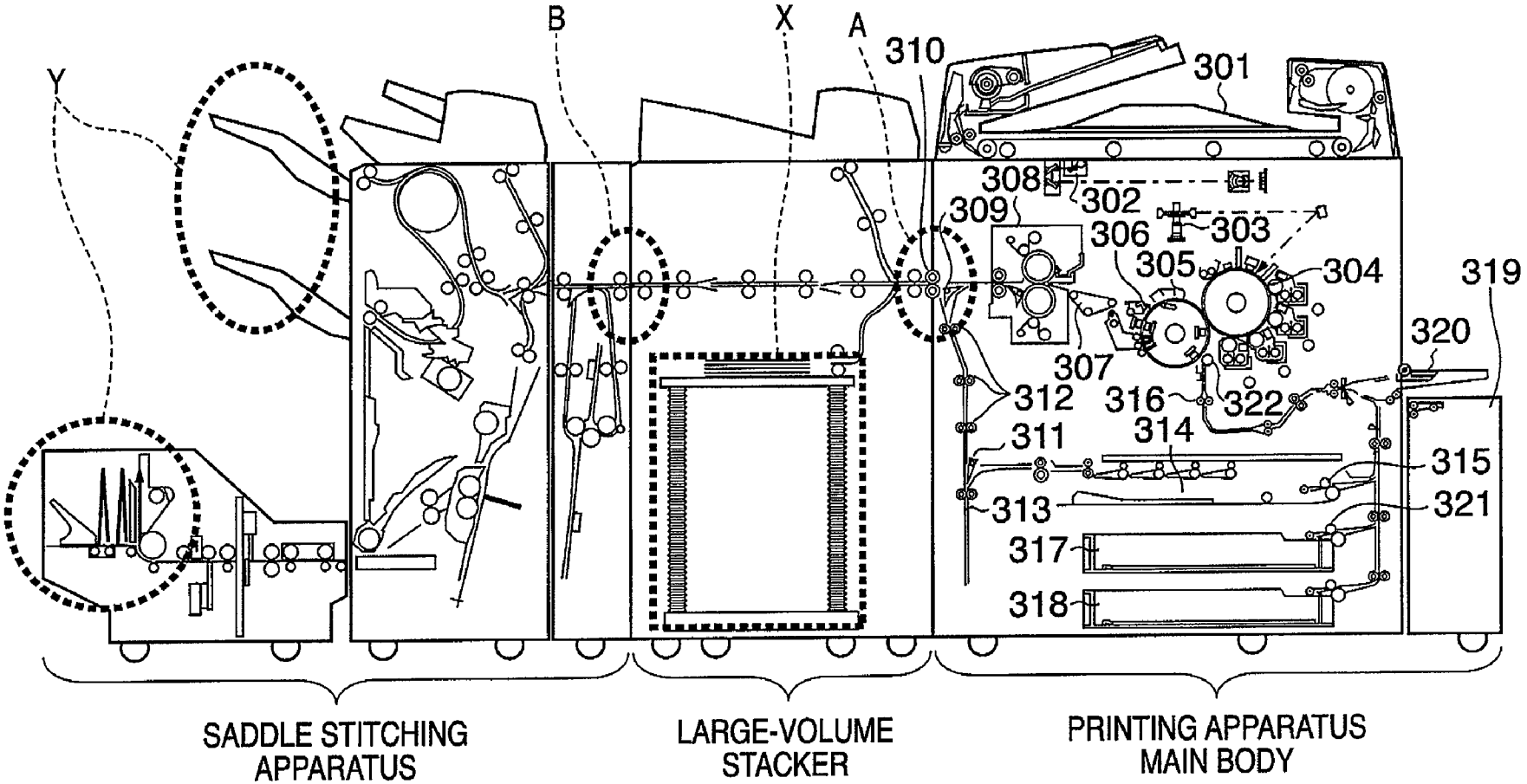
FIG. 10B is a view for explaining the control example of the printing system 1000 to be controlled in the first embodiment of the present invention.

FIG. 10B is a sectional view of the system configuration of the overall printing system 1000 when the printing system 1000 has the system configuration in FIG. 10A. The apparatus configuration of FIG. 10B corresponds to that of FIG. 10A.

Similar to the above-described system configuration examples, the internal apparatus configuration in FIG. 10B also allows supplying a sheet printed by the printer unit 203 of the printing apparatus 100 into the respective sheet processing apparatuses. More specifically, as shown in FIG. 10B, the respective sheet processing apparatuses comprise sheet feeding paths capable of feeding a sheet via points A and B in the apparatuses. This system configuration also follows the above-described restrictions. For example, the sheet processing apparatuses are so connected as to install the saddle stitching apparatus at the most downstream position in the sheet conveyance direction.

For example, when the printing system 1000 has the system configuration shown in FIGS. 10A and 10B, the controller 205 executes the following exemplary control for a job for which the user issues a printing execution request via the UI unit according to the above-described method.

Assume that a target job whose printing execution request is accepted from the user requires sheet processing (e.g., stacking) by the large-volume stacker after print processing in the system configuration of FIGS. 10A and 10B. This job is called a "stacker job".

When processing the stacker job in the system configuration of FIGS. 10A and 10B, the controller 205 makes job sheets printed by the printing apparatus 100 pass through point A in FIG. 10B, and causes the large-volume stacker to execute sheet processing. The controller 205 causes the large-volume stacker to hold, at the delivery destination X inside the large-volume stacker shown in FIG. 10B, the printing result of the stacker job having undergone the sheet processing (e.g., stacking) by the large-volume stacker, without conveying the printing result to another apparatus (e.g., a succeeding apparatus).

The operator can directly take out, from the delivery destination X, the printed material of the stacker job held at the delivery destination X in FIG. 10B. In other words, this configuration can omit a series of apparatus operations and operator operations to convey sheets to the most downstream delivery destination Y in the sheet conveyance direction in FIG. 10B and take out the printed material of the stacker job from the delivery destination Y.

A series of control operations executed by the controller 205 when the printing system 1000 has the system configuration in FIGS. 10A and 10B corresponds to a control example (case 1) in FIG. 10B.

When a target job whose printing execution request is accepted from the user requires sheet processing by the saddle stitching apparatus after print processing in the system configuration of FIGS. 10A and 10B, this job is called a "saddle stitching job". The sheet processing is, for example, saddle stitching, punching, cutting, shift delivery, or folding.

When processing the saddle stitching job in the system configuration of FIGS. 10A and 10B, the controller 205 makes job sheets printed by the printing apparatus 100 pass through points A and B in FIG. 10B, and causes the saddle stitching apparatus to execute sheet processing. The controller 205 causes the saddle stitching apparatus to hold, at the delivery destination Y of the saddle stitching apparatus shown in FIG. 10B, the printing result of the saddle stitching job having undergone the sheet processing by the saddle stitching apparatus, without conveying the printing result to another apparatus.

The delivery destination Y in FIG. 10B has a plurality of delivery destination candidates. This is because the saddle stitching apparatus of the embodiment can execute a plurality of types of sheet processes and the delivery destination changes for each sheet processes, which will be described with reference to FIG. 13.

A series of control operations executed by the controller 205 when the printing system 1000 has the system configuration in FIGS. 10A and 10B corresponds to a control example (case 2) in FIG. 10B.

In the system configuration of FIGS. 10A and 10B, the controller 205 inhibits acceptance of a request from the user to execute sheet processing (e.g., case binding or pad binding) by the glue binding apparatus.

For example, when the printing system has the system configuration as shown in FIGS. 10A and 10B and the UI unit executes the display in FIG. 7, the controller 205 controls to hatch or gray out the keys 707 and 708. In other words, the controller 205 invalidates user operations to the keys 707 and 708.

When the printing system 1000 has the system configuration as shown in FIGS. 10A and 10B, as described above, the controller 205 inhibits the printing system 1000 from executing glue binding.

Control executed by the controller 205 when the printing system 1000 has the system configuration in FIGS. 10A and 10B corresponds to (inhibition control) in FIG. 10B.

As described above, the controller 205 executes various control examples depending on the number of connected inline type sheet processing apparatuses in the printing system 1000. That is, the controller 205 executes various control examples corresponding to types of sheet processes executable by the printing system 1000.

As is apparent from the description of FIGS. 8A to 10B and the like, the control unit of the printing system 1000 causes the printing system 1000 to execute various control examples corresponding to the system configuration status (including the number of connected inline sheet processing apparatuses and their connection order) of the printing system 1000.

According to the embodiment, the connection order of inline sheet processing apparatuses and the number of connected inline sheet processing apparatuses in the printing system 1000 can flexibly change to meet user needs because all user merits are considered.

The reason why each inline type sheet processing apparatus permitted to be used in the printing system 1000 is an independent housing and is detachable from the printing apparatus will be described.

As one reason, this mechanism considers, as a POD company to which the printing system 1000 is delivered, a company or the like which does not require case binding but wants to perform large-volume stacking.

In the printing system use environment, a need to implement all the nine sheet processes by inline sheet processing apparatuses is expected. A need to implement only specific sheet processing by an inline sheet processing apparatus may also arise. The embodiment provides a mechanism coping with various needs from respective POD companies to which the printing system 1000 is delivered.

The reason why inline type sheet processing apparatuses permitted to be used in the printing system 1000 can be arbitrarily changed in connection order and combined under the restrictions will be explained. This reason is also a reason for setting a delivery destination at which the operator can take out a printed material from each inline sheet processing apparatus, as shown in FIGS. 8A, 8B, 9A, and 9B.

As one reason, user friendliness of the printing system 1000 improves by flexibly building the system in accordance with the use frequencies of sheet processes requested in the printing system 1000.

For example, a POD company having the POD printing system 10000 in FIG. 1 tends to receive a relatively large number of print jobs requiring case binding for a user manual, guidebook, and the like, as print form needs from customers. In this use environment, it is convenient to build the printing system 1000 not in the connection order as shown in FIGS. 8A and 8B but in the connection order as shown in FIGS. 9A and 9B.

In other words, it is more convenient to connect the glue binding apparatus at a portion closer to the printing apparatus 100. This is because a shorter sheet conveyance distance in the apparatus necessary to execute case binding for a case binding job is effective.

For example, as the sheet conveyance distance becomes longer, the time taken to complete a printed material as the final product of the job becomes longer. As the sheet conveyance distance becomes longer, the jam generation rate in the apparatus during sheet conveyance is likely to be higher. These are reasons for the flexible connection order.

For a POD company which receives many case binding jobs as user needs, not the system configuration of FIGS. 8A and 8B but that of FIGS. 9A and 9B can shorten the sheet conveyance distance necessary to create the printed material of a case binding job, and allows the operator to quickly take out the printed material.

Assume that another POD company tends to receive many jobs requiring large-volume sheet stacking. For this POD company, not the system configuration of FIGS. 9A and 9B but that of FIGS. 8A and 8B can shorten the sheet conveyance distance necessary to create the printed material of a stacker job, and allows the operator to quickly take out the printed material.

In this fashion, the embodiment pays attention to an increase in the productivity of jobs in the printing system 1000 with an efficient, flexible system configuration suited to the use environment. In addition, the embodiment can provide many mechanisms which pursue friendliness to a user who utilizes the printing system 1000.

Concrete examples of the internal structures of various inline type sheet processing apparatuses available in the printing system 1000 illustrated in FIGS. 8A to 10B will be described for each sheet processing apparatus.

[Internal Structure of Large-volume Stacker]

Figure 11:
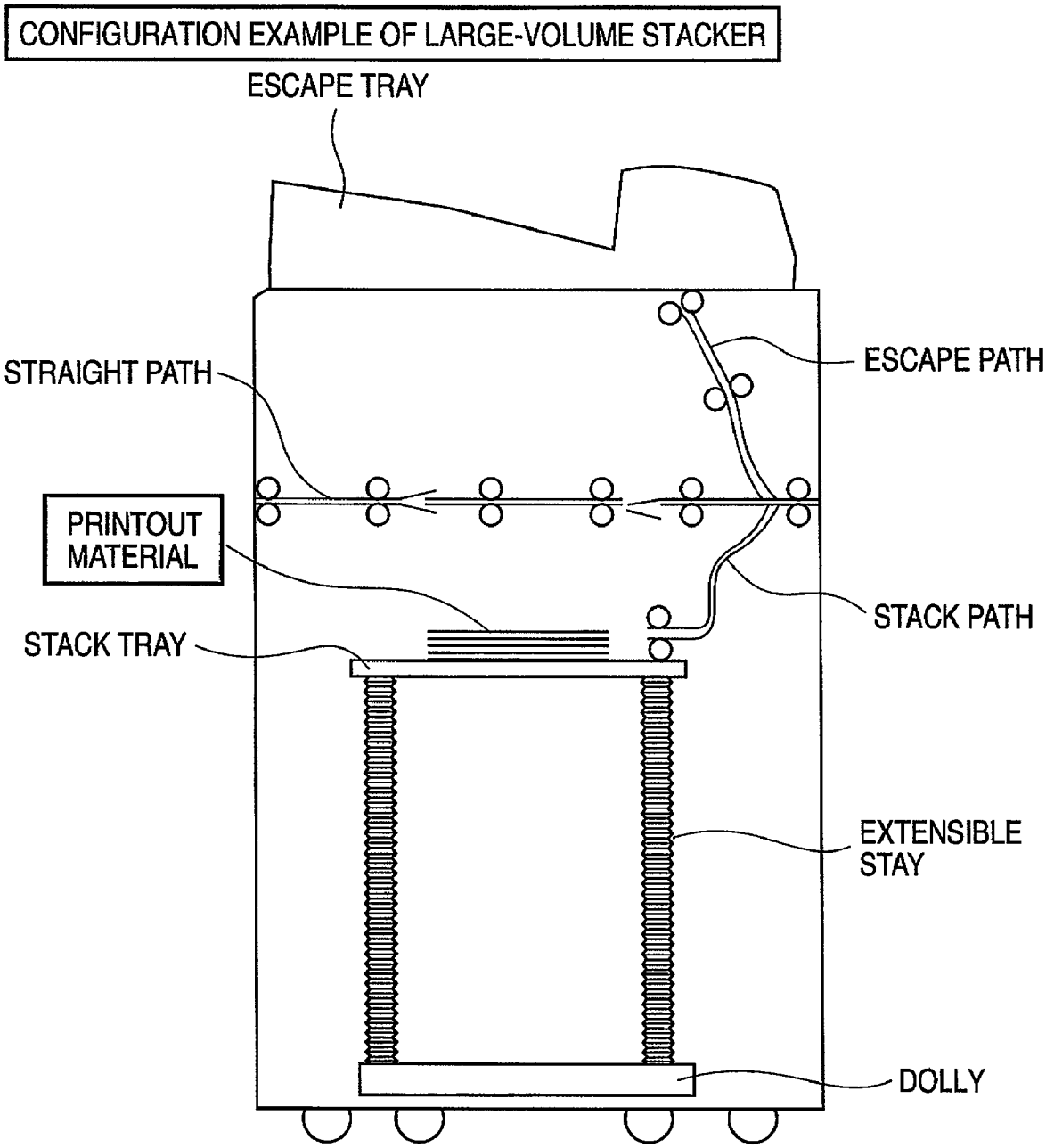
FIG. 11 is a sectional view for explaining an internal structure of an inline finisher to be controlled in the first embodiment of the present invention.

FIG. 11 is a sectional view showing an internal structure of the large-volume stacker in FIGS. 8A to 10B to be controlled by the controller 205 in the embodiment.

In the large-volume stacker, the sheet feeding paths extending from the printing apparatus 100 is roughly divided into three: a straight path, escape path, and stack path, as shown in FIG. 11. The large-volume stacker incorporates these three sheet feeding paths.

Figure 12:
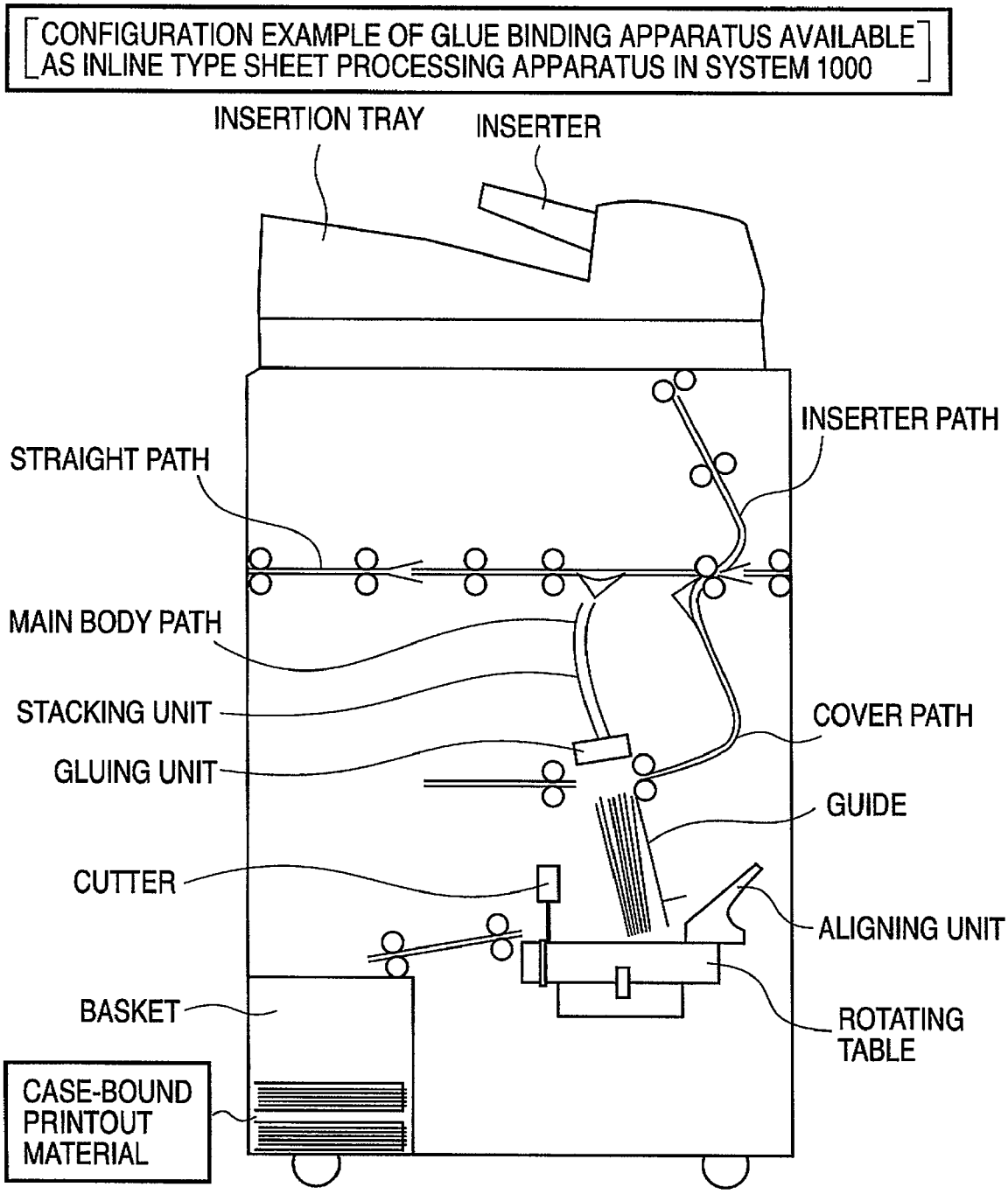
FIG. 12 is a sectional view for explaining an internal structure of an inline finisher to be controlled in the first embodiment of the present invention.

The straight path of the large-volume stacker in FIG. 11 and that of the glue binding apparatus in FIG. 12 function to transfer sheets received from a preceding apparatus to a succeeding apparatus, and are also called through paths in inline sheet processing apparatuses in this example.

The straight path in the large-volume stacker is a sheet feeding path for transferring, to a succeeding apparatus, sheets of a job requiring no sheet stacking by the stacking unit of the large-volume stacker. In other words, the straight path is a unit for conveying sheets of a job requiring no sheet processing by the sheet processing apparatus from an upstream apparatus to a downstream apparatus.

The escape path in the large-volume stacker is used to output sheets without stacking them. For example, when no succeeding sheet processing apparatus is connected, a printed material is conveyed to the escape path and taken out from the stack tray so as to quickly take out the printed material from the stack tray for the purpose of output confirmation work (proof print) or the like.

The sheet feeding path in the large-volume stacker has a plurality of sheet sensors necessary to detect the sheet conveyance status and jam.

The CPU (not shown) of the large-volume stacker notifies the controller 205 of sheet detection information from each sensor via a signal line (signal line in FIG. 2 for electrically connecting the sheet processing apparatus 200 and controller 205) for communicating data with the controller 205. Based on the information from the large-volume stacker, the controller 205 grasps the sheet conveyance status and jam in the large-volume stacker. When the printing system is configured by cascade-connecting another sheet processing apparatus between the large-volume stacker and the printing apparatus 100, the CPU of the large-volume stacker notifies the controller 205 via the CPU of the cascade-connected sheet processing apparatus of sensor information of the large-volume stacker. As described above, the large-volume stacker comprises an arrangement unique to an inline finisher.

The stack path in the large-volume stacker is a sheet feeding path for causing the large-volume stacker to stack sheets of a job requiring sheet stacking by the stacking unit of the stacker.

Assume that the printing system 1000 comprises the large-volume stacker shown in FIGS. 8A to 10B. In this system configuration status, assume that the controller 205 accepts a request from a user via the UI unit by a key operation to the key 709 in the display of FIG. 7 to execute sheet stacking executable by the stacker for a target job. In this case, the controller 205 controls to convey sheets to the stack path of the large-volume stacker. The sheets conveyed to the stack path are delivered to the stack tray.

The stack tray in FIG. 11 is a stacking unit mounted on an extensible stay. A shock absorber or the like is attached to the joint between the stay and the stack tray. The controller 205 controls the large-volume stacker to stack printed sheets of a target job on the stack tray. A dolly supports the extensible stay from below it. When attaching a handle (not shown) to the dolly, the dolly can carry stacked outputs on it to another offline finisher.

When the front door of the stacker unit is kept closed, the extensible stay moves up to a position where outputs are easily stacked. If the operator opens the front door (or issues an opening instruction), the stack tray moves down.

Outputs can be stacked by flat stacking or shift stacking. Flat stacking means always stacking sheets at the same position. Shift stacking means stacking sheets with a shift toward far and near sides every number of copies or jobs so as to divide outputs and easily handle them.

The large-volume stacker permitted to be used as an inline type sheet processing apparatus in the printing system 1000 can execute a plurality of stacking methods when stacking sheets from the printer unit 203. The controller 205 controls various operations for the stacker.

[Internal Structure of Glue Binding Apparatus]

FIG. 12 is a sectional view showing an internal structure of the glue binding apparatus in FIGS. 8A to 10B to be controlled by the controller 205 in the embodiment.

In the glue binding apparatus, the sheet feeding paths extending from the printing apparatus 100 is roughly divided into three: a straight path, main body path, and cover path, as shown in FIG. 12. The glue binding apparatus incorporates these three sheet feeding paths.

The straight path (through path) in the glue binding apparatus in FIG. 12 is a sheet feeding path functioning to transfer, to a succeeding apparatus, sheets of a job requiring no sheet glue binding by the glue binding unit of the apparatus. In other words, the straight path is a unit for conveying sheets of a job requiring no sheet processing by the sheet processing apparatus from an upstream apparatus to a downstream apparatus.

The sheet feeding path in the glue binding apparatus has a plurality of sheet sensors necessary to detect the sheet conveyance status and jam.

The CPU (not shown) of the glue binding apparatus notifies the controller 205 of sheet detection information from each sensor via a signal line (signal line in FIG. 2 for electrically connecting the sheet processing apparatus 200 and controller 205) for communicating data with the controller 205. Based on the information from the glue binding apparatus, the controller 205 grasps the sheet conveyance status and jam in the glue binding apparatus. When the printing system is configured by cascade-connecting another sheet processing apparatus between the glue binding apparatus and the printing apparatus 100, the CPU of the glue binding apparatus notifies the controller 205 via the CPU of the cascade-connected sheet processing apparatus of sensor information of the glue binding apparatus. In this manner, the glue binding apparatus comprises an arrangement unique to an inline finisher.

The main body path and cover path in the glue binding apparatus in FIG. 12 are sheet feeding paths for creating a case-bound printed material.

For example, according to the embodiment, the printer unit 203 prints print data of a body by case binding printing. Printed sheets are used as the body of an output material corresponding to a case-bounded printed material of one bundle. In case binding, a sheet bundle of a body on which print data corresponding to the body (contents) is printed is called a "main body" in the embodiment. Processing to wrap the main body with one cover sheet is executed in case binding. The controller 205 executes various sheet conveyance control operations to convey a cover sheet through the cover path, and convey sheets of the main body printed by the printer unit 203 to the main body path.

In this configuration, assume that the controller 205 accepts a request from a user via the UI unit by a key operation to the key 707 in the display of FIG. 7 to execute case binding executable by the glue binding apparatus for a target job. In this case, the controller 205 controls the apparatus as follows.

For example, the controller 205 controls to sequentially stack sheets printed by the printer unit 203 on the stacking unit via the main body path in FIG. 12. After stacking, on the stacking unit, sheets of all pages on which body data necessary for sheets of one bundle in a target job are printed, the controller 205 controls to convey a cover sheet necessary for the job via the cover path.

Case binding has a matter associated with one feature of the embodiment. In case binding as an example of glue binding in the embodiment, the number of sheets processible as one sheet bundle is much larger than the number of sheets processible as one sheet bundle by sheet processing different from glue binding. For example, case binding permits processing a maximum of 200 sheets as one sheet bundle of the body. To the contrary, stapling or the like permits processing a maximum of 20 print sheets as one sheet bundle, and saddle stitching permits processing a maximum of 15 print sheets. The permissible number of print sheets to be processed as one sheet bundle is greatly different between glue binding and other sheet processes.

In the embodiment, the controller 205 can control an inline type sheet processing apparatus to execute case binding as glue binding. Further, the embodiment can provide new finishing which is not requested in the office environment and is executable by an inline type sheet processing apparatus. In other words, this configuration is one mechanism assuming the POD environment, and is associated with control to be described later.

Case binding can target a pre-printed sheet which bears cover data and is conveyed from the inserter tray of the inserter of the glue binding apparatus, as shown in FIG. 12. Case binding can also target a sheet which bears a cover image printed by the printing apparatus 100. Either sheet is conveyed as a cover sheet to the cover path. Conveyance of the cover sheet temporarily stops below the stacking unit.

In parallel with this operation, the glue binding apparatus glues a main body of sheets which bear all the pages of the body and are stacked on the stacking unit. For example, the gluing unit applies a predetermined amount of glue to the lower portion of the main body. After the glue fully spreads, the pasted portion of the main body is attached to the center of the cover, covered, and joined. In joining, the main body is pushed down, and the covered main body slides onto a rotating table along a guide. The guide moves so that the covered main body falls onto the rotating table.

The aligning unit aligns the covered main body laid on the rotating table, and the cutter cuts an edge. The rotating table rotates through 90°, the aligning unit aligns the main body, and the cutter cuts the top edge. The rotating table rotates through 180°, the aligning unit aligns the main body, and the cutter cuts the tail edge.

After cutting, the aligning unit pushes the main body to an inner portion, putting the completed covered main body into a basket.

After the glue is satisfactorily dried in the basket, the operator can take out the completed case-bound bundle.

The glue binding apparatus comprises a gluing unit which executes glue binding for sheets of a target job for which the user issues a glue binding execution request together with a printing execution request via the UI unit.

As described above with reference to the configuration, glue binding executable by an inline type sheet processing apparatus in the embodiment requires many processing steps and many preparations, compared to other types of sheet processes. In other words, the configuration of glue binding is different from those of sheet processes such as stapling and saddle stitching often used in the office environment. The processing time taken to complete requested sheet processing is likely to be longer than those of other finishing processes. The embodiment pays attention even to this point.

As is apparent from only the glue binding function, the embodiment adopts a mechanism which applies not only to the office environment but also to a new printing environment such as the POD environment, pursues user friendliness and productivity, and aims to commercialize a printing system and product. For example, new functions such as the case binding function and large-volume stacking function which are not supported in the office environment are provided as constituent features available even in the POD environment. As illustrated in FIGS. 8A to 10B, system configurations capable of connecting a plurality of inline type sheet processing apparatuses are also mechanisms for achieving this purpose.

It should be noted that the embodiment not only provides the above-described new functions and system configurations, but also finds out and examines problems to be tackled, such as cased of use and user needs assumed in the use of the functions and configurations. One feature is to provide constituent features which are solutions to the problems. According to the embodiment, when an office-equipment maker finds and enters a new market, market demands and the like are found out and examined in advance as problems to newly equipped functions and system configurations, and mechanisms are employed as configurations considering solutions to the problems. This is also one feature of the embodiment. As an example of the constituent features, the controller 205 executes various control examples in the embodiment.

[Internal Structure of Saddle Stitching Apparatus]

Figure 13:
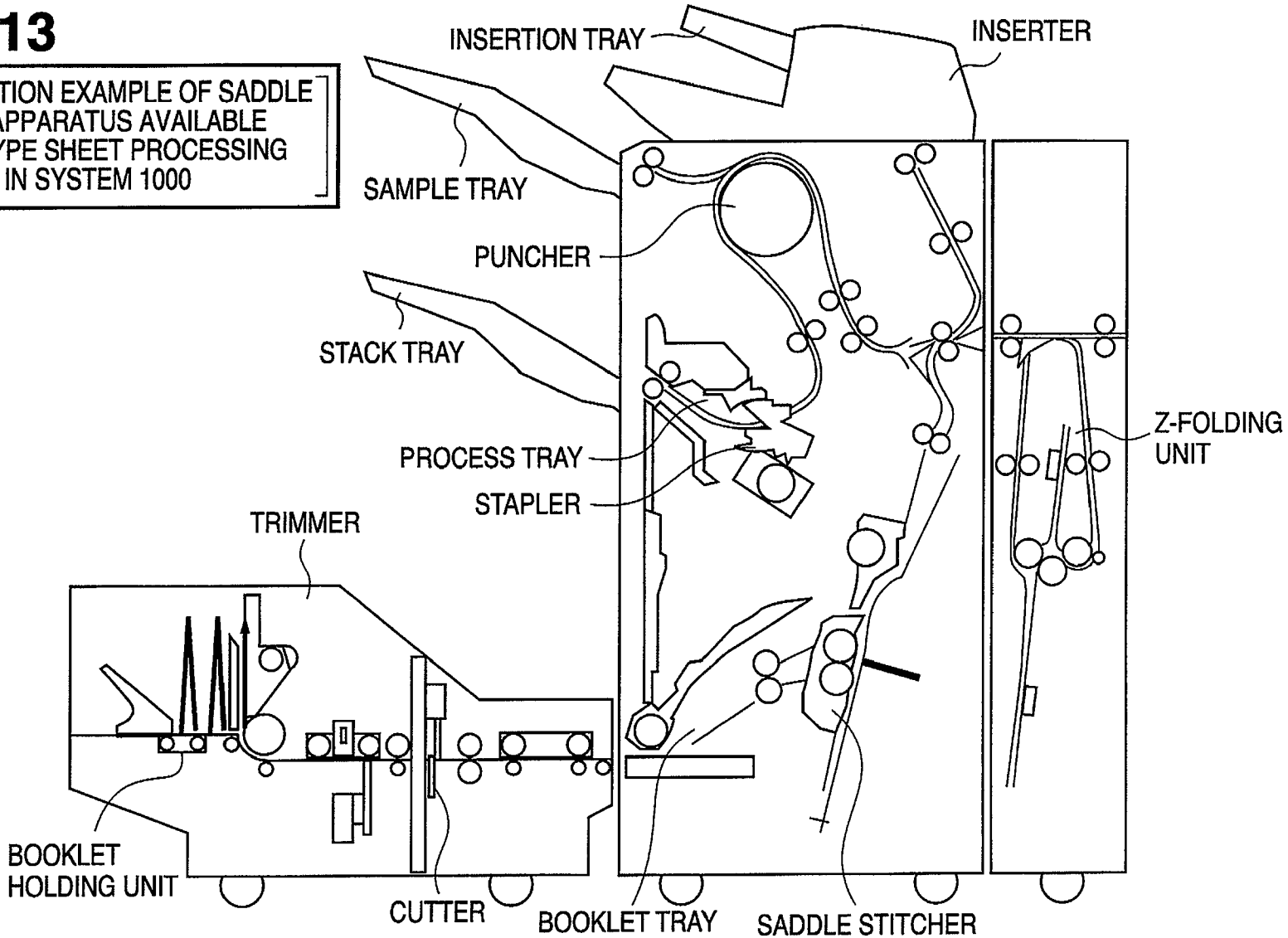
FIG. 13 is a sectional view for explaining an internal structure of an inline finisher to be controlled in the first embodiment of the present invention.

FIG. 13 is a sectional view showing an internal structure of the saddle stitching apparatus in FIGS. 8A to 10B to be controlled by the controller 205 in the embodiment.

The saddle stitching apparatus incorporates various units for selectively executing stapling, cutting, punching, folding, shift delivery, and the like for sheets from the printing apparatus 100. As described in the restrictions, the saddle stitching apparatus does not have a through path serving as the function of conveying sheets to a succeeding apparatus.

The sheet feeding path in the saddle stitching apparatus has a plurality of sheet sensors necessary to detect the sheet conveyance status and jam.

The CPU (not shown) of the saddle stitching apparatus notifies the controller 205 of sheet detection information from each sensor via a signal line (signal line in FIG. 2 for electrically connecting the sheet processing apparatus 200 and controller 205) for communicating data with the controller 205. Based on the information from the saddle stitching apparatus, the controller 205 grasps the sheet conveyance status and jam in the saddle stitching apparatus. When the printing system is configured by cascade-connecting another sheet processing apparatus between the saddle stitching apparatus and the printing apparatus 100, the CPU of the saddle stitching apparatus notifies the controller 205 via the CPU of the cascade-connected sheet processing apparatus of sensor information of the saddle stitching apparatus. The saddle stitching apparatus comprises an arrangement unique to an inline finisher.

As shown in FIG. 13, the saddle stitching apparatus comprises a sample tray, stack tray, and booklet tray. The controller 205 controls to switch the unit for use in accordance with the job type and the number of discharged print sheets.

Assume that the controller 205 accepts a request from a user via the UI unit by a key operation to the key 701 in the display of FIG. 7 to execute stapling by the saddle stitching apparatus for a target job. In this case, the controller 205 controls to convey sheets from the printer unit 203 to the stack tray. Before discharging print sheets to the stack tray, they are sequentially stacked for each job on the process tray in the saddle stitcher, and bound by a stapler on the process tray. Then, the print sheet bundle is discharged onto the stack tray. According to this method, the controller 205 causes the saddle stitching apparatus to staple sheets printed by the printer unit 203.

The saddle stitching apparatus further comprises a Z-folding unit for folding a sheet in three (Z shape), and a puncher for forming two (or three) holes for filing. The saddle stitching apparatus executes each processing in accordance with each job type. For example, when the user makes a Z-folding setting via the operation unit as a setting associated with print sheet processing for a job to be output, the controller 205 causes the Z-folding unit to fold print sheets of the job. Then, the controller 205 controls to make the print sheets pass through the apparatus, and deliver them onto a discharge tray such as the stack tray or sample tray. For example, when the user makes a punching setting via the operation unit as a setting associated with print sheet processing for a job to be output, the controller 205 causes the puncher to punch print sheets of the job. Then, the controller 205 controls to make the print sheets pass through the apparatus, and deliver them onto a discharge tray such as the stack tray or sample tray.

The saddle stitcher performs saddle stitching to bind print sheets at two center portions, pinch the print sheets at their center by rollers, fold them in half, and create a booklet like a pamphlet.

Print sheets bound by the saddle stitcher are discharged onto the booklet tray. Whether the saddle stitcher can execute print sheet processing such as bookbinding is also based on print sheet processing requirements set by the user for a job to be output, as described above.

The inserter sends print sheets set on the inserter tray to a discharge tray such as the stack tray or sample tray without supplying the print sheets to the printer. The inserter can insert a print sheet set on it between print sheets (sheets printed by the printer unit) supplied into the saddle stitcher. The user sets print sheets on the inserter tray of the inserter while the print sheets face up. The pickup roller sequentially feeds print sheets from the top. A print sheet from the inserter is directly conveyed to the stack tray or sample tray, and discharged while facing down. When supplying a print sheet to the saddle stitcher, the print sheet is fed to the puncher once, and then switched back and fed to adjust the face orientation.

Whether the inserter can execute print sheet processing such as print sheet insertion is also based on print sheet processing settings made by the user for a job to be output, as described above.

In the embodiment, the saddle stitching apparatus also incorporates, for example, a cutter (trimmer), which will be described below.

A (saddle-stitched) booklet output from the saddle stitcher enters the trimmer. At this time, the booklet output is fed by a predetermined length by the roller, and cut by a predetermined length by the cutter, aligning uneven edges between pages of the booklet. The resultant booklet is put in a booklet holding unit. Whether the trimmer can execute print sheet processing such as cutting is also based on print sheet processing settings made by the user for a job to be output, as described above.

As described above, the saddle stitching apparatus comprises a saddle stitcher which executes saddle stitching for sheets of a target job for which the user issues a saddle stitching execution request together with a printing execution request via the UI unit.

Figure 14:
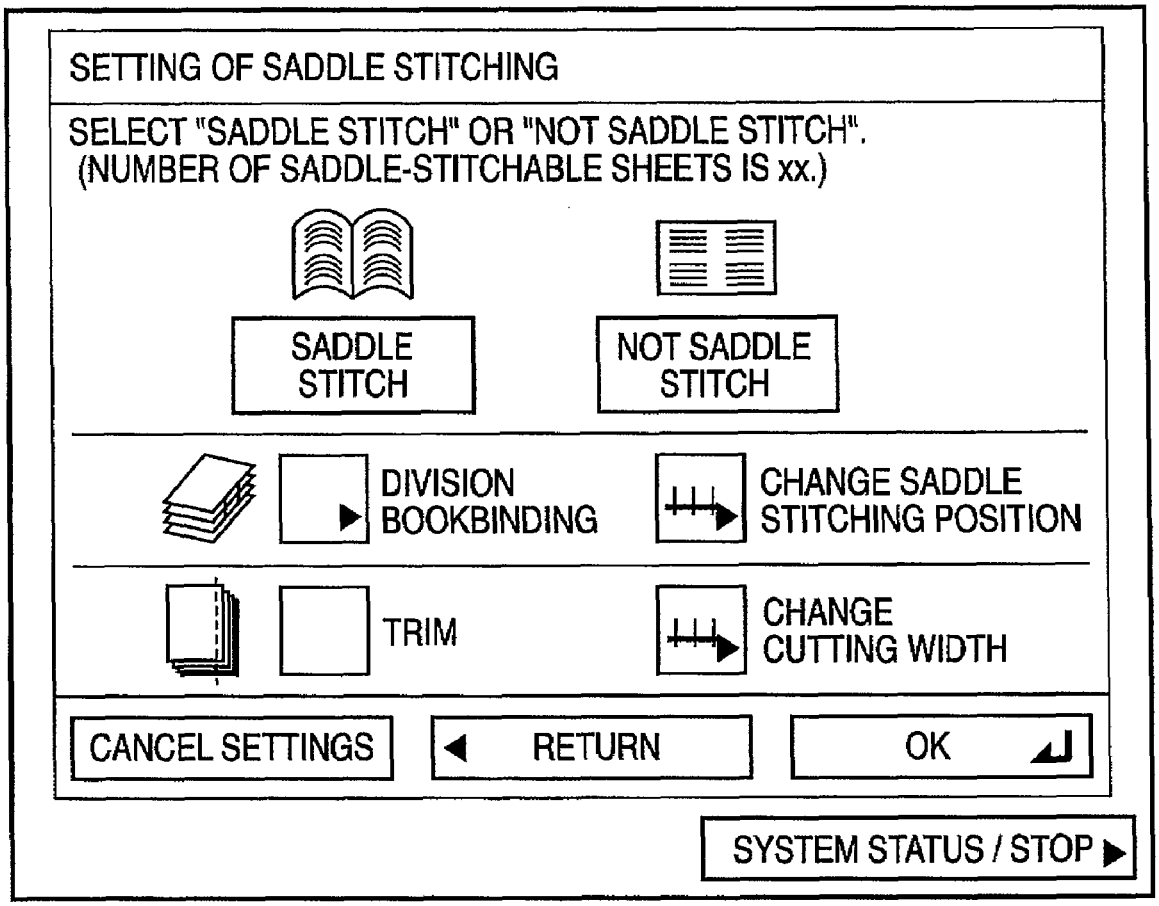
FIG. 14 is a view showing an example of a display window on the UI unit to be controlled in the first embodiment of the present invention.

For example, when the user selects saddle stitching with the key 705 in the display of FIG. 7, the controller 205 causes the UI unit to execute a display in FIG. 14. The controller 205 controls to accept detailed settings of saddle stitching from the user via the display in FIG. 14. For example, the controller 205 allows the user to determine whether to actually saddle-stitch sheets near their center with staples. The controller 205 can also accept a setting such as division bookbinding, change of the saddle stitching position, execution/non-execution of cutting, or change of the cutting width from the user.

Figure 15:
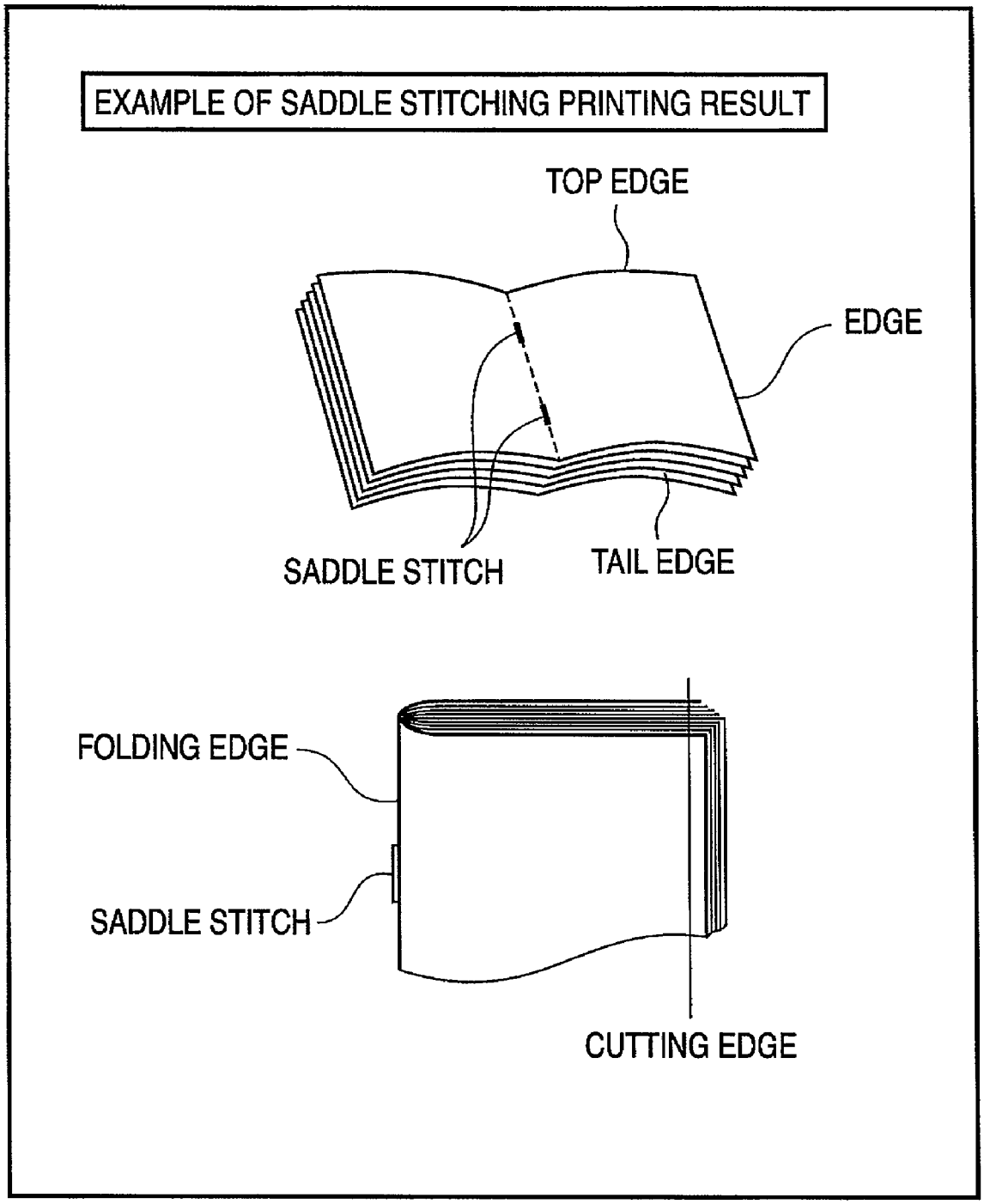
FIG. 15 is a view for explaining a control example when creating a printed material by the printing system 1000 to be controlled in the first embodiment of the present invention.

Assume that the user sets "saddle-stitch" and "cut" via the display in FIG. 14 executed by the UI unit under the control of the controller 205. In this case, the controller 205 controls the operation of the printing system 1000 to process a target job into a print style as shown in FIG. 15 as a result of saddle stitching printing. Then, saddle stitches are put, and the edge is cut, as represented by the result of saddle stitching printing in FIG. 15. By setting the positions of the saddle stitches and cutting edge in advance, they can be changed to desired positions.

Figure 16:
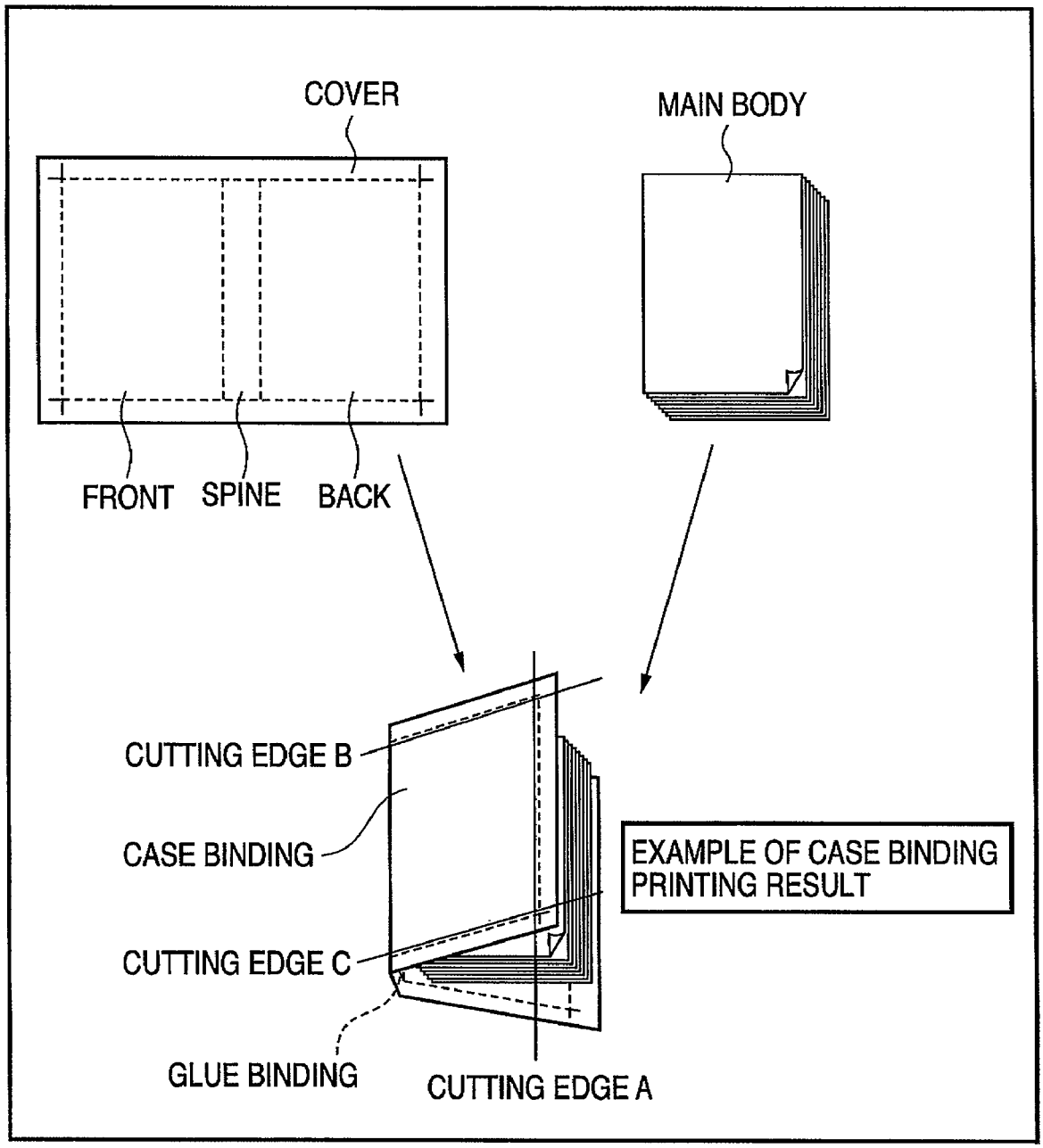
FIG. 16 is a view for explaining a control example when creating a printed material by the printing system 1000 to be controlled in the first embodiment of the present invention.

When the user requests execution of case binding with the key 707 in the display of FIG. 7, the controller 205 controls the printing system 1000 to process a target job into a print style as shown in FIG. 16 as a result of case binding printing. The cutting widths of cutting edges A, B, and C of a printed material to be case-bound can be set as shown in the example of FIG. 16.

The printing system 1000 can accept a printing execution request and sheet processing execution request for a target job even from an information processing apparatus serving as an example of an external apparatus. An example when a host computer uses the printing system 1000 will be described.

For example, the printing system 1000 is controlled as follows when operated by a host computer (e.g., the PC 103 or 104 in FIG. 1) which downloads program data for various processes and control examples in the embodiment from a data supply source (e.g., a WEB) or a specific storage medium. Note that the control unit of the PC executes the main control.

Figure 17A:
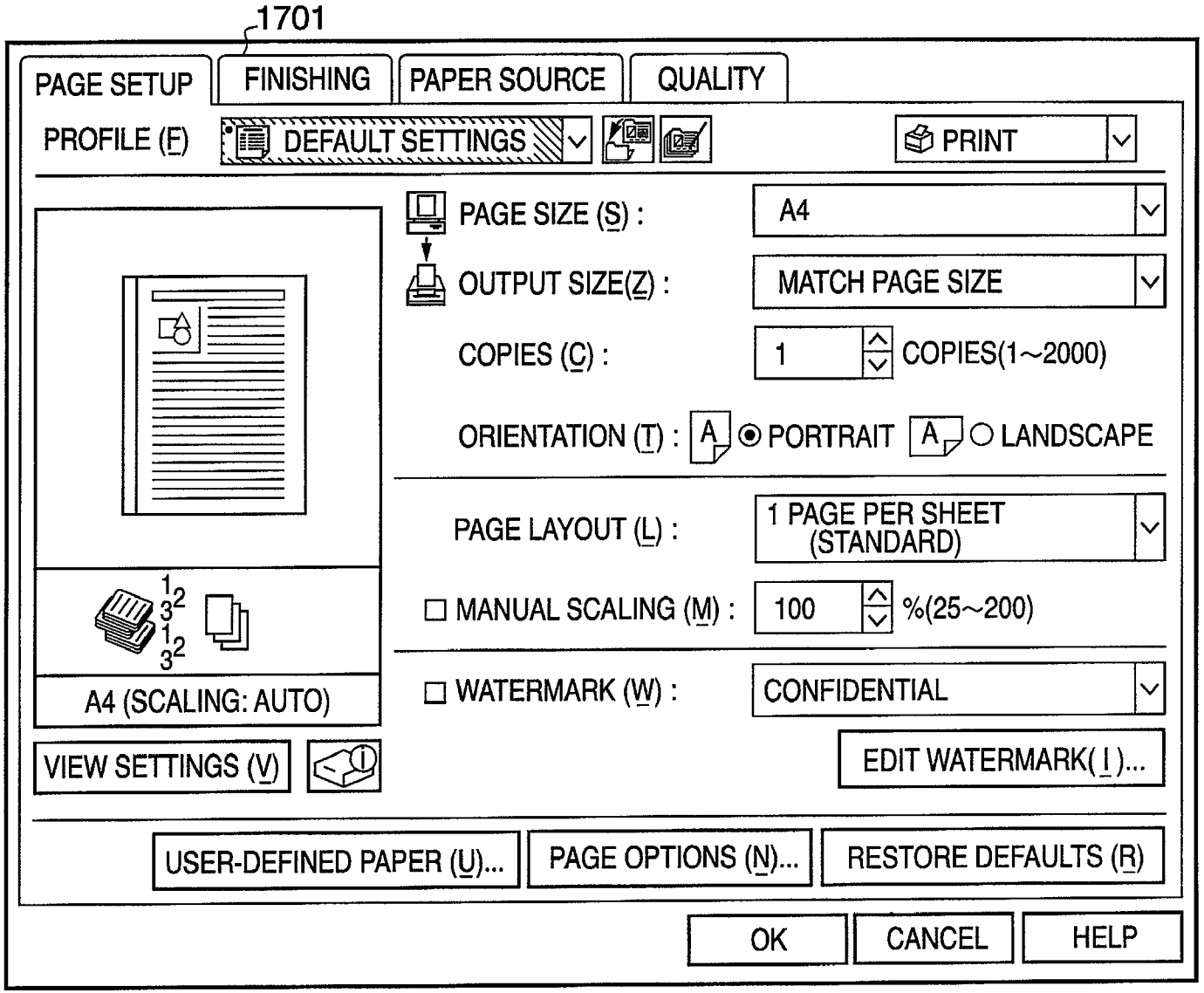
FIG. 17A is a view showing an example of a display window on the UI unit to be controlled in the first embodiment of the present invention.
Figure 17B:
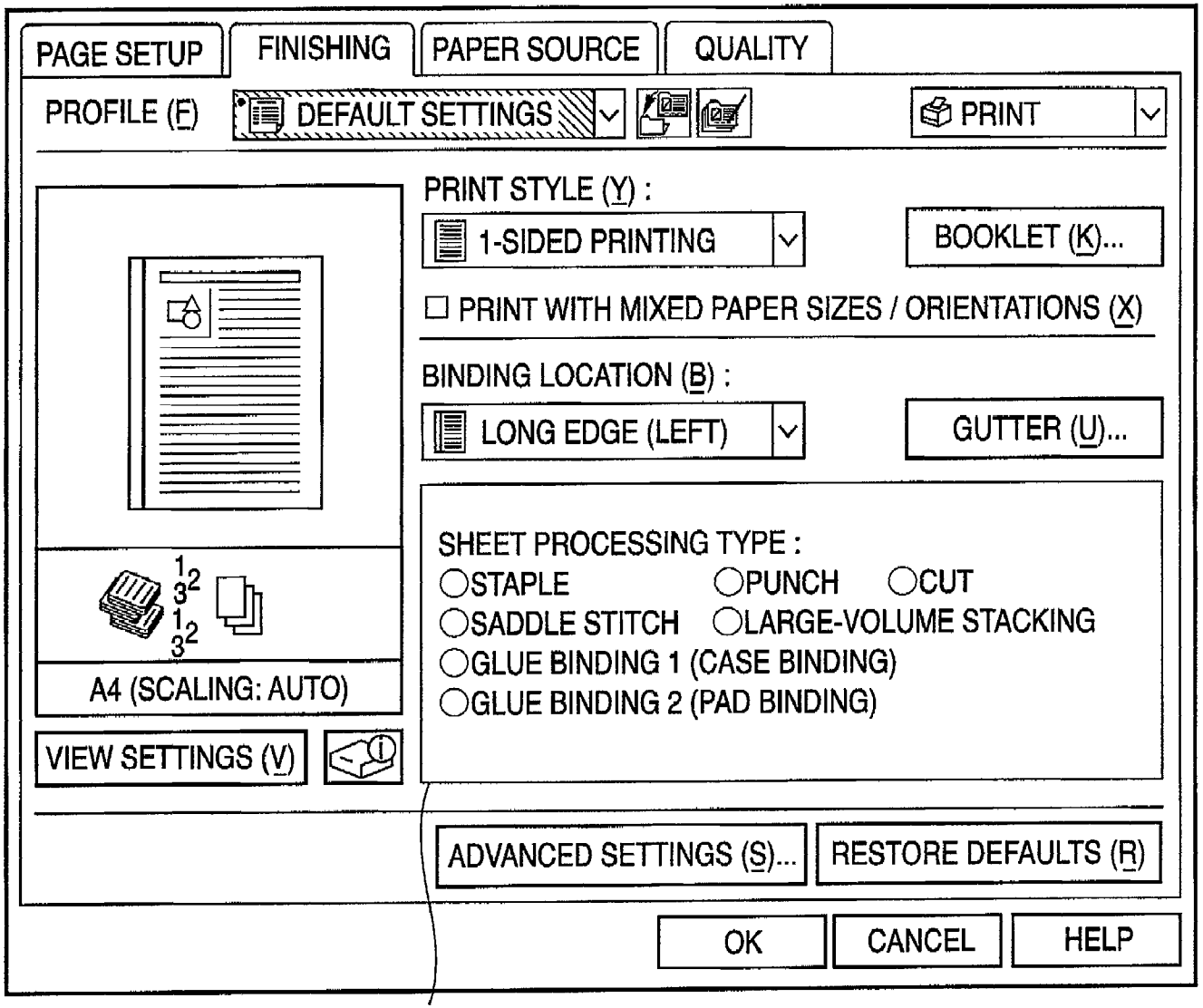
FIG. 17B is a view showing an example of a display window on the UI unit to be controlled in the first embodiment of the present invention.

Assume that an instruction to activate a printer driver for operating the printing apparatus 100 of the printing system 1000 is input in response to a mouse or keyboard operation by a user. In response to the instruction, the CPU of the host computer displays a print setup window shown in FIG. 17A on the display unit of the host computer. FIGS. 17A and 17B are views showing examples of user interface windows controlled in the embodiment.

For example, the user presses a finishing key 1701 with the mouse on the operation window of FIG. 17A or 17B. Then, the CPU of the host computer controls the display unit to switch the print setup window to one as shown in FIG. 17B.

The CPU of the host computer allows the user to select the type of sheet processing to be executed by the inline type sheet processing apparatus 200 of the printing system 1000 via a sheet processing setting item on the print setup window of FIG. 17A or 17B.

Although not shown, the external apparatus including the host computer displays, as windows other than those in FIGS. 17A and 17B, display windows for inputting instructions equivalent to those inputtable via various display windows described in detail in the embodiment. In other words, the external apparatus can execute the same processes and control examples as those described in the embodiment.

Assume that the user selects desired sheet processing via the sheet setting item, returns to the window in FIG. 17A or 17B, and presses the OK key.

In response to this, the CPU of the host computer associates, as one job, commands representing various printing conditions set by the user via the print setup window with a series of data to be printed by the printer unit 203. Then, the host computer transmits the job to the printing system 1000 via the network 101.

The external I/F unit 202 of the printing system 1000 receives the job from the computer. In response to this, the controller 205 of the printing system controls the printing system 1000 to process the job from the host computer based on processing settings made by the user on the host computer.

The above-described configuration can provide various effects described in the embodiment even for a job from an external apparatus or the like, and can further increase the use efficiency of the printing system 1000.

The control unit of the printing system 1000 according to the embodiment executes various control examples to be described below on the premise of the above-described constituent features.

The configurations described with reference to FIGS. 1 to 17B correspond to constituent features common to all embodiments. For example, various control examples described in the embodiments correspond to constituent features based on these configurations.

As described with reference to FIGS. 1 to 17B, the printing system 1000 according to the embodiment is configured to be able to create a printing environment suitable not only for the office environment but also for the POD environment.

For example, the printing system 1000 employs a mechanism capable of coping with cases of used and user needs which are assumed not in the office environment but in the POD environment.

The printing system 1000 is configured to, for example, allow a POD company to receive orders of various print forms from customers in the POD environment.

More specifically, an inline sheet processing apparatus can execute finishing (e.g., glue binding or large-volume stacking) which is not requested as a user need in the office environment. In other words, the embodiment can deal with even user needs in consideration of the POD environment, in addition to needs (e.g., for stapling) in the office environment. For example, the printing system 1000 can flexibly cope with the business form of a POD company which does business in the POD environment where the printing system 1000 is delivered.

For example, a plurality of inline sheet processing apparatuses are connectable to the printing apparatus 100, and each inline sheet processing apparatus can independently operate as an independent housing, as described above. The number of connected sheet processing apparatuses is arbitrary, and an inline sheet processing apparatus can be flexibly added or changed in the printing system 1000.

The embodiment adopts a design which fully considers the operability of the user of the printing system 1000. For example, the embodiment allows the operator to manually register the system configuration of the printing system 1000 in the HDD 209. This configuration will be exemplified.

Assume that a POD company wants to build the system configuration shown in FIGS. 8A and 8B for the printing system 1000. In this case, the operator of the POD company connects three sheet processing apparatuses in FIGS. 8A and 8B purchased together with the printing apparatus 100 to the printing apparatus in the connection order shown in FIGS. 8A and 8B. Then, the operator presses the user mode key 505 of the operation unit 204. In response to this key operation, the controller 205 causes the touch panel section 401 to execute a display in FIG. 18A.

The display in FIG. 18A allows the operator to manually input system configuration information of the printing system 1000. The controller 205 allows the operator via displays in FIGS. 18A to 18D to determine the types of inline type sheet processing apparatuses to be connected to the printing apparatus 100. In addition, the controller 205 allows the operator via the displays in FIGS. 18A to 18D to determine the connection order of inline type sheet processing apparatuses to be connected to the printing apparatus 100.

If the operator presses an "advanced settings" key provided for each setting item in the display of FIG. 18A, the controller 205 displays a window (not shown). This window enables specifying sheet processing apparatuses used in the printing system one by one. In the embodiment, since the printing system follows the restrictions, as described above, the controller 205 also notifies the operator of this information as guidance information. For example, the controller 205 notifies the operator of a guidance "register the types of sheet processing apparatuses to be connected to the printing apparatus and their connection order. You can connect a maximum of five sheet processing apparatuses. Connect a saddle stitching apparatus last." In this case, the maximum number of connected inline sheet processing apparatuses is five, but is not limited to this.

The controller 205 controls the touch panel section 401 so that the operator can determine sheet processing apparatuses for use one by one from the top setting item in FIG. 18A. The controller 205 determines that the setting order itself from the top setting item is an actual apparatus connection order.

In this configuration, when the printing system 1000 has the system configuration shown in FIGS. 8A and 8B, the controller 205 prompts the operator to register the types of sheet processing apparatuses and their connection order, like the display in FIG. 18B. More specifically, the controller 205 prompts the operator to set "large-volume stacker ⇒glue binding apparatus ⇒saddle stitching apparatus" sequentially from the top setting item, like the display in FIG. 18B. The controller 205 determines that this setting order is an actual connection order, as shown in FIGS. 8A and 8B.

When the printing system 1000 has the system configuration shown in FIGS. 9A and 9B, the controller 205 prompts the operator to register the types of sheet processing apparatuses and their connection order, like the display in FIG. 18C. More specifically, the controller 205 prompts the operator to set "glue binding apparatus ⇒large-volume stacker ⇒saddle stitching apparatus" sequentially from the top setting item, like the display in FIG. 18C. The controller 205 determines that this setting order is an actual connection order, as shown in FIGS. 9A and 9B.

When the printing system 1000 has the system configuration shown in FIGS. 10A and 10B, the controller 205 prompts the operator to register the types of sheet processing apparatuses and their connection order, like the display in FIG. 18D. More specifically, the controller 205 prompts the operator to set "large-volume stacker ⇒saddle stitching apparatus" sequentially from the top setting item, like the display in FIG. 18D. The controller 205 determines that this setting order is an actual connection order, as shown in FIGS. 10A and 10B.

Figure 19:
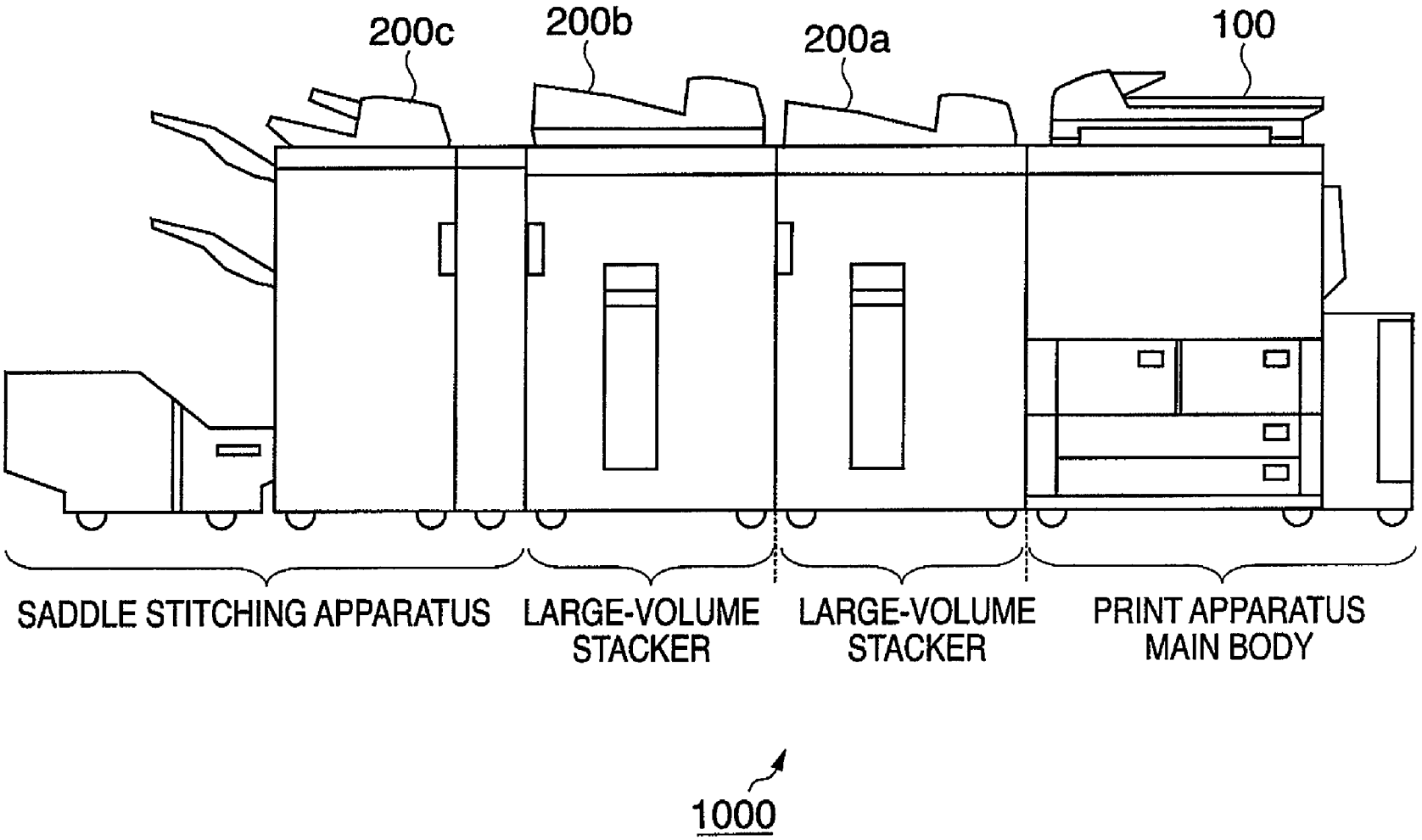
FIG. 19 is a view showing another system configuration of the printing system 1000 to be controlled in the first embodiment of the present invention.

In a system configuration of the printing system 1000 of the embodiment illustrated in FIG. 19, a total of three inline finishers, that is, two large-volume stackers and one saddle stitching apparatus illustrated in FIG. 11 are connected. In this system configuration, two large-volume stackers are connected as inline finishers of the same type. In this way, the printing system of the embodiment is configured to be able to connect inline finishers of the same type. A configuration in which inline finishers of the same type are cascade-connected as illustrated in FIG. 19 will be called tandem connection. The system configuration illustrated in FIG. 19 assumes a situation in which a printing company, to which the printing system is delivered, frequently executes large-volume stacking. In the embodiment, a plurality of large-volume stackers can be tandem-connected.

The UI control to improve user friendliness assuming use cases on site is also one feature of the embodiment.

As described with reference to FIGS. 1 to 19, the printing system 1000 comprises various mechanisms toward practical use of a product capable of flexibly coping with various use cases and user needs in the POD environment and the like that are different from use cases and user needs in the office environment.

In addition to providing new functions and new configurations as described above, the printing system 1000 can execute various control examples as follows in order to maximize the effects of the printing system 1000.

For example, the control unit of the printing system causes the printing system 1000 to execute the following control.

Before a description of concrete control, the configuration of the printing system 1000 will be complemented.

A variety of inline finishers such as the large-volume stacker in the embodiment each have an openable/closable door (front door) on the front surface of the housing. The front door allows an operator to remove a jammed sheet from each finisher or take out the printed materials of a job printed by the printer unit 203.

For example, the large-volume stacker in the embodiment comprises a stack tray (also simply called a stacker unit) inside the stacker that can stack many printed materials, as illustrated in the internal structure of FIG. 11. The large-volume stacker also comprises an escape tray (also called a sample tray) outside the stacker (at the top of the stacker). The controller 205 controls to selectively supply the printed materials of a target job to the stack tray inside the large-volume stacker and the escape tray outside it based on various criteria in the embodiment. Each inline finisher in the embodiment such as the large-volume stacker except for the saddle stitching apparatus also has a function of conveying a printed material received from a preceding apparatus into a succeeding inline finisher via the internal through path of the inline finisher. The large-volume stacker in the embodiment is configured such that the tray can automatically move down in accordance with the amount of sheet stacking of printed materials on the internal stack tray. The large-volume stacker is also configured to be able to align printed materials.

Figure 20:
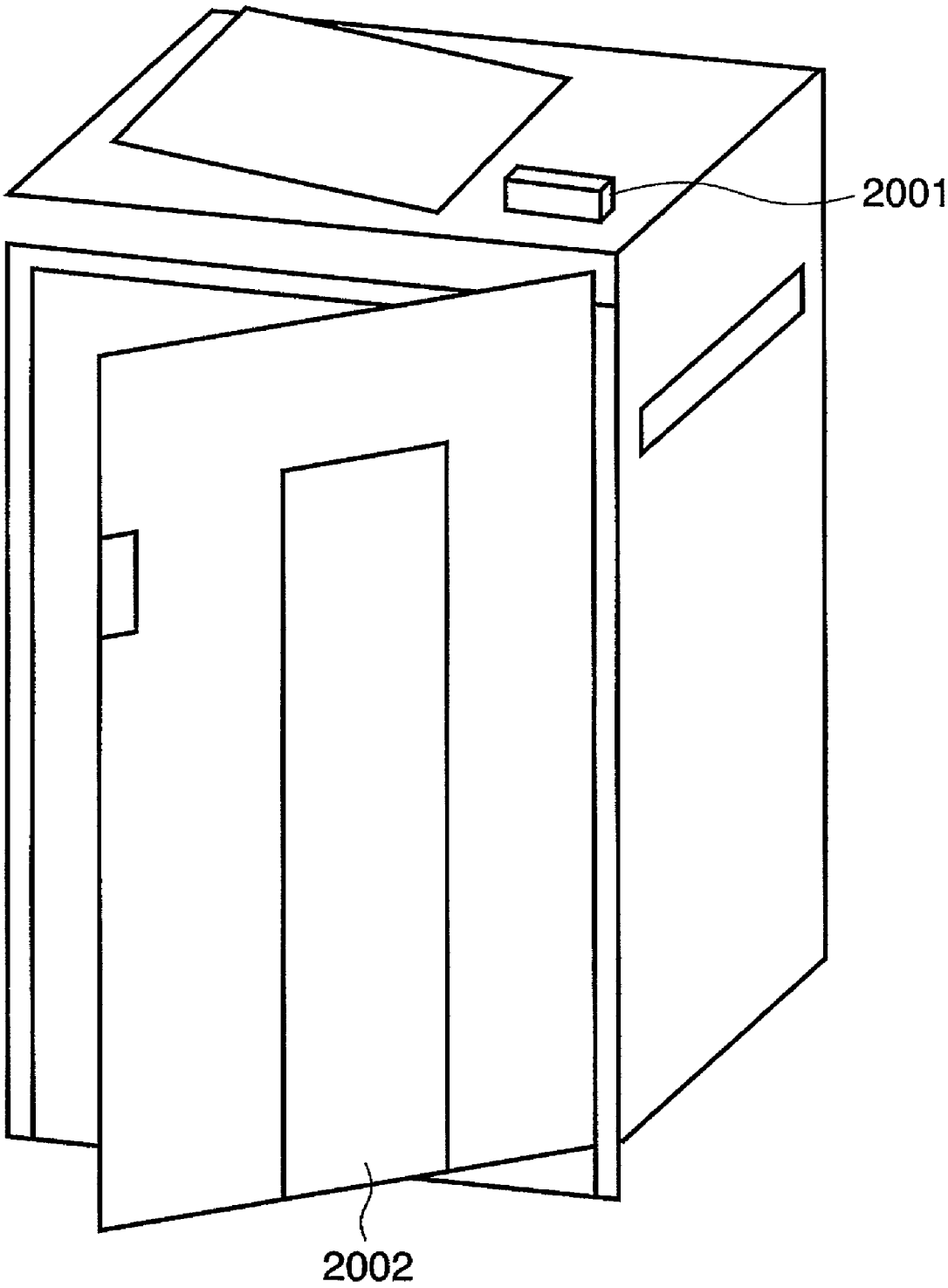
FIG. 20 is a perspective view for explaining a large-volume stacker in the first embodiment of the present invention.

This structure is as described with reference to FIG. 11. The large-volume stacker has, on its front surface, a door 2002 which can be opened and closed by an operator, as shown in FIG. 20. The large-volume stacker also has, at the top of the housing, a switch 2001 for allowing an operator to input an instruction to open the door 2002. The control unit (not shown) of the large-volume stacker mainly controls various operations in the large-volume stacker. The control unit opens the door 2002 in accordance with an instruction manually input by the operator via the switch 2001. More specifically, the door 2002 is locked with a key (not shown) when closed. The operator unlocks the key to open the door 2002, and can take out printed materials stacked on the stack tray of the large-volume stacker. It is also controlled to automatically open the door 2002 in accordance with not only an operation via the switch 2001 but also an instruction from the controller 205 of the printing apparatus 100. At this time, the controller 205 transmits a door open signal to the control unit of the large-volume stacker via a signal line inside the printing apparatus 100 shown in FIG. 2. The operator opens the door 2002 to take out printed materials stacked on the stack tray of the large-volume stacker. The controller 205 of the printing apparatus 100 may also execute these control operations.

In the embodiment, when the operator is to take out the printed materials of a printed job from the large-volume stacker, the controller 205 mainly controls the printing system 1000 not to deliver, to the stack tray of the large-volume stacker, the sheets of a subsequent job whose printing execution request is issued after the printed job.

In other words, the printing system 1000 controls the sheet processor in the sheet processing apparatus not to deliver the sheets of a subsequent job while the operator takes out the printed materials of a printed job from the sheet processing apparatus.

However, the controller 205 controls to execute, for example, the following exemplary operations even while the operator takes out printed materials from the stack tray of the large-volume stacker.

For example, the controller 205 controls the printing system 1000 to deliver the printed materials of a subsequent job to the escape tray of the large-volume stacker while, for example, the operator takes out printed materials stacked on the stacker tray and the door 2002 of the large-volume stacker is open.

In a predetermined case, the controller 205 controls the printing system 1000 to be able to convey the printed materials of a subsequent job via the through path in the large-volume stacker. This is a case where, while the door 2002 of the large-volume stacker is open, the subsequent job does not require stacking by the large-volume stacker and requires finishing by an inline finisher connected to the output side of the large-volume stacker.

In this way, the controller 205 permits execution of these operations in the printing system 1000 even while the door 2002 is kept open.

To execute these operations, the controller 205 inhibits or permits the start of the printing operation of a subsequent job whose printing execution request is issued after a job whose sheets are taken out by the operator from the sheet processing apparatus. In other words, the controller 205 controls whether to permit/inhibit execution of the printing operation of a subsequent job, and the printing timing of the job.

This configuration is also unique to an inline finisher physically and electrically connected to the printing apparatus.

On the premise of this configuration, the controller 205 serving as an example of the control unit of the printing system 1000 executes the following exemplary control.

Prerequisite constituent features will be complemented before a description of the following exemplary control.

As a premise, the printing system 1000 comprises the printing apparatus 100 having the printer unit 203 capable of printing data in the HDD 209 capable of storing data of jobs. The printing system 1000 comprises a plurality of sheet processing apparatuses 200*a* to 200*n* connectable to the printing apparatus 100. These sheet processing apparatuses can execute sheet processing (also called finishing or post-processing) for sheets (also called printed materials or print media) of a job printed by the printer unit 203. Each sheet processing apparatus allows an operator to take out a printed material having undergone sheet processing by it. The printing system 1000 can selectively supply sheets of a job printed by the printer unit 203 from the printer unit 203 of the printing apparatus 100 to these sheet processing apparatuses.

The controller 205 serving as an example of the control unit of the embodiment executes the following control in the printing system 1000 having the system configuration which aims at the POD market.

Figure 21:
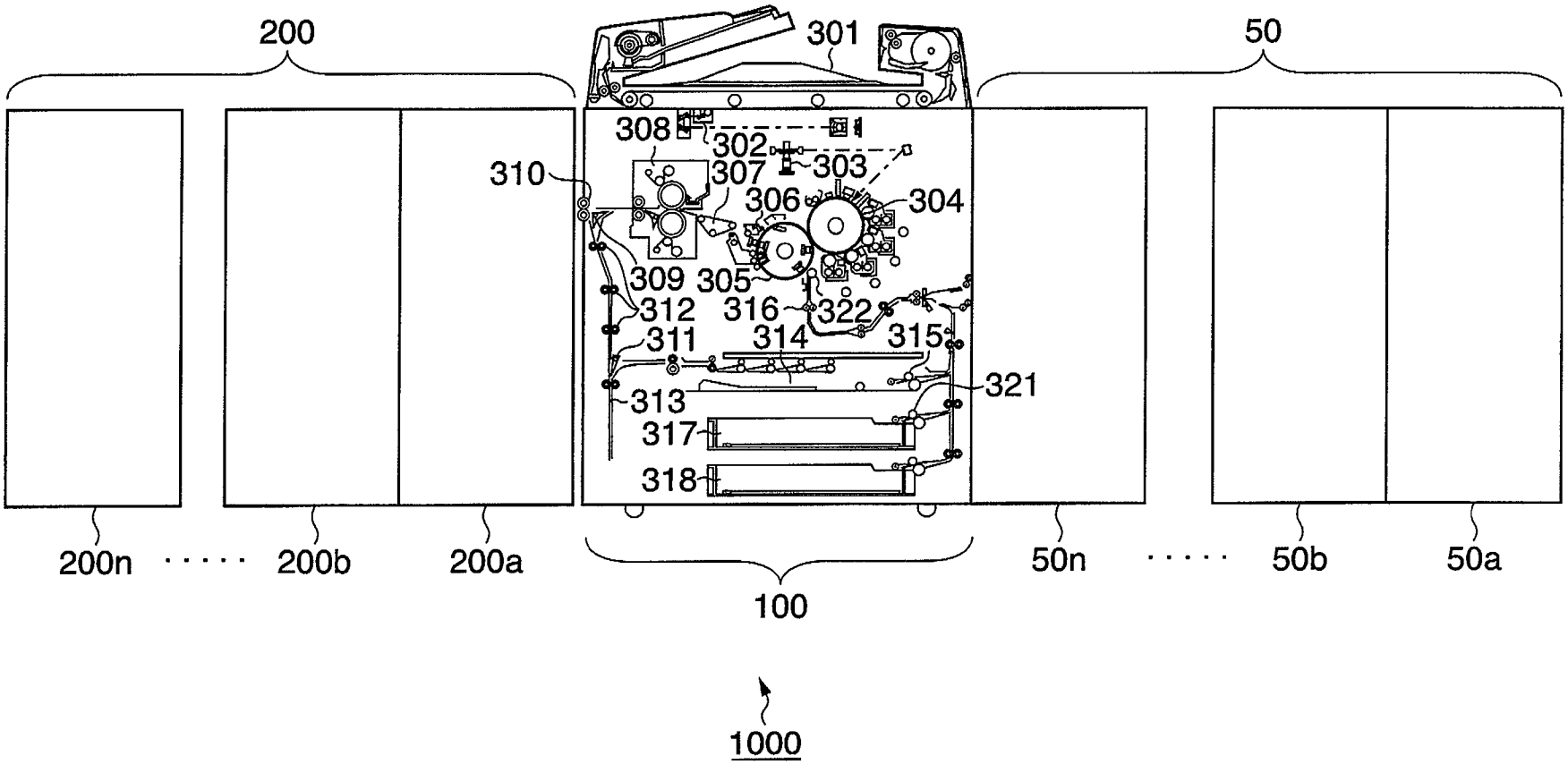
FIG. 21 is a view showing still another system configuration of the printing system 1000 to be controlled in the first embodiment of the present invention.

In the printing system 1000, a plurality of feeding apparatuses (large-volume feeding decks) can be cascade-connected to the printing apparatus 100 as a feeding apparatus having a feeding means for feeding a print medium. An arbitrary number of sheet feeding apparatuses connectable to the printing apparatus 100 can be installed in accordance with the use environment in order to enhance the effects of the embodiment. In FIG. 21, N feeding apparatuses 50 are connectable as a group of feeding apparatuses. The feeding apparatuses are defined as feeding apparatuses 50*a*, 50*b*, . . . sequentially from the first feeding apparatus, and the Nth feeding apparatus is defined as a feeding apparatus 50*n*. Each feeding apparatus comprises a feeding means for feeding a print medium, a multi feed detection means for detecting occurrence of multi feed of overlapping print media, and a multi feed discharge means for discharging multi-fed print media. Feed and discharge of sheets by these feeding apparatuses are controlled by the controller 205 serving as a control means based on various setting contents.

Figure 22:
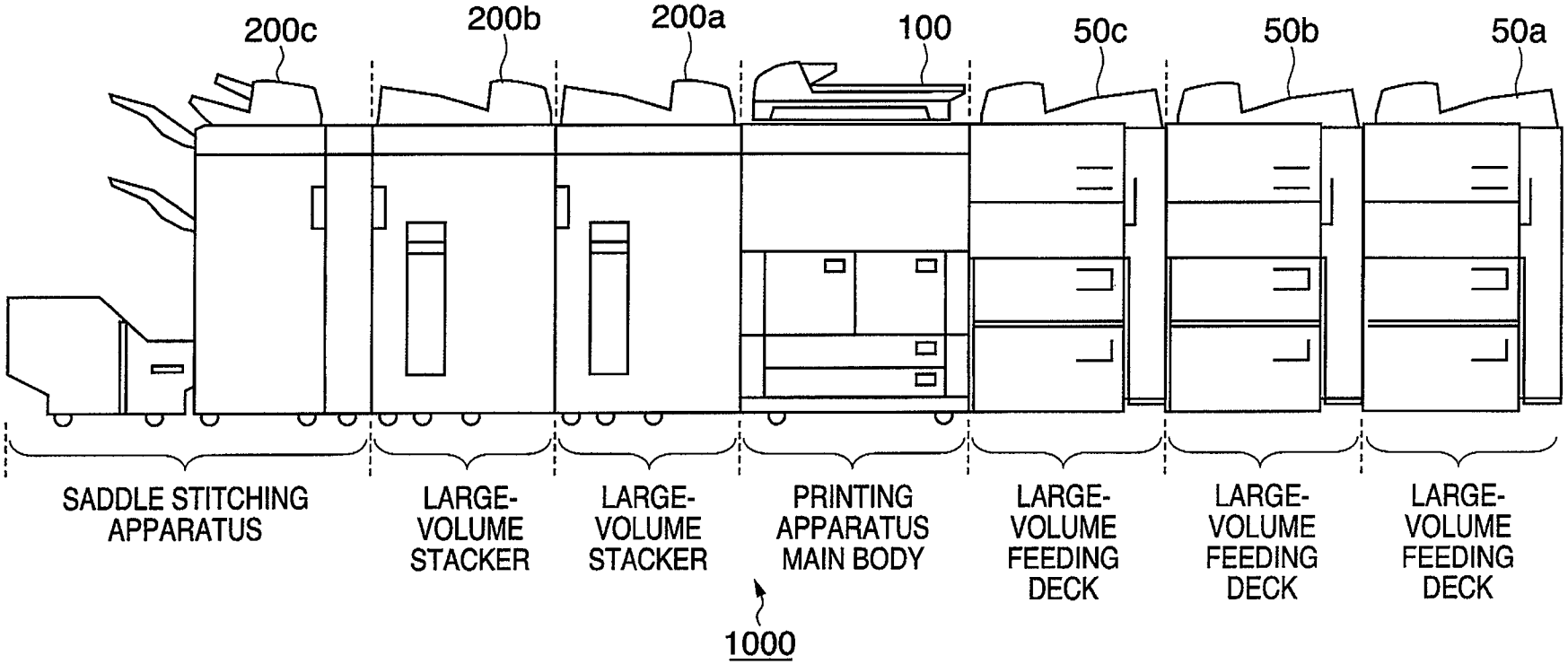
FIG. 22 is a view showing this system configuration of the printing system 1000 to be controlled in the first embodiment of the present invention.

For descriptive convenience, the printing system 1000 having three feeding apparatuses as shown in FIG. 22 will be exemplified. In the printing system 1000 of FIG. 22, the feeding apparatuses 50*a*, 50*b*, and 50*c* are connected in the order named to the printing apparatus 100. The internal system configuration in this case is as shown in FIG. 23.

Figure 23:
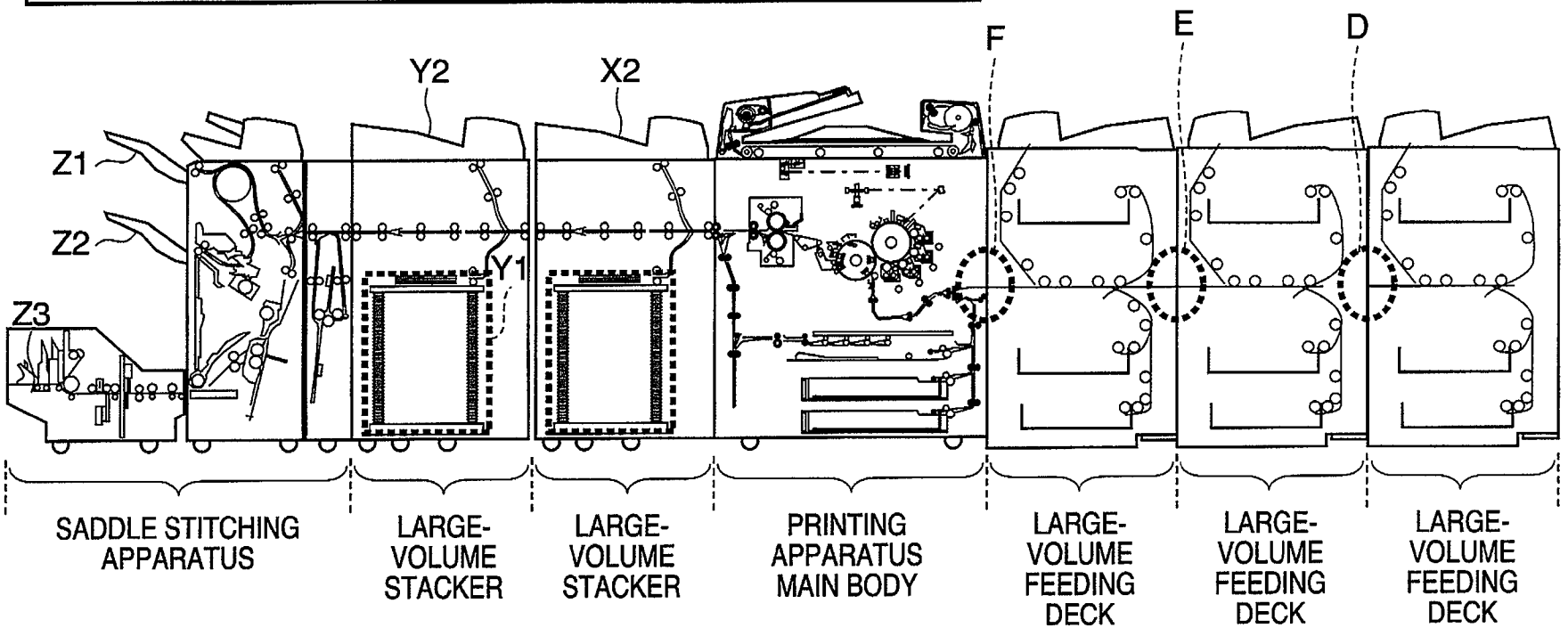
FIG. 23 is a sectional view showing an internal structure of this system configuration of the printing system 1000 to be controlled in the first embodiment of the present invention.

FIG. 23 is a sectional view of the apparatuses of the whole printing system 1000 when the printing system 1000 has the system configuration in FIG. 22. The internal system configuration in FIG. 23 allows supplying a sheet to each feeding apparatus in order to supply it to the printer unit 203 of the printing apparatus 100. More specifically, this internal system configuration has a sheet feeding path capable of conveying a sheet to the printer unit 203 via points D and E, as shown in FIG. 23.

[Internal Structure of Large-volume Feeding Deck]

Figure 24:
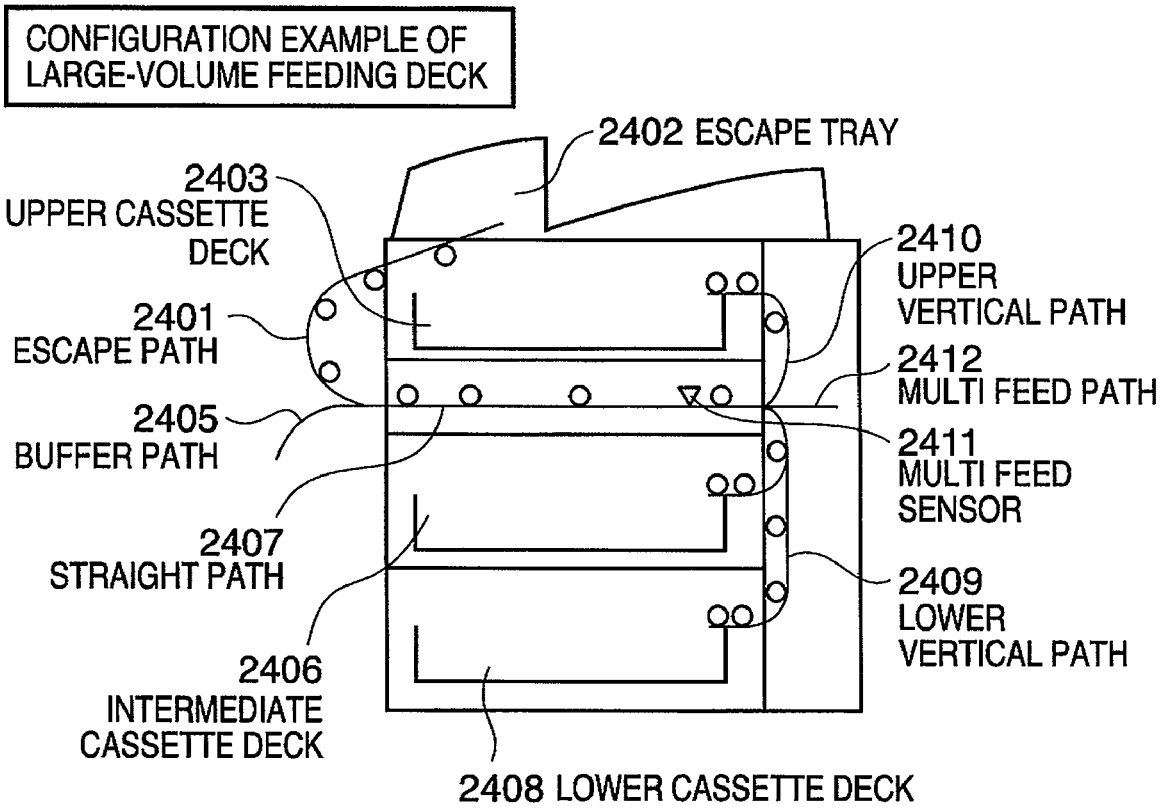
FIG. 24 is a sectional view for explaining an internal structure of a large-volume feeding deck to be controlled in the first embodiment of the present invention.

FIG. 24 is a sectional view showing the internal structure of the large-volume feeding deck in FIGS. 22 and 23.

In the large-volume feeding deck, the sheet feeding paths are roughly classified into five: for example, a buffer path 2405 serving as a feeding path extending to the printing apparatus 100, an escape path 2401, an upper vertical path 2410, a lower vertical path 2409, and a multi feed path 2412. The large-volume feeding deck incorporates these five sheet feeding paths.

The multi feed path 2412 in the large-volume feeding deck of FIG. 24 is a feeding path for receiving sheets from a preceding apparatus.

The upper vertical path 2410 in the large-volume feeding deck is a feeding path for conveying sheets fed from an upper cassette deck 2403. The lower vertical path is a feeding path for conveying sheets fed from an intermediate cassette deck 2406 and lower cassette deck 2408.

A straight path 2407 in the large-volume feeding deck is a sheet feeding path for transferring sheets received from the upper vertical path 2410 and lower vertical path 2409 to a succeeding apparatus. The straight path 2407 is also a unit for conveying, from an upstream apparatus to a downstream apparatus via the multi feed path, a sheet fed from an apparatus other than the sheet processing apparatus.

The escape path 2401 in the large-volume feeding deck is used to output a sheet without conveying it to an upstream apparatus. For example, when a jam occurs in a succeeding sheet processing apparatus or a multi feed sensor 2411 serving as the multi feed detection means detects multi feed, a sheet is conveyed to the escape path 2401 and discharged from an escape tray 2402.

The sheet feeding path in the large-volume feeding deck has a plurality of sheet sensors necessary to detect the sheet conveyance status, multi feed, and jam.

"Multi feed" in the embodiment means conveying two or more print media (also called sheets) to be processed by the printing system 1000 through the sheet feeding path in the printing system 1000 while the print media at least partially overlap each other.

The CPU (not shown) in the large-volume feeding deck notifies the controller 205 of sheet detection information from each sensor via a signal line (signal line in FIG. 2 for electrically connecting the feeding apparatus 50 and controller 205) for communicating data with the controller 205. Based on the information from the large-volume feeding deck, the controller 205 grasps the sheet conveyance status and jam in the large-volume feeding deck. When another feeding apparatus is cascade-connected between the feeding apparatus and the printing apparatus 100 in the printing system, the CPU of the feeding apparatus notifies the controller 205 via the CPU of the cascade-connected feeding apparatus of sensor information of the large-volume feeding deck.

The escape tray 2402 in FIG. 24 is a stacking unit on which sheets conveyed via the escape path 2401 are stacked. The escape tray 2402 has a sheet full load sensor, and the CPU (not shown) in the large-volume feeding deck notifies the controller 205 of information from this sensor. Based on the information from the large-volume feeding deck, the controller 205 grasps stacking information of sheets on the escape tray 2402.

The large-volume feeding deck comprises the upper cassette deck 2403, intermediate cassette deck 2406, and lower cassette deck 2408 (each capable of storing, e.g., 5,000 sheets) as feeding units for storing sheets necessary for print processing. Each feeding unit can store sheets of various materials at various sheet sizes, and has an air heater function and separation fan function. With the air heater function, a heater is attached based on sheet material information and the humidity in the cassette which are notified from the controller 205. With the separation fan function, the air flow of the sheet suction fan is adjusted.

[Feeding Path to Escape Tray]

The feeding path of a sheet from the upper cassette deck to the escape tray will be explained with reference to FIGS. 24 and 25A to 25D.

Figure 25A:
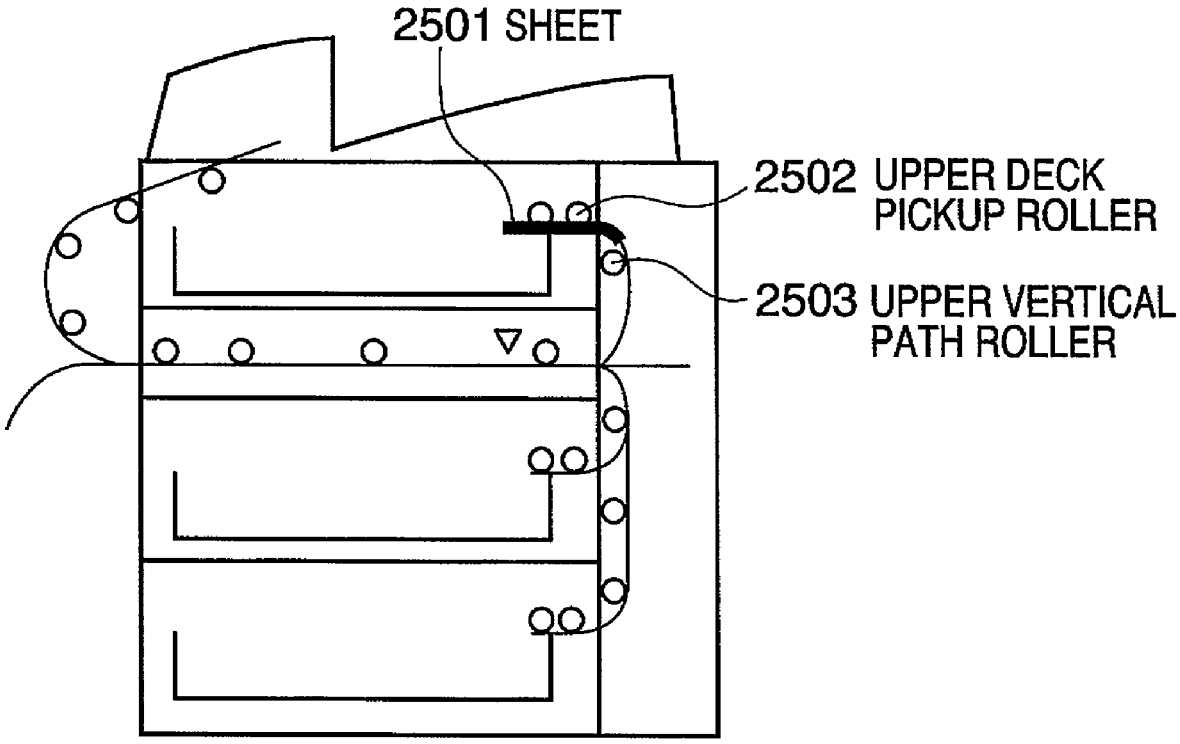
FIG. 25A is a sectional view for explaining the internal structure of the large-volume feeding deck to be controlled in the first embodiment of the present invention.
Figure 25B:
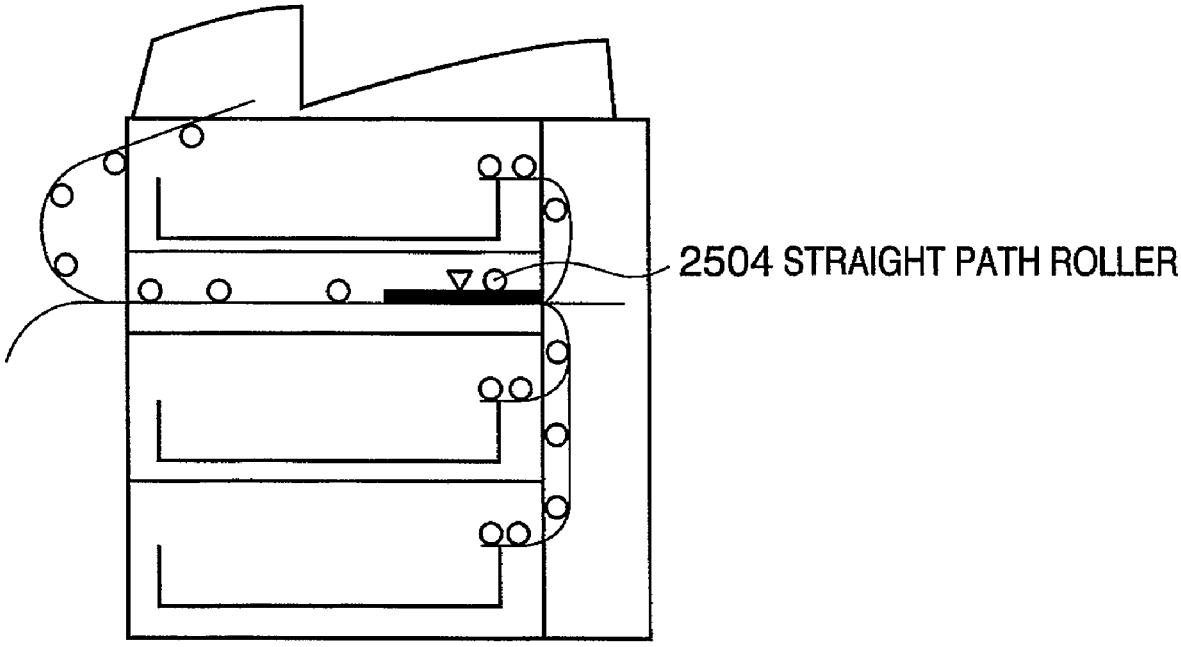
FIG. 25B is a sectional view for explaining the internal structure of the large-volume feeding deck to be controlled in the first embodiment of the present invention.

Assume that the controller 205 accepts a request from a user via the UI unit by a key operation to the key 701 in the display of FIG. 7 to execute print processing for sheets from the upper cassette deck. In this case, the controller 205 controls feeding of sheets from the upper cassette deck 2403. The top one of sheets 2501 set in the upper cassette deck 2403 is picked up by an upper deck pickup roller 2502 and conveyed to the upper vertical path 2410 (FIG. 25A). The sheet 2501 conveyed to the upper vertical path 2410 is conveyed by an upper vertical path roller 2503, and guided to the entry of the straight path 2407. Then, multi feed detection processing is executed using the multi feed sensor 2411 in order to detect whether sheets on the straight path 2407 are multi-fed (FIG. 25B).

Figure 25C:
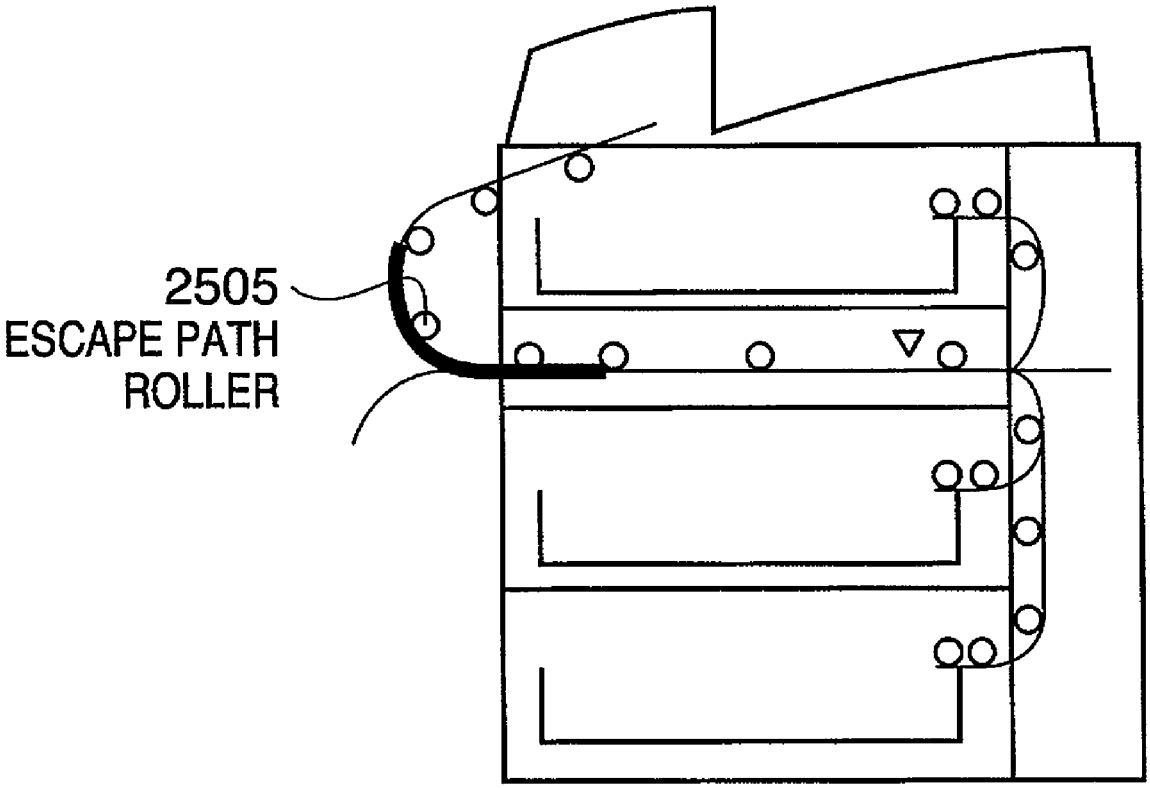
FIG. 25C is a sectional view for explaining the internal structure of the large-volume feeding deck to be controlled in the first embodiment of the present invention.
Figure 25D:
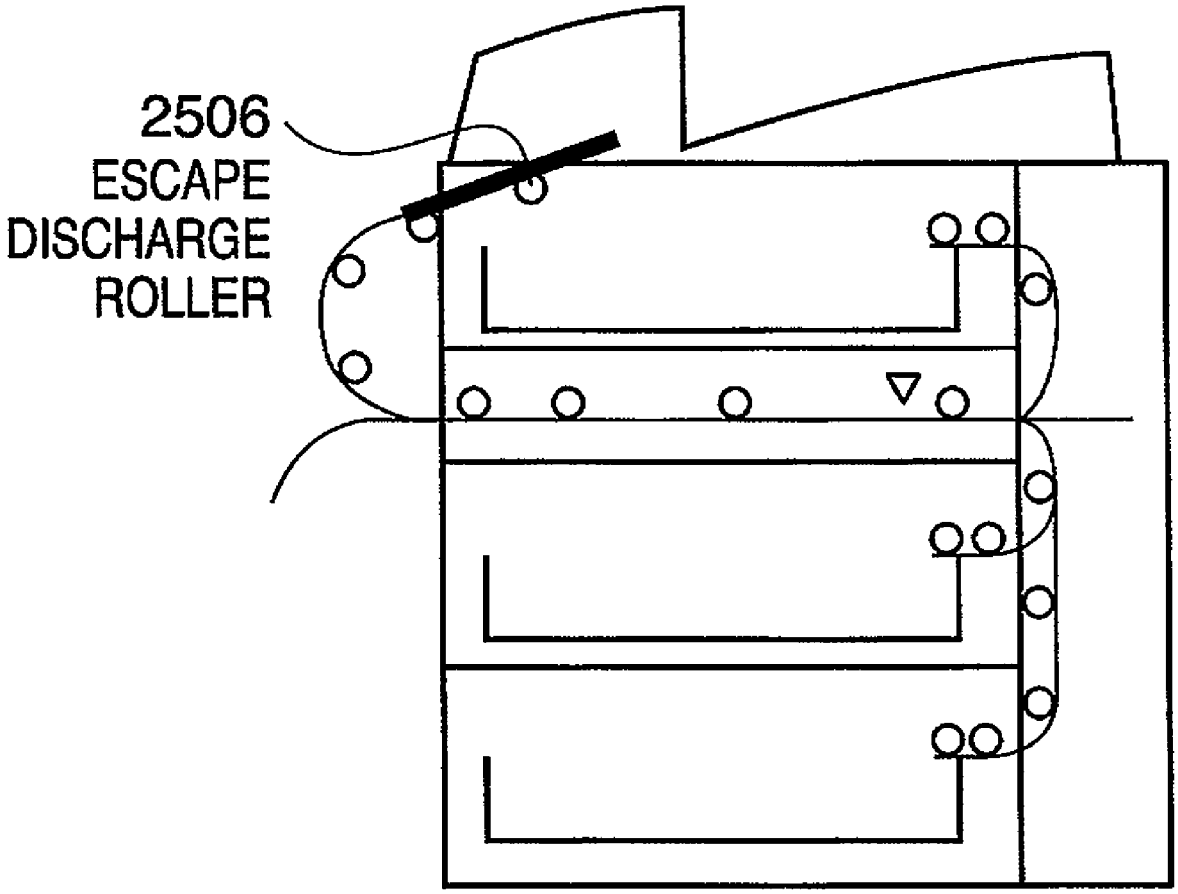
FIG. 25D is a sectional view for explaining the internal structure of the large-volume feeding deck to be controlled in the first embodiment of the present invention.

In the multi feed detection processing, the thickness of the sheet 2501 is measured, and whether the sheets 2501 are multi-fed is determined based on the measurement data. In this case, the printing system 1000 adopts a configuration capable of detecting multi feed by the multi feed sensor 2411 by measuring the thickness of the sheet 2501, but may also adopt another multi feed detection means. The sheet 2501 on the straight path 2407 is conveyed by a straight path roller 2504 to the branch point between the escape path 2401 and the buffer path 2405. A conveyance destination is determined based on the result of multi feed detection processing representing whether the sheets 2501 are multi-fed. If it is determined that the sheets 2501 are multi-fed, the sheets 2501 are guided to the escape path 2401 (FIG. 25C). The sheets conveyed to the escape path 2401 are guided to the discharge port of the escape tray 2402 by an escape path roller 2505 (FIG. 25D). The sheets 2501 conveyed to the discharge port of the escape tray 2402 are discharged onto the escape tray 2402 by an escape discharge roller 2506.

Processing when multi feed occurs in a target job whose printing execution request is accepted from a user in the system configuration of FIG. 22 will be described in detail with reference to FIGS. 24 to 30.

The user is prompted to set an output destination from the feeding apparatus 50 via the operation unit 204 of the printing apparatus 100. After the end of setting, it is determined whether the user has pressed a copy start key (S2601). In S2601, the process waits until the user presses the copy start key.

If the user presses the copy start key, the controller 205 of the printing system 1000 issues a feeding instruction. The controller 205 of the printing system 1000 causes the feeding apparatus 50 to feed a sheet (S2602). The sheet fed from the feeding apparatus is conveyed to the printer unit 203.

To detect whether sheets are multi-fed, multi feed detection processing is executed using the multi feed sensor 2411 (S2603). In the multi feed detection processing, the thickness of the sheet is measured, and whether sheets are multi-fed is determined based on the measurement data. At this time, multi feed may be determined by the controller 205 of the printing system 1000 or the CPU (not shown) of the feeding apparatus.

Based on the result of multi feed detection processing, it is determined whether sheets are multi-fed (S2604). If it is determined that sheets are not multi-fed from the feeding apparatus 50, the sheet is conveyed to the printer unit 203 (S2605).

In S2606, it is determined whether the set job has ended and all sheets have been discharged. If it is determined in S2606 that the set job has not ended, the process returns to S2601. If it is determined in S2606 that the set job has ended, a series of processes ends.

Figure 27:
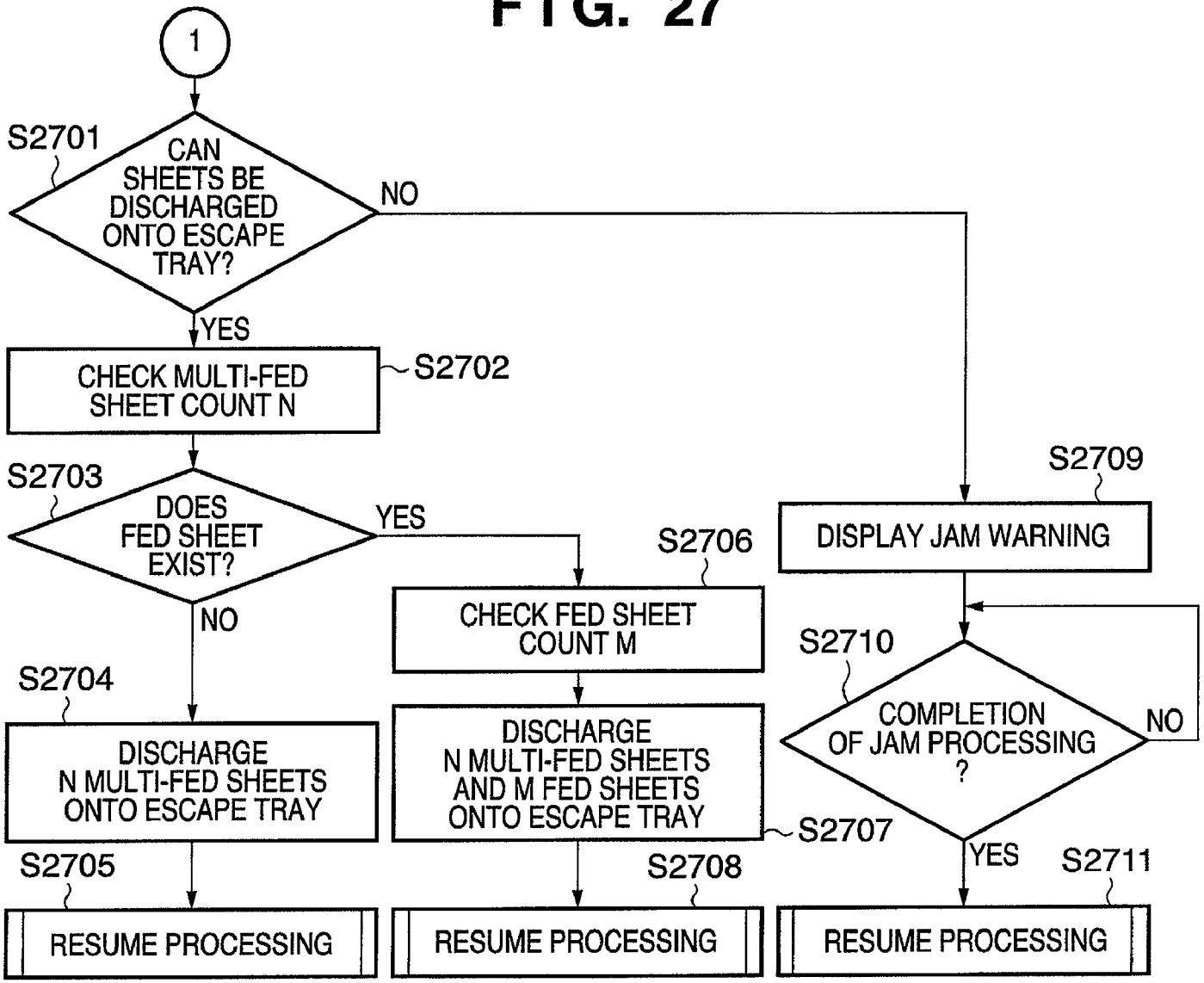
FIG. 27 is a flowchart showing a control example of the printing system 1000 to be controlled in the first embodiment of the present invention.

If it is determined in S2604 based on the result of multi feed detection processing in S2603 that sheets are multi-fed, the process proceeds to one shown in the flowchart of FIG. 27. If multi feed is detected, a feeding operation and image forming operation for sheets fed from the paper cassette of the printer unit 203 and the feeding apparatus 50 are interrupted. Based on the result of multi feed detection processing representing that sheets are multi-fed, the controller 205 of the printing system 1000 determines whether sheets detected to be multi-fed can be discharged onto the escape tray 2402 (S2701).

If it is determined in S2701 that the multi-fed sheets can be discharged onto the escape tray 2402, multi-fed sheet count determination processing is executed (S2702). If it is determined that the multi-fed sheets cannot be discharged onto the escape tray 2402, the sheets are jammed, and the operation unit 204 displays a warning to remove all sheets from the feeding path in the apparatus (S2709).

After the operation unit 204 executes a predetermined display in S2709, it is determined whether the user has removed all jammed sheets (S2710). If it is determined in S2710 that jam processing has ended, the process proceeds to a resume sequence (S2711).

After the multi-fed sheet count determination processing in S2702, it is checked whether a fed sheet exists (S2703). If no fed sheet exists and the multi-fed sheet count is N as a result of the multi-fed sheet count determination processing, the N multi-fed sheets are discharged onto the escape tray 2402 (S2704). If a fed sheet exists, fed sheet count determination processing is executed (S2706). If the fed sheet count is M as a result of the fed sheet count determination processing, the N multi-fed sheets and the M fed sheets are discharged onto the escape tray (S2707). The discharged sheets may be shifted to allow the user to easily recognize the multi-fed sheets and the fed sheets. After discharging sheets onto the escape tray, the process proceeds to the resume sequence (S2705 and S2708).

The resume sequence (to be referred to as recovery processing hereinafter) is processing to discharge, onto the escape tray, sheets detected to be multi-fed in multi feed detection processing, and discharge all subsequent sheets fed from another feeding apparatus 50. That is, pages up to one immediately before detecting multi feed are discharged. Page processing upon occurrence of multi feed will be described in detail with reference to FIGS. 28 and 29.

Figure 28:
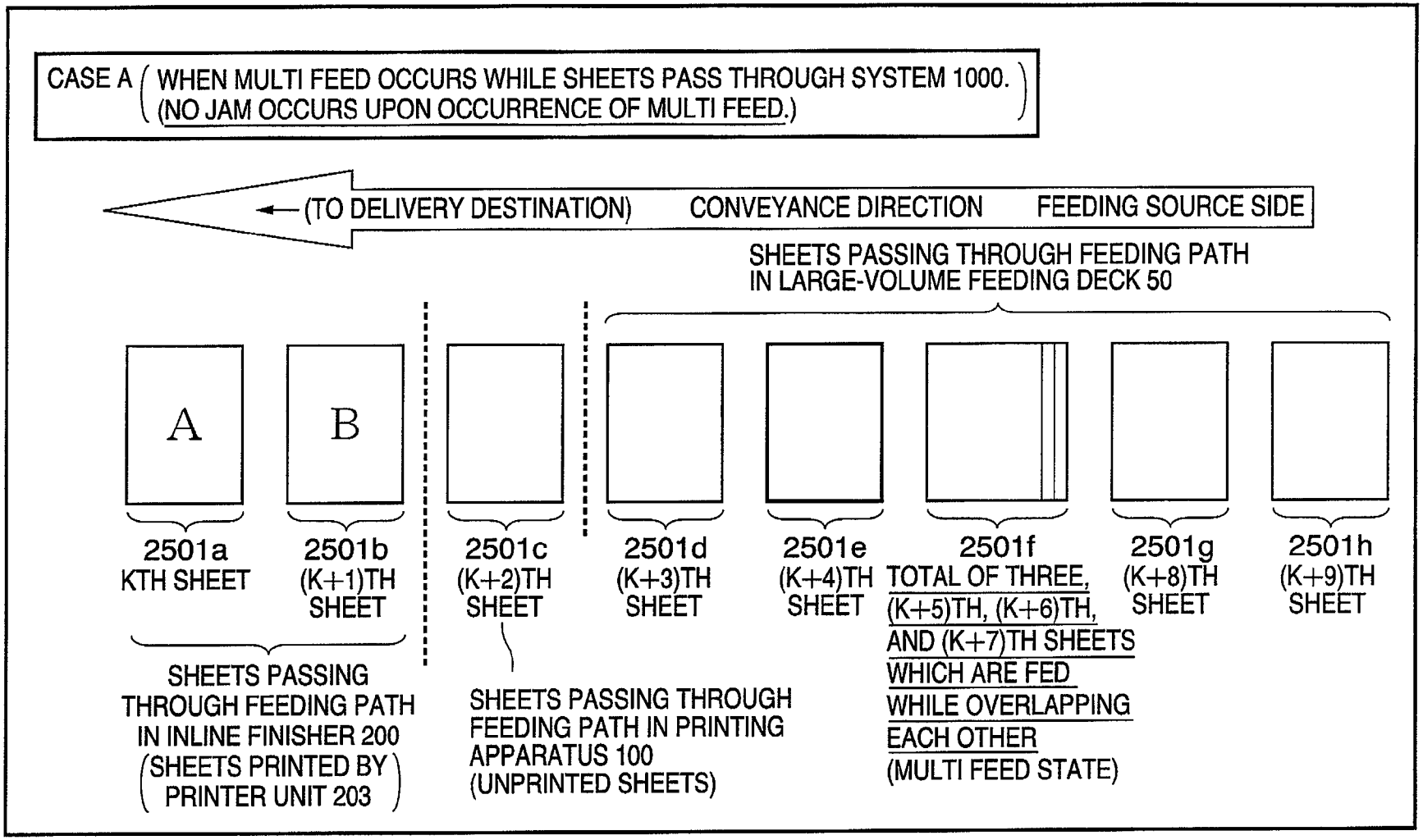
FIG. 28 is a view for explaining sheets on the feeding path in the printing system 1000 to be controlled in the first embodiment of the present invention.

FIG. 28 shows an example of sheets on the feeding path when multi feed occurs (but no jam occurs upon occurrence of multi feed) while sheets exist on the feeding path in the printing system 1000. K sheets have already been discharged to the sheet processing apparatus 200, and 10 sheets exist on the feeding path in the printing system 1000. Sheets 2501*a* and 2501*b* are passing through the feeding path in the sheet processing apparatus 200, and have been printed by the printer unit 203. A sheet 2501*c* is passing through the feeding path in the printing apparatus 100, and is not printed. Sheets 2501*d* and 2501*e* are passing through the feeding path in the feeding apparatus 50. Three sheets 2501*f* are multi-fed on the feeding path in the feeding apparatus 50. Sheets 2501*g* and 2501*h* are passing through a feeding path on the feeding source side from the multi-fed sheets.

Figure 29:
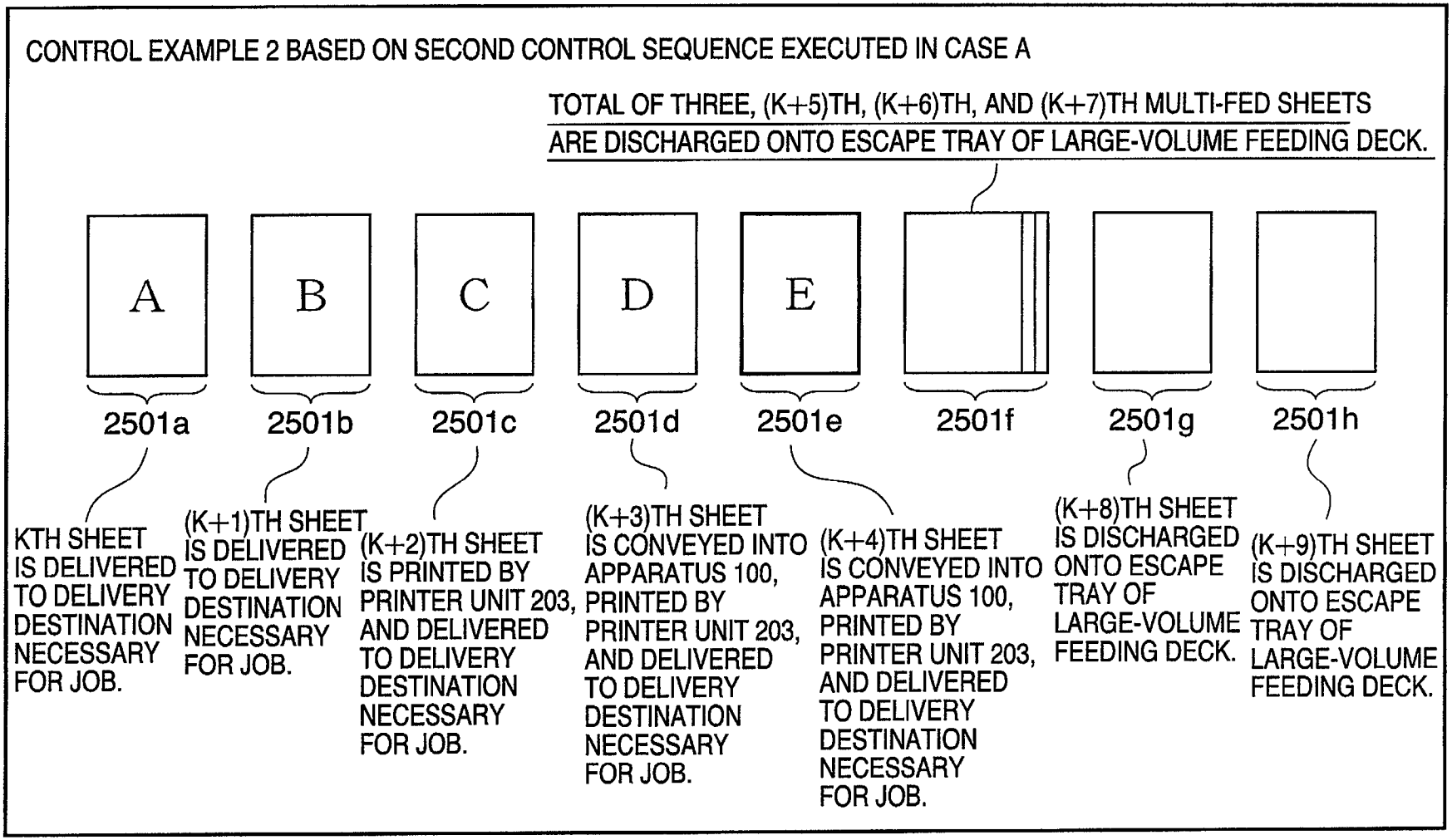
FIG. 29 is a view for explaining sheets on the feeding path in the printing system 1000 to be controlled in the first embodiment of the present invention.

Control as shown in FIG. 29 is done in multi-fed sheet discharge processing upon occurrence of multi feed according to the first embodiment. The sheets 2501*a* and 2501*b* are discharged from inside the sheet processing apparatus 200 to a discharge destination requested by the job. The sheet 2501*c* is printed by the printer unit 203, and discharged to a discharge destination requested by the job. The sheets 2501*d* and 2501*e* are conveyed into the printing apparatus 100, printed, and discharged to a discharge destination requested by the job. The three sheets 2501*f* are discharged onto the escape tray of the feeding apparatus 50. The sheets 2501*g* and 2501*h* are discharged onto the escape tray of the feeding apparatus 50.

By performing this multi-fed sheet discharge processing, sheets after detecting multi feed are discharged onto the escape tray. The job is newly reproduced from a state before multi feed occurs.

After all sheets are discharged by multi-fed sheet discharge processing, the printing apparatus 100 performs recovery processing to resume the sheet output operation (S3001).

Figure 30:
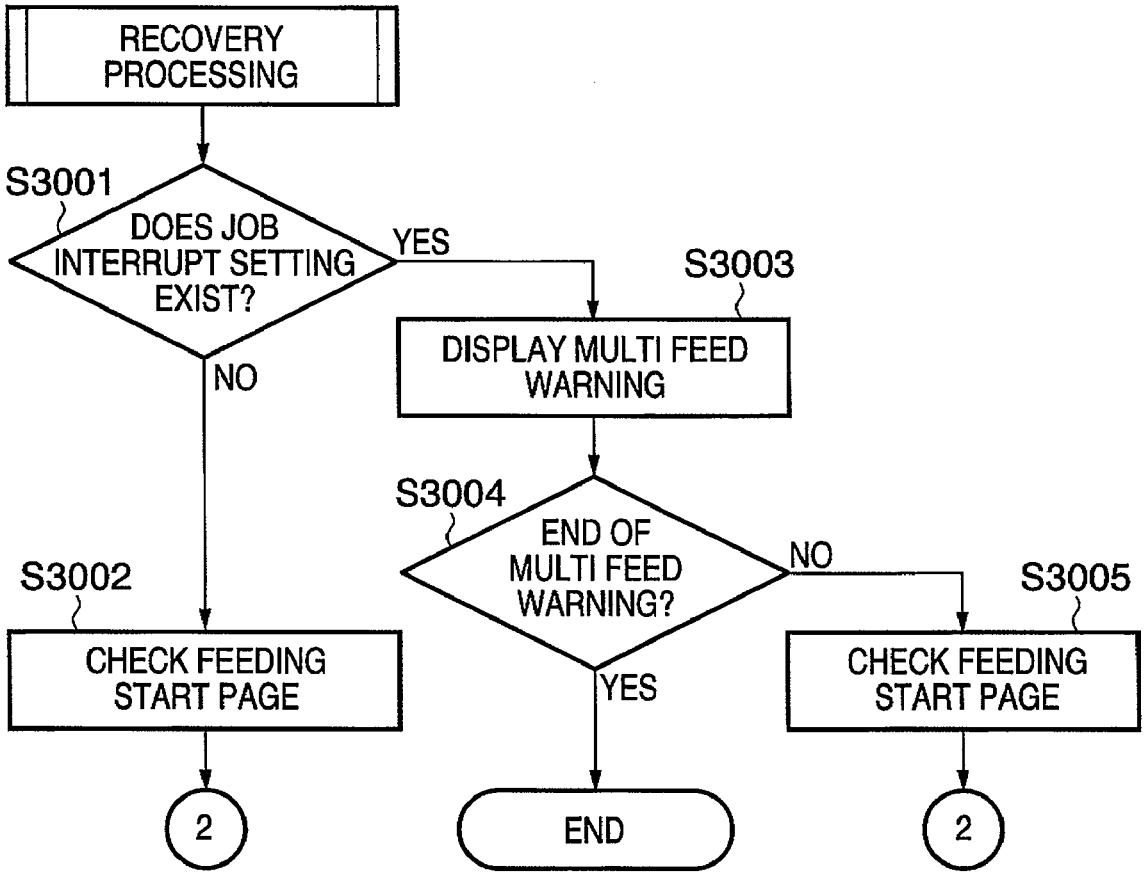
FIG. 30 is a flowchart showing a control example of the printing system 1000 to be controlled in the first embodiment of the present invention.

The recovery processing will be explained with reference to FIGS. 30 and 63. The controller 205 of the printing system 1000 determines whether a job interrupt setting exists (S3001). Job interrupt setting information is saved in the HDD 209 or RAM 208.

Figure 34:
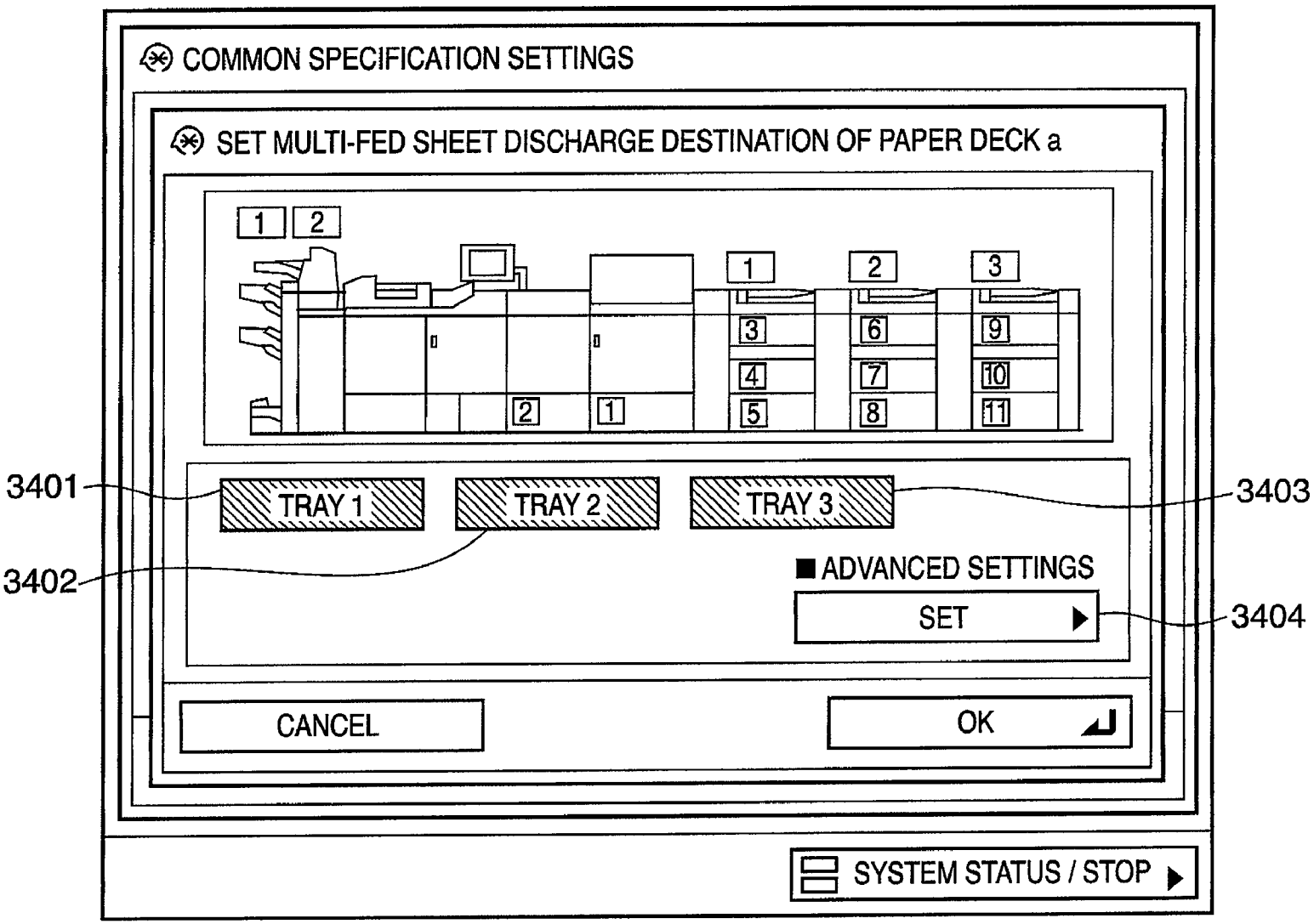
FIG. 34 is a view of a window for setting a discharge tray for large-volume feeding deck a in the printing system 1000 to be controlled in the first embodiment of the present invention.
Figure 63:
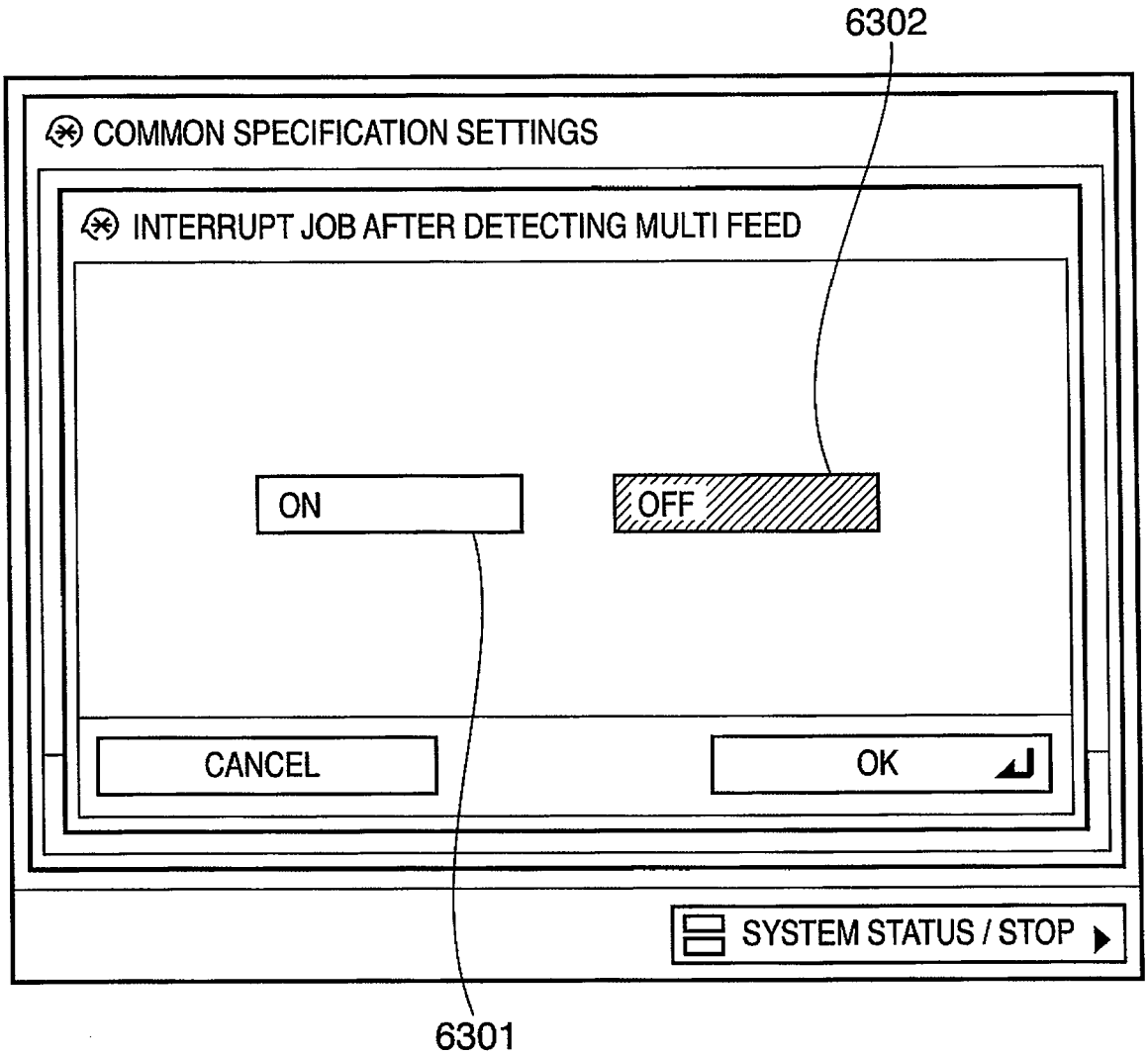
FIG. 63 is a view showing an example of a display window on the UI unit to be controlled in the first embodiment of the present invention.

A job interrupt setting window shown in FIG. 63 appears when the user selects one of keys 3401 to 3403 shown in FIG. 34 on the operation unit 204. The controller 205 saves, in the HDD 209 or RAM, information on either an ON button 6301 or OFF button 6302 selected in FIG. 63.

If it is determined in S3001 that the job interrupt setting exists, the operation unit 204 displays a warning which prompts the user to select whether to interrupt or resume the job (S3003). If no job interrupt setting exists, the process proceeds to a resume sequence (S3002).

After the operation unit 204 executes a predetermined display in S3003, it is determined whether the user has pressed the job resume key (S3004). If it is determined in S3004 that the user has pressed the job resume key, the process proceeds to a resume sequence (S3005). If the user presses not the job resume key but the interrupt key, the job ends. If sheets remain in wait for the resume of the job, all subsequent remaining sheets from the feeding apparatus 50 are discharged onto the escape tray 2402. After executing the recovery processing, the process returns to step S2602 to continue the print job.

In the embodiment, the operation unit 204 executes the display after recovery processing. However, the timing to execute the display for this processing is arbitrary between detection of multi feed and the start of a job.

When sheets are multi-fed from the feeding apparatus 50, the above-described control can be performed to execute appropriate recovery processing and resume the operation.

A multi-fed sheet discharge destination designation method and multi-fed sheet discharge operation according to the first embodiment will be explained in detail.

Figure 31:
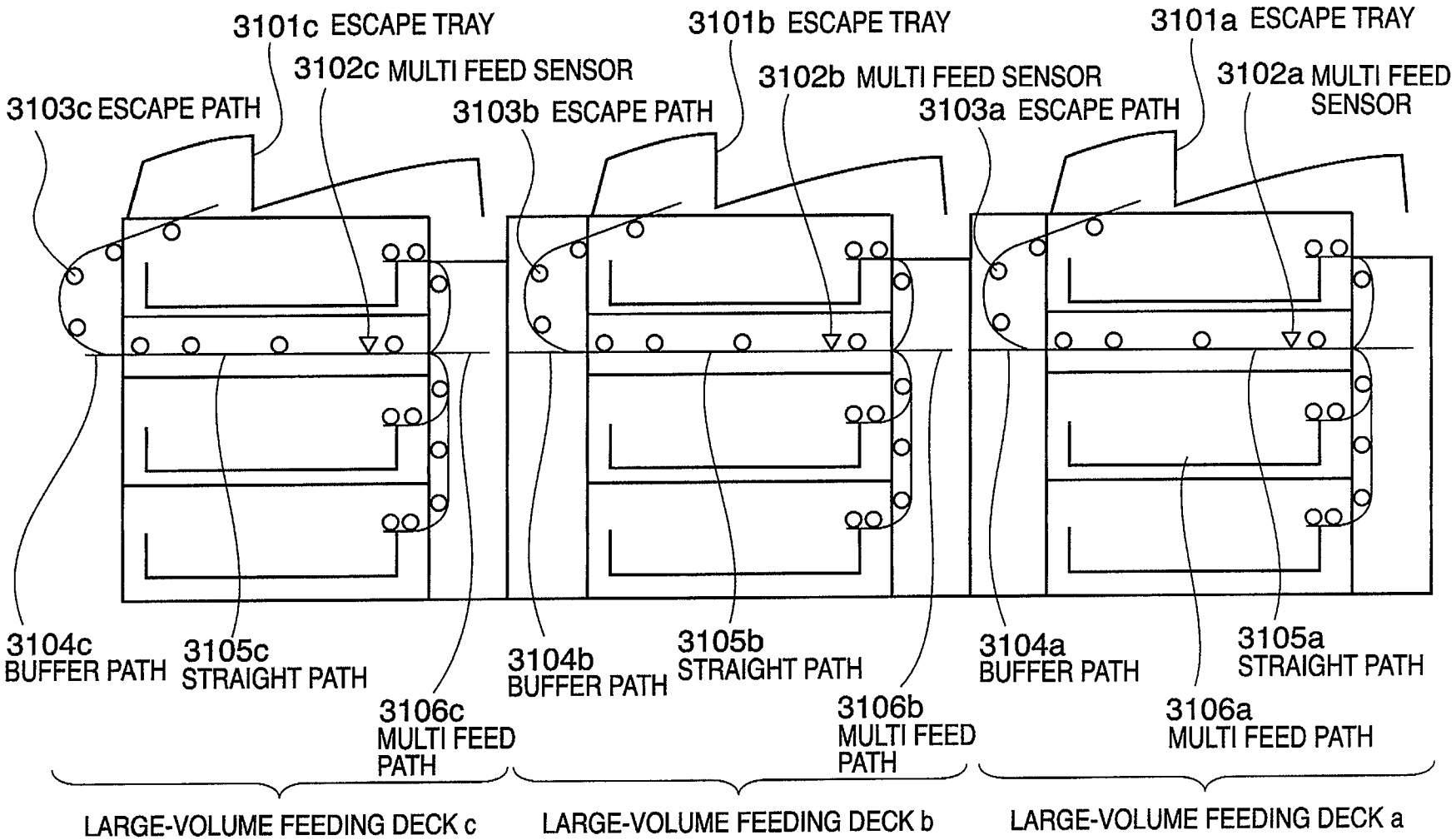
FIG. 31 is a sectional view of the internal structure of a feeding apparatus connected to the printing apparatus 100 in the first embodiment of the present invention.

In FIG. 22, three large-volume feeding decks are connected in the printing system 1000. FIG. 31 is a sectional view showing the internal structures of only the feeding units. A multi feed sensor 3102*a* detects multi feed of sheets from large-volume feeding deck a. At this time, multi-fed sheets can be output to an escape tray 3101*a*, 3101*b*, or 3101*c*.

Figure 32:
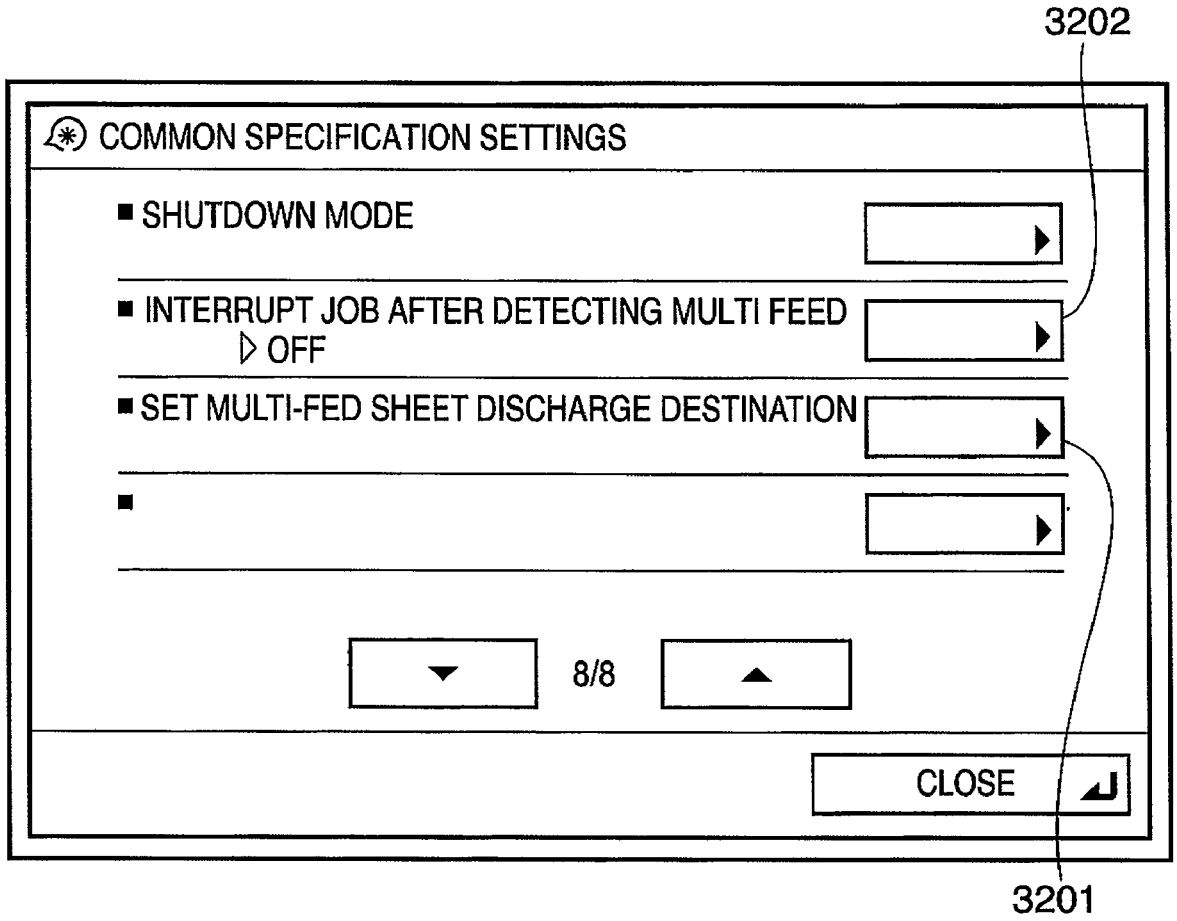
FIG. 32 is a view of a window for setting a multi-fed sheet discharge destination in the printing system 1000 to be controlled in the first embodiment of the present invention.
Figure 33:
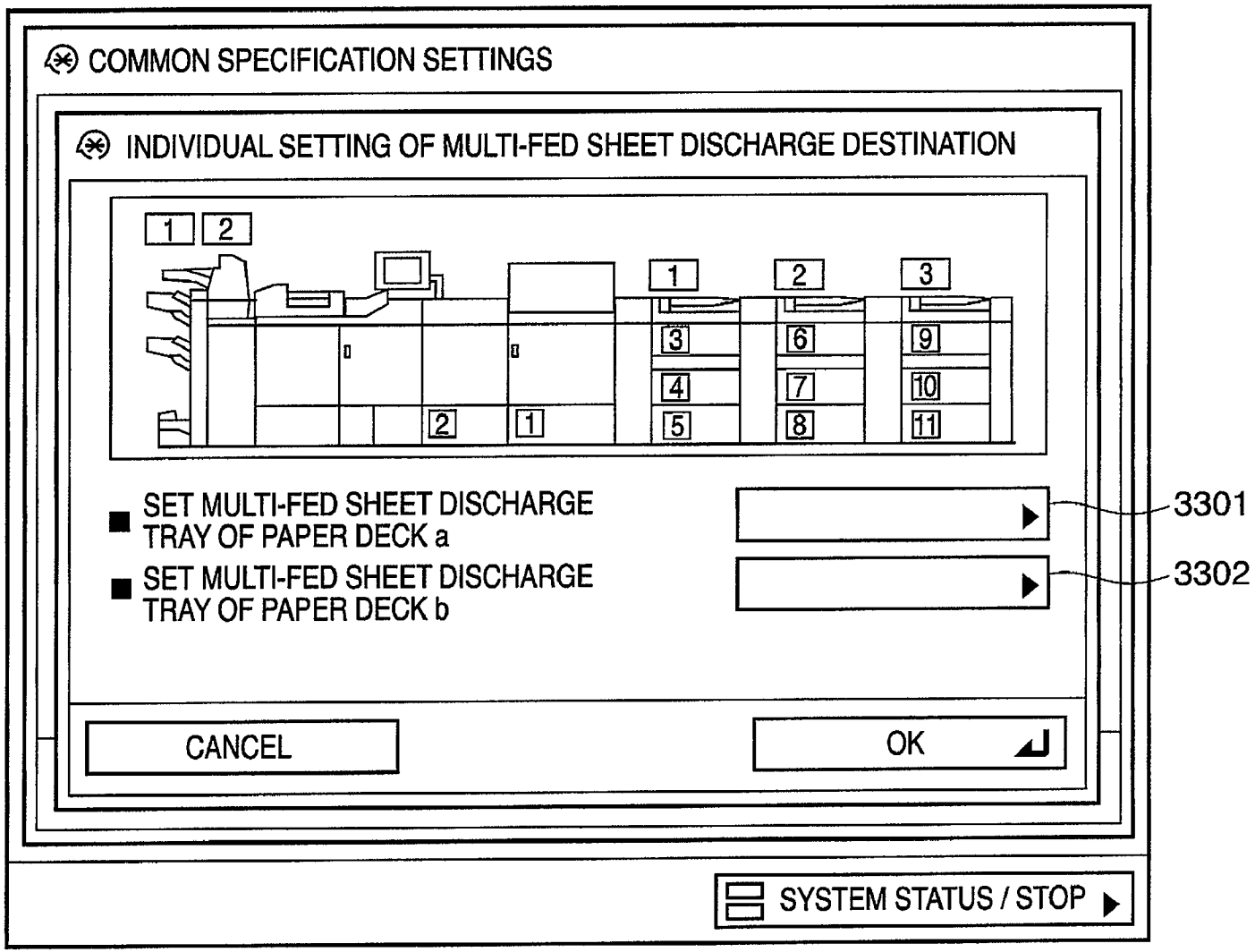
FIG. 33 is a view of a window for setting a multi-fed sheet discharge destination for each feeding apparatus in the printing system 1000 to be controlled in the first embodiment of the present invention.

Setting of the multi-fed sheet discharge destination starts by operating a key 3201 in FIG. 32. Upon operating the key 3201, a window (FIG. 33) appears to select which of large-volume feeding decks a and b is set as a delivery destination. Since large-volume feeding deck c does not have a dischargeable escape tray other than the escape tray 3101*c* in FIG. 31, it cannot be set as the delivery destination. By operating a key 3301, a window (FIG. 34) appears to select which of escape trays is set as the discharge tray. Any of the escape trays 3101*c*, 3101*b*, and 3101*a* is determined as the discharge tray by selecting one, two, or all of tray 1 (key 3401), tray 2 (key 3402), and tray 3 (key 3403).

In the subsequent description, tray 1 represents the escape tray 3101*c* in FIG. 31, tray 2 represents the escape tray 3101*b*, and tray 3 represents the escape tray 3101*a*. As a result of operating the key 3401, 3402, or 3403, the key of a tray selected as a multi-fed sheet discharge tray is displayed in color and explicitly represented as a discharge tray. Information on a selected escape tray is stored in the RAM 208 or HDD 209 via the controller 205.

Figure 35:
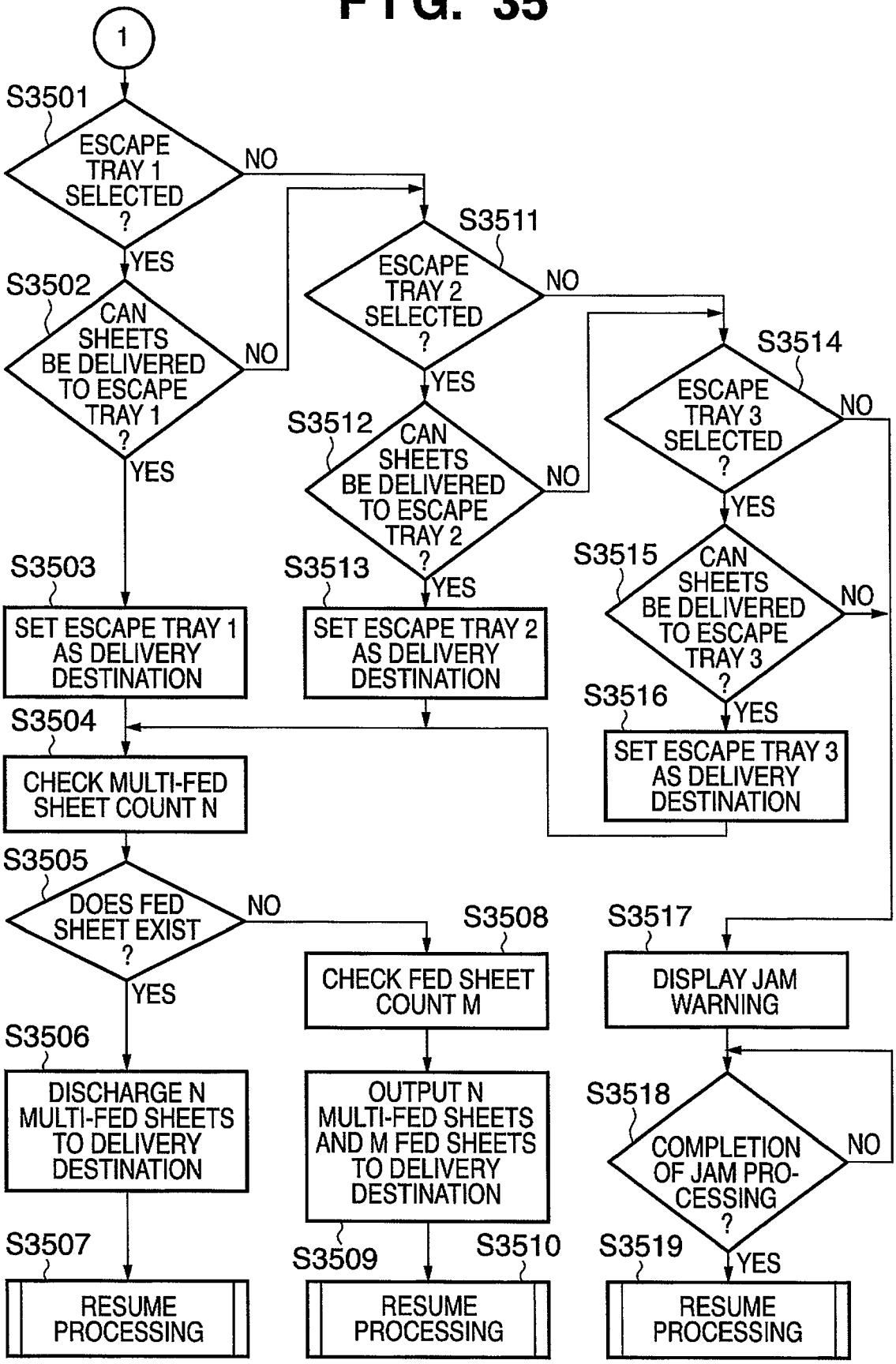
FIG. 35 is a flowchart of a multi-fed sheet discharge control example upon occurrence of multi feed in the printing system 1000 to be controlled in the first embodiment of the present invention.

Control to discharge multi-fed sheets serving as multi-fed print media will be described with reference to the flowchart of FIG. 35. After multi feed is detected in S2604 in job execution control of FIG. 26, the process in FIG. 35 is executed. In S3501, information in the RAM 208 or HDD 209 is read out to determine whether the user has selected the key 3401 representing the escape tray 3101*c*. If the user has selected the key 3401, it is determined in S3502 whether sheets can be delivered to escape tray 1. If sheets can be delivered to escape tray 1, information representing that escape tray 1 is set as the delivery destination is stored in the RAM 208 in S3503. If it is determined in S3501 that the user has not selected escape tray 1 as the discharge destination or it is determined in S3502 that no sheet can be delivered to escape tray 1, the process proceeds to S3511 to determine whether the user has selected the key 3402 and set escape tray 2 as the delivery destination. In S3512, it is similarly determined whether sheets can be delivered to escape tray 2.

If it is determined in S3511 that the user has selected the key 3402 and it is determined in S3512 that sheets can be delivered to escape tray 2, information representing that escape tray 2 is set as the delivery destination is stored in the RAM 208 (S3513). If it is determined in S3511 and S3512 that no sheet can be delivered to escape tray 2, the process proceeds to S3514. In S3514, it is determined whether the user has selected the key 3403 corresponding to escape tray 3. If the user has selected the key 3403, the process proceeds to step S3515. In S3515, it is similarly determined whether sheets can be delivered to escape tray 3. If sheets can be output, escape tray 3 is set as the delivery destination in S3516, and the information is stored in the RAM 208. If no sheet can be delivered to any tray, the job stops in S3517, it is determined that a jam has occurred, and the operation unit displays a warning to prompt the user to remove all sheets from the feeding unit. If it is detected in S3518 that the user has removed all sheets from the feeding unit, job resume processing is done in S3519.

If any escape tray is set as the output destination in S3503, S3513, or S3516, multi-fed sheet count determination processing is performed in S3504. In S3505, it is determined whether a fed sheet exists. If no fed sheet exists, delivery destination information stored in the RAM is acquired, multi-fed sheets are delivered to the determined delivery destination, and job resume processing is performed in S3507. If it is determined in S3505 that a fed sheet exists, a fed sheet count M is determined in S3508. N multi-fed sheets and M fed sheets are discharged at once in accordance with the delivery destination information stored in the RAM (S3509). In S3510, resume processing is done. Determination of the multi-fed sheet count, determination of the fed sheet count, and the contents of recovery processing are the same as those described above, and a description thereof will not be repeated.

As described above, according to the first embodiment, the printing system 1000 can cope with problems described in Description of the Related Art. The printing system 1000 can also build a user-friendly, convenient printing environment suited not only to the office environment but also to the POD environment. The printing system 1000 can meet needs on site in the printing environment such as the POD environment, including a need to operate the system at productivity as high as possible, and a need to reduce the workload on an operator as much as possible. More specifically, a plurality of escape trays can be selected as multi-fed sheet discharge destinations upon occurrence of multi feed in the feeding apparatus, improving the printing continuity of the system.

Second Embodiment

Figure 37:
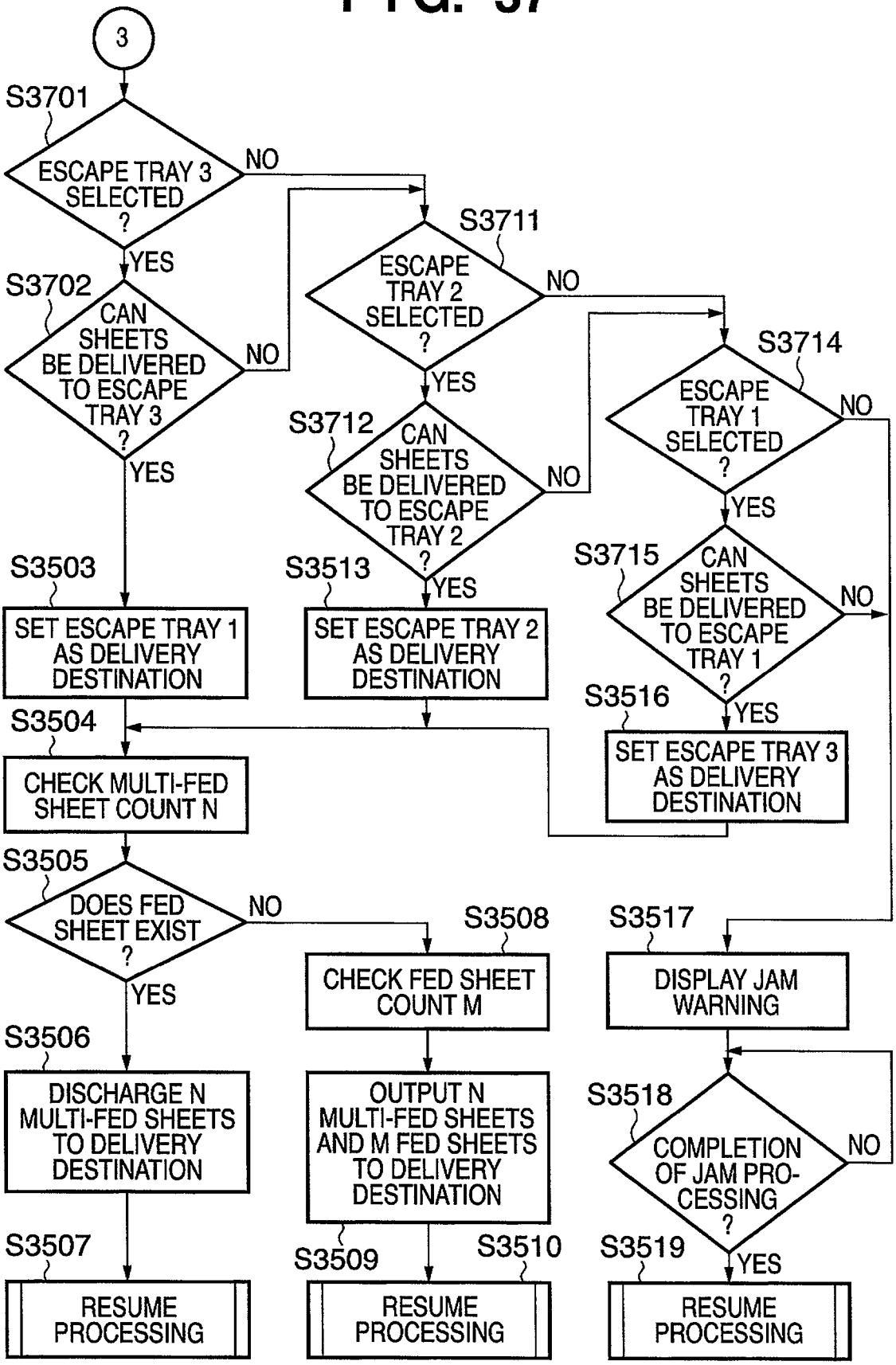
FIG. 37 is a flowchart of a multi-fed sheet discharge control example upon occurrence of multi feed in the printing system 1000 to be controlled in the second embodiment of the present invention.
Figure 38:
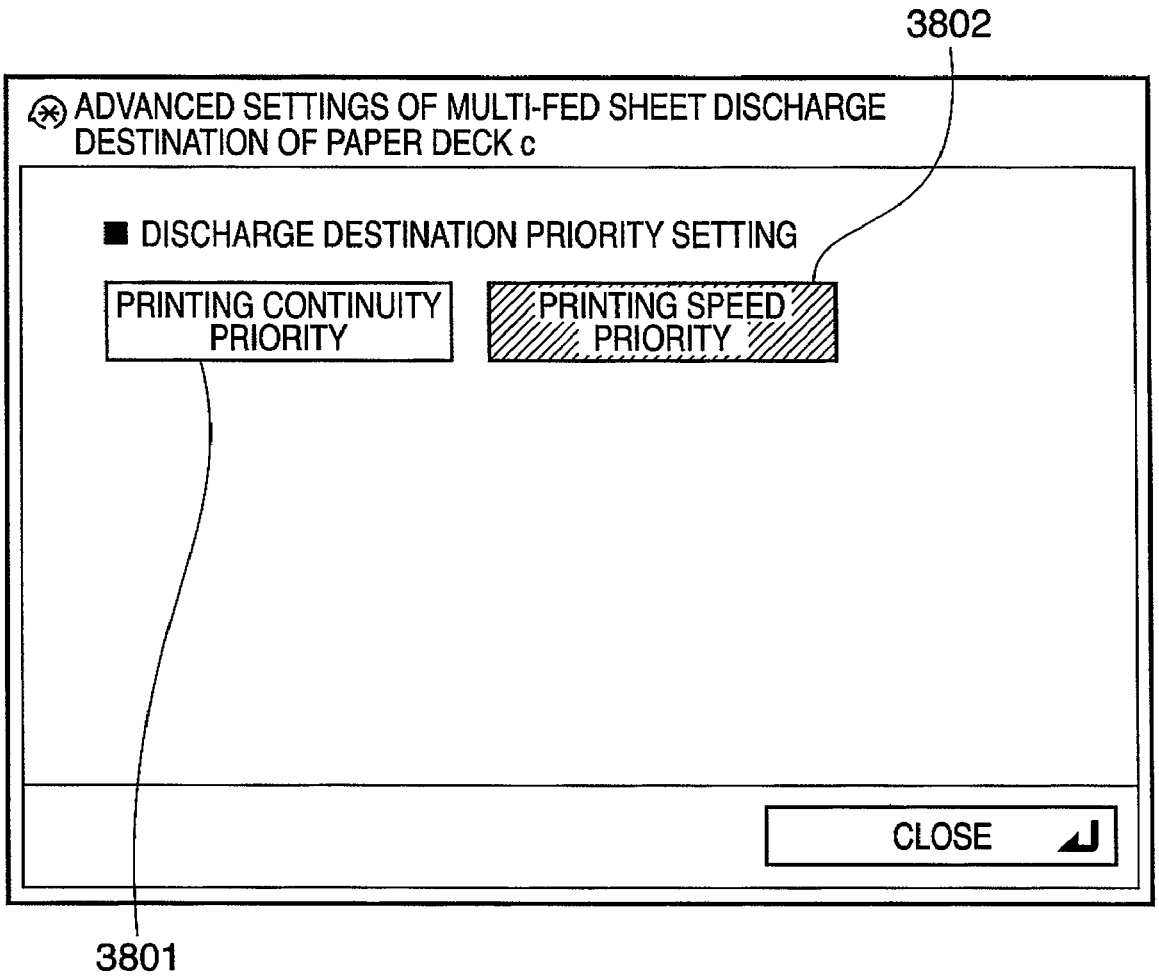
FIG. 38 is a view showing an example of a display window on a UI unit to be controlled in the second embodiment of the present invention.

Control of a printing system 1000 according to the second embodiment of the present invention will be described in detail with reference to FIGS. 36 to 38. According to the flowchart of FIG. 35 described in the first embodiment, the discharge destination of multi-fed sheets detected in large-volume feeding deck a is searched in the feeding tray selection order of escape tray 1→escape tray 2→escape tray 3. In the first embodiment, an escape tray (large-volume feeding deck c) closest to the printing apparatus among trays selected as discharge destination candidates in FIG. 34 is preferentially used. This is based on the assumption that the printing continuity becomes the highest when sheets are fed from only large-volume feeding deck a. However, control based on this sequence raises the probability that the escape tray 3101*c* of large-volume feeding deck c becomes full of sheets. If a job requiring sheets fed from large-volume feeding deck c is input while the escape tray 3101*c* is full, the probability that the job stops rises owing to an escape tray full state. According to the control in FIG. 35, the sheet feeding path until multi-fed sheets are output to the escape tray becomes long.

According to the second embodiment, escape trays are searched and selected in the ascending order of the sheet feeding path length in order to shorten the sheet feeding path and further increase productivity. The remaining configuration and operation are the same as those in the first embodiment, and a description thereof will not be repeated.

Figure 36:
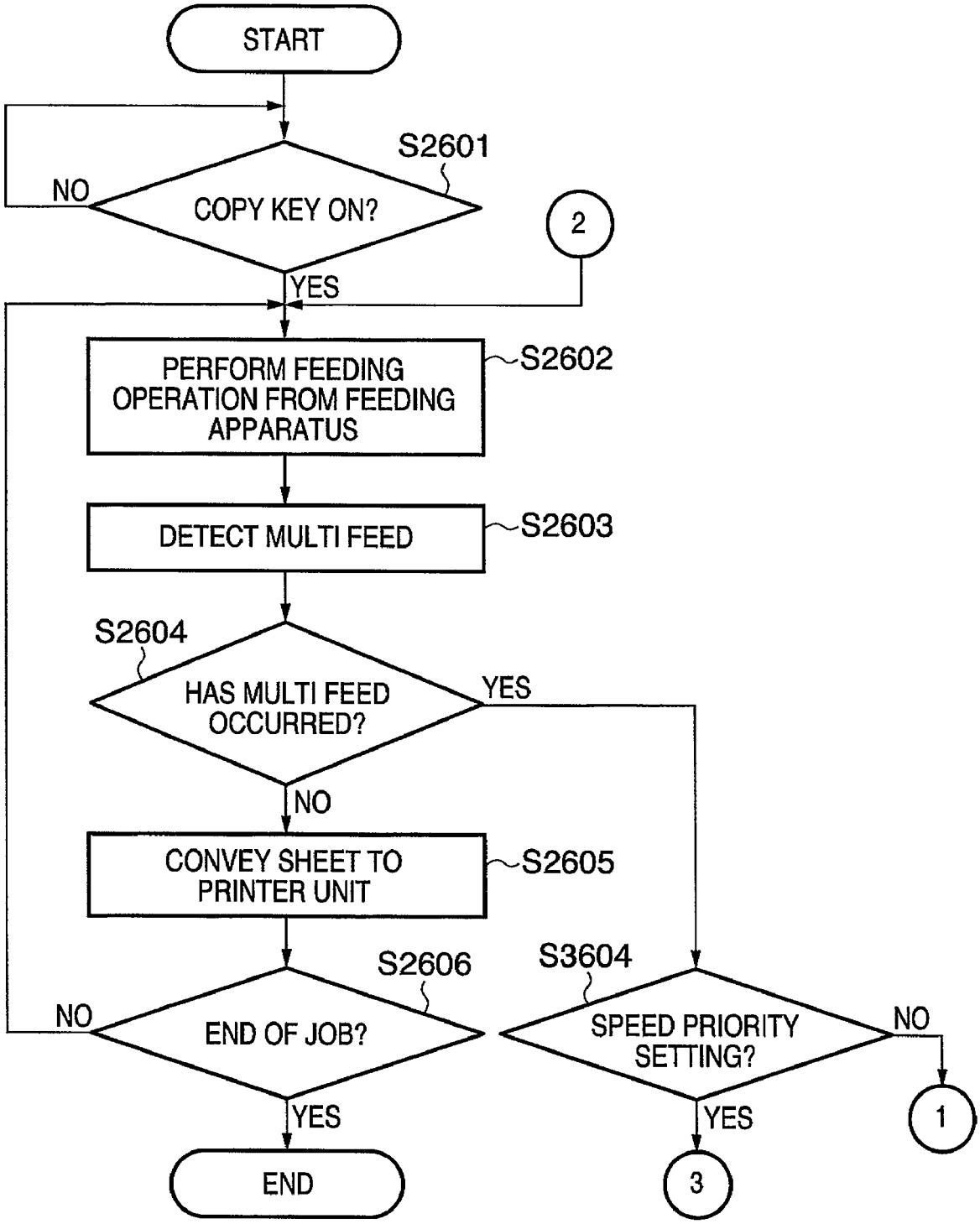
FIG. 36 is a flowchart of a control example when executing a copy job in a printing system 1000 to be controlled in the second embodiment of the present invention.

FIG. 36 is a flowchart when executing a copy job. The flowchart in FIG. 36 is basically the same as that in FIG. 26. The same reference numerals denote the same processes, and a description thereof will not be repeated.

After multi feed occurs, it is checked in S3604 whether a speed priority setting exists. If the user has selected a key 3404 in a multi-fed sheet discharge destination setup window (FIG. 34), an operation unit 204 displays a window in FIG. 38. In this window, the user selects either a key 3801 or 3802. The default is a printing continuity priority setting, and the color of the key 3801 is changed so that the user can recognize the selected setting. If the user has selected the key 3802, the setting changes to the printing speed priority setting, and the setting is stored in a RAM 208 or HDD 209. The keys 3801 and 3802 can be exclusively operated. If the user operates one key, he cannot operate the other key. Information representing which of the keys 3801 and 3802 has been operated and which of the settings has been selected is stored in the RAM 208 or HDD 209. A controller 205 functions as a multi feed discharge destination setting means for causing the operation unit 204 to display a multi-fed sheet discharge destination setup window as shown in FIG. 34, and storing the setting contents in the RAM 208 or HDD 209.

In step S3604, the information is read out from the RAM 208 or HDD 209. If the information represents the printing continuity priority setting, the process proceeds to S3501 in FIG. 35. The control sequence in FIG. 35 has already been explained in the first embodiment, and a description thereof will not be repeated. If the printing speed priority setting has been made, the process proceeds from S3604 to S3701 in FIG. 37. The basic sequence of the flowchart in FIG. 37 is also the same as that in FIG. 35. The same reference numerals denote the same processes, and a description thereof will not be repeated. In S3701, S3711, and S3714, the sheet discharge destination detection order is escape tray 3→escape tray 2→escape tray 1, which is different from that for the printing continuity priority setting.

By changing the tray priority selection order at the speed priority setting as a configuration capable of speed priority setting, a more user-friendly printing system can be provided. The multi-fed sheet discharge destination can be set to shorten the feeding path of multi-fed sheets. The time taken till recovery processing can be shortened, and the productivity of the printing system can increase.

Third Embodiment

Control of a printing system 1000 according to the third embodiment of the present invention will be described in detail with reference to FIGS. 39 to 42. The configuration and basic control of the printing system 1000 and the like are the same as those in the first embodiment, and only a difference will be described.

Figure 39:
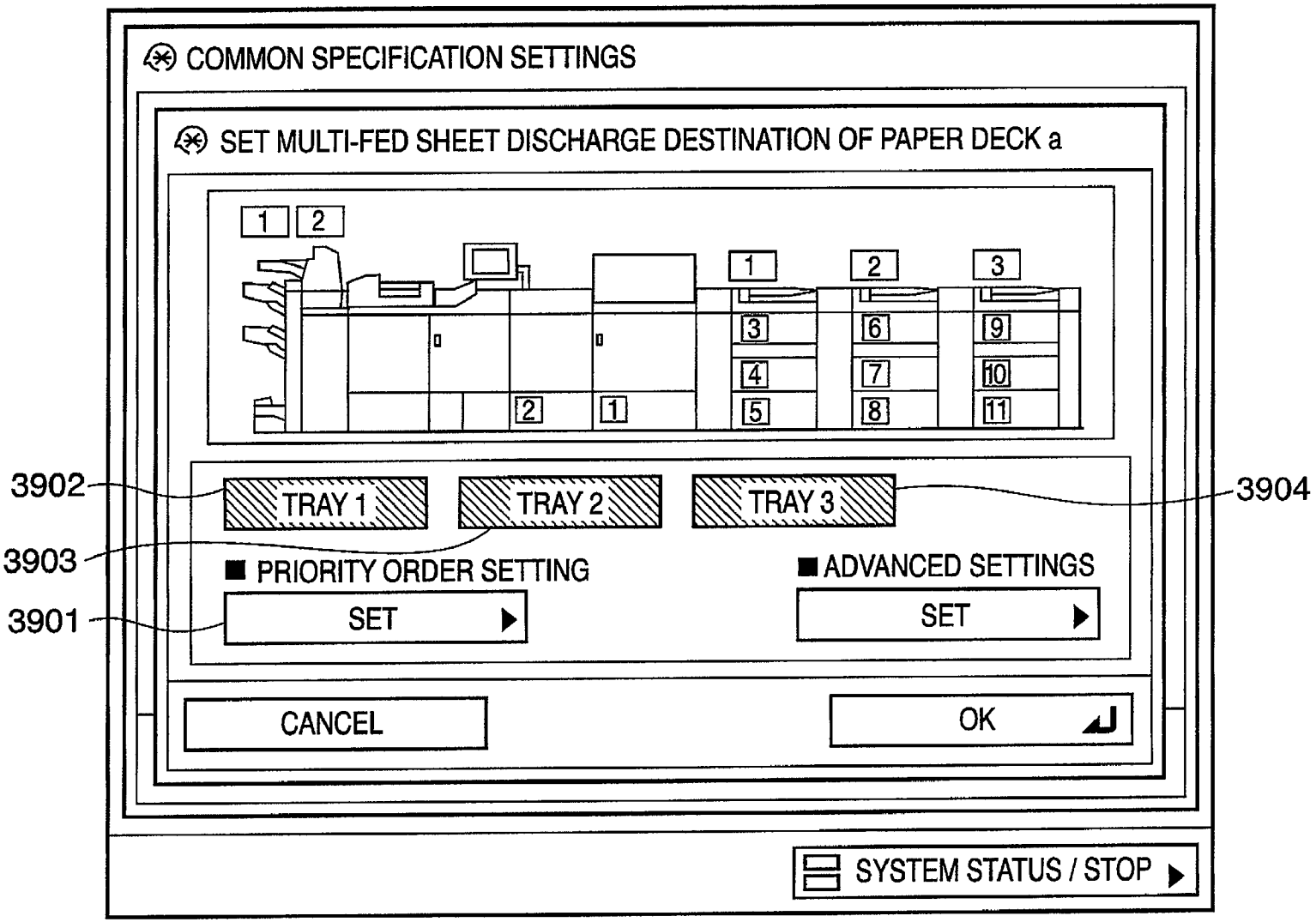
FIG. 39 is a view showing an example of a display window on a UI unit to be controlled in the third embodiment of the present invention.

Similar to the above-mentioned operation, the search order is set by operating a key 3201 shown in FIG. 32 based on a user setting with a key on an operation unit 204. An operation from the discharge destination setting of each feeding deck is different. In the third embodiment, unlike the above-described embodiments, the operation unit 204 displays the window as shown in FIG. 39 after the user operates a key 3301. After displaying the window, the user determines a multi-fed sheet discharge tray by operating one of keys 3902, 3903, and 3904. In this operation, the user can select one or a plurality of trays. The key of a tray serving as a sheet discharge destination is explicitly displayed in a different color. Information on the number of trays serving as multi-fed sheet discharge destinations as a result of operating the keys 3902, 3903, and 3904 is stored in a RAM 208 or HDD 209. If the user operates a key 3901 after selecting the discharge tray, the operation unit 204 displays a search order setup window (FIG. 40).

Figure 40:
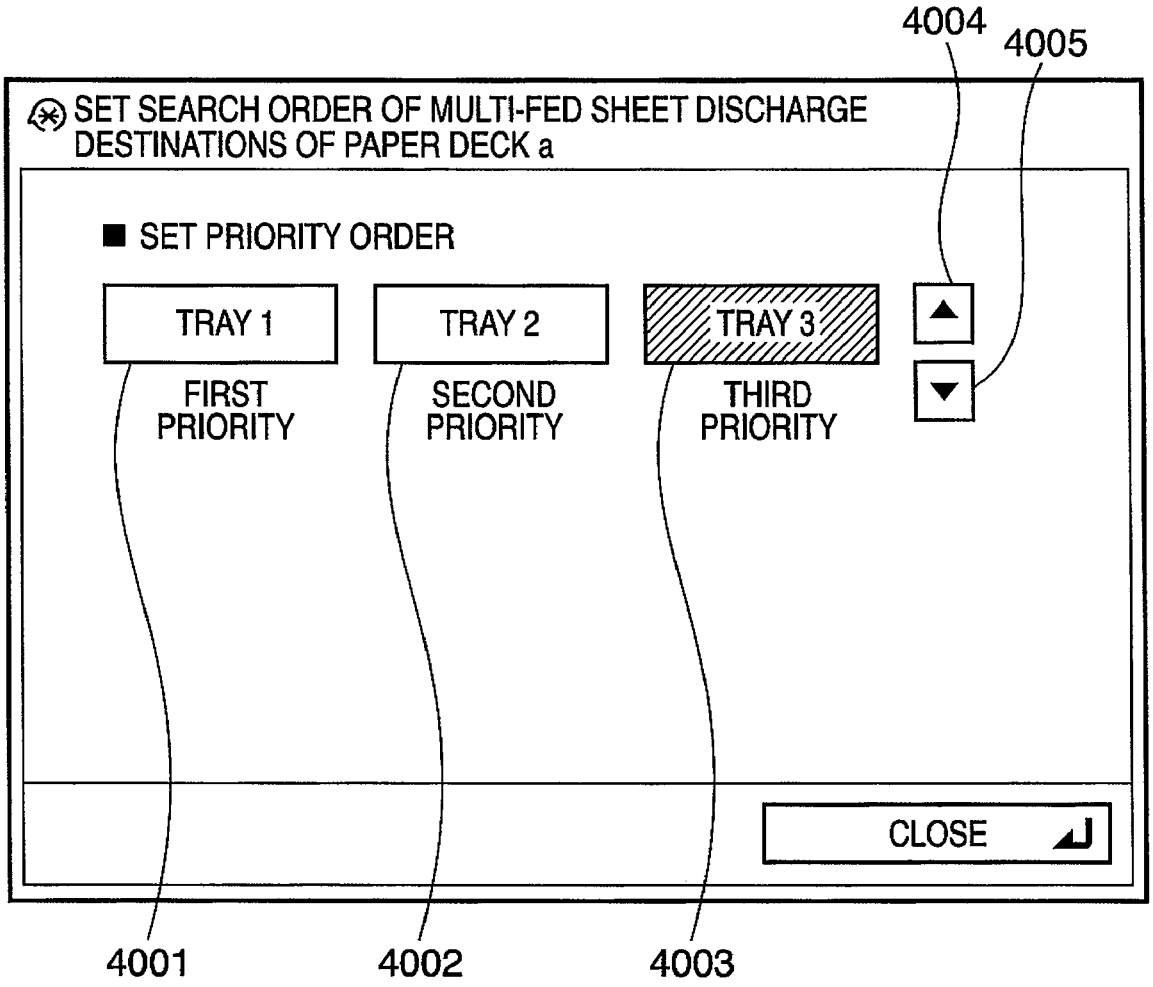
FIG. 40 is a view showing an example of a display window on the UI unit to be controlled in the third embodiment of the present invention.
Figure 41:
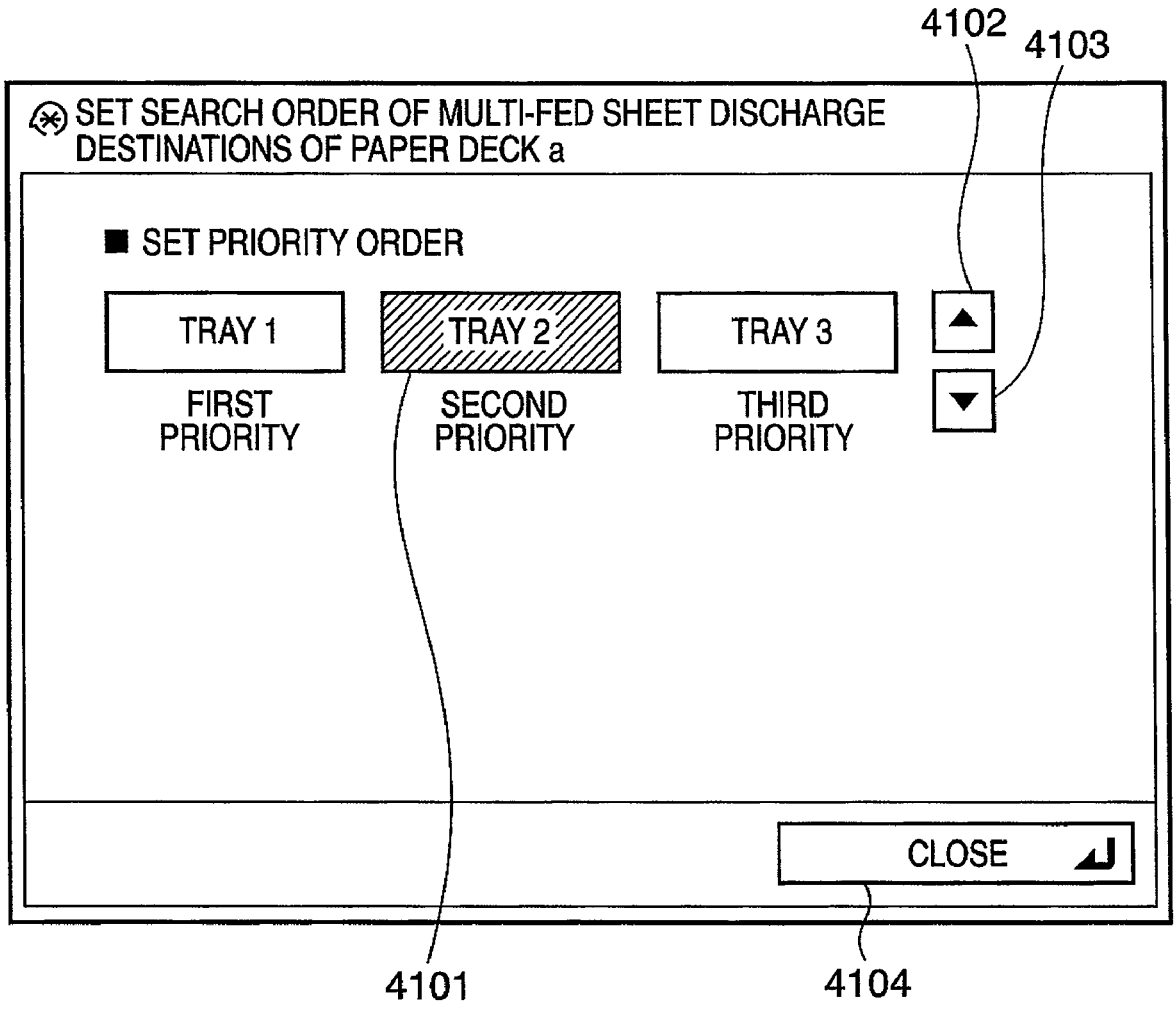
FIG. 41 is a view showing an example of a display window on the UI unit to be controlled in the third embodiment of the present invention.
Figure 42:
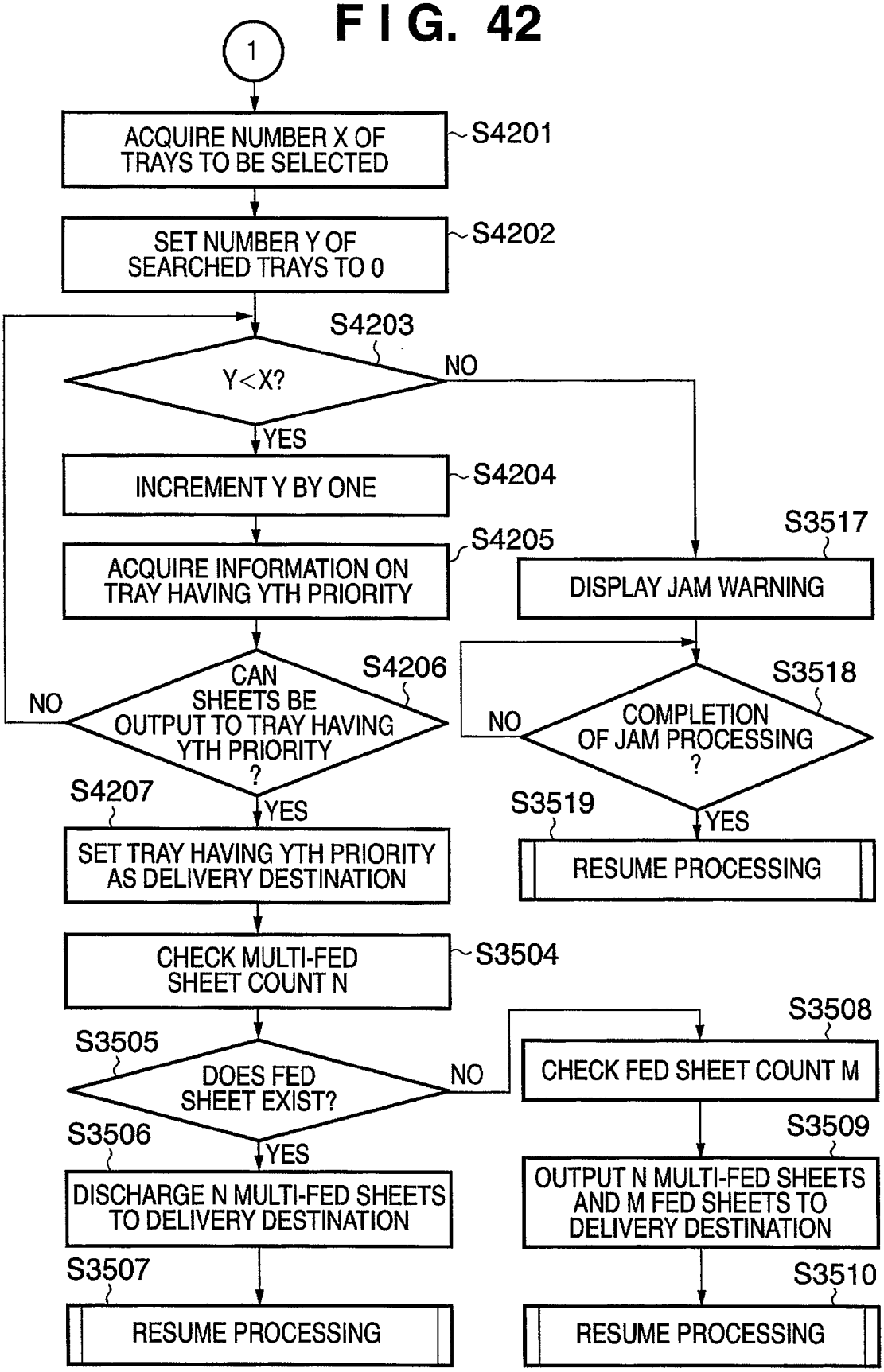
FIG. 42 is a flowchart of a multi-fed sheet discharge control example upon occurrence of multi feed in a printing system 1000 to be controlled in the third embodiment of the present invention.

Although the window in FIG. 40 presents three keys for trays 1, 2, and 3, the key display changes depending on which of the keys 3902, 3903, and 3904 has been operated. Assume that the user selects all the keys 3902, 3903, and 3904. The keys are displayed in an order complying with corresponding to priorities set as initial values according to a specific rule. The display order complies with the delivery order at the above-described printing continuity priority setting. However, the keys may also be displayed in accordance with the printing speed priority setting or in an order in which target escape trays are selected. The search priority of tray 3 can be increased by selecting a key 4003 to select the tray whose priority is to be changed, and then selecting a key 4004. A key 4005 cannot be selected because the priority of tray 3 is the lowest at the moment. As a result of selecting the key 4004, the operation unit 204 displays a window in FIG. 41. The priority of tray 3 becomes the highest by selecting a key 4101 and then a key 4102. The search priority order of trays 3, 1, and 2 is determined. By selecting a key 4104, the setting of the search priority order ends, and information on the tray search priority order is stored in the RAM 208 or HDD 209. When only two of the keys 3902, 3903, and 3904 are selected in FIG. 39, the window in FIG. 40 shows only the two selected buttons, and the priority order of two corresponding trays is determined. When only one of the keys 3902, 3903, and 3904 is selected in FIG. 39, the key 3901 cannot be selected, and the window in FIG. 40 is not displayed.

Figure 26:
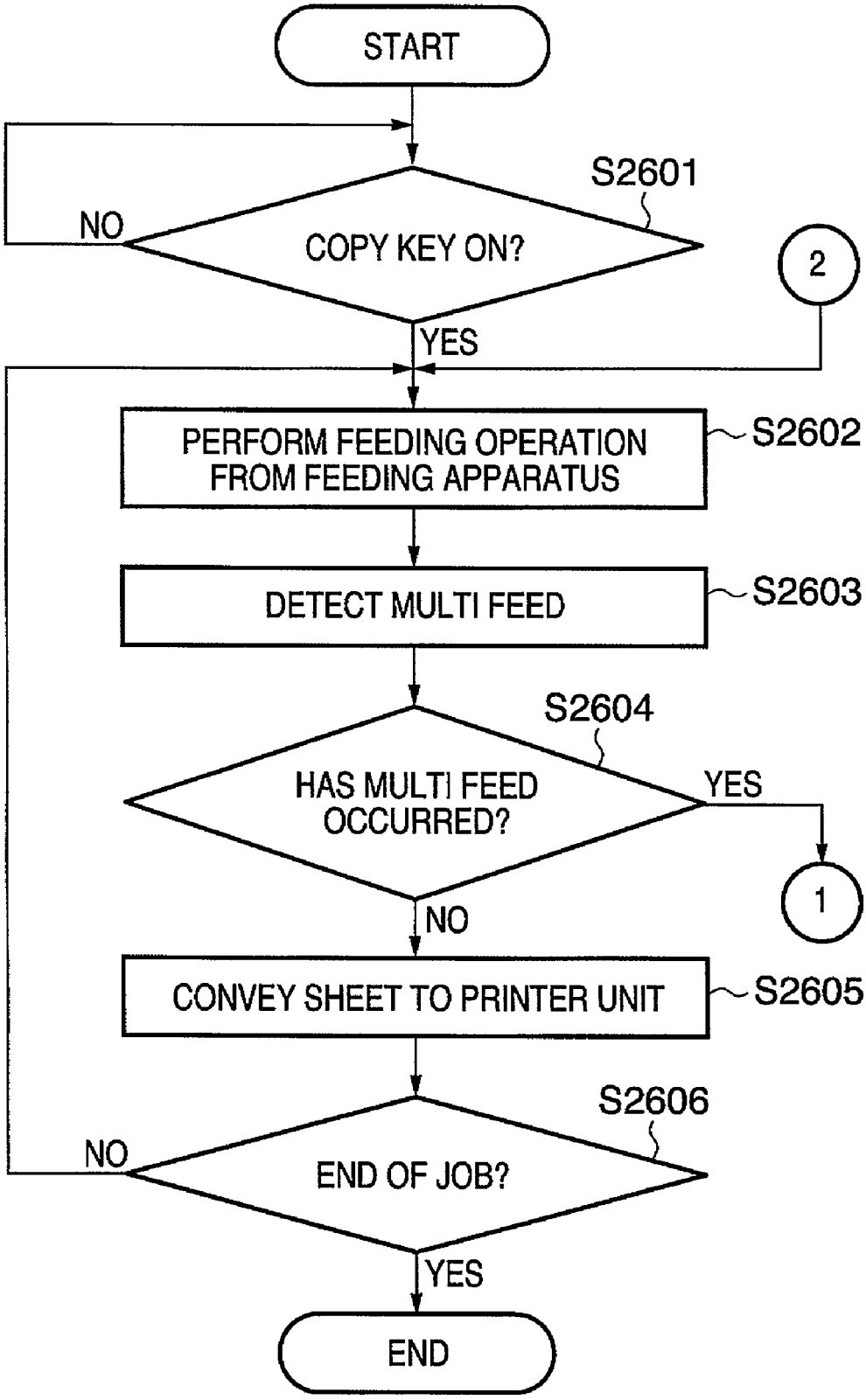
FIG. 26 is a flowchart showing a control example of the printing system 1000 to be controlled in the first embodiment of the present invention.

Job execution control complies with the flowchart in FIG. 26 except for processing after detecting multi feed. Multi-fed sheet discharge control after detecting multi feed will be described with reference to the flowchart of FIG. 42. After detecting multi feed, information on trays serving as discharge destinations is read out from the RAM 208 or HDD 209. The maximum number of discharge destinations to which multi-fed sheets can be output is determined, and stored as X in the RAM (S4201). The number of searched trays is stored as Y in the RAM (S4202). In S4203, the number X of trays to be searched is compared with the number Y of searched trays. If $X \leqq Y$, the search ends. Since all escape trays selected as sheet discharge destinations cannot be used, the operation unit 204 displays a jam warning in S4212. The operation after the jam warning is the same as the above-described one, and a description thereof will not be repeated.

If $X>Y$, the Y value is incremented by one to count up the number of searched trays (S4204). In S4205, information on a tray having the Yth priority is acquired by referring to the priority order setting stored in the RAM 208 or HDD 209 after selecting the key 4104. In S4206, it is determined whether sheets can be output to the escape tray having the Yth priority. If it is determined that no sheet can be output to the escape tray having the Yth priority, the process returns to S4203 to sequentially decrease the priority order and search for a tray. This process is repeated until an escape tray capable of accepting sheets is detected or the number of searched trays becomes equal to the number of trays serving as sheet discharge destinations. If an escape tray capable of accepting sheets is detected, the process proceeds to S4208. The subsequent process is the same as the process in the flowchart of FIG. 35, and a description thereof will not be repeated.

According to the third embodiment, a delivery destination can be determined by prioritizing delivery trays. That is, the priority order of escape trays serving as discharge destinations can be set, and sheets can be discharged to destination destinations in accordance with the priority order. In other words, a plurality of escape trays can be selected as output destinations upon occurrence of multi feed in the feeding apparatus. The selection order of output escape trays can be determined in accordance with the priority order.

Fourth Embodiment

Control of a printing system 1000 according to the fourth embodiment of the present invention will be described in detail with reference to FIGS. 43 to 47. The configuration and basic control of the printing system 1000 and the like are the same as those in the first embodiment, and only a difference will be described.

Figure 43:
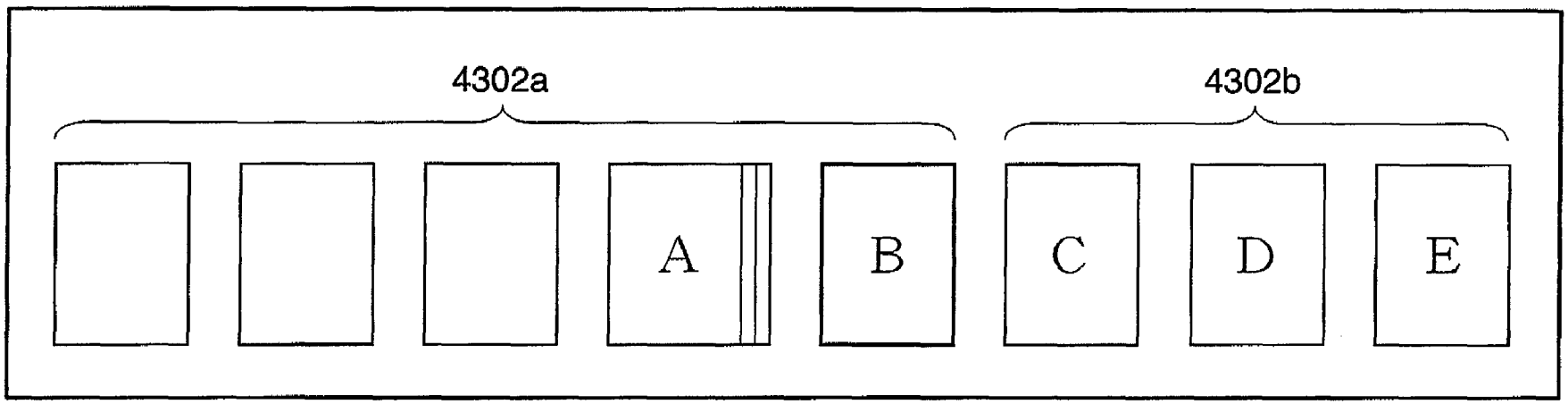
FIG. 43 is a view showing sheets on the feeding path in a printing system 1000 to be controlled in the fourth embodiment of the present invention.
Figure 44:
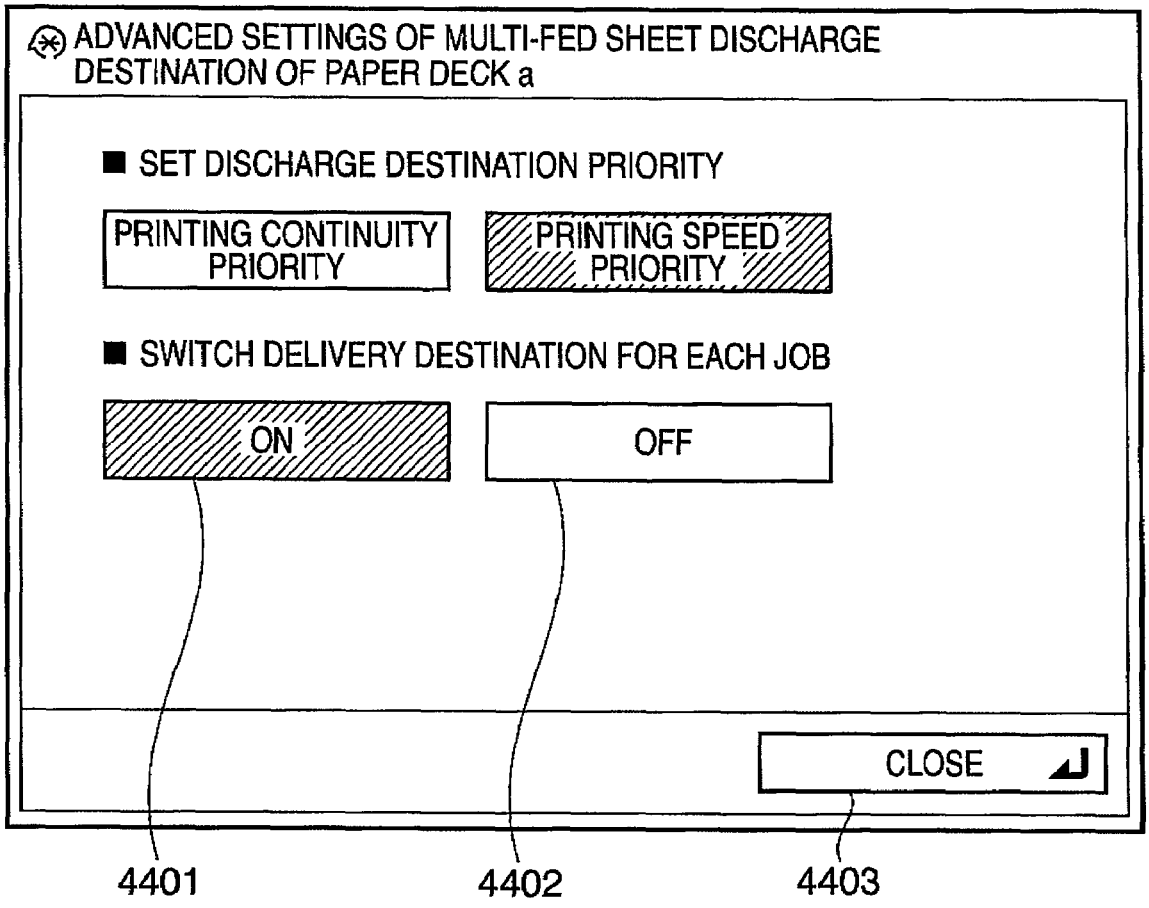
FIG. 44 is a view showing an example of a display window on a UI unit to be controlled in the fourth embodiment of the present invention.

In an environment where a plurality of jobs can be input, print jobs 1 and 2 may use the same feeding apparatus. In this environment, if multi feed is detected in the feeding apparatus, a state as shown in FIG. 43 may occur in the feeding apparatus. Sheets 4302*a* are used for job 1, and sheets 4302*b* are used for job 2. In the fourth embodiments, when sheets fed in the feeding apparatus are used for a plurality of jobs, the delivery destination can be changed for each job. A case where sheets are fed from feeding deck a in FIG. 23 for print jobs 1 and 2 and multi feed of sheets for print job 1 is detected will be exemplified.

The setting to change the delivery tray for each job is made based on a user setting displayed on an operation unit 204. If the user selects a key 3404 in the window of FIG. 34 displayed on the operation unit 204, the operation unit 204 displays a window in FIG. 44. By selecting a key 4401, the setting to switch the discharge destination for each job is validated. By selecting a key 4402, the setting to switch the discharge destination for each job is invalidated. The keys 4401 and 4402 can be exclusively selected. The result of selecting the key 4401 or 4402 is stored in a RAM 208 or HDD 209. Similarly, information on a tray selected as a discharge destination as a result of operating a key 3401, 3402, or 3403 is stored in the RAM 208 or HDD 209.

Figure 45:
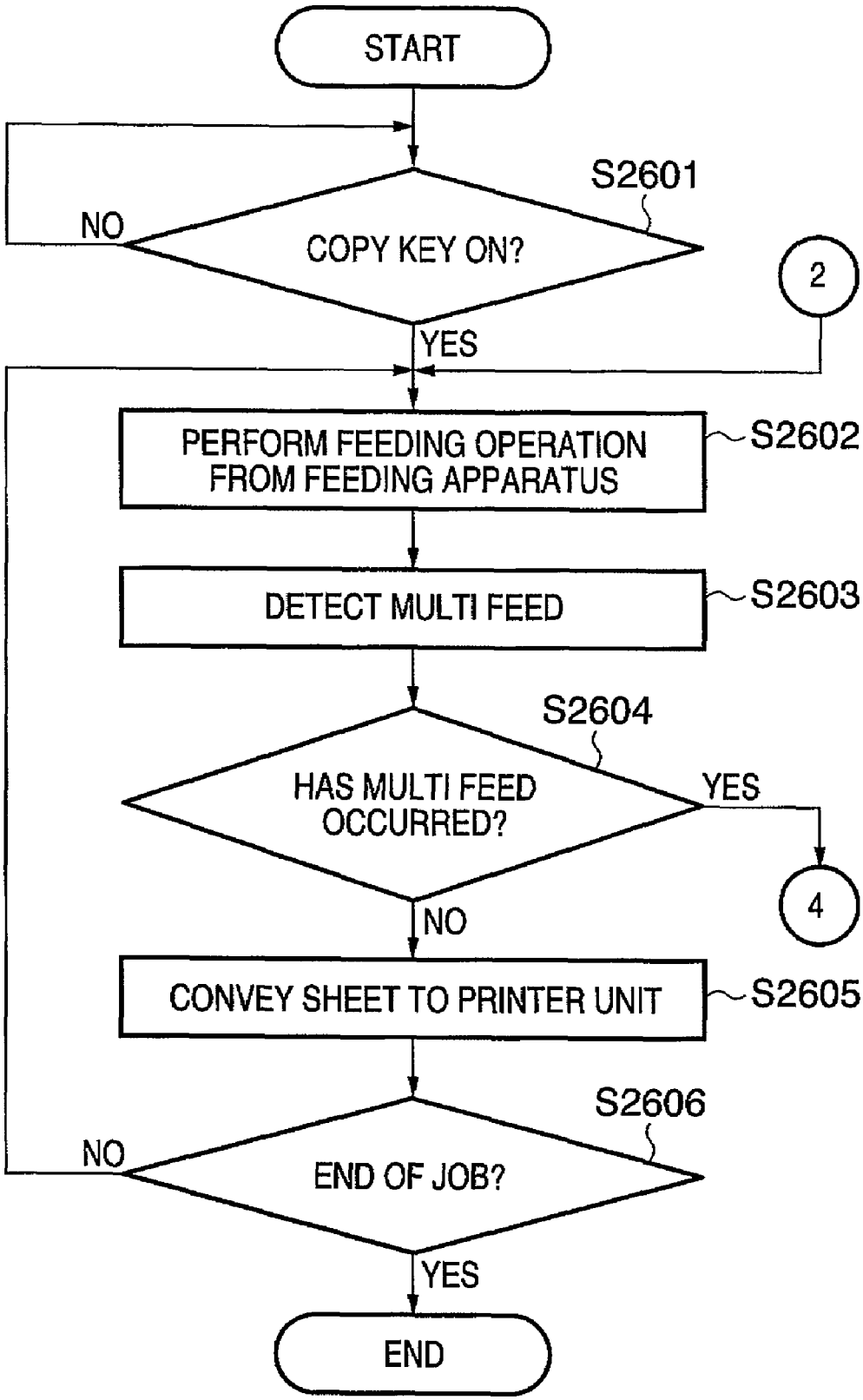
FIG. 45 is a flowchart of a control example when executing a copy job in the printing system 1000 to be controlled in the fourth embodiment of the present invention.
Figure 46:
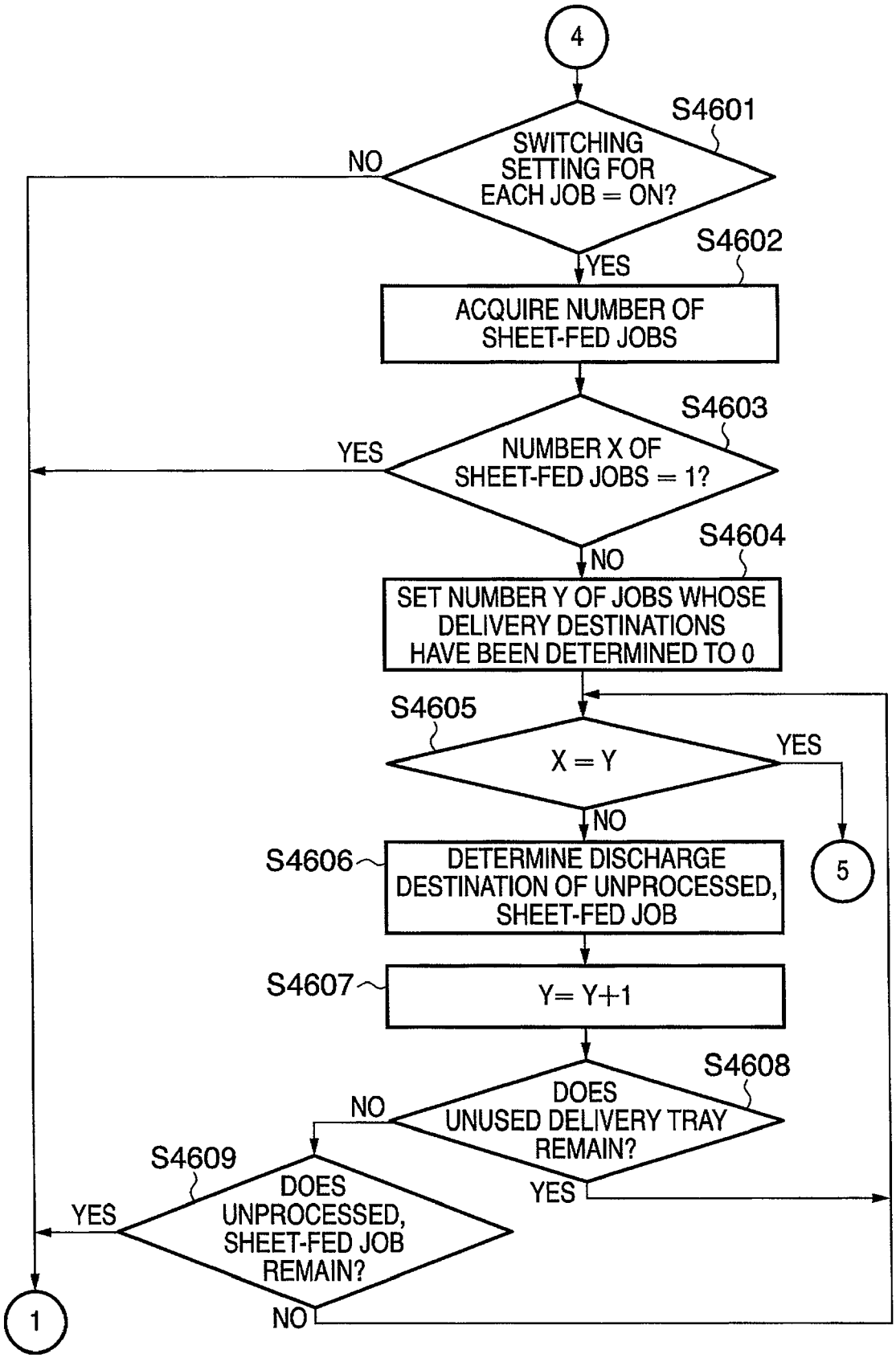
FIG. 46 is a flowchart of a multi-fed sheet discharge control example upon occurrence of multi feed in the printing system 1000 to be controlled in the fourth embodiment of the present invention.

Job execution control complies with the flowchart in FIG. 45. The basic process in FIG. 45 is the same as that in FIG. 26 except that the process proceeds to the flowchart in FIG. 46 after detecting multi feed. After detecting multi feed, information is read out from the RAM to determine whether the user has selected the key 4401 (S4601). If the user has selected the key 4401, it is determined that the setting to change the escape tray for each job is valid. If the user has not selected the key 4401 and the setting to change the tray for each job is invalid, the process proceeds to S3501 in FIG. 35 or S3701 in FIG. 37 depending on which of the printing continuity priority setting and printing speed priority setting exists. Then, normal multi-fed sheet discharge processing is executed.

If the setting to change the delivery destination for each job is valid, the number of sheet-fed jobs is acquired (S4602). Letting X be the number of sheet-fed jobs, it is determined whether $X=1$ (S4603). If $X=1$, that is, all sheets which exist now in the feeding deck and should be discharged as multi-fed sheets are fed for one job, the process proceeds to S3501 in FIG. 35 to perform normal multi-fed sheet discharge processing.

The number Y of jobs whose delivery destinations have been determined is initialized to 0 (S4604). The following process is repeated until X becomes equal to Y, that is, discharge trays to which sheets are output are determined for all sheet-fed jobs (S4605). First, information on one unprocessed, sheet-fed job is read out from the RAM, and the discharge destination of the job is set to a target tray. Then, the job is set as a processed job, the set escape tray is set as a tray used, and the information is stored in the RAM 208 (S4606). In S4607, the number Y of processed jobs is incremented by one. If an unused delivery tray remains, the process returns to S4605 to set a discharge destination for the next job (S4608). If all delivery trays are used and an unprocessed, sheet-fed job remains (S4609), the number of escape tray candidates capable of accepting sheets is smaller than the number of sheet-fed jobs. Thus, sheets cannot be output separately for each job, and normal delivery processing is done.

To continue the process, the process returns to normal delivery processing. It is also possible to output all subsequent jobs to be processed to a specific tray or stop jobs. By repeating the above-described processing, the output destinations of all sheet-fed jobs are determined. Then, the process proceeds to the flowchart of FIG. 47 to perform discharge processing.

Figure 47:
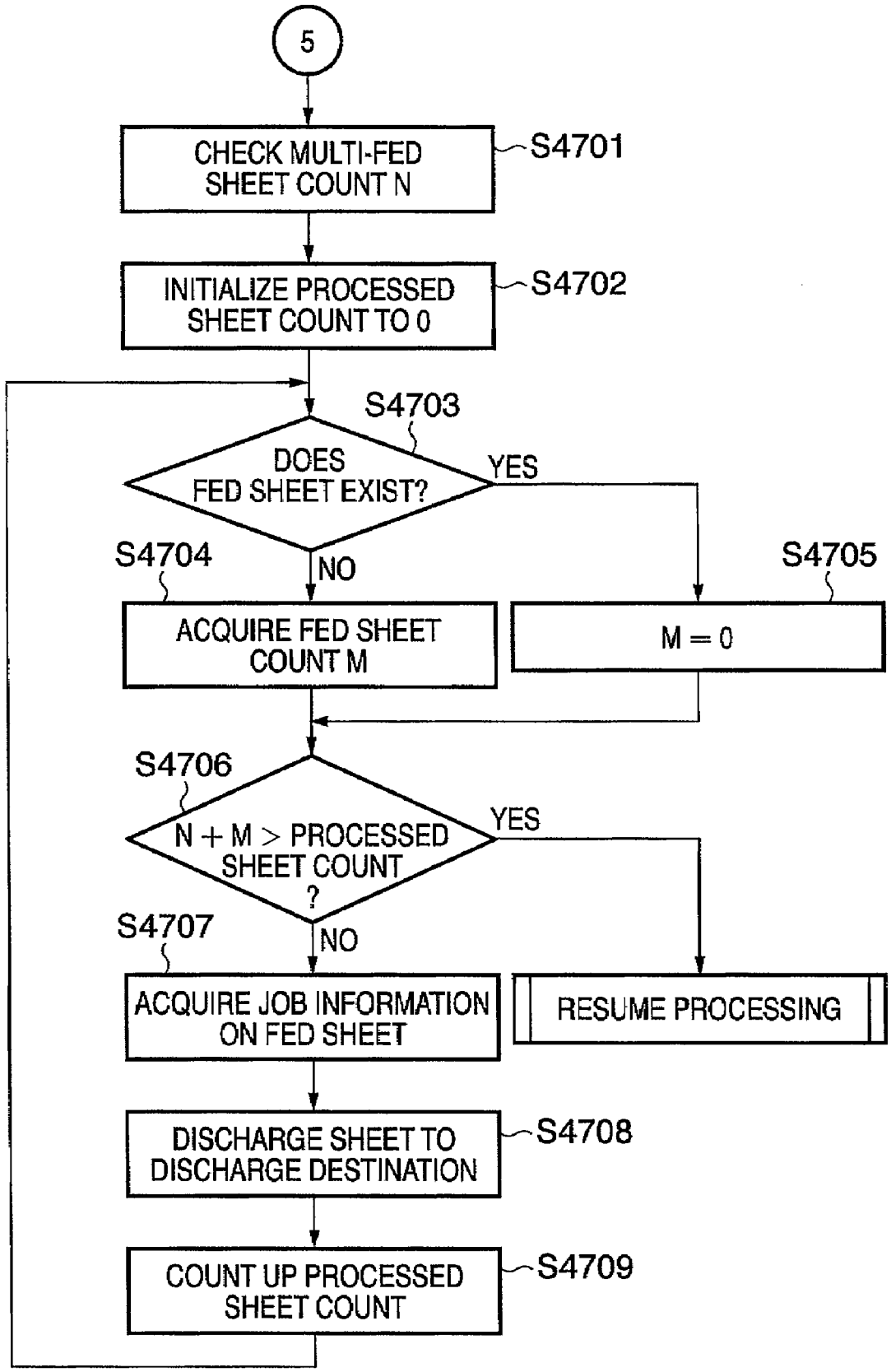
FIG. 47 is a flowchart of a multi-fed sheet discharge control example upon occurrence of multi feed in the printing system 1000 to be controlled in the fourth embodiment of the present invention.
Figure 48:
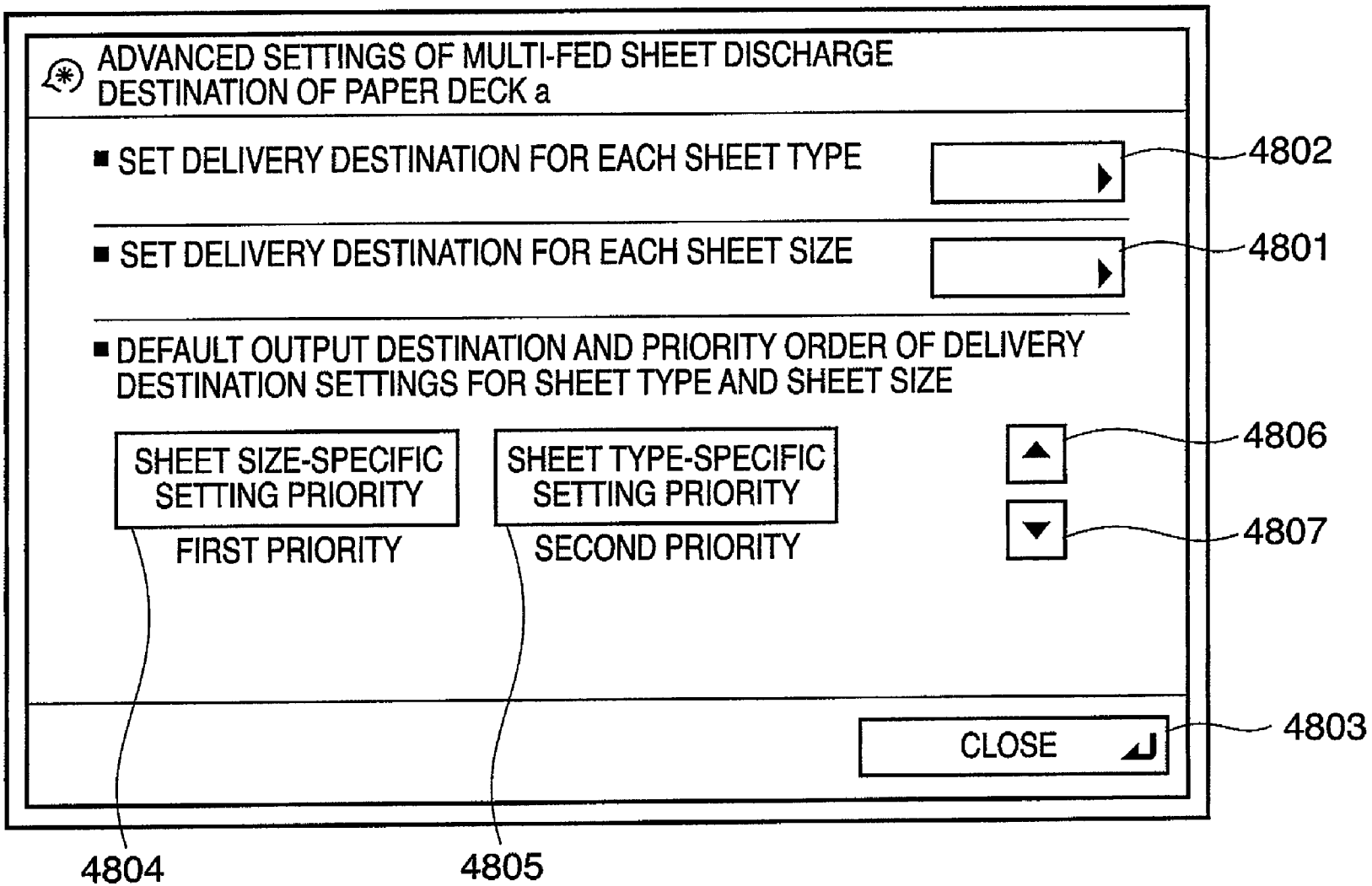
FIG. 48 is a view showing an example of a display window on a UI unit to be controlled in the fifth embodiment of the present invention.
Figure 49:
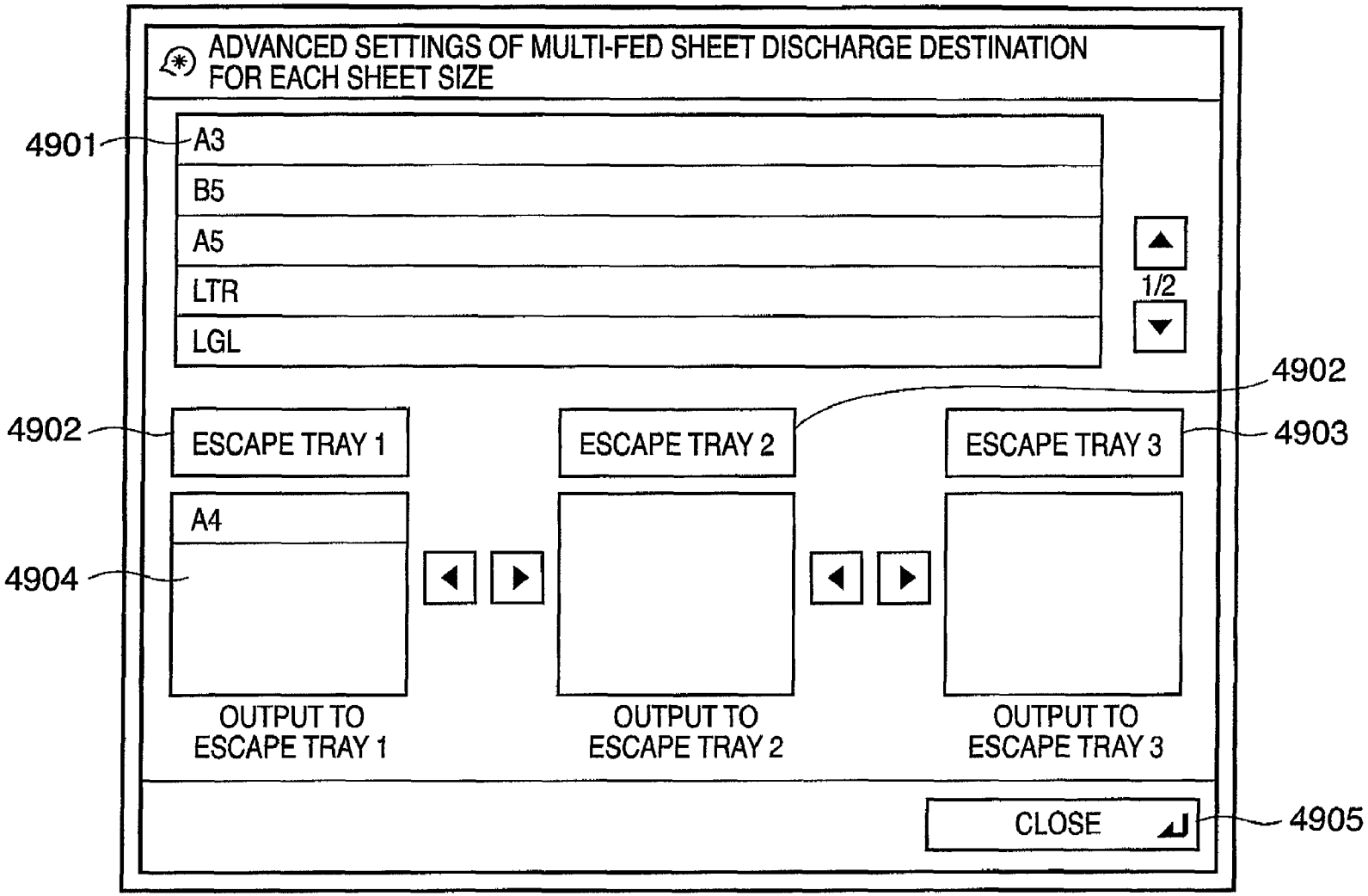
FIG. 49 is a view showing an example of a display window on the UI unit to be controlled in the fifth embodiment of the present invention.

The discharge processing will be explained with reference to FIG. 47. In S4701, the multi-fed sheet count N is acquired. In S4702, the processed sheet count is initialized to 0. It is checked whether a fed sheet exists in the feeding apparatus (S4703). If a fed sheet exists, the fed sheet count M is acquired (S4704). If no fed sheet exists, $M=0$ (S4705), and the process continues. If the processed sheet count is smaller than the multi-fed sheet count, the following process is repeated (S4706). First, job information on the first fed sheet to be processed is read out and acquired from the RAM (S4707). Delivery tray information is identified from the acquired job information, and the sheet is discharged to a set discharge destination (S4708). The processed sheet count is counted up by the discharged multi-fed sheet count, and the process returns to S4706. The discharge processing is complete by repeating this process by the number of processed sheets and the number of sheets to be processed as multi-fed sheets.

According to the fourth embodiment, multi-fed sheets can be discharged to a different discharge destination for each print job. That is, a plurality of escape trays can be selected as output destinations upon occurrence of multi feed in the feeding apparatus, and sheets can be sorted at the discharge destination for each job.

Fifth Embodiment

Control of a printing system 1000 according to the fifth embodiment of the present invention will be described in detail with reference to FIGS. 48 to 51. The configuration and basic control of the printing system 1000 and the like are the same as those in the first embodiment, and only a difference will be described.

In the fifth embodiment, an output destination is set for each size from a window (FIG. 48 or 49) displayed on an operation unit 204. If the user selects a key 3404 in the window of FIG. 34 displayed on the operation unit 204, the operation unit 204 displays a window in FIG. 48. If the user selects a key 4801, the operation unit 204 displays a window in FIG. 49. The user selects one sheet size from a sheet size list 4901, and selects one of keys 4902 to 4904 to select the size of sheets to be discharged to each escape tray. An escape tray displayed as a discharge destination in the window changes depending on which of keys 3401, 3402, and 3403 has been selected. If the user sets to discharge sheets of A4 size to escape tray 3, and selects a key 3401 in the window of FIG. 34 to exclude a corresponding tray from discharge destinations, the setting of A4 size returns to the list 4901 and canceled. Sheet size lists 4901 represent the sizes of sheets to be output to respective trays. The selection results of the keys 4902 to 4904 are reflected in the sheet size lists 4901. By selecting a key 4908 after setting, information which designates an output tray for each size is stored in a RAM 208 or HDD 209.

Figure 50:
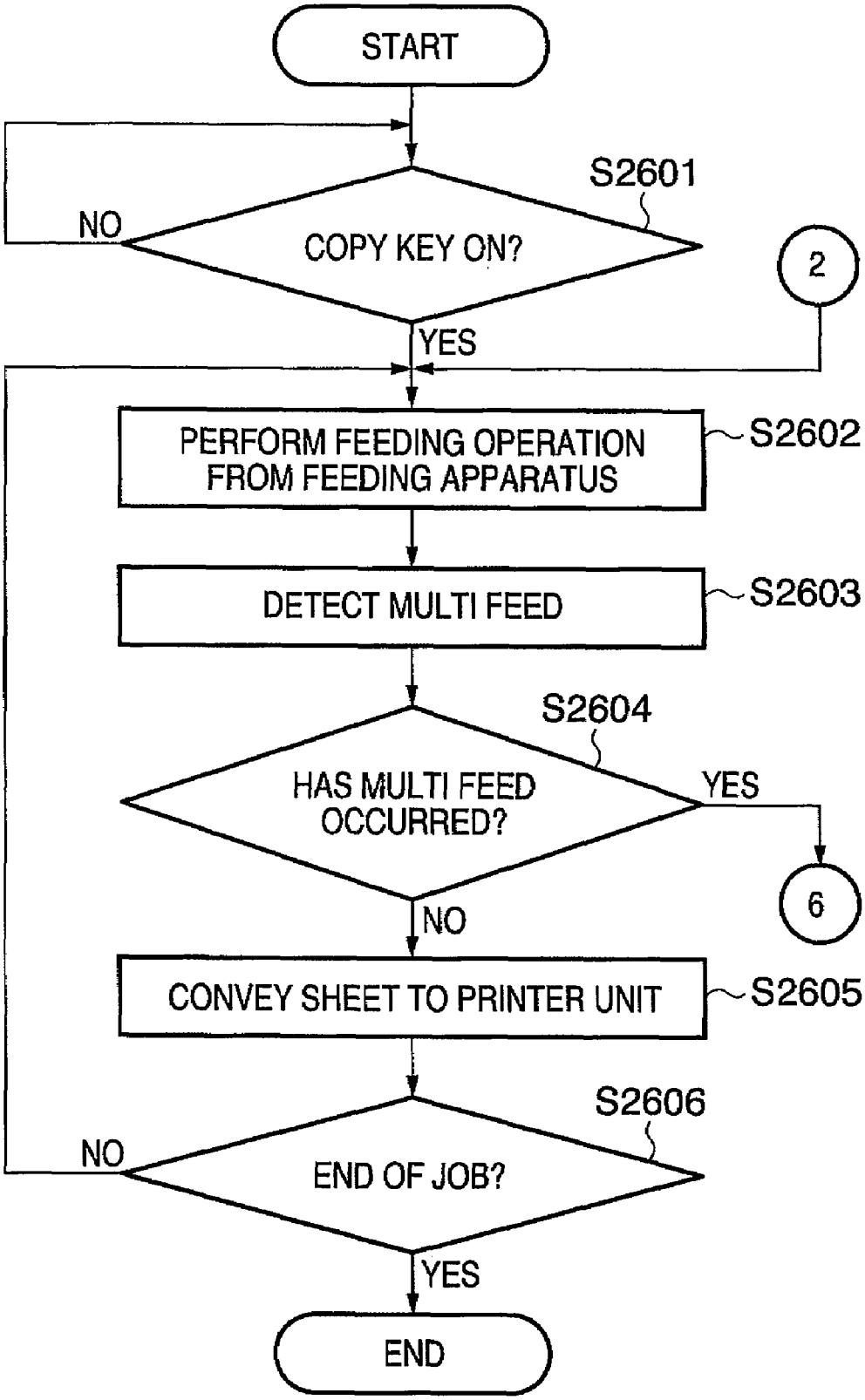
FIG. 50 is a flowchart of a control example when executing a copy job in a printing system 1000 to be controlled in the fifth embodiment of the present invention.
Figure 51:
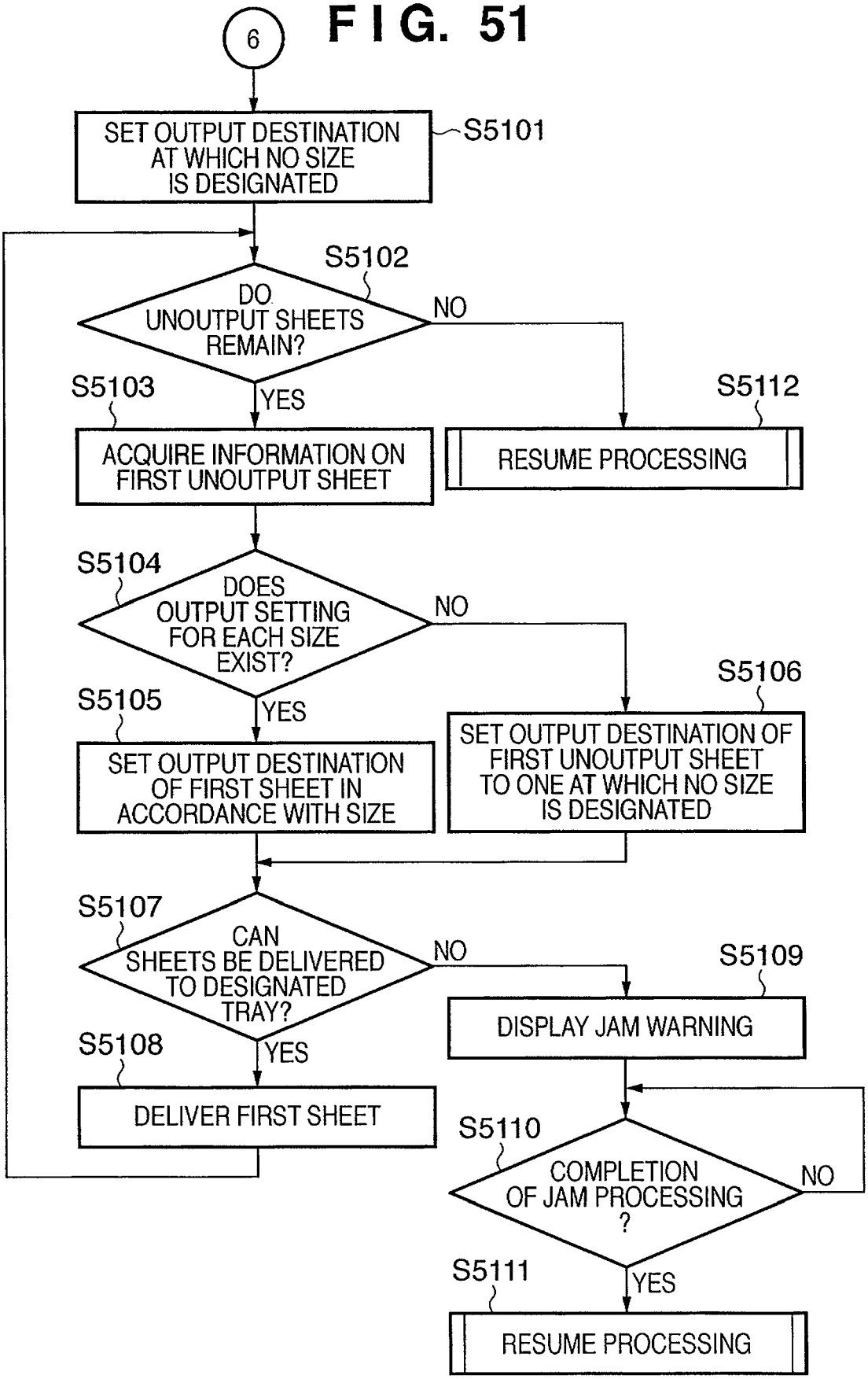
FIG. 51 is a flowchart of a multi-fed sheet discharge control example upon occurrence of multi feed in the printing system 1000 to be controlled in the fifth embodiment of the present invention.

A job control execution sequence complies with the flowchart in FIG. 50. The sequence itself is the same as the process in FIG. 26, but processing after detecting multi feed changes to one shown in the flowchart of FIG. 51. Processing after detecting multi feed will be described with reference to the flowchart of FIG. 51. A tray for accepting sheets whose output destination is not set is determined for each sheet size (S5101). A tray having the shortest feeding path is selected, but a tray having the smallest number of output sheets for each sheet size may also be selected. The following process is repeated while unoutput sheets remain (S5102). First, information on the first sheet out of unoutput multi-fed sheets is acquired (S5103). Then, size information is read out from the acquired sheet information. Information is acquired from the RAM 208 to check whether an output destination has been registered for the sheet size acquired from the size information (S5104). If an output destination has been set for the size, the sheet output destination is set to the designated tray (S5105). If no output destination has been set for the size, the sheet output destination is set to an output destination corresponding to the size for which no output destination is designated (S5106). It is checked whether sheets can be output to the designated output destination (S5107). If sheets can be output to the designated output destination, sheets are output in S5108. If no sheet can be output to the designated output destination, the operation unit 204 displays a jam warning in S5109. The process waits until the completion of jam processing (S5110), and resume processing is done upon completion of jam processing (S5111). After outputting all multi-fed sheets by repeating this process, resume processing is performed in S5112. The contents of the resume processing are the same as those described above, and a description thereof will not be repeated.

According to the fifth embodiment, a multi-fed sheet discharge destination can be set for each size. That is, when multi feed occurs in the feeding apparatus, the escape tray to which sheets are output can change depending on the sheet size.

Sixth Embodiment

Figure 52:
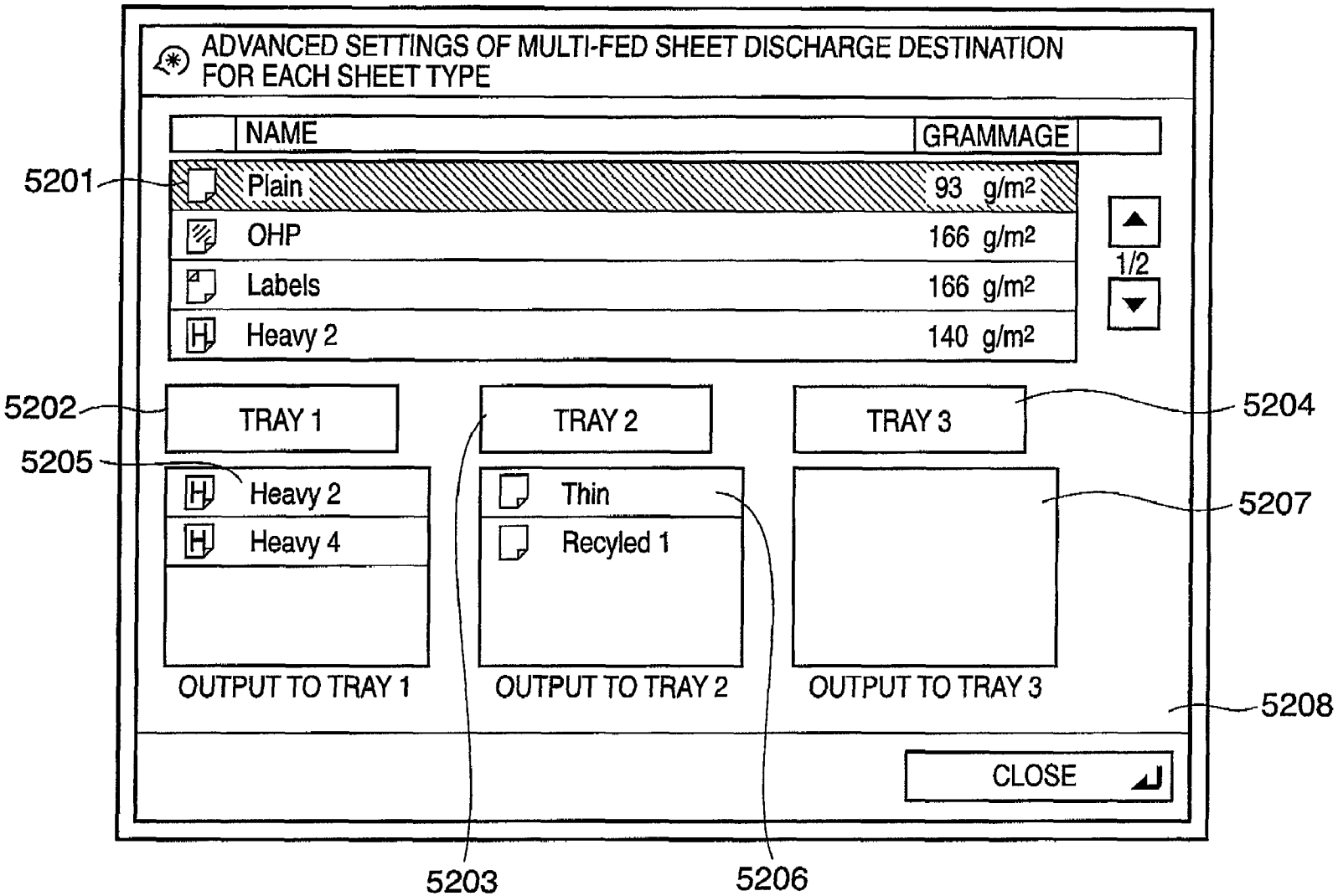
FIG. 52 is a view showing an example of a display window on a UI unit to be controlled in the sixth embodiment of the present invention.

Control of a printing system 1000 according to the sixth embodiment of the present invention will be described in detail with reference to FIGS. 52 to 54. The configuration and basic control of the printing system 1000 and the like are the same as those in the fifth embodiment, and only a difference will be described.

An output destination for each medium type is set based on a user setting displayed on an operation unit 204. If the user selects a key 3404 in the window of FIG. 34 displayed on the operation unit 204, the operation unit 204 displays a window in FIG. 48. If the user selects a key 4802, the operation unit 204 displays a window in FIG. 52. The user selects an output medium type from a medium type list 5201, and selects a key 5202, the medium type is registered in an output target list 5205 for escape tray 1. If the user selects a key 5203, the medium type is registered in an output target list for escape tray 2. If the user selects a key 5204, the medium type is registered in an output target list for escape tray 3. By selecting a key 5208 after registration, the setting information is registered in a RAM 208 or HDD 209.

Figure 53:
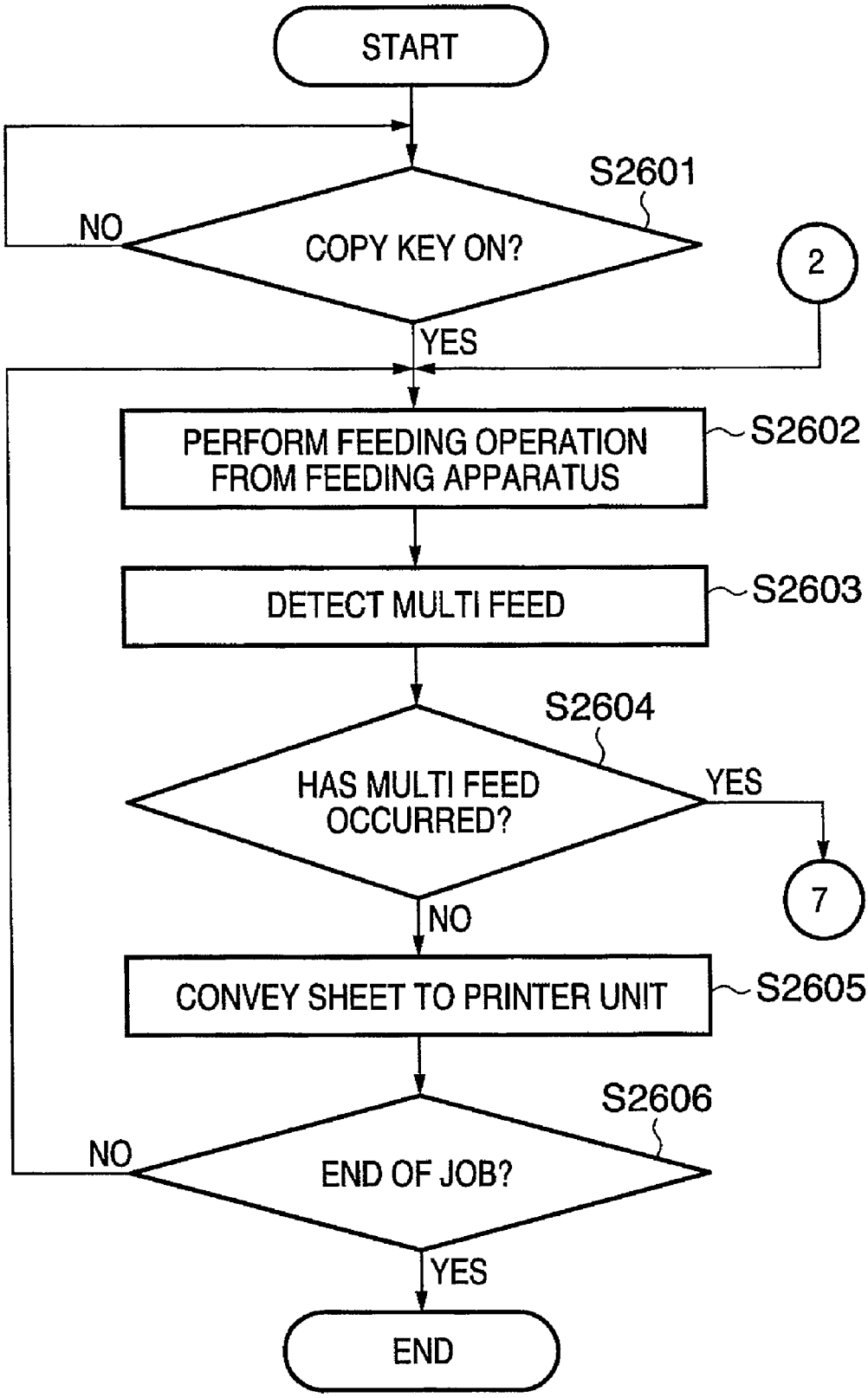
FIG. 53 is a flowchart of a multi-fed sheet discharge control example upon occurrence of multi feed in a printing system 1000 to be controlled in the sixth embodiment of the present invention.
Figure 54:
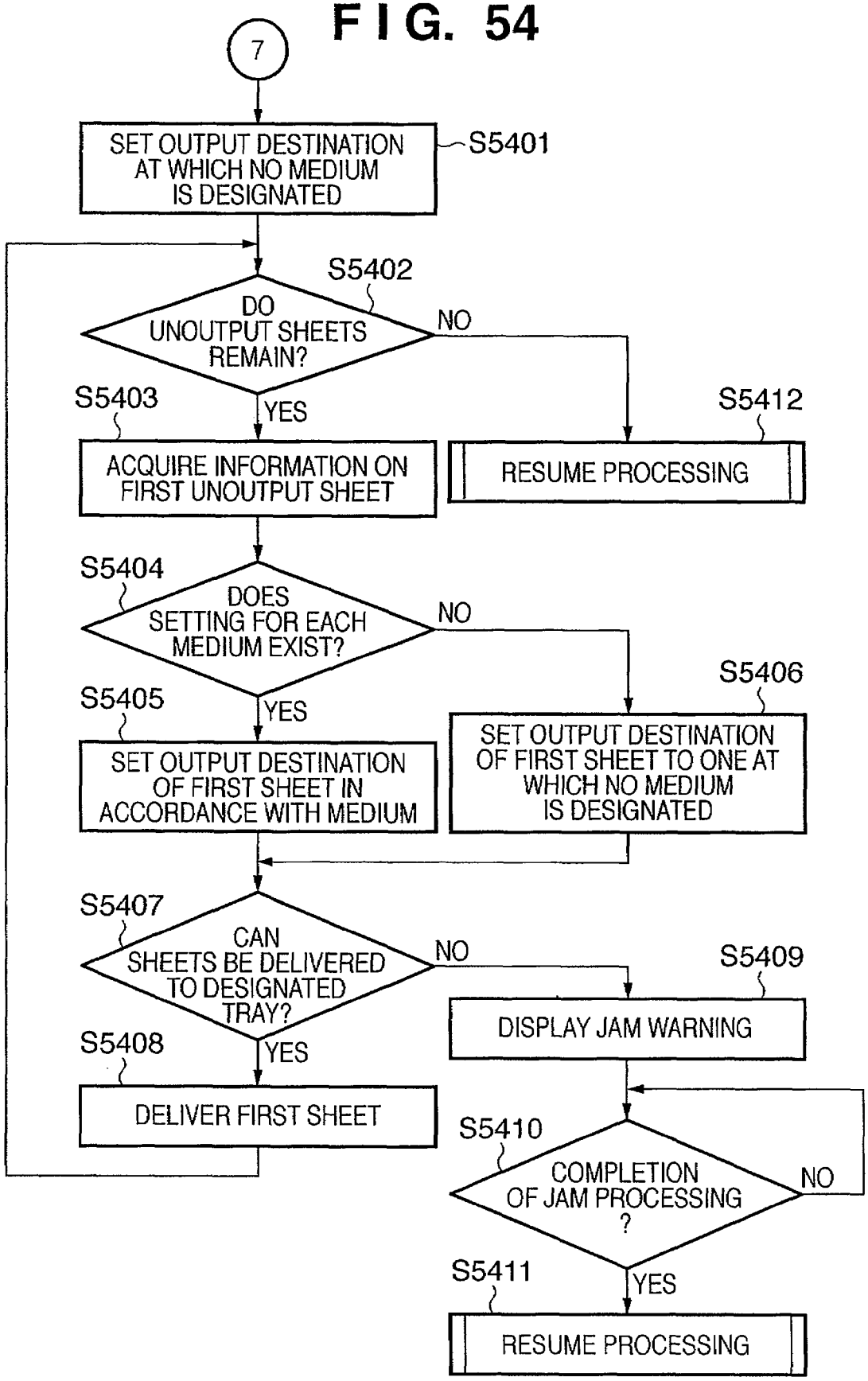
FIG. 54 is a flowchart of a multi-fed sheet discharge control example upon occurrence of multi feed in the printing system 1000 to be controlled in the sixth embodiment of the present invention.

A job control sequence complies with the flowchart in FIG. 53. FIG. 54 shows an operation after detecting multi feed in S2604 in FIG. 53. The discharge operation after detecting multi-fed sheets will be described in detail with reference to the flowchart of FIG. 54. A discharge destination is uniquely set for a medium for which no discharge destination is designated (S5401). As the selection order at this time, an escape tray having the shortest feeding path is selected. However, it is also possible to designate a specific tray, or select a tray having a small number of registered media. Thereafter, the following operation continues while unoutput sheets remain in the feeding apparatus (S5402). First, information on the first unoutput sheet is acquired (S5403). Then, the medium type is determined from the sheet information, and an output target list for each escape tray is read out from the RAM to check whether an output destination has been set for the medium type (S5404). If an output destination has been set for the medium type, the output destination of the first sheet is set to the target tray (S5405). If no output destination has been set for the medium type, the output destination of the first sheet is set to an output destination corresponding to the medium for which no output destination is designated (S5406). It is checked whether sheets can be discharged to the tray set as the output destination of the first sheet (S5407). If sheets can be discharged to the tray set as the output destination of the first sheet, the first sheet is discharged (S5408), and the next sheet is processed. If no sheet can be output to the tray set as the output destination of the first sheet, the operation unit 204 displays a jam warning in S5409. The process waits until the completion of jam processing (S5410), and resume processing is done upon completion of jam processing (S5411). After outputting all multi-fed sheets by repeating this process, resume processing is performed in S5412. The contents of the resume processing are the same as those described above, and a description thereof will not be repeated. This process continues while unoutput sheets remain. After all sheets are output, resume processing is performed in S5412.

According to the sixth embodiment, a multi-fed sheet discharge destination can be set for each medium type. That is, a plurality of escape trays can be selected as output destinations upon occurrence of multi feed in the feeding apparatus. In particular, an escape tray can change depending on the medium type.

Seventh Embodiment

Figure 55:
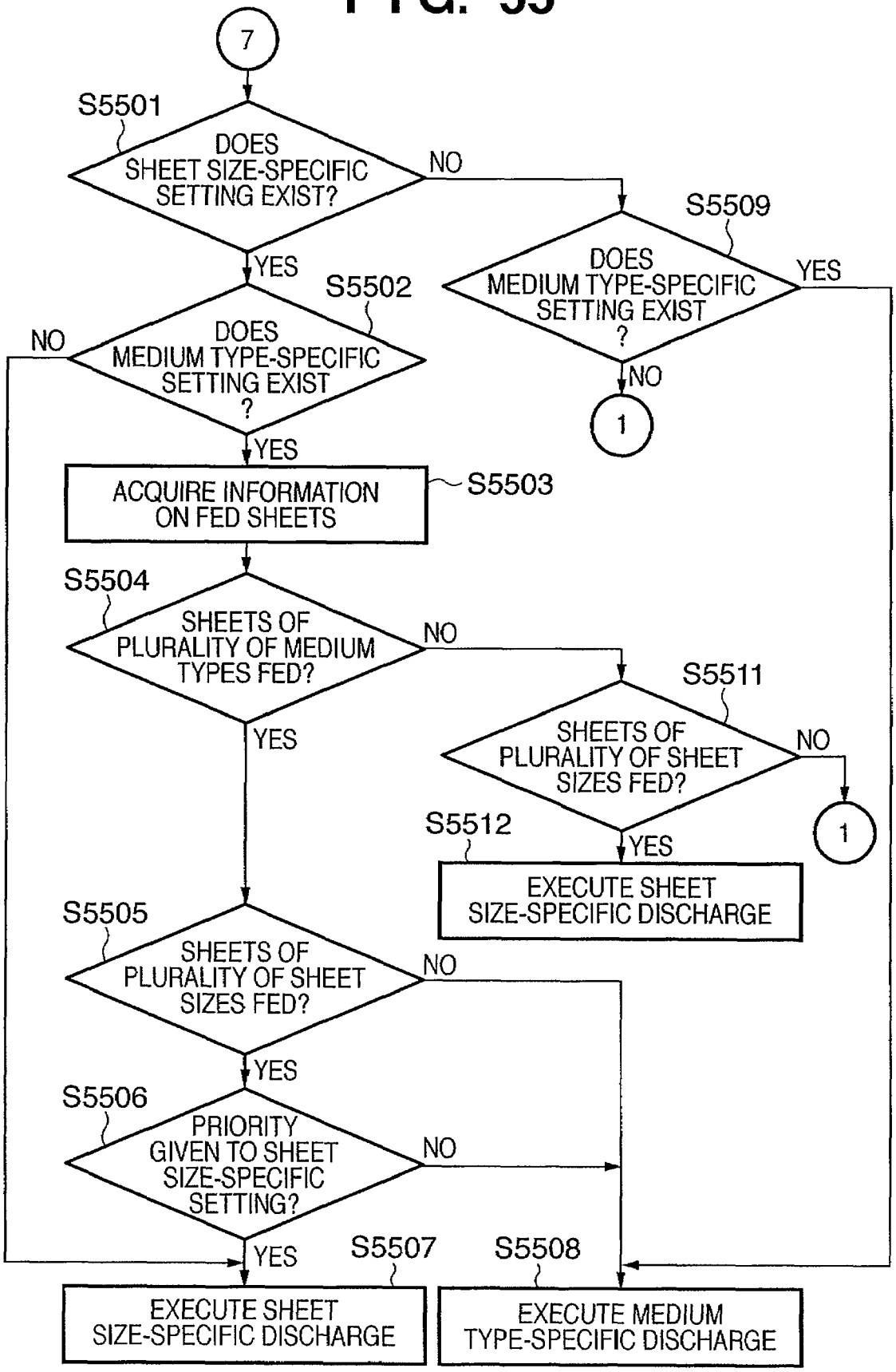
FIG. 55 is a flowchart of a multi-fed sheet discharge control example upon occurrence of multi feed in a printing system 1000 to be controlled in the seventh embodiment of the present invention.
Figure 56:
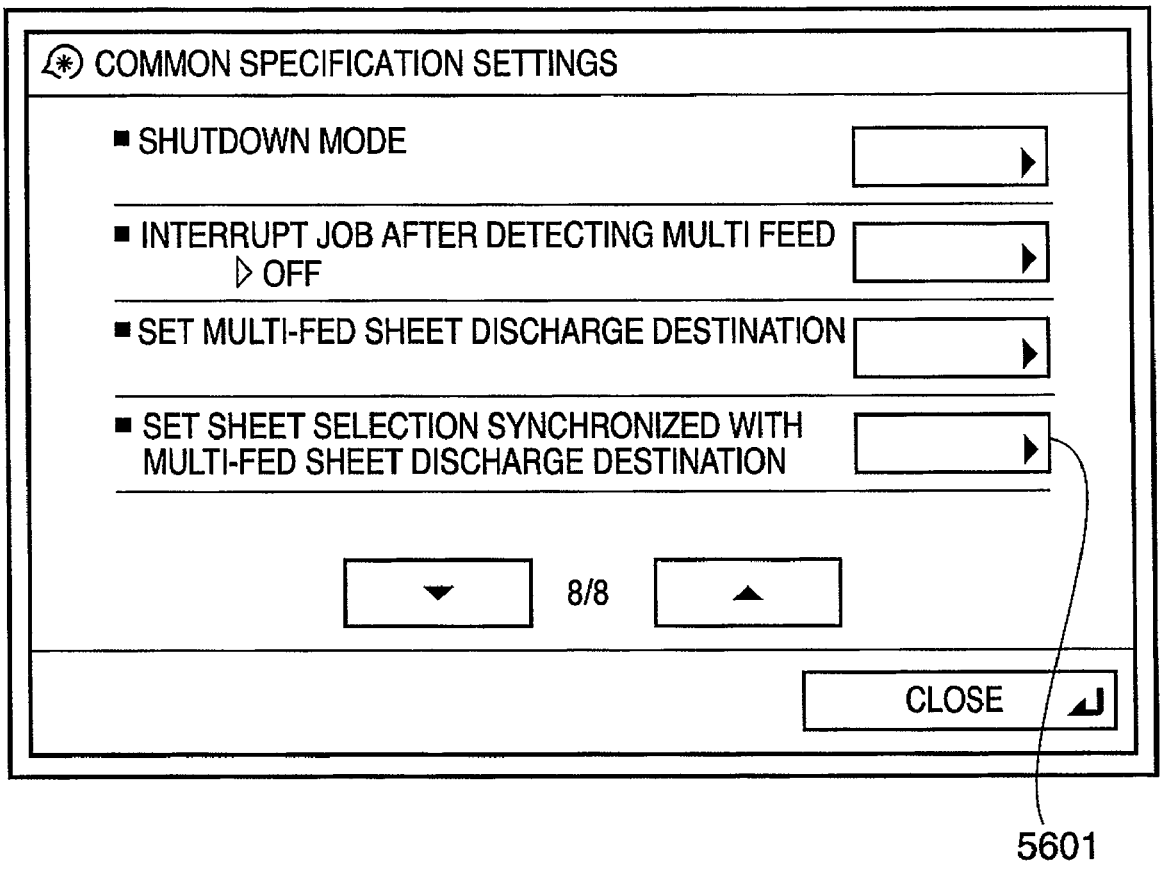
FIG. 56 is a view showing an example of a display window on a UI unit to be controlled in the eighth embodiment of the present invention.
Figure 57:
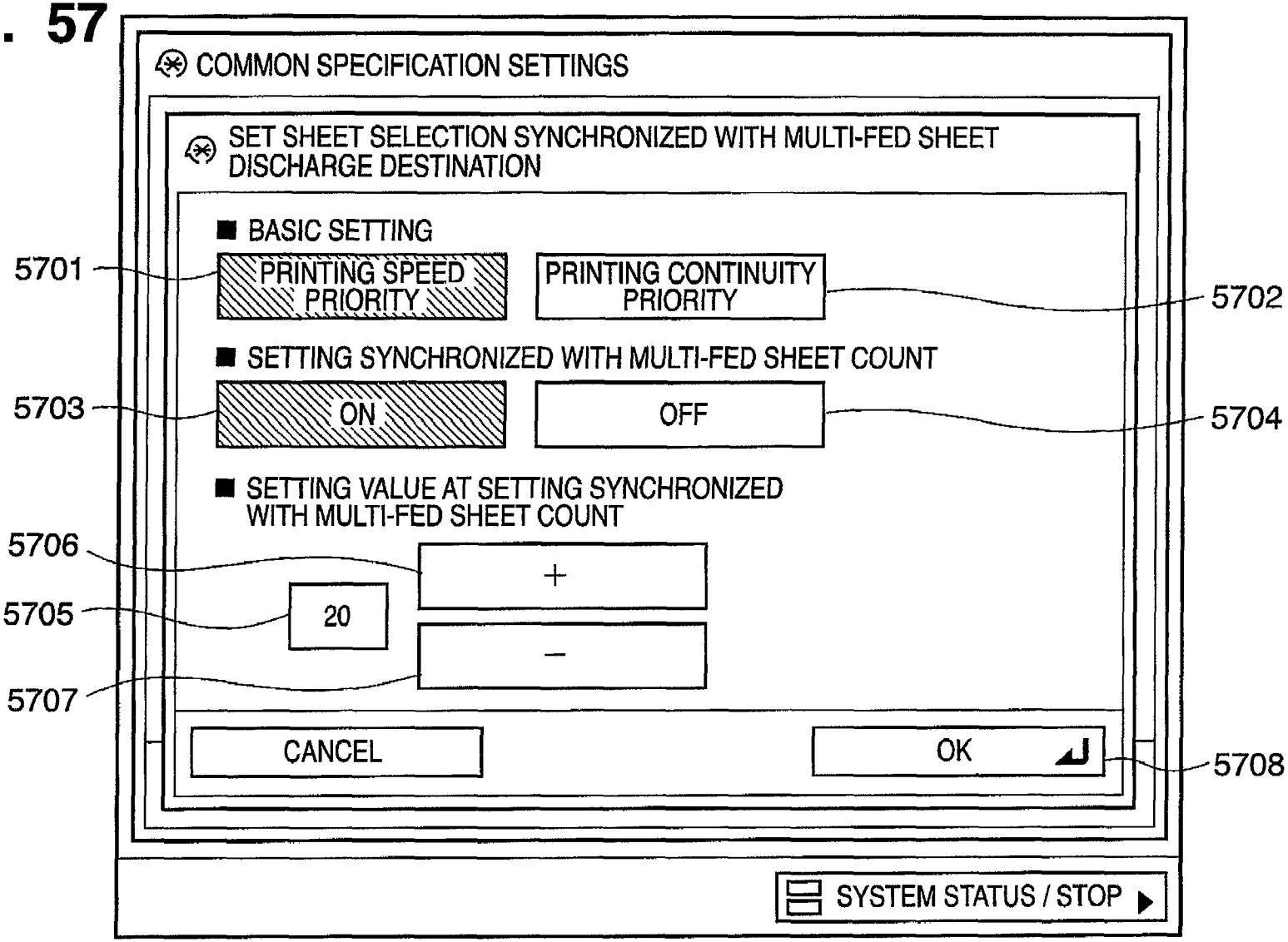
FIG. 57 is a view showing an example of a display window on the UI unit to be controlled in the eighth embodiment of the present invention.

Control of a printing system 1000 according to the seventh embodiment of the present invention will be described in detail with reference to FIG. 55. The configuration and basic control of the printing system 1000 and the like are the same as those in the fifth embodiment, and only a difference will be described.

Output destinations for each size and each medium type described in the fifth and sixth embodiments can also be simultaneously set. At this time, the output destinations can also be prioritized when determining output destinations. The priority order is set in the window of FIG. 48 displayed on an operation unit 204. When the user selects a key 4804 or 4805 to change the priority order, he selects a key 4806 or 4807 to determine the priority order. By selecting a key 4803, the determination of the priority order is complete. The setting at this time is stored in a RAM 208 or HDD 209.

An operation after detecting multi feed will be described in detail with reference to the flowchart of FIG. 55. It is checked whether a sheet size-specific setting and medium type-specific setting exist (S5501, S5502, and S5509). If neither setting exists, normal discharge processing is performed. If either setting exists, sheet size-specific output (S5507) or medium type-specific output (S5508) is performed. If both the size-specific output setting and type-specific output setting exist, information on fed sheets is acquired (S5503). If it is determined from information on all sheets that sheets of a plurality of medium types have been fed (S5504), and that sheets of a plurality of sheet sizes have been fed (S5505), the above-described priority order information is read out from the RAM (S5506). If the priority is given to the sheet size-specific setting, sheet size-specific discharge is executed in S5507. If the priority is given to the medium type-specific setting, medium type-specific discharge is executed in S5508. If it is determined in S5504 that sheets of a plurality of sheet types have not been fed, it is checked in S5511 whether sheets of a plurality of sheet sizes have been fed. When sheets fed as multi-fed sheets have a single size and are of a single medium type, normal discharge processing is done. If only sheets at a plurality of sheet sizes have been fed, sheet size-specific discharge is executed in S5512. Details of size-specific discharge and medium type-specific discharge have already been described in the fifth and sixth embodiments, and a description thereof will not be repeated.

The seventh embodiment can simultaneously obtain the effects of the fifth and sixth embodiments.

Eighth Embodiment

Control of a printing system 1000 according to the eighth embodiment of the present invention will be described in detail with reference to FIGS. 56 to 62. The configuration and basic control of the printing system 1000 and the like are the same as those in the first embodiment, and only a difference will be described.

In the printing system 1000, when identical sheets are set in a plurality of feeding apparatuses, an APS (Auto Paper Select) operation is done for a print job input with a sheet size "auto". The APS operation is a function of selecting the most appropriate sheet from sheets set in feeding apparatuses for input print data. In this case, a controller 205 functions as a search means for automatically searching for a print medium optimum for a print job whose execution instruction has been accepted.

Generally in the APS operation, a feeding apparatus having a short sheet feeding path is preferentially used to increase productivity. However, when a feeding apparatus susceptible to multi feed owing to its features has the shortest feeding path, a long time is taken to discharge multi-fed sheets, and the productivity may decrease. A feeding apparatus far from a printing apparatus can use a plurality of escape trays. Even if the escape tray of a feeding apparatus used to feed sheets becomes full, sheets can be output to the escape tray of a downstream feeding apparatus. Thus, the job is hardly interrupted owing to the full state of the escape tray, and the productivity can increase. The eighth embodiment will describe a printing system which switches the feeding apparatus in accordance with the multi-fed sheet discharge destination setting.

By pressing a key 5601 in a user setup window (FIG. 56) displayed on an operation unit 204, it is set to switch the feeding deck in accordance with the multi-fed sheet discharge destination setting. After pressing the key 5601, the operation unit 204 displays a window in FIG. 57. By operating either a key 5701 or 5702, the user selects a "printing speed priority mode" or "printing continuity priority mode". These two modes can be exclusively selected, and the key of a selected mode is explicitly displayed in a different color. After selecting a mode, the mode selected upon pressing a key 5708 is stored as information in a RAM 208.

Figure 58:
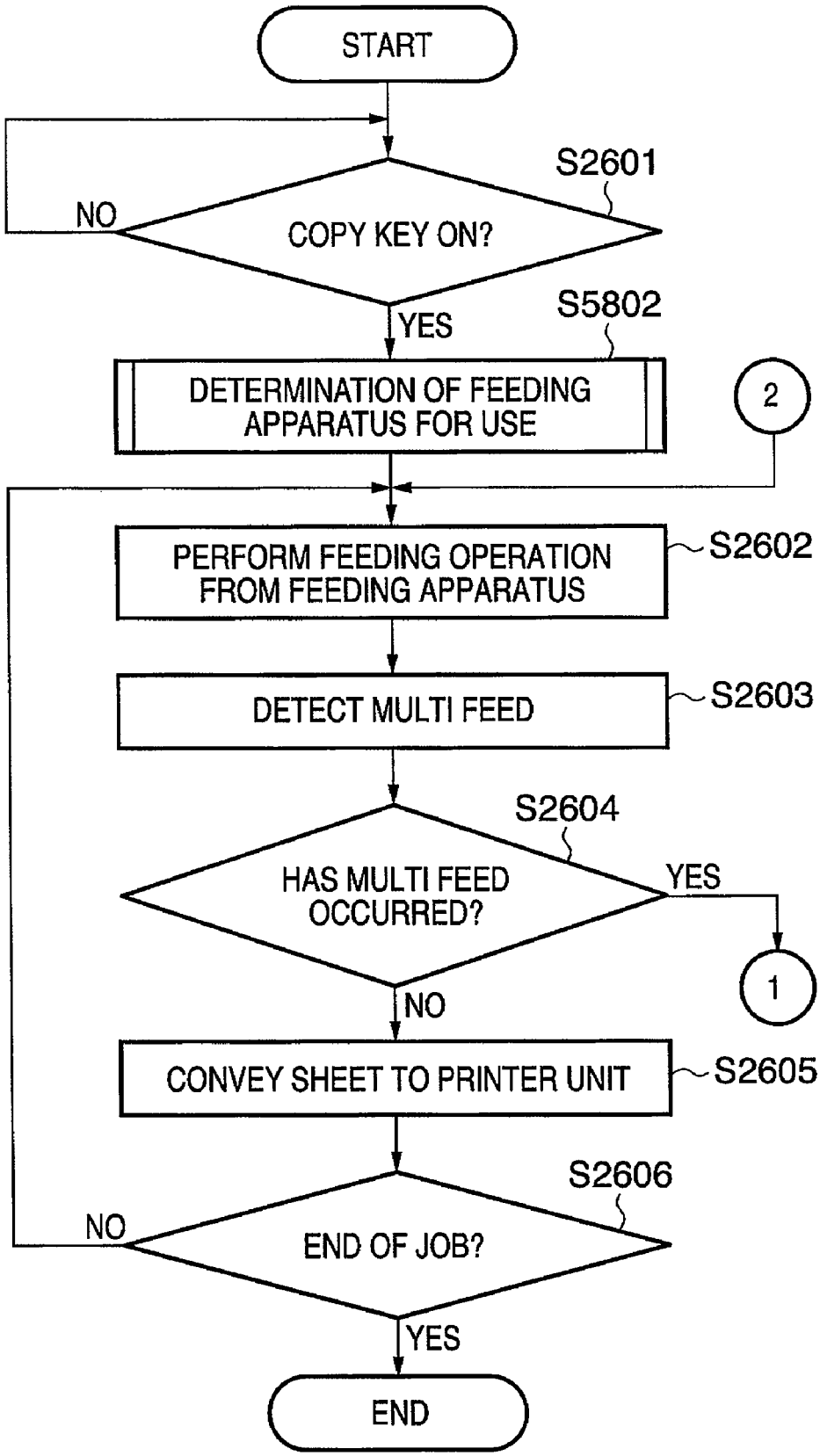
FIG. 58 is a flowchart of a control example when executing a copy job in a printing system 1000 to be controlled in the eighth embodiment of the present invention.

A job control operation complies with the flowchart of FIG. 58. In S2601, the process waits until the user presses the copy start key. After the user presses the copy start key, a feeding apparatus for use is determined in S5802.

Figure 59:
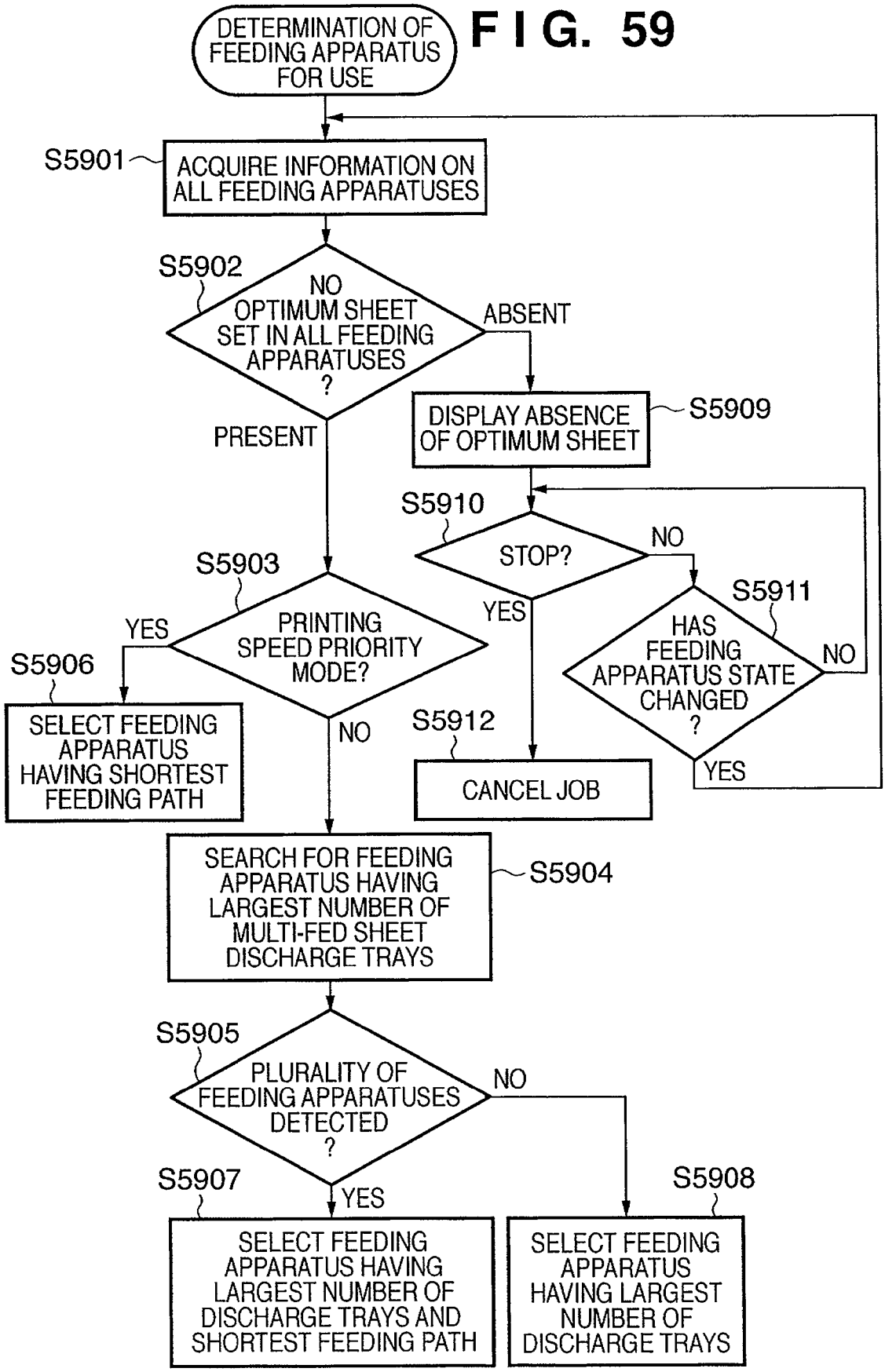
FIG. 59 is a flowchart of APS operation control in the printing system 1000 to be controlled in the eighth embodiment of the present invention.
Figure 60:
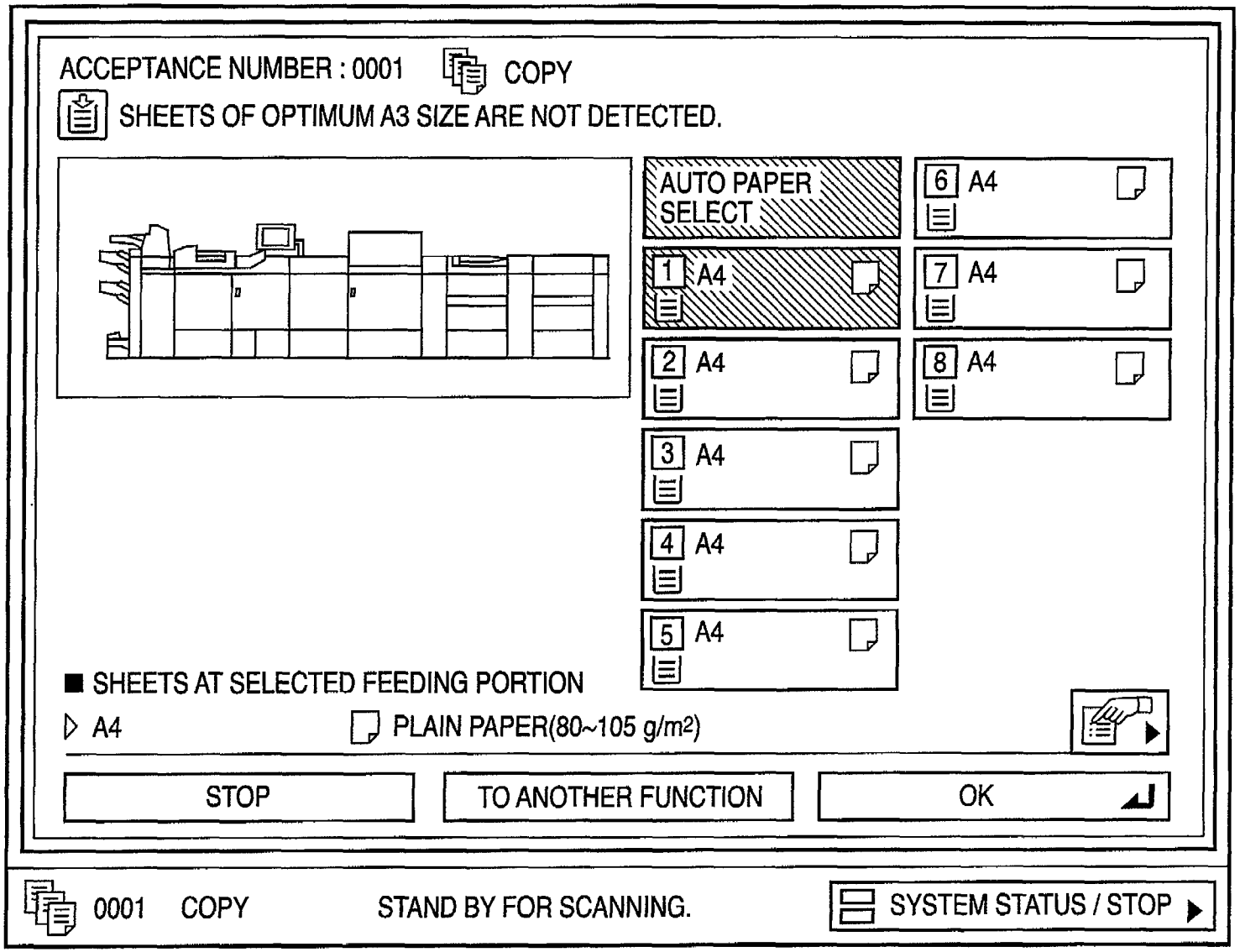
FIG. 60 is a view showing an example of a display window on the UI unit to be controlled in the eighth embodiment of the present invention.

The determination processing for a feeding apparatus for use complies with the flowchart of FIG. 59. Information on all connected feeding apparatuses is acquired (S5901). The feeding apparatus information includes pieces of information on the size of a sheet feedable from each feeding apparatus, the medium type of sheet, and an escape tray set as an output destination in each feeding apparatus. By referring to the acquired feeding apparatus information, it is determined whether optimum sheets exist (S5902). If a size optimum for all feeding apparatuses does not exist, the operation unit 204 displays a warning that there is no optimum sheet (window example: FIG. 60). Then, if the user presses the stop key in the warning window, execution of the job is canceled (S5910 and S5912). If an image has been formed, the image data is discarded.

If the user does not press the stop key, it is checked whether the feeding apparatus state has changed (S5911). If the feeding apparatus state has changed, it is determined whether optimum sheets have been set (S5902). If no feeding apparatus state has changed, the process waits until the user presses the stop key.

If optimum sheets have been set in at least one feeding apparatus, it is checked in S5903 by referring to information in the RAM whether the printing speed priority mode has been selected. If the printing speed priority mode has been set, a feeding apparatus having the shortest feeding path is selected (S5906).

If the printing continuity priority mode has been set, a feeding apparatus having the largest number of output tray candidates among feeding apparatuses capable of feeding optimum sheets is selected by further referring to the feeding apparatus information (S5904). If a plurality of feeding apparatuses meet this condition (S5905), a feeding apparatus having the shortest feeding path is selected from them (S5907). If a plurality of feeding apparatuses do not meet this condition, a feeding apparatus having the largest number of output tray candidates is selected in S5908.

Subsequent job control procedures and multi-fed sheet discharge control have already been explained, and a description thereof will not be repeated.

[Selection of Feeding Apparatus Considering Multi Feed Detection Count]

In the above-described printing system, a feeding apparatus is selected to maximize the printing continuity of the printing system. Even when a feeding apparatus has a tray on which multi feed frequently occurs, it is used without discriminating it from other feeding apparatuses. If multi feed occurs, discharge of multi-fed sheets and recovery processing are executed, and the printing speed slightly decreases. If a feeding apparatus suffering frequent occurrence of multi feed keeps feeding sheets, the productivity of the printing system drops undesirably. In this case, the productivity can be maintained by inhibiting, as much as possible, selection of a feeding apparatus which feeds overlapping sheets. As a premise of this, the controller 205 counts the multi feed occurrence count for each feeding apparatus.

By selecting a key 5703 in the user setup window (FIG. 57), it can be set to select a feeding apparatus in accordance with the multi feed count. The key 5703 and a key 5704 can be exclusively selected. A field 5705 displays a multi feed count threshold at which the priority is decreased in automatic feeding apparatus selection. This threshold can be increased or decreased by operating a key 5706 or 5707. When the user selects a key 5708, information representing that a feeding apparatus is selected in accordance with the multi feed count, and the threshold of the multi feed count are stored in the RAM.

Figure 61:
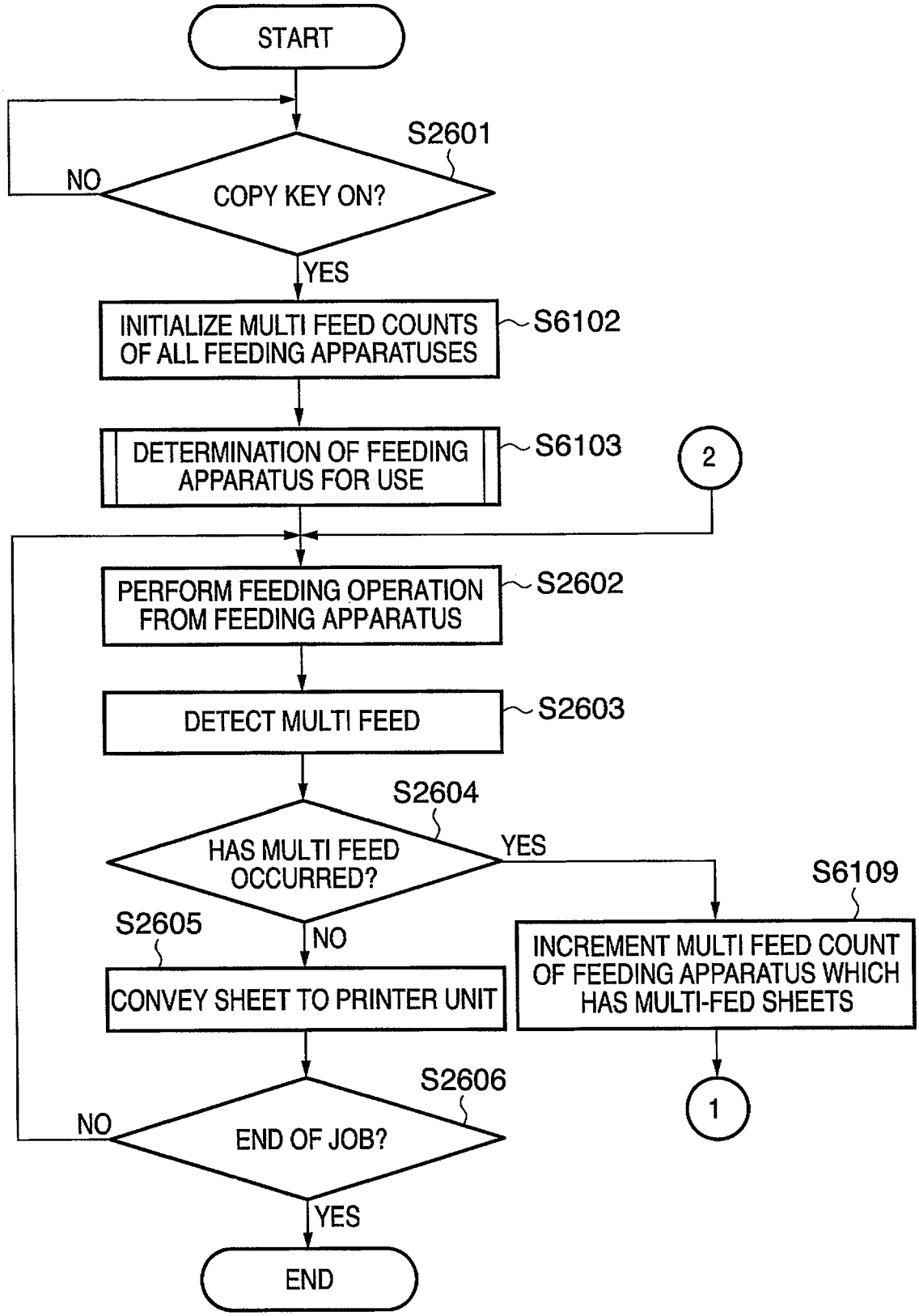
FIG. 61 is a flowchart of a control example when executing a copy job in the printing system 1000 to be controlled in the eighth embodiment of the present invention.

Job execution control will be explained with reference to the flowchart of FIG. 61. In S2601, the process waits until the user presses the copy start key. After the user presses the copy start key, the multi feed counts of feeding apparatuses are initialized in S6102. In S6103, a feeding apparatus for feeding sheets is determined, and a print job is executed. If multi feed occurs (S2604), the multi feed count of the feeding apparatus suffering the occurrence of multi feed is incremented by one in S6109, and multi-fed sheets are discharged.

Figure 62:
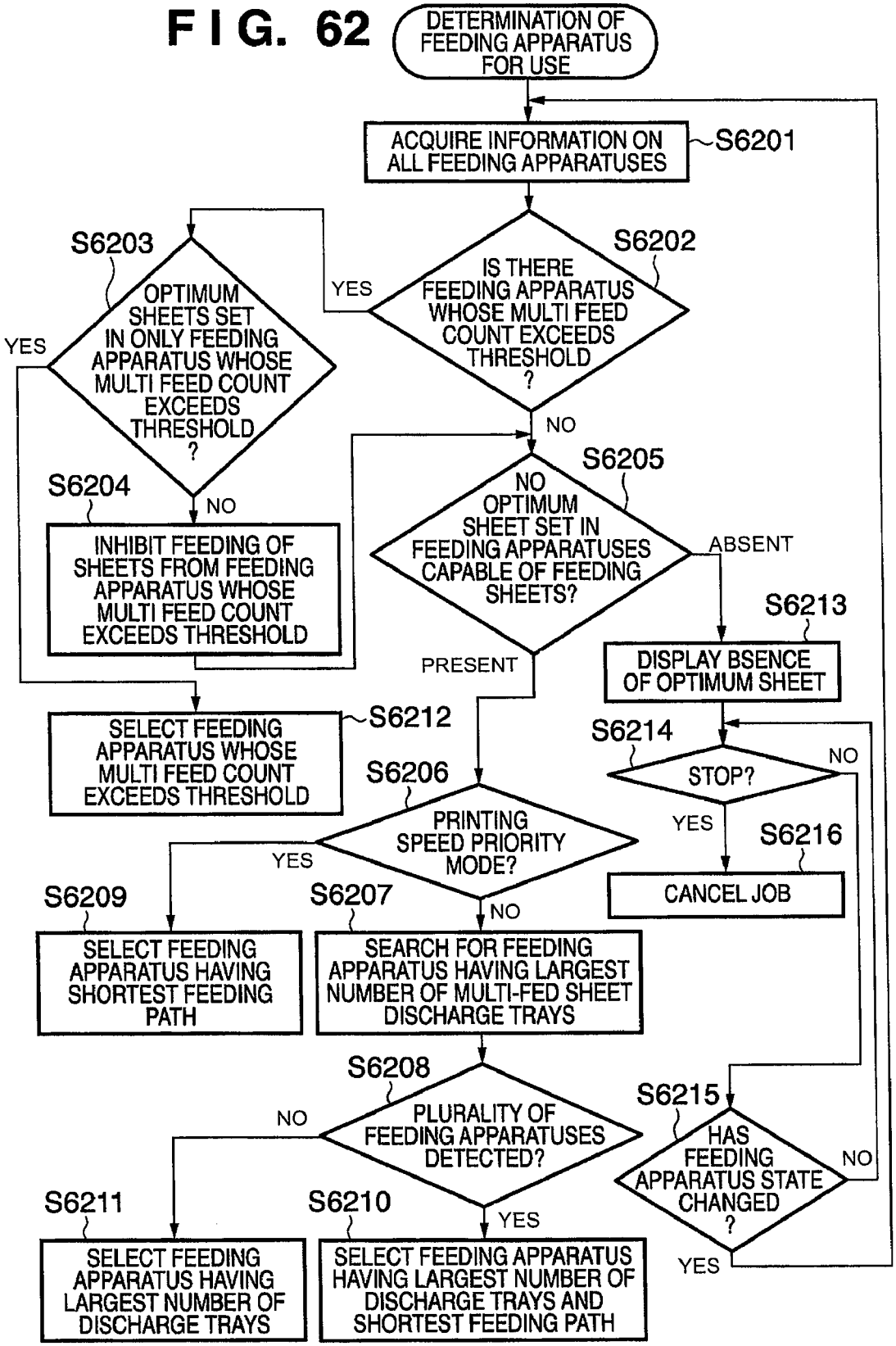
FIG. 62 is a flowchart of APS operation control in the printing system 1000 to be controlled in the eighth embodiment of the present invention.

Determination processing for a feeding apparatus for use will be described with reference to the flowchart of FIG. 62. After information on all feeding apparatuses is acquired (S6201), it is determined whether there is a feeding apparatus whose multi feed count exceeds the threshold (S6202). If there is a feeding apparatus whose multi feed count exceeds the threshold, it is checked by referring to the feeding apparatus information whether optimum sheets are set in only the feeding apparatus whose multi feed count exceeds the threshold. If optimum sheets are set in only the feeding apparatus whose multi feed count exceeds the threshold, the feeding apparatus is selected. If optimum sheets can also be fed from another feeding apparatus, it is temporarily set not to feed sheets from the feeding apparatus whose multi feed count exceeds the threshold (S6204). Only feeding apparatuses capable of feeding sheets are searched in S6205 and the subsequent process. Subsequent feeding apparatus selection processing is the same as that described above, and a description thereof will not be repeated.

According to the eighth embodiment, a feeding apparatus can be automatically selected in accordance with the multi-fed sheet discharge setting. That is, productivity can be increased by automatically switching a feeding apparatus in accordance with the user setting depending on the multi-fed sheet discharge setting. The feeding apparatus can be automatically switched based on the multi feed count.

Ninth Embodiment

Figure 64:
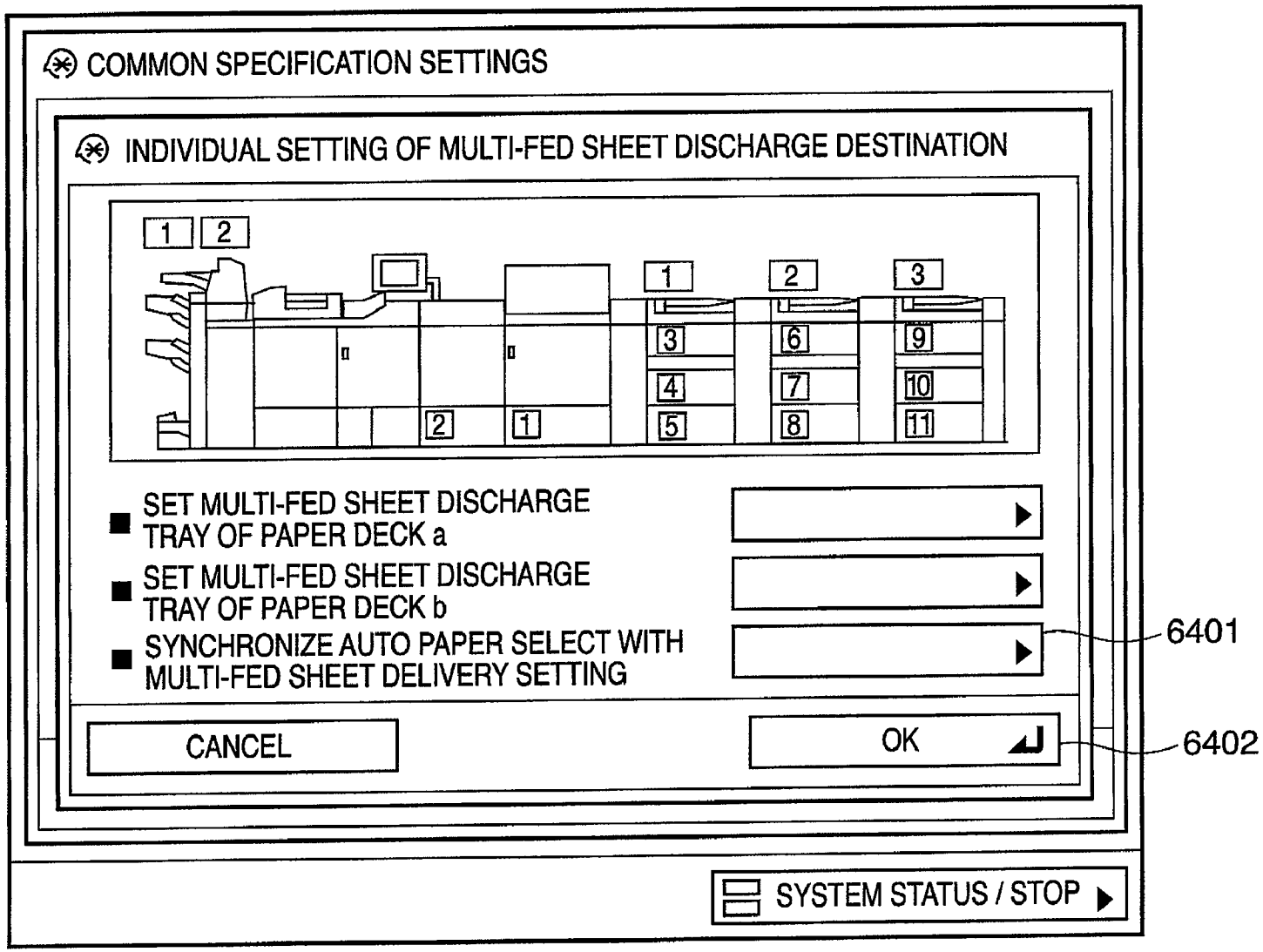
FIG. 64 is a view showing an example of a display window on a UI unit to be controlled in the ninth embodiment of the present invention.

Control of a printing system 1000 according to the ninth embodiment of the present invention will be described in detail with reference to FIGS. 64 to 66. The configuration and basic control of the printing system 1000 and the like are the same as those in the first embodiment, and only a difference will be described.

In the eighth embodiment, the user selects whether the APS operation follows the multi-fed sheet delivery destination setting, and which of productivity and speed is important. However, a large-scale printing system gives priority to continuing printing without stopping a print job, rather than the print job execution speed. Hence, the user may select only whether to reflect the multi-fed sheet delivery destination setting in the APS operation. As for the operation mode of the APS operation, APS is always done by giving priority to printing continuity. This case will be described in detail with reference to the drawings.

A key 3201 is selected in a user setup window (FIG. 32) displayed on an operation unit 204 to set to switch the feeding apparatus in accordance with the multi-fed sheet discharge setting. After selecting the key 3201, the operation unit 204 displays a multi-fed sheet discharge destination setup window (FIG. 64). By pressing a key 6401, the operation unit 204 displays a window in FIG. 65. By pressing a key 6501, the setting to switch the feeding apparatus in accordance with the multi-fed sheet discharge setting is invalidated. By pressing a key 6502, the setting to switch the feeding apparatus in accordance with the multi-fed sheet discharge setting is validated. The keys 6501 and 6502 exclusively become active. By selecting a key 6503 after setting, information on a selected one of the keys 6501 and 6502 is stored in the RAM.

Job execution control is the same as that in the eighth embodiment. Only different processing (S5802) to determine a feeding apparatus for use will be explained. The determination processing for a feeding apparatus for use complies with the flowchart of FIG. 66. Information representing which of the keys 6501 and 6502 has been selected is acquired from the RAM (S6601). If the operator has selected the key 6501, a feeding source designated by him is used as a feeding unit (S6609). If the operator has selected the key 6502, information on connected feeding apparatuses is acquired from the RAM, and information on all sheets set in feeding apparatuses is acquired. From the acquired information, it is determined whether a plurality of feeding units are available for executing a print job (S6602). If a plurality of feeding units are not available, the feeding unit of a uniquely determined, available feeding apparatus is selected as a feeding source (S6608).

If a plurality of feeding units are available as feeding source selection candidates, the process proceeds from step S6602 to step S6603 to determine whether these feeding units include the feeding unit of a feeding apparatus (upstream feeding apparatus) configured to have a plurality of selectable discharge destinations. In the ninth embodiment, feeding apparatuses 50*a* and 50*b* can discharge multi-fed sheets to a plurality of discharge destinations, and correspond to upstream feeding apparatuses. To the contrary, a feeding apparatus 50*c* and a feeding unit in the main body of a printing apparatus 100 do not correspond to upstream feeding apparatuses. If the feeding units include the feeding unit of an upstream feeding apparatus, the process proceeds to step S6604. If the feeding units do not include the feeding unit of an upstream feeding apparatus, the process proceeds to step S6607. In step S6607, of a plurality of feeding source selection candidates, the feeding unit of a feeding apparatus corresponding to a feeding source having the shortest feeding path, except the feeding unit of an upstream feeding apparatus, is automatically selected as a feeding source for a target job. Then, print processing starts.

In step S6604, it is determined by referring to the RAM or the like whether the operator has set a multi feed discharge destination in advance. If the operator has not set a multi feed discharge destination, the process proceeds to step S6607. If the operator has set a multi feed discharge destination, the process proceeds to step S6605 to determine whether a plurality of multi-fed sheet discharge destinations are set in the upstream feeding apparatus. If a plurality of multi-fed sheet discharge destinations are not set, the process proceeds to step S6607. If a plurality of multi-fed sheet discharge destinations are set, the process proceeds to step S6606 to automatically select the feeding unit of the upstream feeding apparatus as a feeding source for a target job. Then, print processing starts.

According to the ninth embodiment, a feeding apparatus can be selected by synchronizing APS and the multi-fed sheet discharge setting with each other without prompting the user to know the setting. The printing continuity of the printing system can improve. That is, the APS operation can be optimized in accordance with the multi-fed sheet discharge setting by the user, increasing productivity.

10th Embodiment

Figure 67:
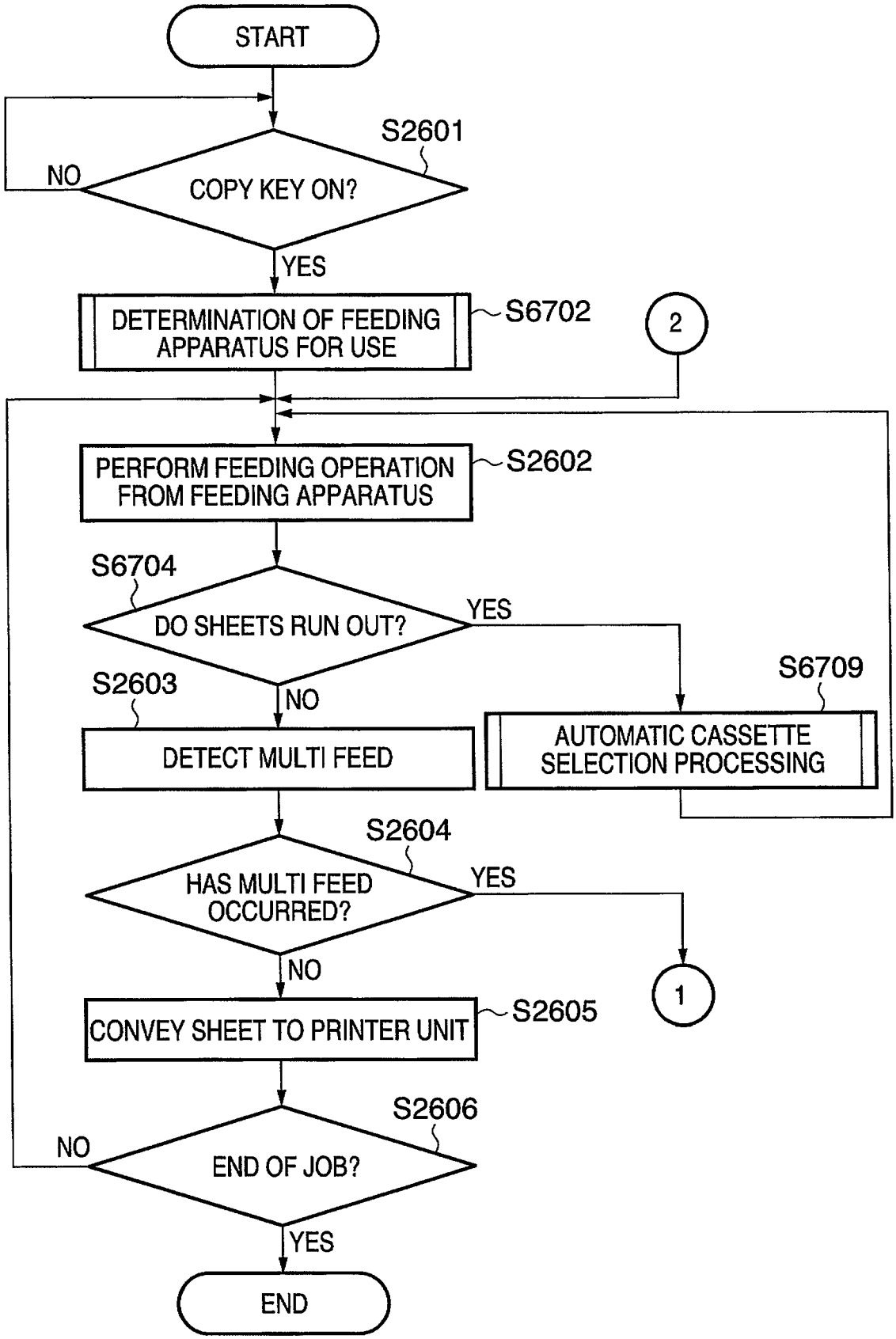
FIG. 67 is a flowchart of a control example when executing a copy job in a printing system 1000 to be controlled in the 10th embodiment of the present invention.
Figure 68:
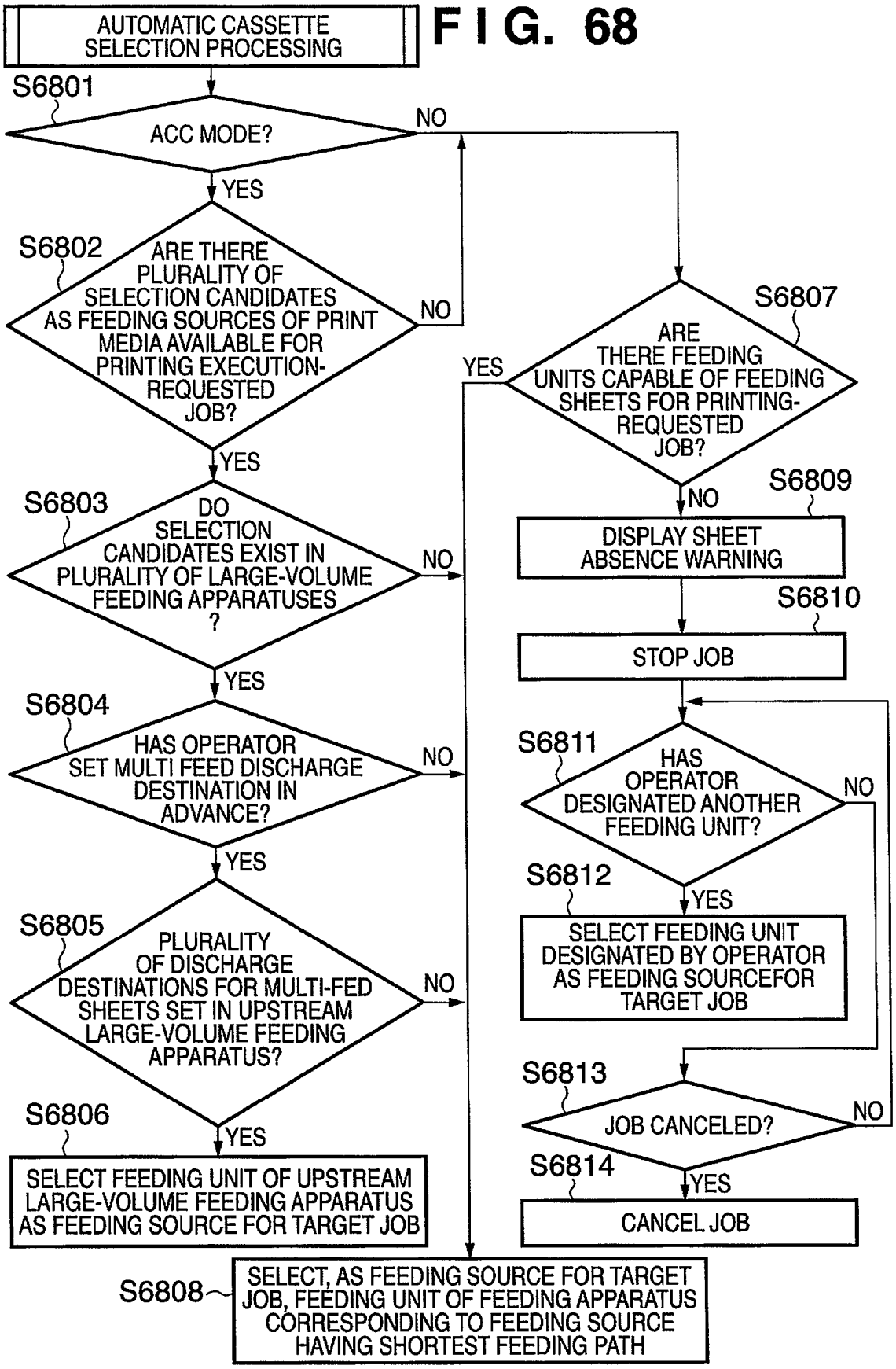
FIG. 68 is a flowchart of ACC operation control in the printing system 1000 to be controlled in the 10th embodiment of the present invention.

Control of a printing system 1000 according to the 10th embodiment of the present invention will be described in detail with reference to FIGS. 67 and 68. The configuration and basic control of the printing system 1000 and the like are the same as those in the first embodiment, and only a difference will be described.

In the eighth and ninth embodiments, the APS operation is switched in accordance with the multi-fed sheet discharge destination setting. As an operation similar to APS, the printing system provides ACC (Auto Cassette Change) to automatically change a feeding unit when sheets run out. In the ACC operation, similar to the APS operation, a feeding unit having the shortest sheet feeding path is preferentially selected as a normal setting. However, printing continuity may improve by changing the priority order to decrease the possibility at which a job is interrupted owing to handling of multi-fed sheets, rather than giving priority to the feeding path. In the following example, a feeding unit selected in the ACC operation is changed in accordance with the multi-fed sheet discharge setting.

Figure 65:
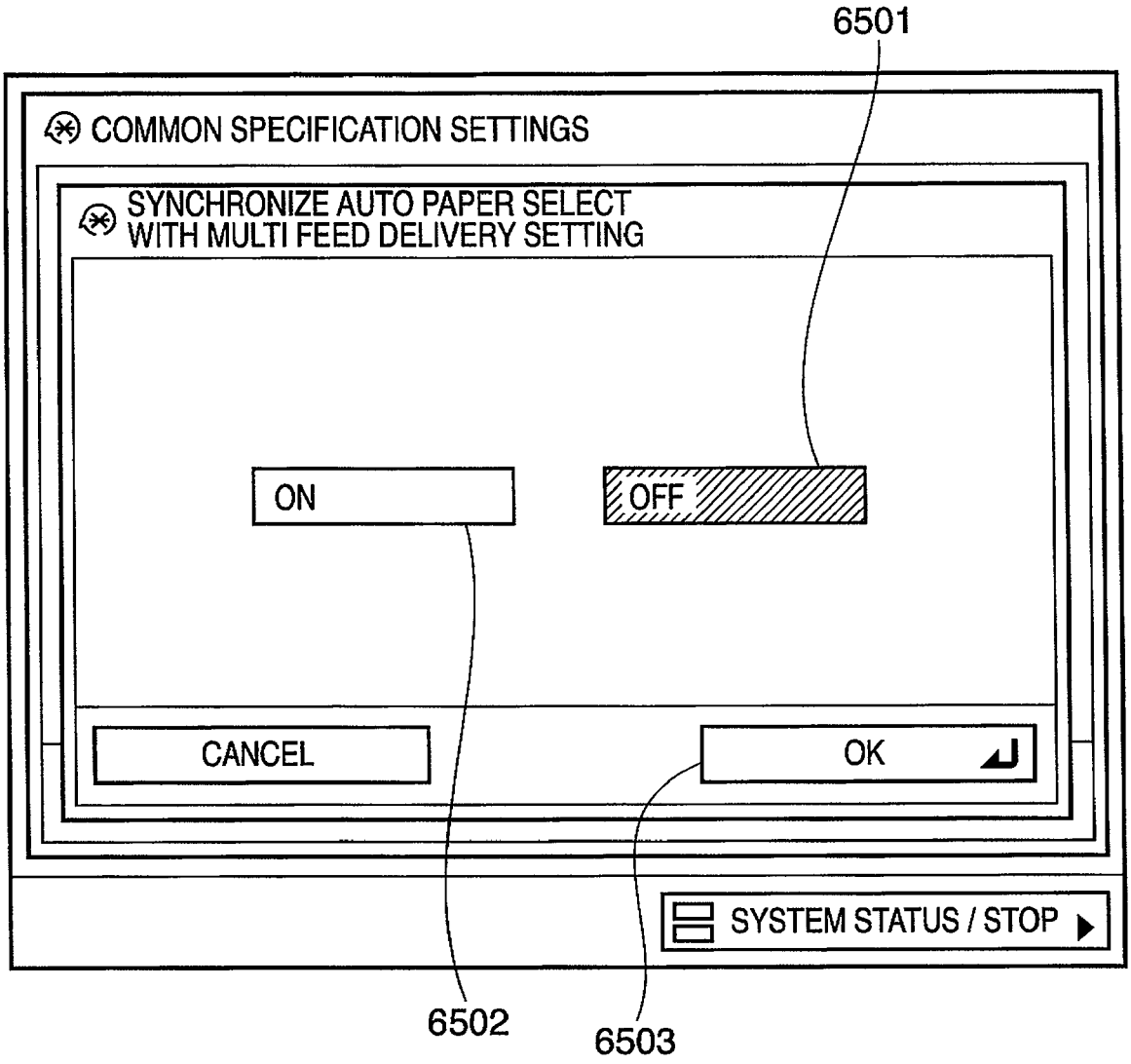
FIG. 65 is a view showing an example of a display window on the UI unit to be controlled in the ninth embodiment of the present invention.
Figure 66:
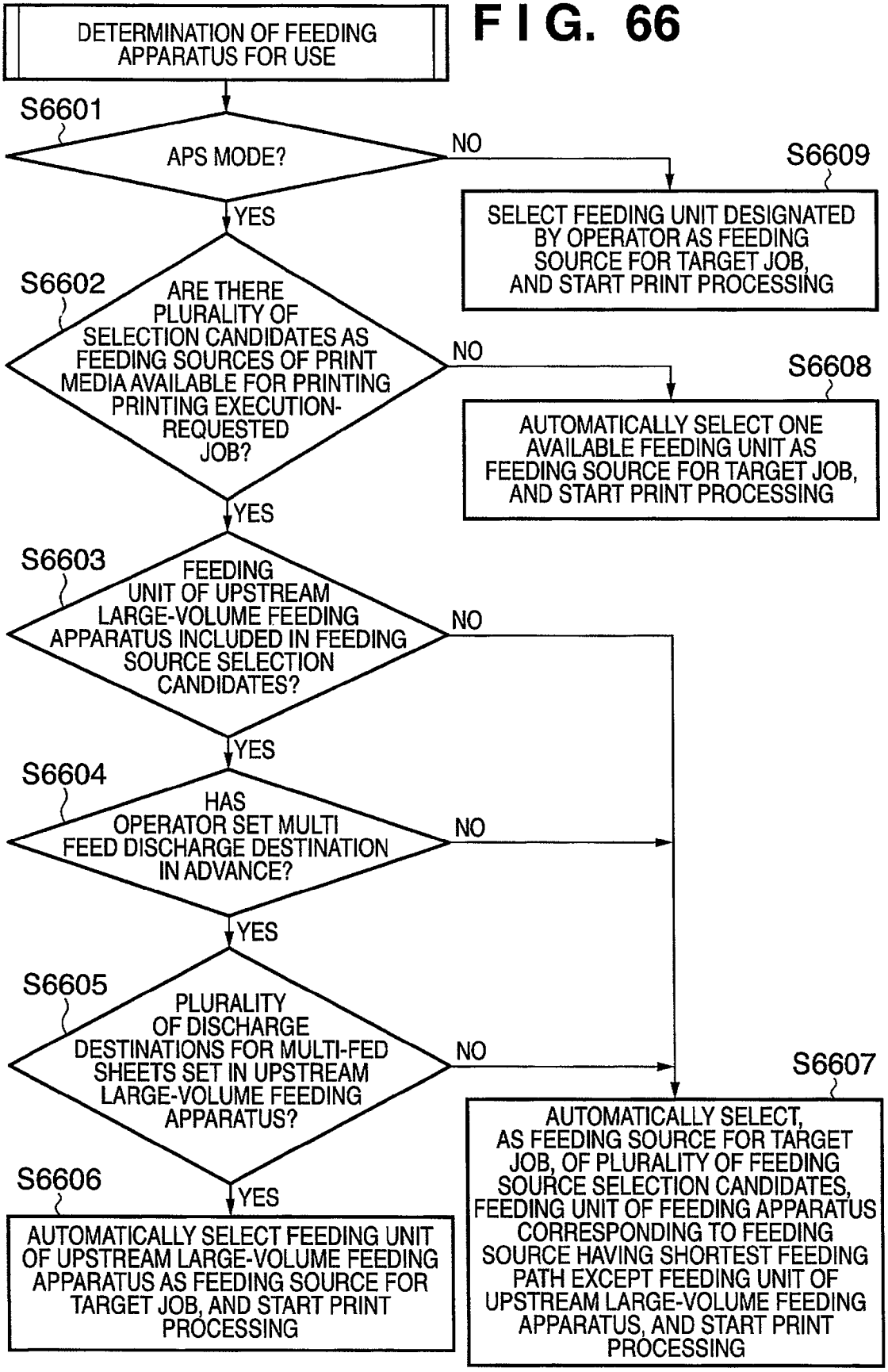
FIG. 66 is a flowchart of APS operation control in a printing system 1000 to be controlled in the ninth embodiment of the present invention.

Similar to the ninth embodiment, either a key 6501 or 6502 is selected in a user setup window in FIG. 65 to set to synchronize the ACC operation and multi-fed sheet discharge setting. If the operator has selected the key 6501, the multi-fed sheet discharge setting is not synchronized with the ACC operation.

Job execution control will be explained with reference to the flowchart of FIG. 67. In S2601, the process waits until the operator presses the copy start key. After the operator presses the start key, a feeding apparatus for use is determined in S6702. After determining the feeding apparatus for use, feeding processing starts in S2602. If sheets remain after the feeding operation, the same operation as that in the eighth embodiment is done. If a feeding unit selected as a feeding source runs out of sheets, automatic cassette selection processing is performed in S6709.

Figure 69:
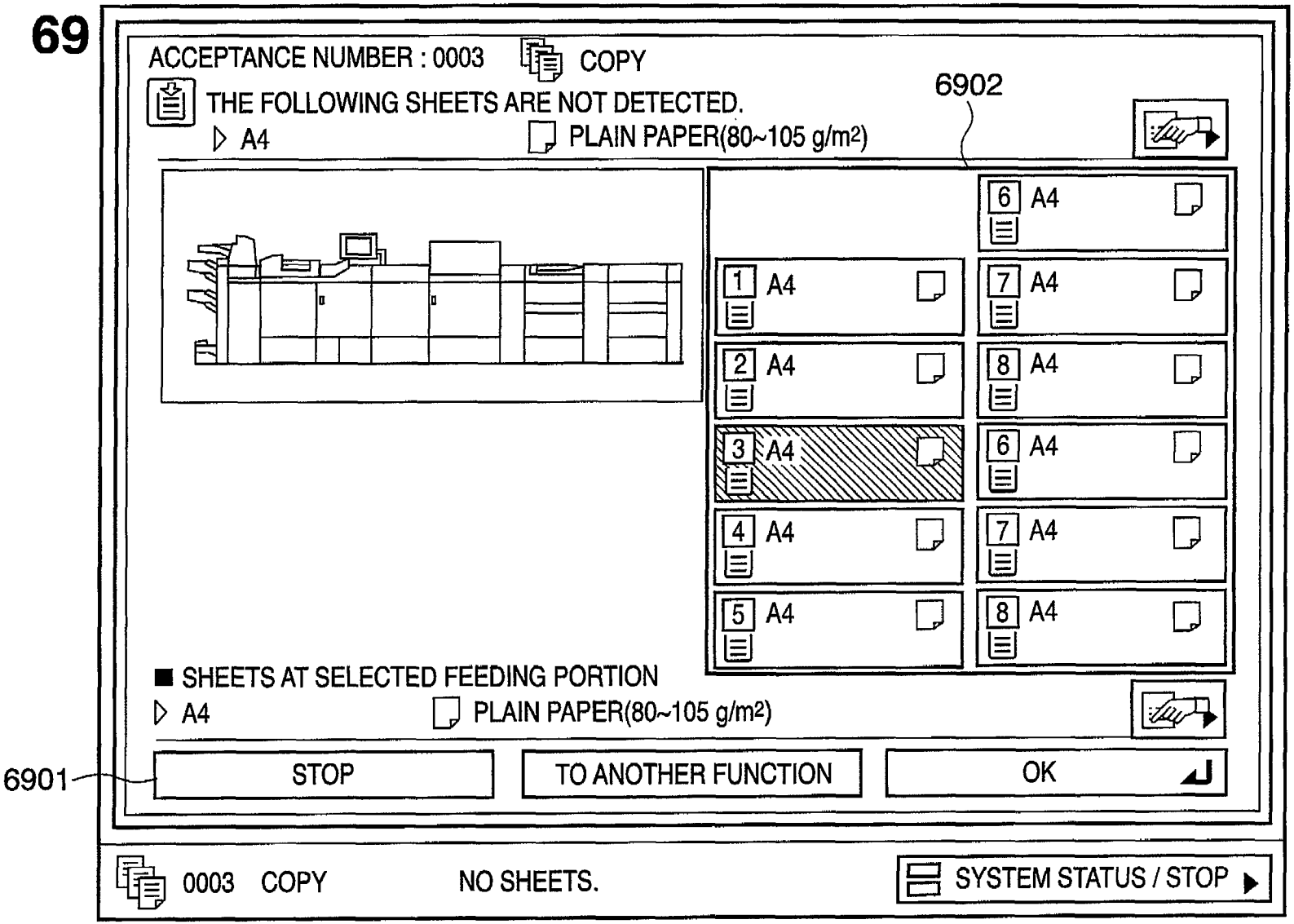
FIG. 69 is a view showing an example of a display window on a UI unit to be controlled in the 10th embodiment of the present invention.

The automatic cassette selection processing will be described in detail with reference to FIG. 68. Information representing which of the keys 6501 and 6502 has been selected is acquired from the RAM. If the operator has selected the key 6501, feeding apparatus information is acquired from the RAM, and it is checked whether there are feeding units capable of feeding sheets for a job in process (S6807). If there are feeding units capable of feeding sheets, a feeding unit having the shortest feeding path is set as a feeding source (S6808). If it is determined in S6807 that there is no other feeding unit capable of feeding sheets, a warning (FIG. 69) is displayed in S6809 to notify the operator that sheets run out. In S6810, the job temporarily stops. If the operator designates another feeding unit by pressing one of keys 6902, the designated feeding unit is set as a feeding source for the interrupted job (S6811 and S6812). If the operator does not designate any feeding unit for the print job in S6811, it is determined in S6813 whether the operator has canceled the job. The job is canceled by operating a key 6901. If the operator has canceled the job, cancellation processing is executed for the input job in S6814.

If the operator has not canceled the job, the process returns to S6811 to confirm an operator instruction, and keep the job interrupted until the operator designates a feeding unit or cancels the job. If the operator has selected the key 6502 in S6801, information on all feeding apparatuses is acquired to check in S6802 whether there are a plurality of feeding units capable of feeding sheets to a job in execution. If a plurality of feeding units exist as candidates, it is checked whether these feeding units exist in a plurality of feeding apparatuses (S6803). If a plurality of feeding units cannot be selected as a feeding source, the process in S6807 is executed. If feeding units capable of feeding sheets exist in a plurality of feeding apparatuses (YES in S6803), it is determined in S6804 whether the operator has set a multi-fed sheet discharge destination. If the operator has set a multi-fed sheet discharge destination, it is checked whether it is set to discharge sheets to a plurality of discharge destinations in an upstream feeding apparatus (S6805). If the number of multi-fed sheet discharge destination candidates for an upstream feeding unit having a longer feeding path is larger than that for a feeding unit which is selected as a default, the feeding unit of the upstream feeding apparatus is set as a feeding source (S6806). If no condition is satisfied in S6803, S6804, and S6805, a feeding unit having the shortest feeding path is set as a feeding source in S6808 as normal ACC processing. After executing automatic cassette selection processing, the process returns to the job control procedure in S6703 to feed sheets from the selected feeding unit. As a result, the print job can be kept executed. The remaining job control procedures have already been described in the ninth embodiment, and a description thereof will not be repeated.

According to the 10th embodiment, an optimum feeding unit can be selected in ACC processing in accordance with the multi-fed sheet discharge setting without prompting the user to know the setting. That is, the ACC operation can be optimized in accordance with the multi-fed sheet discharge setting by the user, preventing a decrease in productivity even when sheets run out.

Other Embodiments

The first to 10th embodiments have described switching of the delivery destination for each feeding apparatus and each delivery destination setting job, setting of the discharge destination for each sheet size, setting of the discharge destination for each sheet type, optimization of APS processing corresponding to the discharge destination, and optimization of ACC processing. Although the embodiments can be singly practiced, a plurality of embodiments can also be combined to configure the printing system 1000. A combination of embodiments is not particularly limited.

The first to 10th embodiments and combinations of them can establish a convenient, flexible printing environment capable of coping with use cases and needs assumable in the POD environment in Description of the Related Art. Various mechanisms toward commercialization of a product can be provided.

Other Mechanisms

A host computer (e.g., the PC 103 or 104) may use an externally installed program to achieve the functions shown in the drawings in the embodiments. In this case, data for displaying the same operation windows as those described in the embodiments of the present invention including operation windows are externally installed to provide various user interface windows on the display unit of the host computer. This process is described with reference to the configuration based on the UI windows of FIG. 17A in the embodiments. In this configuration, the present invention is also applicable to a case in which an output apparatus receives a set of information including a program from a storage medium such as a CD-ROM, flash memory, or FD, or from an external storage medium via a network.

The object of the present invention is also achieved by supplying a storage medium which stores software for implementing the embodiments to a system or apparatus, and reading out and executing the program stored in the storage medium by the computer (CPU or MPU) of the system or apparatus.

In this case, the program codes read out from the storage medium implement new functions of the present invention, and the storage medium which stores the program codes constitutes the present invention.

The program form is arbitrary such as an object code, a program executed by an interpreter, or script data supplied to an OS as long as a program function is attained.

The storage medium for supplying the program includes a flexible disk, hard disk, optical disk, magnetooptical disk, MO, CD-ROM, CD-R, CD-RW, magnetic tape, nonvolatile memory card, ROM, and DVD.

In this case, the program codes read out from the storage medium implement the functions of the above-described embodiments, and the storage medium which stores the program codes constitutes the present invention.

As another program supply method, the program can also be supplied by connecting a computer to an Internet site via the browser of the computer, and downloading the program or a compressed file containing an automatic installing function from the site to a recording medium such as a hard disk. The program can also be implemented by grouping program codes which form the program of the present invention into a plurality of files, and downloading the files from different homepages. That is, claims of the present invention also incorporate a WWW server, FTP server, and the like which prompt a plurality of users to download the program files for implementing functional processes of the present invention by a computer.

The program of the present invention can be encrypted, stored in a storage medium such as a CD-ROM, and distributed to a user. A user who satisfies predetermined conditions is prompted to download decryption key information from a homepage via the Internet. The user executes the encrypted program using the key information, and installs the program in the computer.

The functions of the above-described embodiments are implemented when an OS (Operating System) or the like running on the computer performs some or all of actual processes based on the instructions of the program codes.

The present invention may also be applied to a system including a plurality of devices or an apparatus formed by a single device. The present invention can also be achieved by supplying a program to the system or apparatus. In this case, the system or apparatus can obtain the effects of the present invention by providing, to the system or apparatus, a storage medium which stores a program represented by software for achieving the present invention.

The present invention is not limited to the above-described embodiments, and various modifications (including organic combinations of the embodiments) can be made without departing from the scope of the invention, and are not excluded from the scope of the invention. For example, in the embodiments of the present invention, the controller 205 in the printing apparatus 100 mainly performs various control examples. For example, an external controller of a housing different from the printing apparatus 100 may also execute some or all of these control examples.

Various examples and embodiments of the present invention have been described. It is apparent to those skilled in the art that the spirit and scope of the invention are not limited to a specific description in the specification.

The present invention can build a user-friendly, convenient printing environment applicable not only to the office environment but also to the POD environment. The present invention can also meet needs on site in the printing environment such as the POD environment, including a need to operate the system at productivity as high as possible, and a need to reduce the workload on an operator as much as possible. In particular, the present invention obtains the following effects.

For example, the present invention can cope with multi feed which may occur in a printing environment such as the POD environment where use cases and user needs are different from those in the office environment. The present invention can provide a printing system capable of processing a plurality of jobs at productivity as high as possible by suppressing problems arising from multi feed, such as a fixing error, a jam in the printing apparatus, and mixing of a blank sheet when multi feed occurs. An output destination when sheets are multi-fed can be arbitrarily set in accordance with the sheet size, type, and the like, reducing the burden of post processing on a user. The productivity of the printing system can be increased by automatically switching a feeding apparatus in accordance with the setting of a multi-fed print medium discharge destination. The present invention can flexibly deal with various use cases and user needs which may arise in association with multi feed in the POD environment.

The present invention can build a convenient, flexible printing environment capable of coping with use cases and needs assumable in the POD environment in Description of the Related Art. The present invention can provide various mechanisms toward commercialization of a product.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-014201 filed on Jan. 24, 2007, which is hereby incorporated by reference herein in its entirety.

What is claimed is:

1. A system configured to be able to cause a printing system to perform processing based on a certain abnormal state, the certain abnormal state being a state in which overlapping sheets are supplied from a supplier, the system comprising:

a receiver adapted to receive a certain processing condition about the certain abnormal state via a user interface; and a controller adapted to control the printing system to discharge the overlapping sheets to a certain place selected based on the certain processing condition set via the user interface, wherein the certain processing condition is used to select the certain place from a plurality of candidates before performing print processing.

2. The system according to claim 1, wherein said controller determines whether to use the supplier in performing the print processing, in accordance with a result of selecting the certain place.

3. A system configured to be able to cause a printing system to perform processing based on a certain abnormal state, the certain abnormal state being a state in which overlapping sheets are supplied from a supplier, the system comprising:

a receiver adapted to receive a certain processing condition about the certain abnormal state via a user interface; and a controller adapted to control the printing system to discharge the overlapping sheets to a certain place selected based on the certain processing condition set via the user interface, wherein said controller controls the printing system to discharge a plurality of overlapping sheets to a plurality of certain places sequentially, the plurality of certain places are differentiated from another certain place, and the other certain place is used to discharge sheets on which print data are printed by a printer, and wherein said controller controls the printing system to continue print processing by using the plurality of certain places even if the certain abnormal state repeatedly occurs before completing the print processing.

4. The system according to claim 3, wherein said controller restricts use of the plurality of certain places based on the certain processing condition received via the user interface.

5. A program product stored in a computer usable storage medium, the program product including a program code for causing a computer system to perform a method for enabling a printing system to perform processing based on a certain abnormal state, the certain abnormal state being a state in which overlapping sheets are supplied from a supplier, the method comprising:

receiving a certain processing condition about the certain abnormal state via a user interface; and controlling the printing system to discharge the overlapping sheets to a certain place selected based on the certain processing condition, wherein the certain processing condition is used to select the certain place from a plurality of candidates before performing print processing.

6. A method for causing a printing system to perform processing based on a certain abnormal state, the certain abnormal state being a state in which overlapping sheets are supplied from a supplier, the method comprising:

receiving a certain processing condition about the certain abnormal state via a user interface; and controlling the printing system to discharge the overlapping sheets to a certain place selected based on the certain processing condition, wherein said controlling further comprises controlling the printing system to discharge a plurality of overlapping sheets to a plurality of certain places sequentially, the plurality of certain places are differentiated from another certain place, and the other certain place is used to discharge sheets on which print data are printed by a printer, and controlling the printing system to continue print processing by using the plurality of certain places even if the certain abnormal state repeatedly occurs before completing the print processing.

* * * * *